US008669030B2

(12) United States Patent
Fujiwara et al.

(10) Patent No.: US 8,669,030 B2
(45) Date of Patent: Mar. 11, 2014

(54) ELECTROPHOTOGRAPHIC PHOTORECEPTOR, AND IMAGE FORMING METHOD AND APPARATUS USING THE SAME

(75) Inventors: Yukio Fujiwara, Numazu (JP); Tetsuro Suzuki, Fuji (JP); Kazukiyo Nagai, Numazu (JP); Hiroshi Tamura, Susono (JP); Hiroshi Ikuno, Yokohama (JP); Hidetoshi Kami, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 1362 days.

(21) Appl. No.: 12/000,239

(22) Filed: Dec. 11, 2007

(65) Prior Publication Data

US 2008/0138725 A1 Jun. 12, 2008

(30) Foreign Application Priority Data

| | | |
|---|---|---|
| Dec. 11, 2006 | (JP) | 2006-333106 |
| Dec. 18, 2006 | (JP) | 2006-339402 |
| Jan. 12, 2007 | (JP) | 2007-004342 |
| Jan. 16, 2007 | (JP) | 2007-006939 |

(51) Int. Cl.
*G03G 15/04* (2006.01)
*G03G 15/045* (2006.01)

(52) U.S. Cl.
USPC ..... 430/66; 430/48; 430/69; 430/132; 430/133; 399/159

(58) Field of Classification Search
USPC ..... 430/48, 66, 69, 132, 133; 399/159
See application file for complete search history.

(56) References Cited

U.S. PATENT DOCUMENTS

| | | | | |
|---|---|---|---|---|
| 4,092,173 | A * | 5/1978 | Novak et al. | 430/531 |
| 5,322,753 | A | 6/1994 | Tamura et al. | |
| 5,488,137 | A | 1/1996 | Tamura et al. | |
| 5,492,784 | A | 2/1996 | Yoshikawa et al. | |
| 5,608,010 | A | 3/1997 | Tamura et al. | |
| 5,871,876 | A | 2/1999 | Ikuno et al. | |
| 5,976,746 | A | 11/1999 | Tanaka et al. | |
| 6,027,846 | A | 2/2000 | Shimada et al. | |
| 6,030,733 | A | 2/2000 | Kami et al. | |
| 6,043,334 | A * | 3/2000 | Kanamaru et al. | 430/58.35 |
| 6,066,428 | A | 5/2000 | Katayama et al. | |
| 6,151,468 | A | 11/2000 | Kami et al. | |
| 6,172,176 | B1 | 1/2001 | Tanaka et al. | |

(Continued)

FOREIGN PATENT DOCUMENTS

| | | |
|---|---|---|
| JP | 9-34137 | 2/1997 |
| JP | 9-216944 | 8/1997 |

(Continued)

OTHER PUBLICATIONS

Office Action issued Sep. 7, 2011 in Japan Application No. 2007-004342.

*Primary Examiner* — Thorl Chea
(74) *Attorney, Agent, or Firm* — Oblon, Spivak, McClelland, Maier & Neustadt, L.L.P.

(57) ABSTRACT

A photoreceptor including an electroconductive substrate; a photosensitive layer which is located overlying the electroconductive substrate and which is not radically crosslinked; and an outermost layer which is located overlying the photosensitive layer and which includes a radically crosslinked material, wherein the radically crosslinked material includes a unit having a specific formula. An image forming method, an image forming apparatus, and a process cartridge, which use the photoreceptor.

18 Claims, 10 Drawing Sheets

(56) References Cited

U.S. PATENT DOCUMENTS

| | | | |
|---|---|---|---|
| 6,187,492 | B1 | 2/2001 | Ri et al. |
| 6,194,535 | B1 | 2/2001 | Katayama et al. |
| 6,210,848 | B1 | 4/2001 | Nagai et al. |
| 6,316,577 | B1 | 11/2001 | Shimada et al. |
| 6,432,596 | B2 | 8/2002 | Ikuno et al. |
| 6,444,387 | B2 | 9/2002 | Ri et al. |
| 6,486,293 | B1 | 11/2002 | Ri et al. |
| 6,548,216 | B2 | 4/2003 | Kawamura et al. |
| 6,576,386 | B1 | 6/2003 | Ri et al. |
| 6,664,361 | B2 | 12/2003 | Sasaki et al. |
| 6,686,114 | B2 | 2/2004 | Sakon et al. |
| 6,790,571 | B2 | 9/2004 | Kawamura et al. |
| 6,861,188 | B2 | 3/2005 | Ikegami et al. |
| 6,899,983 | B2 | 5/2005 | Tamoto et al. |
| 6,919,419 | B2 | 7/2005 | Ri et al. |
| 6,974,654 | B2 | 12/2005 | Kawamura et al. |
| 6,998,209 | B2 | 2/2006 | Ikuno et al. |
| 7,056,633 | B2 | 6/2006 | Kawamura et al. |
| 7,071,285 | B2 | 7/2006 | Kawamura et al. |
| 7,122,284 | B2 | 10/2006 | Kawamura et al. |
| 7,175,957 | B2 | 2/2007 | Suzuki et al. |
| 7,179,573 | B2 | 2/2007 | Suzuki et al. |
| 7,189,487 | B2 | 3/2007 | Ikuno et al. |
| 7,251,437 | B2 | 7/2007 | Tamoto et al. |
| 7,267,916 | B2 | 9/2007 | Sugino et al. |
| 7,279,260 | B2 | 10/2007 | Nagai et al. |
| 7,399,563 | B2 | 7/2008 | Suzuki et al. |
| 2005/0008957 | A1 | 1/2005 | Ikegami et al. |
| 2005/0106483 | A1 | 5/2005 | Shoshi et al. |
| 2005/0118518 | A1 | 6/2005 | Ikegami et al. |
| 2005/0141919 | A1 | 6/2005 | Kitajima et al. |
| 2005/0158641 | A1 | 7/2005 | Yanagawa et al. |
| 2005/0158644 | A1 | 7/2005 | Kondo et al. |
| 2005/0175911 | A1 | 8/2005 | Tamoto et al. |
| 2005/0181291 | A1 | 8/2005 | Kami et al. |
| 2005/0221210 | A1 | 10/2005 | Suzuki et al. |
| 2005/0238987 | A1 | 10/2005 | Ohshima et al. |
| 2005/0266325 | A1 | 12/2005 | Yanagawa et al. |
| 2005/0266328 | A1 | 12/2005 | Yanagawa et al. |
| 2005/0282075 | A1 | 12/2005 | Ikuno et al. |
| 2005/0287452 | A1 | 12/2005 | Tamura et al. |
| 2005/0287465 | A1 | 12/2005 | Ohshima et al. |
| 2006/0014093 | A1 | 1/2006 | Li et al. |
| 2006/0014096 | A1 | 1/2006 | Ohshima et al. |
| 2006/0051689 | A1 | 3/2006 | Suzuki et al. |
| 2006/0068308 | A1 | 3/2006 | Ohshima et al. |
| 2006/0093955 | A1 | 5/2006 | Ohshima et al. |
| 2006/0099525 | A1* | 5/2006 | Yu et al. ..... 430/58.05 |
| 2006/0110668 | A1 | 5/2006 | Kawasaki et al. |
| 2006/0160003 | A1 | 7/2006 | Nagai et al. |
| 2006/0177749 | A1 | 8/2006 | Tamoto et al. |
| 2007/0009818 | A1 | 1/2007 | Yanagawa et al. |
| 2007/0031746 | A1 | 2/2007 | Toshine et al. |
| 2007/0117033 | A1 | 5/2007 | Sugino et al. |
| 2007/0122724 | A1 | 5/2007 | Suzuki et al. |
| 2007/0128530 | A1 | 6/2007 | Nagai et al. |
| 2007/0154825 | A1 | 7/2007 | Tamoto et al. |
| 2007/0196749 | A1 | 8/2007 | Inaba et al. |
| 2007/0196750 | A1 | 8/2007 | Fujiwara et al. |
| 2007/0212625 | A1 | 9/2007 | Suzuki et al. |
| 2007/0212626 | A1 | 9/2007 | Toshine et al. |
| 2007/0212627 | A1 | 9/2007 | Yanagawa et al. |
| 2007/0231720 | A1 | 10/2007 | Mori et al. |
| 2007/0269729 | A1 | 11/2007 | Ikuno et al. |

FOREIGN PATENT DOCUMENTS

| | | |
|---|---|---|
| JP | 2896823 | 3/1999 |
| JP | 2000-66425 | 3/2000 |
| JP | 3194392 | 6/2001 |
| JP | 3262488 | 12/2001 |
| JP | 2004-302451 | 10/2004 |
| JP | 2006-3863 | 1/2006 |
| JP | 2006-71856 | 3/2006 |

* cited by examiner

ELECTROPHOTOGRAPHIC PHOTORECEPTOR, AND IMAGE FORMING METHOD AND APPARATUS USING THE SAME

BACKGROUND OF THE INVENTION

1. Field of the Invention

The present invention relates to an electrophotographic photoreceptor. In addition, the present invention also relates to an image forming method and an image forming apparatus using the electrophotographic photoreceptor.

2. Discussion of the Background

Recently, organic photoreceptors (OPCs) have been used for various image forming apparatuses such as copiers, printers, facsimiles and multi-functional apparatuses instead of inorganic photoreceptors because of having the following advantages over inorganic photoreceptors.

(1) good optical properties such that the photoreceptors have photosensitivity over a broad wavelength range and can absorb a large amount of light;
(2) good electric properties such as high photosensitivity and stable charging property;
(3) a wide material selectivity (i.e., various kinds of materials can be used for the photosensitive layer);
(4) good productivity;
(5) low costs; and
(6) little toxicity.

Recently, image forming apparatuses are required to have a small size and to produce images at a high speed without frequent maintenance operations, and therefore a need exists for a small-size photoreceptor having a good durability. In general, organic photoreceptors are soft because of having an outermost layer including a low molecular weight charge transport material and an inactive polymer. Therefore, when image forming operations such as charging, developing, transferring and cleaning operations are repeatedly performed on such organic photoreceptors, the surface of the photoreceptors can be easily abraded due to the mechanical stresses applied thereto.

In addition, in order to produce high quality images, the particle size of the toners used for forming visual images in image forming apparatus becomes smaller and smaller. In order to well remove residual toner particles on the surface of the photoreceptors of the image forming apparatuses, a cleaning blade having a high hardness is contacted with the surface of the photoreceptors at a high pressure. Thereby, abrasion of the surface of photoreceptors is accelerated.

Abrasion of the surface of the photoreceptors deteriorates the photosensitivity and charging properties of the photoreceptors, resulting in decrease of image density and formation of abnormal images such as background development in that background of images is soiled with toner particles. If local abrasion is caused (such as formation of scratches) to the photoreceptors, the photoreceptors produce streak images due to defective cleaning.

Therefore various attempts have been made to solve the abrasion problem of OPCs.

As one of the attempts, published unexamined Japanese patent application No. (hereinafter referred to as JP-A) 08-262779 (i.e., Japanese patent No. (hereinafter JP) 3262488) discloses a photoreceptor having a crosslinked outermost layer prepared by crosslinking a polyfunctional radically polymerizable monomer. It is described therein that the technique has advantages such that the resultant outermost layer has a dense three-dimensional network because monomers having a large number of functional groups cab be used; the crosslinked outermost layer can be rapidly prepared using light, heat and/or radiation; and the resultant crosslinked outermost layer hardly deteriorates the electric properties of the resultant photoreceptor because the crosslinking reaction can be performed without using acids and bases.

Further, in order to improve the electric properties of such a crosslinked outermost layer, JP-As 05-216249 (i.e., JP 3194392) and 2000-66425 have disclosed to prepare photoreceptors having an outermost layer which is prepared by using a charge transport material having a radically polymerizable monomer to fix a charge transport structure in the crosslinked network. It is described therein that by using this technique, a good combination of abrasion resistance and charge transportability can be imparted to the resultant photoreceptor, and the outermost layer has sufficient thickness tolerance.

Although such a crosslinked outermost layer prepared by using a radically polymerizable monomer has a good abrasion resistance because of having a highly crosslinked three dimensional network, the outermost layer typically has a large dielectric constant because a large number of polar groups are included therein. Therefore, a problem which occurs is that the electric properties (such as photosensitivity) of the photoreceptor deteriorate because the resistance of the layer decreases due to oxidation gasses generated by chargers and change of the environmental conditions such as temperature and humidity, resulting in deterioration of image qualities such as decrease of image density, formation of tailed images and deterioration of resolution.

In attempting to solve the problem, JP-A 2006-3863 discloses a technique in that a polyfunctional monomer, some of whose functional groups are substituted with alkyl groups, is used to introduce inactive groups in the crosslinked layer, to suppress change of the electric properties of the photoreceptor due to changes of environmental conditions. In addition, JP-As 2006-3863 and 05-173350 (i.e., JP 2896823) have disclosed techniques in that a bisphenol A-based difunctional monomer is used in combination with radically crosslinkable monomers to improve the environmental stability of the crosslinked outermost layer, and adhesion of the outermost layer to the lower layer on which the outermost layer is formed, to attempt to prevent change of image density and peeling of the outermost layer.

Thus, it has been attempted to develop photoreceptors with improved environmental stability and resistance to oxidation gasses using the above-mentioned techniques. However, when the number of functional groups are increased to impart high abrasion resistance to the resultant photoreceptor, a number of polar groups and unreacted functional groups are present in the resultant layer, resulting in deterioration of the environmental stability of the photoreceptor. In contrast, when the number of functional groups are decreased, the mechanical strength (i.e., abrasion resistance) of the resultant outermost layer deteriorates. Thus, the abrasion resistance and environmental stability establish a trade-off relationship, and therefore a photoreceptor having a good combination of abrasion resistance and environmental stability has not yet been provided.

Because of these reasons, a need exists for an electrophotographic photoreceptor having a good combination of environmental stability and abrasion resistance.

SUMMARY OF THE INVENTION

As one aspect of the present invention, a photoreceptor is provided which includes an electroconductive substrate, a photosensitive layer which is located overlying the electroconductive substrate and which is not radically crosslinked, and an outermost layer which is located overlying the photosensitive layer and which includes a radically crosslinked material. The radically crosslinked material includes a unit having a formula selected from the group consisting of the following formulae (A), (E) and (I).

(A)

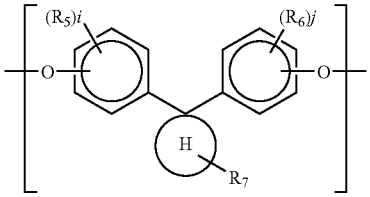

In formula (A), H represents a 1,1-cyclopentane-diyl group, a 1,1-cyclohexane-diyl group, or a 9,9-fluorene-diyl group; each of $R_5$ and $R_6$ represents a linear, branched or cyclic alkyl group having 1 to 6 carbon atoms, a halogen atom, or an aryl group; $R_7$ represents a hydrogen atom, or an alkyl group having 1 to 4 carbon atoms; and each of i and j is 0 or an integer of from 1 to 4.

(E)

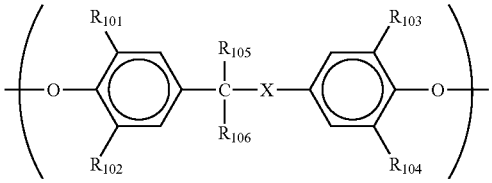

In formula (E), X is a direct bond or one of the following divalent groups:

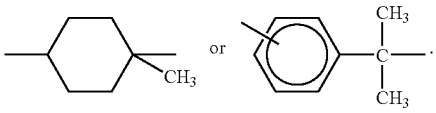

When X is a direct bond, each of $R_{101}$, $R_{102}$, $R_{103}$ and $R_{104}$ represents a hydrogen atom, a linear, branched or cyclic alkyl group having 1 to 6 carbon atoms, a halogen atom, or an aryl group, wherein a case where all of $R_{101}$ to $R_{104}$ is a hydrogen atom is excluded; and each of $R_{105}$ and $R_{106}$ represents a hydrogen atom, a methyl group, or an ethyl group, wherein the number of total carbon atoms included in $R_{105}$ and $R_{106}$ is 0 to 2. When X is not a direct bond, each of $R_{101}$ to $R_{104}$ represents a hydrogen atom, an alkyl group having 1 to 4 carbon atoms or a halogen atom, and each of $R_{105}$ and $R_{106}$ is a methyl group.

(I)

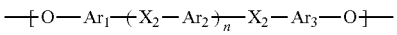

In formula (I), each of $Ar_1$, $Ar_2$ and $Ar_3$ represents a substituted or unsubstituted arylene group; $X_2$ represents an oxygen atom or a sulfur atom; and n is 0 or 1.

In this regard, "overlying" can include direct contact and allow for one or more intermediate layers.

As another aspect of the present invention, an image forming method is provided which includes:

forming an electrostatic image on the above-mentioned photoreceptor;

developing the electrostatic image with a developer including a toner to form a toner image on the photoreceptor; and transferring the toner image onto a receiving material.

As yet another aspect of the present invention, an image forming apparatus is provided which includes:

the above-mentioned photoreceptor;

a latent image forming device (such as combinations of a charger and a light irradiating device) configured to form an electrostatic image on the photoreceptor;

a developing device configured to develop the electrostatic image with a developer including a toner to form a toner image on the photoreceptor; and a transferring device configured to transfer the toner image onto a receiving material optionally via an intermediate transfer medium As a further aspect of the present invention, a process cartridge is provided which includes:

the above-mentioned photoreceptor configured to bear an electrostatic latent image; and at least one of a charging device configured to charge the photoreceptor; a developing device configured to develop the electrostatic latent image with a developer including a toner to form a toner image thereon; a transferring device configured to transfer the toner image onto a receiving material; and a cleaning device configured to clean the surface of the photoreceptor after the toner image is transferred.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1A:
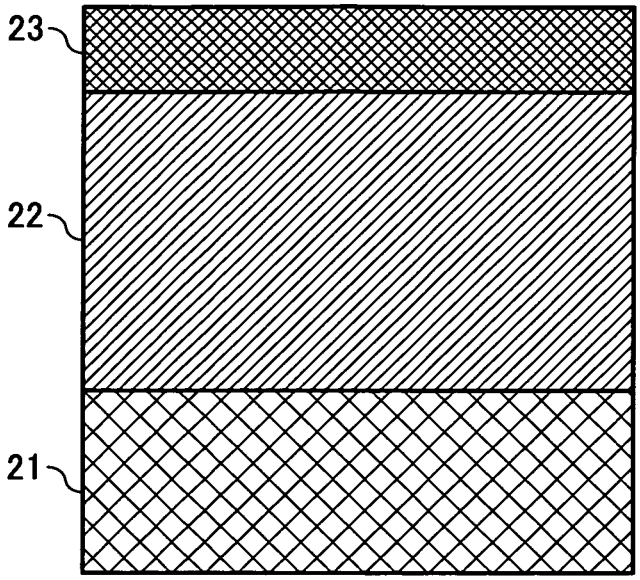
FIGS. 1A and 1B are schematic views illustrating the cross sections of examples of the photoreceptor of the present invention, each of which has a single-layered photosensitive layer.

At first, the photoreceptor of the present invention will be explained.

The photoreceptor of the present invention includes an electroconductive substrate, a photosensitive layer which is located overlying the electroconductive substrate and which is not radically crosslinked, and an outermost layer which is located overlying the photosensitive layer and which includes a radically crosslinked material. The radically crosslinked material includes a unit having a formula selected from the group consisting of the above-mentioned formulae (A), (E) and (I).

At first, the photoreceptor having an outermost layer including a radically crosslinked material including a unit having the following formula (A) (i.e., a first example of the outermost layer) will be explained.

(A)

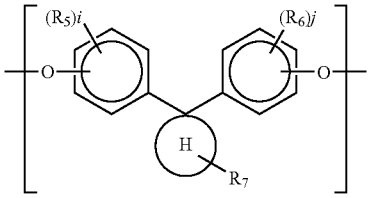

In formula (A), H represents a 1,1-cyclopentane-diyl group, a 1,1-cyclohexane-diyl group, or a 9,9-fluorene-diyl group; each of $R_5$ and $R_6$ represents a linear, branched or cyclic alkyl group having 1 to 6 carbon atoms, a halogen atom, or an aryl group; $R_7$ represents a hydrogen atom, or an alkyl group having 1 to 4 carbon atoms; and each of i and j is 0 or an integer of from 1 to 4.

By incorporating a unit having formula (A) in the radically crosslinked material constituting the outermost layer, a photoreceptor which has a good combination of abrasion resistance and environmental stability (such as resistance to changes of temperature and humidity, and resistance to oxidation gasses such as ozone and NOx generated by chargers, etc.) can be provided, i.e., a photoreceptor which can produce high quality images with hardly causing problems such as change of image density, formation of tailed images and deterioration of resolution can be provided.

Next, the reason why the outermost layer of the photoreceptor of the present invention has a high abrasion resistance will be explained.

It is known that a layer constituted of a radically crosslinked material has a high abrasion resistance because of having a dense three dimensional network. It is described in JP 3262488 and JP-A 2006-227761 that it is important to increase the number of radically crosslinkable groups in the monomers used for forming the radically crosslinked material. For example, when acrylic monomers are used, monomers having a small acrylic equivalent (i.e., a value obtained by dividing the molecular weight of the monomer by the number of functional groups included therein) are preferably used. In this case, the resultant layer has a dense three dimensional network and a high abrasion resistance. In addition, it is effective to use monomers having a large number of functional groups, e.g., polyfunctional monomers such as trifunctional monomers and hexafunctional groups. In this case, when at least one of the three or six functional groups is used for polymerization, it is possible to enhance the probability that the molecular weight of the resultant crosslinked material increases. In other words, when monofunctional or difunctional monomers are used as main components, the resultant polymers have a low mechanical strength, i.e., the resultant layer has low abrasion resistance.

The present inventors discover that radically crosslinked materials including a unit having formula (A) have as good abrasion resistance as that of the crosslinked materials prepared by using polyfunctional monomers mentioned above. This is different from conventional technologies and is a new technology. The reason why such good abrasion resistance can be achieved is not clear, but is considered as follows.

When a unit having formula (A) (hereinafter sometimes referred to as a unit (A)) is incorporated in a crosslinked material, the number of functional groups included in the crosslinked material is less than the number of functional groups included in conventional crosslinked materials prepared by using polyfunctional monomers. Therefore, it may be considered that the resultant layer has low mechanical strength. However, in reality the resultant layer has high mechanical strength. The reason therefor is considered to be that although the crosslinking density decreases, a tangling effect such that molecules of the linear polymer are tangled (i.e., units (A) are tangled) is produced, thereby increasing the mechanical strength. In addition, a π-π stacking effect caused by π-conjugated system of units (A) is also produced. In particular, in the case of the units (A), the two benzene rings therein can be twisted unlike bisphenol A compounds, and thereby the above-mentioned tangling effect can be dramatically heightened.

In general, the mechanism of abrasion of a photoreceptor is considered as follows. Specifically, when a layer constituted of a crosslinked material is charged with a charger and is rubbed with a cleaning blade, the crosslinked material is cut by the heat generated by the cleaning blade and electric discharge caused by the charger, resulting in formation of materials having relatively low molecular weights. These low molecular weight materials are easily removed from the layer by the cleaning blade or a developer rubbing the surface of the layer, resulting in abrasion of the surface of the layer. When a unit (A) is incorporated in the crosslinked material, removal of such low molecular weight materials can be prevented due to tangling effect and π-π stacking effect of the crosslinked material, resulting in prevention of abrasion of the layer.

In addition, when a charge transport material (with or without a functional group) including a unit (A) is included in the crosslinked material, the charge transport material, which has a wide π-electron conjugated system, has good solubility in the crosslinked network (i.e., matrix). Therefore, the evenness of the surface of the crosslinked outermost layer can be improved, resulting in further improvement of the mechanical strength (i.e., improvement of the abrasion resistance) of the layer.

Next, the reason why the outermost layer of the photoreceptor of the present invention has a high environmental stability will be explained.

The reason why the outermost layer has good resistance to environmental changes and oxidation gasses is considered as follows. In conventional techniques, a large number of reactive groups are needed for forming a layer having a dense network and good abrasion resistance, regardless of the methods for t crosslinking he layer (such as urethane crosslinking, acrylic crosslinking, siloxane crosslinking and epoxy crosslinking). Therefore, the resultant crosslinked layer has a high dielectric constant because of including therein a large number of polar groups. Therefore, the resultant crosslinked layer has poor resistance to environmental changes and oxidation gasses. When the above-mentioned technique of using polyfunctional monomers is used, the number of polar groups (such as ester groups) is further increased, and therefore the resultant layer ha a high water absorbability, resulting in formation of tailed images under high humidity conditions.

In addition, when a highly dense crosslinked layer is formed, the movement of the molecules therein is prevented. In particular, the steric change of a charge transport material included therein is prevented under low temperature conditions, resulting in deterioration of the photosensitivity of the photoreceptor. Further, when the number of functional groups included in the crosslinked material increases, the number of unreacted functional groups also increases even after crosslinking. In this case, the crosslinked material well absorbs oxidation gasses generated by chargers, thereby decreasing the electric resistance of the crosslinked layer and deteriorating the resolution of images.

In contrast, a crosslinked material having a unit (A) has good resistance to environmental change and oxidation gasses. The reason therefor is not clear but is considered to be as follows. In crosslinked materials having a unit (A), the ratio (M/F) of the molecular weight (M) of the crosslinked materials to the number (F) of functional groups included therein is relatively large compared to crosslinked materials prepared by using polyfunctional monomers. Namely, the concentration of the functional groups is decreased, and thereby the environmental stability is improved. In addition, the interval between molecular chains in crosslinked materials having a unit (A) is wider than that of crosslinked materials prepared by using polyfunctional monomers, and therefore the molecules can move relatively freely. Further, since the number of polar groups is decreased, increase of dielectric constant can be prevented while high charge transportability can be maintained, resulting in prevention of deterioration of photosensitivity at low temperatures. Furthermore, since bulky groups (chains) are located in spaces formed between the three dimensional network, the resultant layer has low gas permeability and therefore the resistance to oxidation gasses can be enhanced. In addition, although the bisphenol A structure is linear, the structure including a unit (A) is twisted. Therefore, the space occupation ratio of the structure having a unit (A) is greater than the structure having a bisphenol A structure because the benzene rings is twisted, and thereby the gas permeability is further enhanced.

Thus, by using a crosslinked material having a unit (A) therein, the resultant layer constituted of the crosslinked material has good combination of abrasion resistance and resistance to environmental changes and oxidation gasses.

Next, the radically crosslinked material constituting the crosslinked outermost layer of the photoreceptor of the present invention will be explained.

The unit (A) can be incorporated in the crosslinked material by crosslinking a radically polymerizable monomer or oligomer having a unit (A), or a polymer having a radically polymerizable functional group and a unit (A) using light, heat and/or radiation such as electron beams. In the crosslinking process, the unit (A) is fixed in the crosslinked material without decomposed. Presence of the unit (A) can be determined by subjecting the surface of the crosslinked material to pyrolysis gas chromatography (measurement of MS spectrum), or infrared spectroscopy (measurement of absorption property).

The content of the unit (A) in the crosslinked material is from 5 to 80% by weight, and preferably from 10 to 50% by weight, based on the total weight of the crosslinked material. When the content is too low, good resistance to changes of environmental conditions and oxidation gasses cannot be imparted to the photoreceptor and therefore deterioration of the electric properties and formation of abnormal images such as tailed images and low density images cannot be prevented.

The above-mentioned radically polymerizable monomers, oligomers and polymers have a radically polymerizable functional group. Any functional groups having a carbon-carbon double bond and being radical polymerizable can be used therefor. For example, 1-substituted ethylene groups, 1,1-substituted ethylene groups, etc. can be used as the radically polymerizable group.

1-Substituted Ethylene Groups

Specific examples of the 1-substituted ethylene groups include the following group (P):

$$CH2{=}CH{-}X^1{-} \quad (P)$$

wherein $X^1$ represents an arylene group (such as phenylene and naphthylene groups), which optionally has a substituent, a substituted or unsubstituted alkenylene group, a —CO— group, a —COO— group, a —CON($R^{21}$) group ($R^{21}$ represents a hydrogen atom, an alkyl group (e.g., methyl and ethyl groups), an aralkyl group (e.g., benzyl, naphthylmethyl and phenetyl groups), or an aryl group (e.g., phenyl and naphthyl groups)) or a —S— group.

Specific examples of the groups having formula (P) include a vinyl group, a stylyl group, 2-methyl-1,3-butadienyl group, a vinylcarbonyl group, an acryloyloxy group, an acryloylamide group, a vinyl thio ether group, etc.

1,1-Substituted Ethylene Groups

Specific examples of the 1,1-substituted ethylene groups include the following group (R):

$$CH2{=}C(Y){-}(X^2)n{-} \quad (R)$$

wherein Y represents a substituted or unsubstituted alkyl group, a substituted or unsubstituted aralkyl group, a substituted or unsubstituted aryl group (such as phenyl and naphthyl groups), a halogen atom, a cyano group, a nitro group, an alkoxyl group (such as methoxy and ethoxy groups), or a —$COOR^{22}$ group (wherein $R^{22}$ represents a hydrogen atom, a substituted or unsubstituted alkyl group (such as methyl and ethyl groups), a substituted or unsubstituted aralkyl group (such as benzyl and phenethyl groups), a substituted or unsubstituted aryl group (such as phenyl and naphthyl groups) or a —$CONR^{23}R^{24}$ group (wherein each of $R^{23}$ and $R^{24}$ represents a hydrogen atom, a substituted or unsubstituted alkyl group (such as methyl and ethyl groups), a substituted or unsubstituted aralkyl group (such as benzyl, naphthylmethyl and phenethyl groups), a substituted or unsubstituted aryl group (such as phenyl and naphthyl groups)); $X^2$ represents a group selected from the groups mentioned above for use in $X^1$ and an alkylene group, wherein at least one of Y and $X^2$ is an oxycarbonyl group, a cyano group, an alkenylene group or an aromatic ring group; and n is 0 or 1.

Specific examples of the groups having formula (R) include an α-chloroacryloyloxy group, a methacryloyloxy group, an α-cyanoethylene group, an α-cyanoacryloyloxy group, an α-cyanophenylene group, a methacryloylamino group, etc.

Specific examples of the substituents for use in the groups $X^1$, $X^2$ and Y include halogen atoms, nitro groups, cyano groups, alkyl groups (such as methyl and ethyl groups), alkoxy groups (such as methoxy and ethoxy groups), aryloxy groups (such as a phenoxy group), aryl groups (such as phenyl and naphthyl groups), aralkyl groups (such as benzyl and phenethyl groups), etc.

Among these radically polymerizable functional groups, acryloyloxy groups and methacryloyloxy groups are preferably used. Compounds having a (meth)acryloyloxy group can be prepared by subjecting (meth)acrylic acid (salts), (meth) acrylhalides and (meth)acrylates, which have a hydroxyl group, to an ester reaction or an ester exchange reaction. When plural radically polymerizable groups are included in a radically polymerizable functional monomer, the groups may be the same as or different from the others therein.

When a layer having a unit (A) is formed, it is preferable to coat a photosensitive layer with a coating liquid including a radically polymerizable compound having the following formula (B), followed by radically crosslinking the formed layer.

(B)

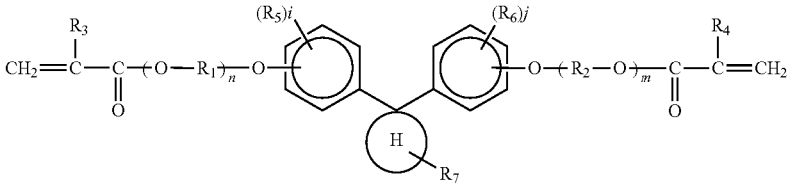

In formula (B), H represents a 1,1-cyclopentane-diyl group, a 1,1-cyclohexane-diyl group, or a 9,9-fluorene-diyl group; each of $R_1$ and $R_2$ represents a linear or branched alkyl group having 1 to 6 carbon atoms, a 1-ketohexylene group, or a phenylene group; each of $R_3$ and $R_4$ represents a hydrogen atom, or a methyl group; each of $R_5$ and $R_6$ represents a linear, branched or cyclic alkyl group having 1 to 6 carbon atoms, a halogen atom, or an aryl group; $R_7$ represents a hydrogen atom, or an alkyl group having 1 to 4 carbon atoms; each of m and n is 0 or an integer of from 1 to 4; and each of i and j is 0 or an integer of from 1 to 4.

The compounds having formula (B) can be prepared by, for example, a method including the following processes:

B1-1

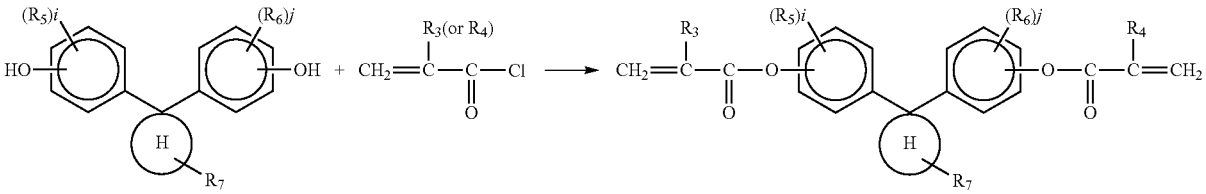

(m, n = 0)

B2-1

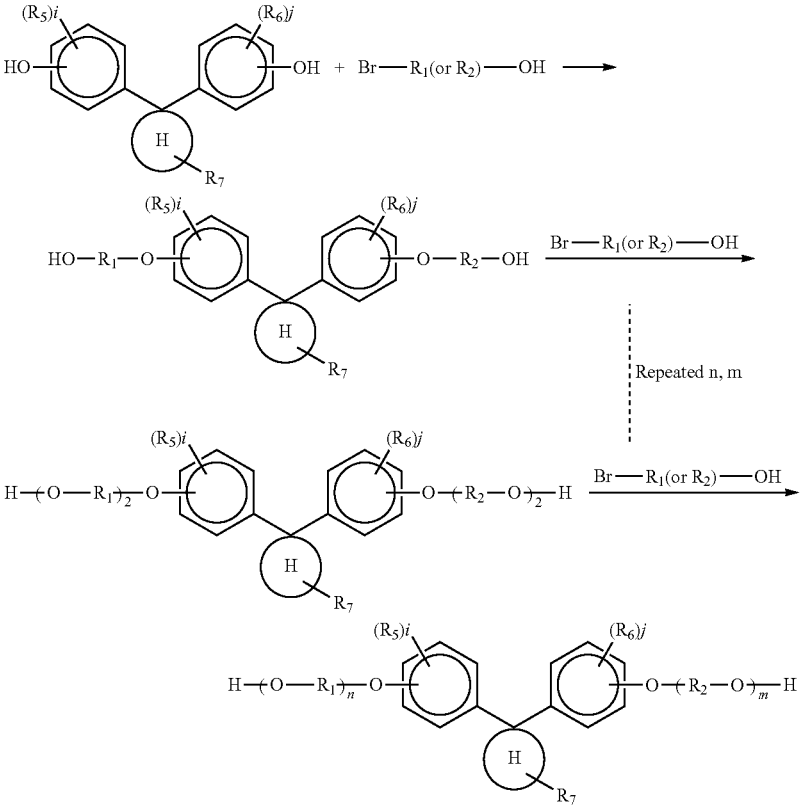

(m, n ≠ 0)

-continued
B2-2
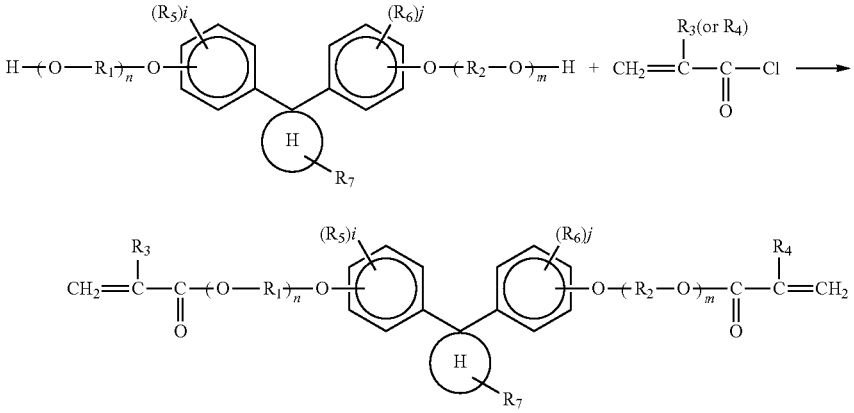
Specific examples of the radically polymerizable compounds include the following but are not limited thereto.
B-1-1
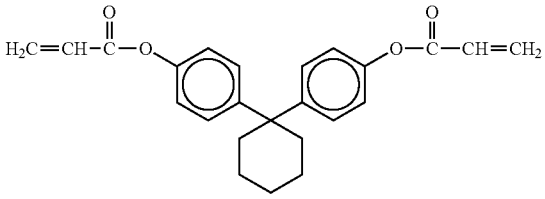
B-1-2
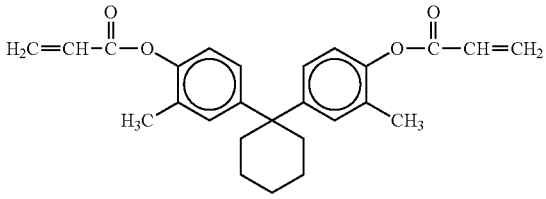
B-1-3
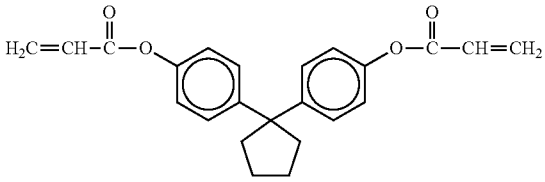
B-1-4
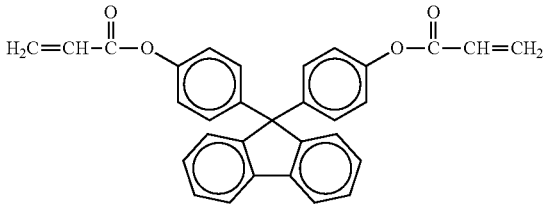
B-1-5
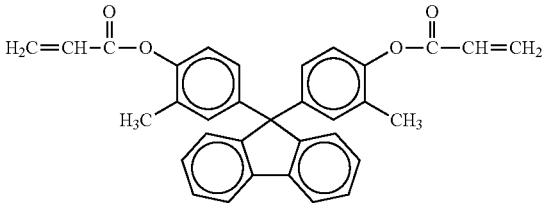
B-1-6
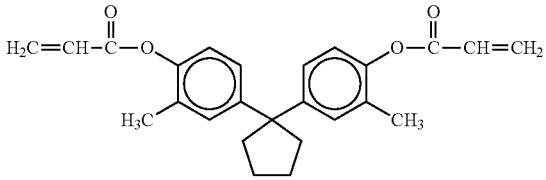
B-1-7
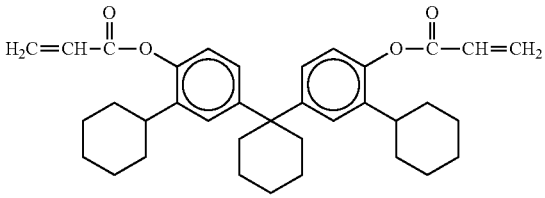
B-1-8
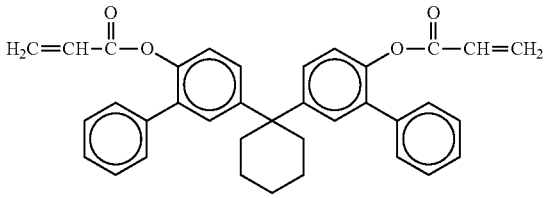

-continued
B-1-9
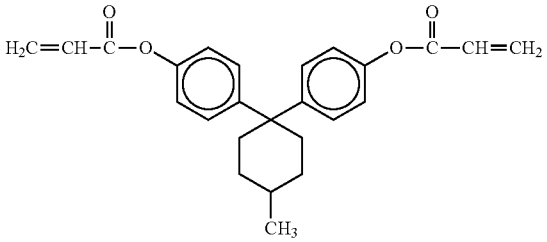
B-1-10
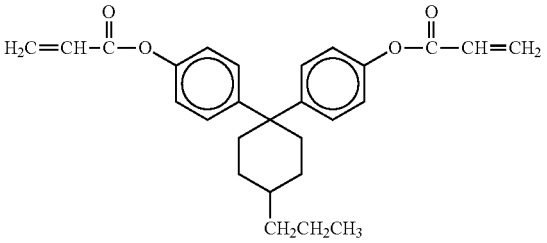
B-1-11
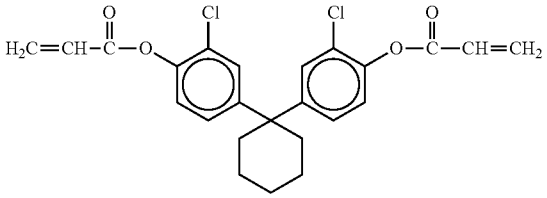
B-1-12
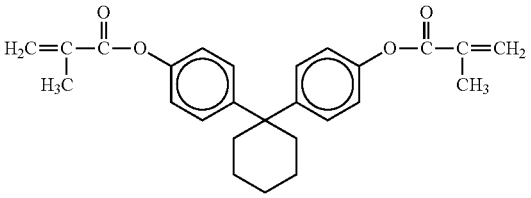
B-1-13
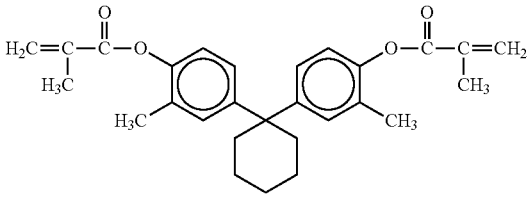
B-1-14
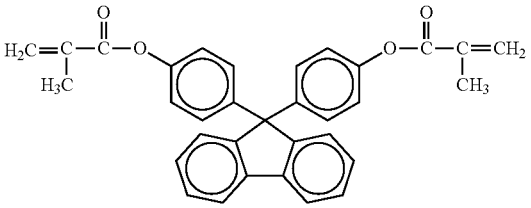
B-1-15
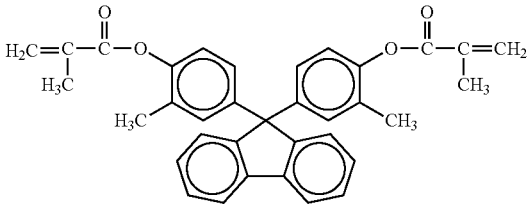
B-1-16
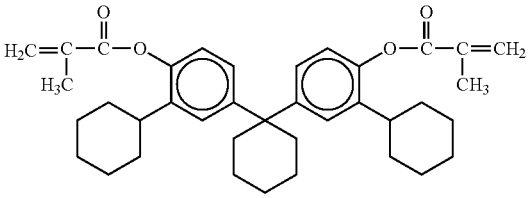
B-2-1
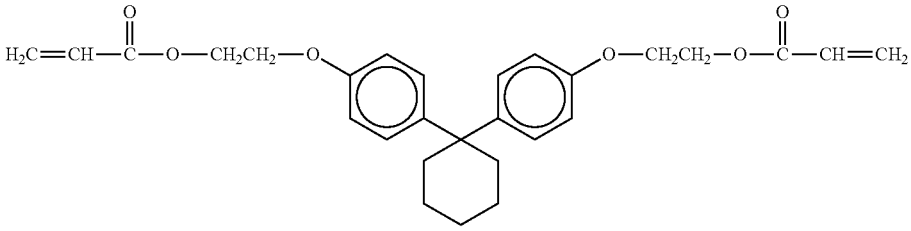
B-2-2
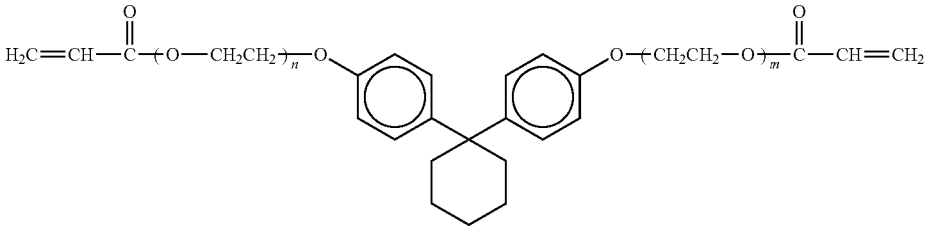
n = 2, m = 2

-continued
B-2-3
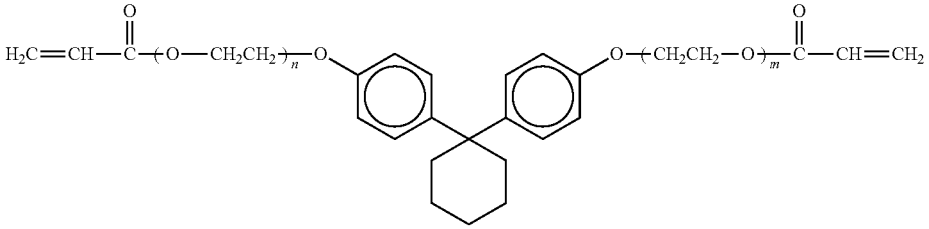
n = 4, m = 4
B-2-4
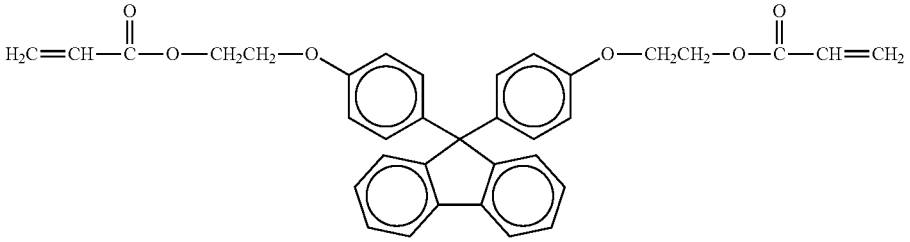
B-2-5
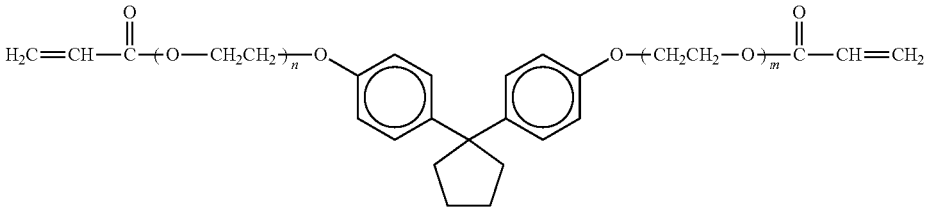
n = 3, m = 3
B-2-6
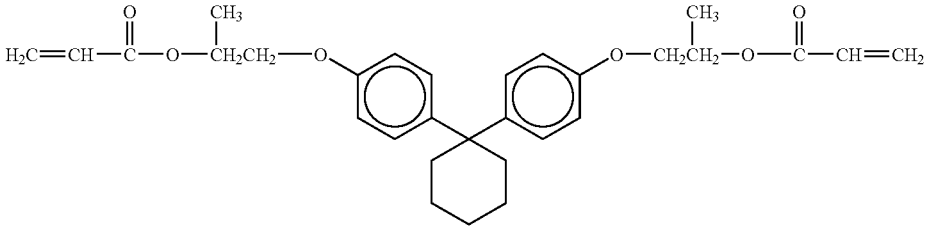
B-2-7
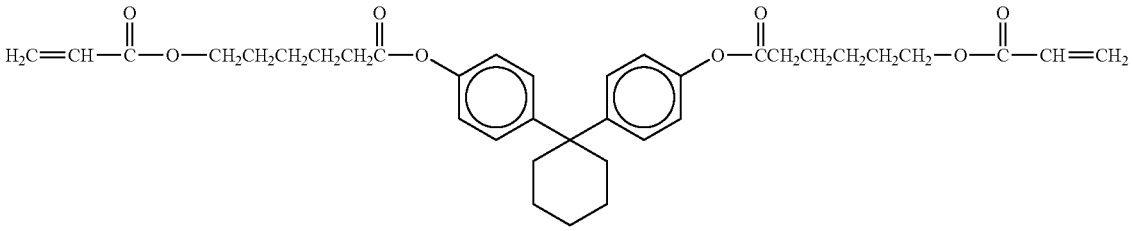
B-2-8
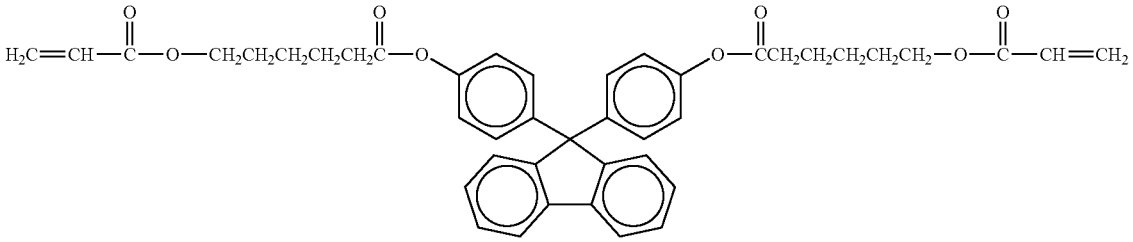

When a layer including a crosslinked material having a unit (A) is formed, it is preferable to coat a photosensitive layer with a coating liquid including a radically polymerizable compound having the following formula (C), followed by radically crosslinking the formed layer.

(C)

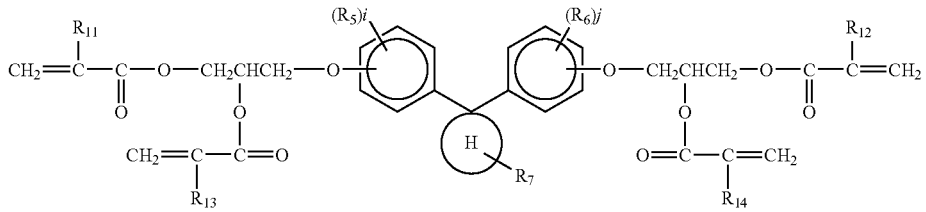

In formula (C), H represents a 1,1-cyclopentane-diyl group, a 1,1-cyclohexane-diyl group, or a 9,9-fluorene-diyl group; each of $R_{11}$, $R_{12}$, $R_{13}$ and $R_{14}$ represents a hydrogen atom, or a methyl group; each of $R_5$ and $R_6$ represents a linear, branched or cyclic alkyl group having 1 to 6 carbon atoms, a halogen atom, or an aryl group; $R_7$ represents a hydrogen atom, or an alkyl group having 1 to 4 carbon atoms; and each of i and j is 0 or an integer of from 1 to 4.

The radically polymerizable compounds having formula (C) can be easily prepared by, for example, a method including the following processes.

C1-1

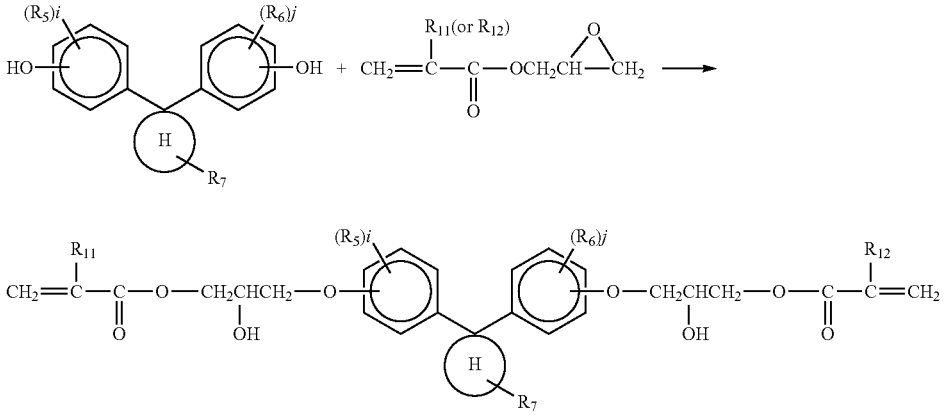

C1-2

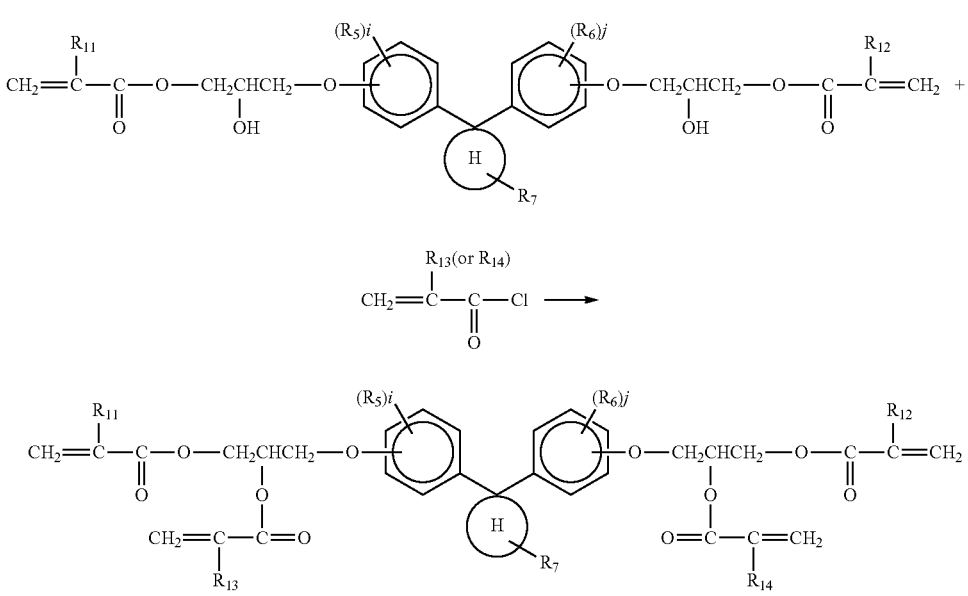

Alternatively, the C1-1 process can be replaced with a combination of the following processes C2-1 and C2-2.
C2-1
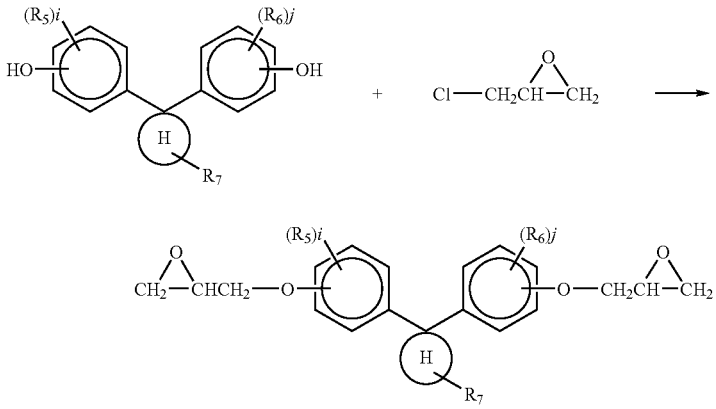
C2-2
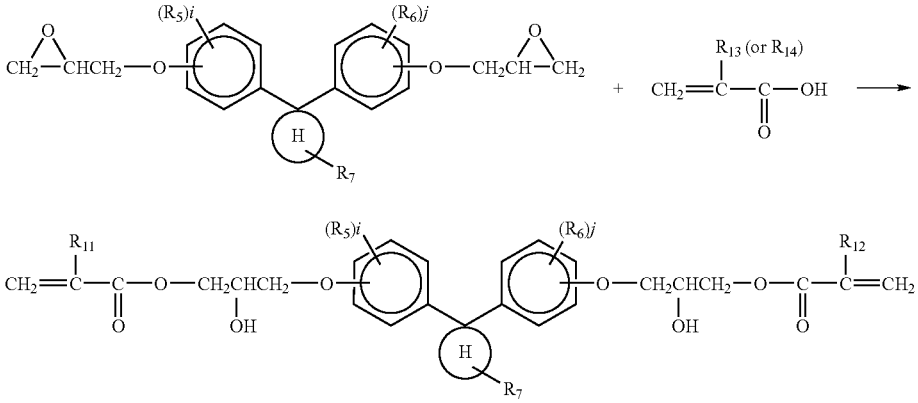
In addition, when all the groups $R_{11}$ to $R_{14}$ are the same group, the compounds can be prepared by a method including the following processes.
C3-1
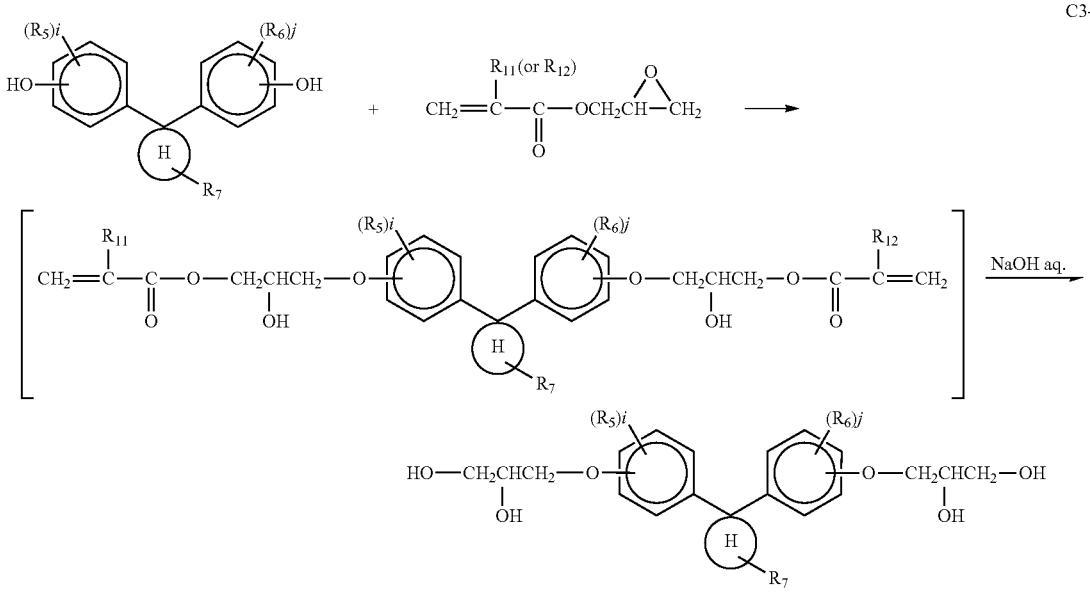

-continued

C3-2

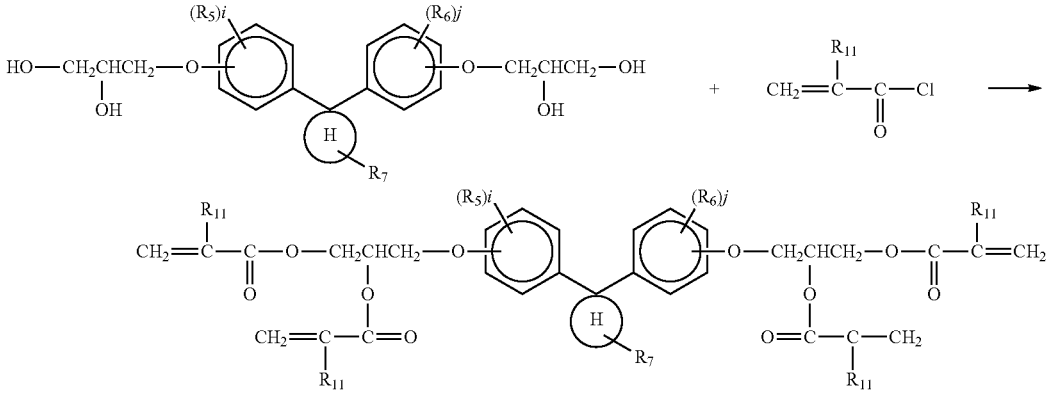

The reactions in the above-mentioned processes can be performed under conditions similar to the conditions under which conventional ring-opening addition reactions of an epoxy ring with a hydroxyl group, and conventional esterification reactions of an acid chloride with a hydroxyl group are performed.

In addition, conventional synthesis methods can also be used. For example, in the above-mentioned processes, an (meth)acryloyl compound is prepared by a reaction of an acid chloride with a hydroxyl group, but it is possible to use a dehydration condensation reaction of the corresponding acid with a hydroxyl group. Further, an acryloyl compound can be prepared by a reaction including the following process C4.

C4

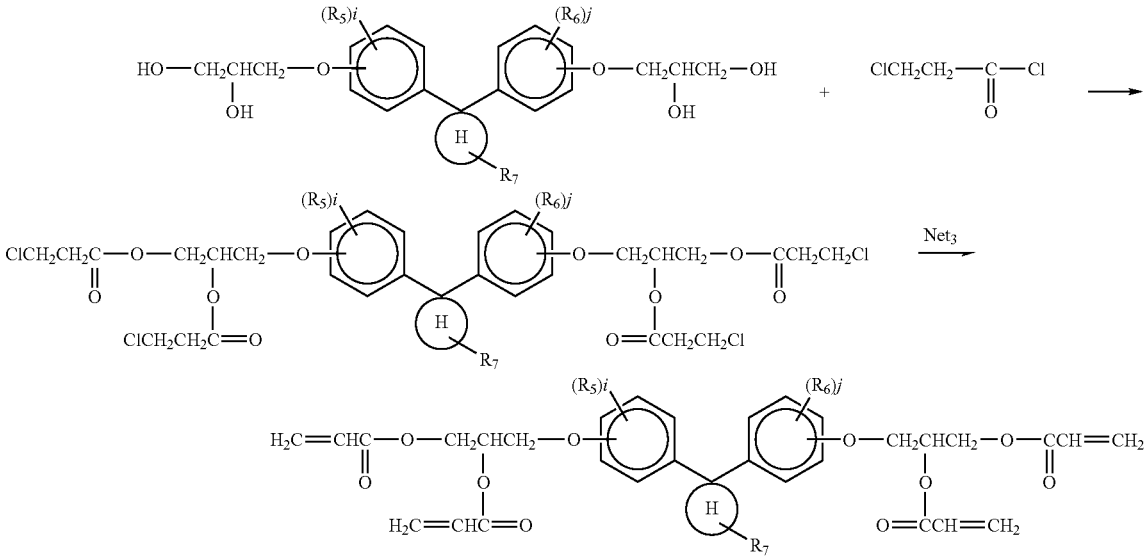

Specific examples of the radically polymerizable compounds having formula (C) include the following compounds but are not limited thereto.

C-1-1

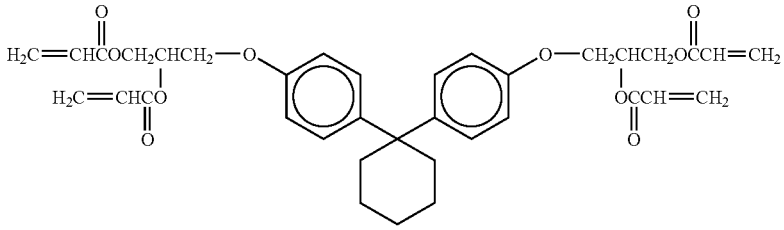

-continued
C-1-2
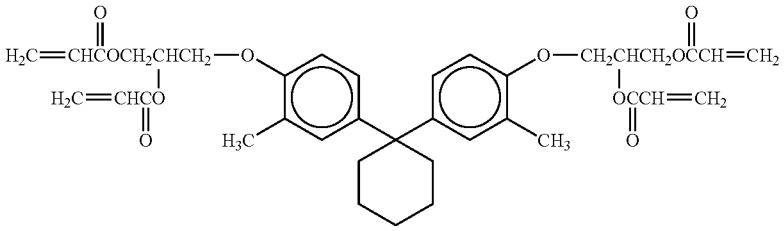
C-1-3
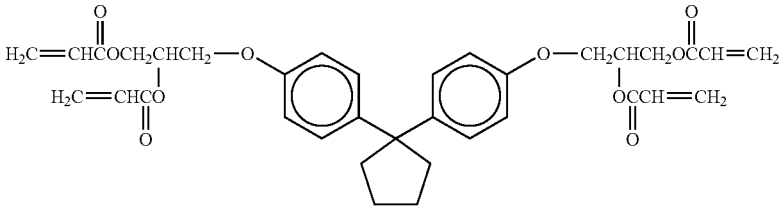
C-1-4
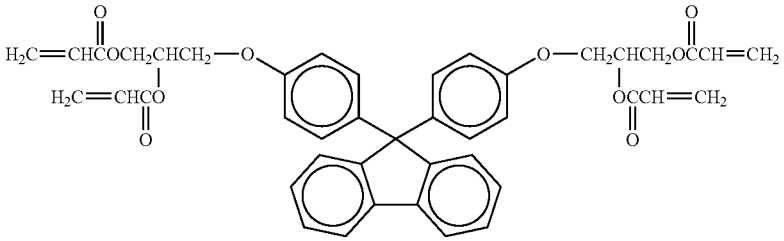
C-1-5
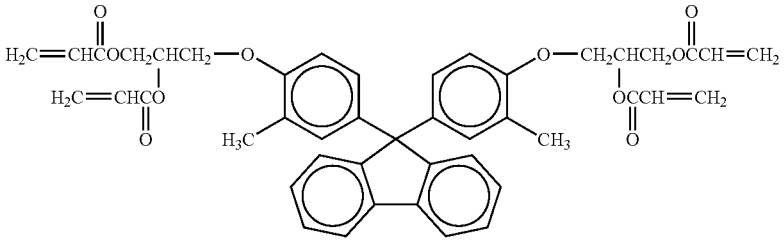
C-1-6
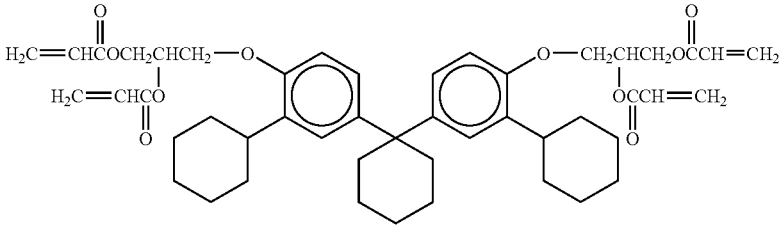
C-1-7
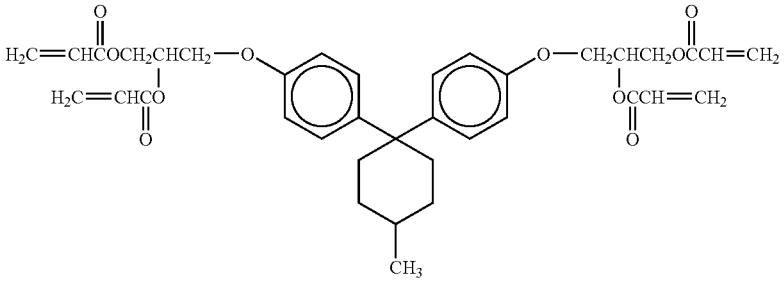

-continued
C-1-8
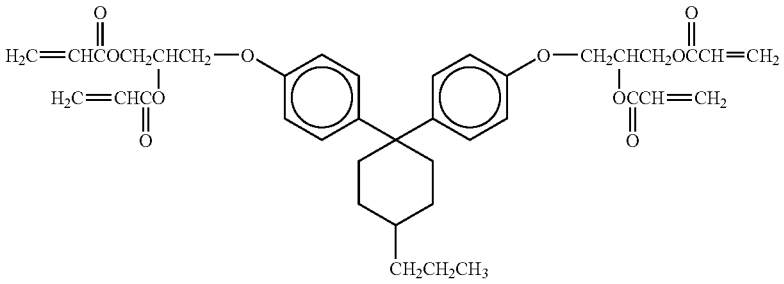
C-1-9
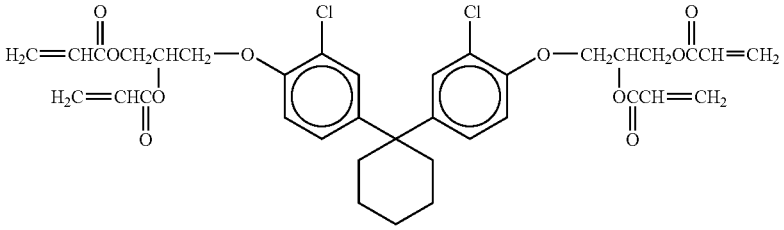
C-1-10
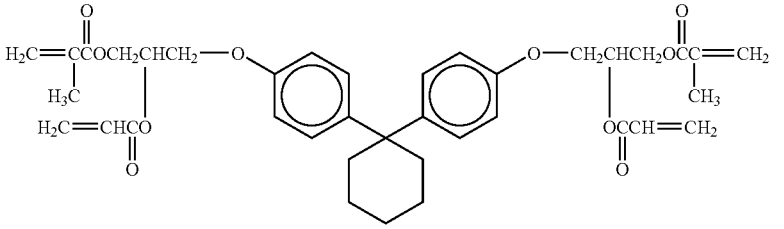
C-1-11
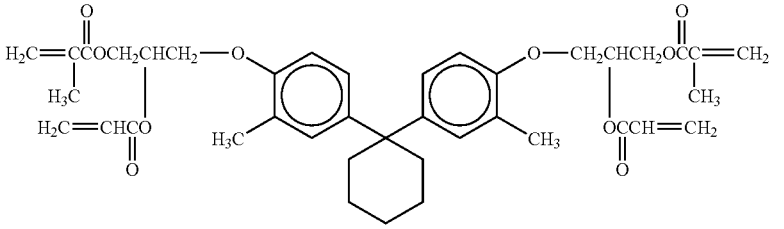
C-1-12
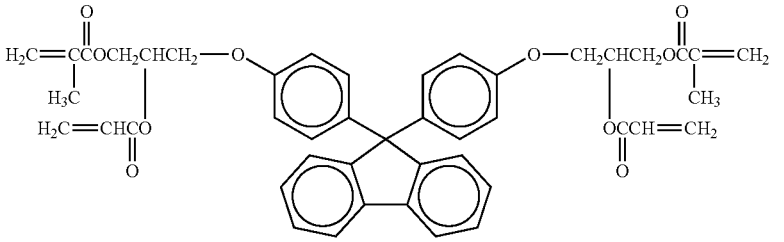
C-1-13
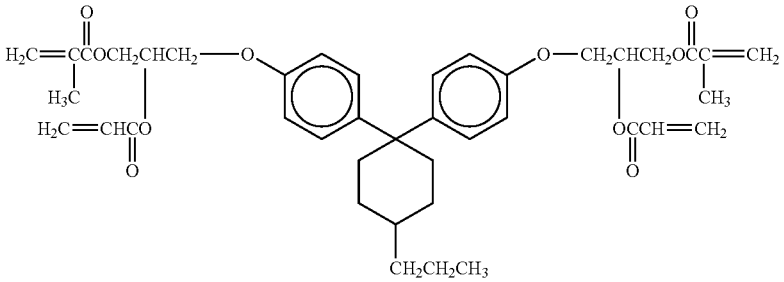

-continued

C-1-14

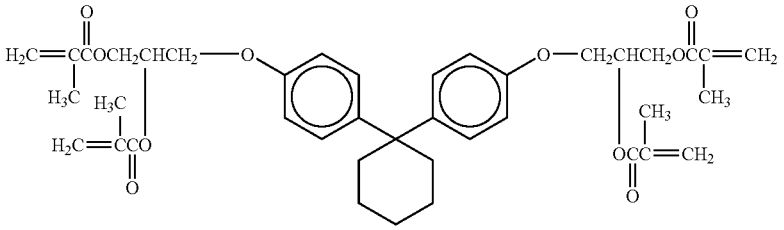

C-1-15

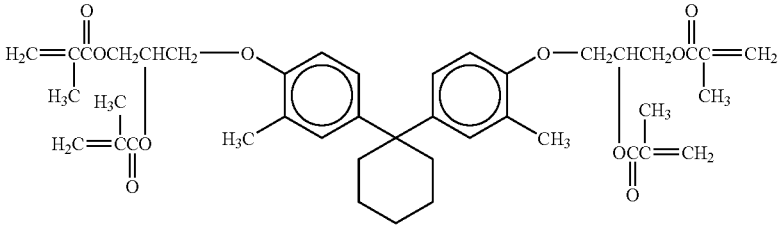

C-1-16

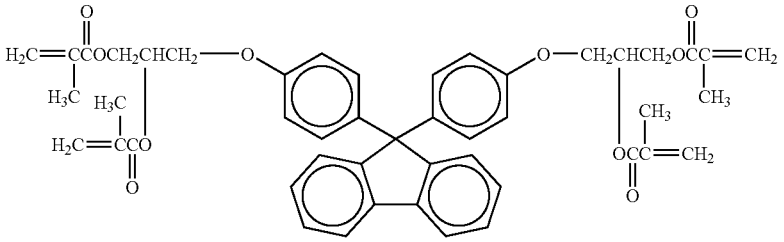

C-1-17

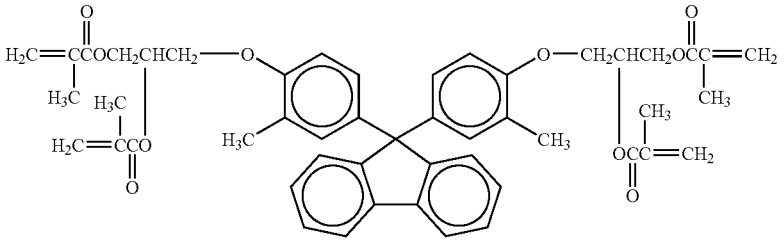

When a layer including a crosslinked material having a unit (A) is formed, it is particularly preferable to coat a photosensitive layer with a coating liquid including a radically polymerizable compound having the following formula (D), followed by radically crosslinking the formed layer.

(D)

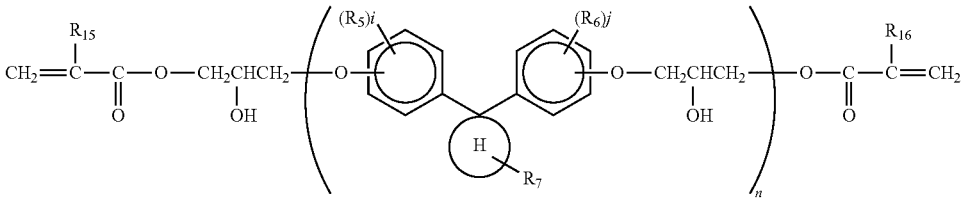

In formula (D), H represents a 1,1-cyclopentane-diyl group, a 1,1-cyclohexane-diyl group, or a 9,9-fluorene-diyl group; each of $R_{15}$, and $R_{16}$ represents a hydrogen atom, or a methyl group; each of $R_5$ and $R_6$ represents a linear, branched or cyclic alkyl group having 1 to 6 carbon atoms, a halogen atom, or an aryl group; $R_7$ represents a hydrogen atom, or an alkyl group having 1 to 4 carbon atoms; n is an integer of from 1 to 50; and each of i and j is 0 or an integer of from 1 to 4.

The radically polymerizable compounds having formula (D) can be prepared by, for example, a method including the following processes.

D1-1
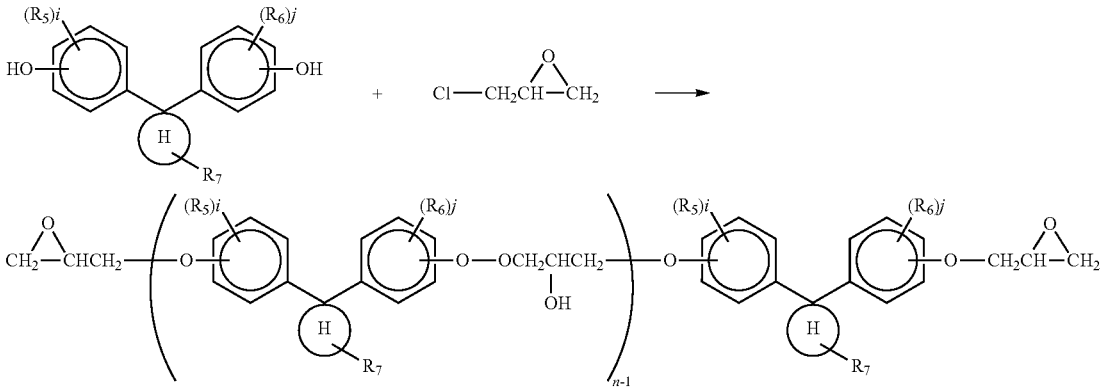
D1-2
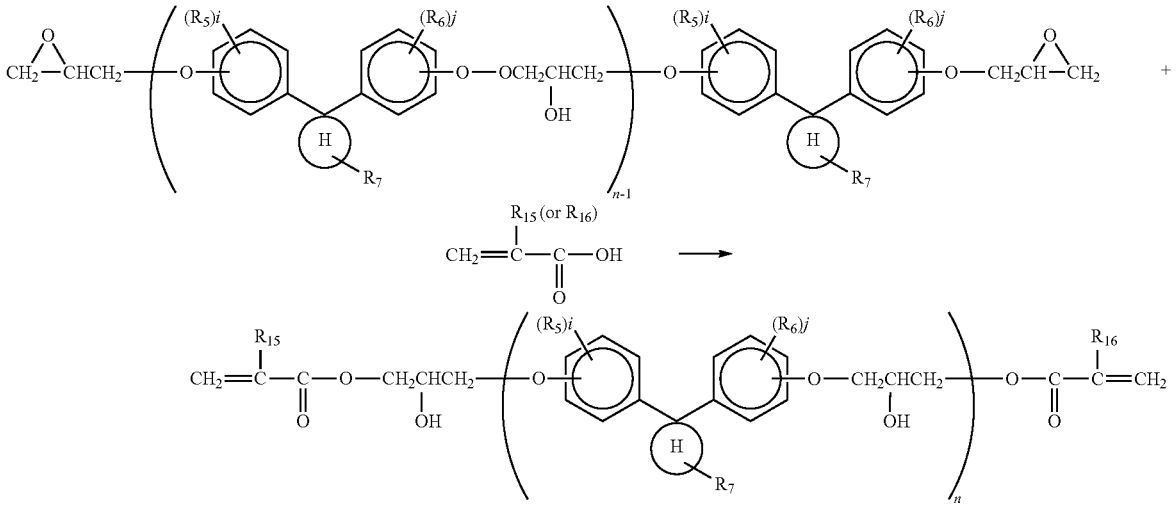
When n=1, the radically polymerizable compounds can also be prepared by the process C1-1.
Specific examples of the radically polymerizable compounds (D) include the following compounds but are not limited thereto.
D-1-1
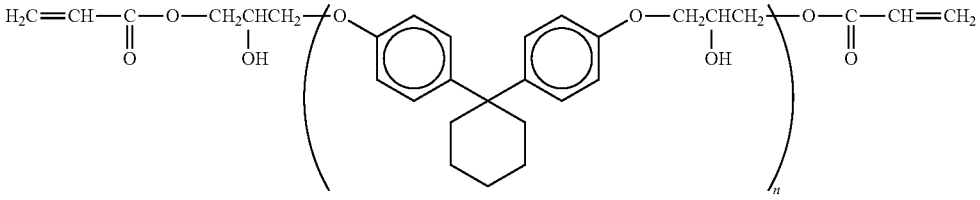
n = 1
D-1-2
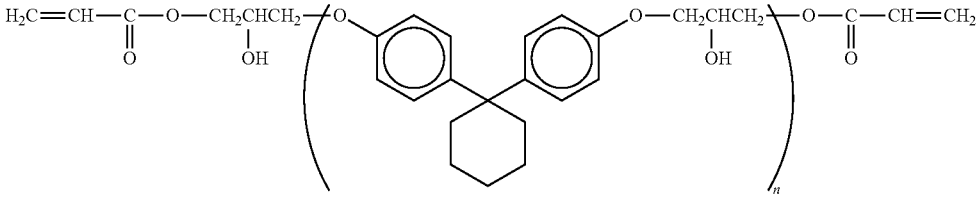
n = 1 - 5 (mixture)

-continued
D-1-3
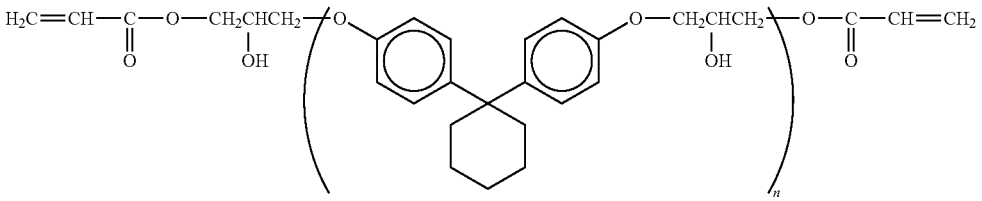
n = 1 - 10 (mixture)
D-1-4
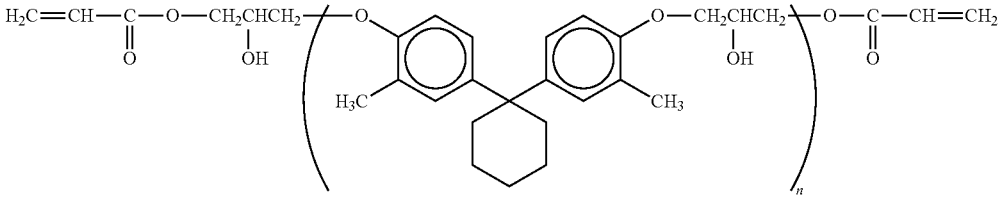
n = 1 - 5 (mixture)
D-1-5
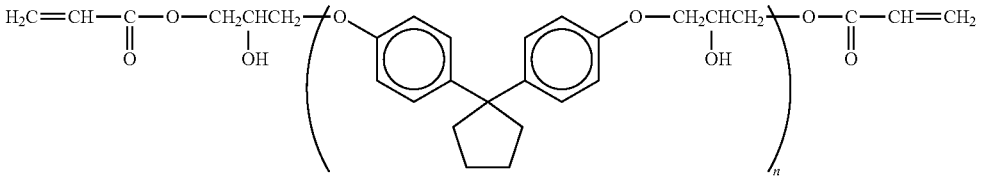
n = 3 - 10 (mixture)
D-1-6
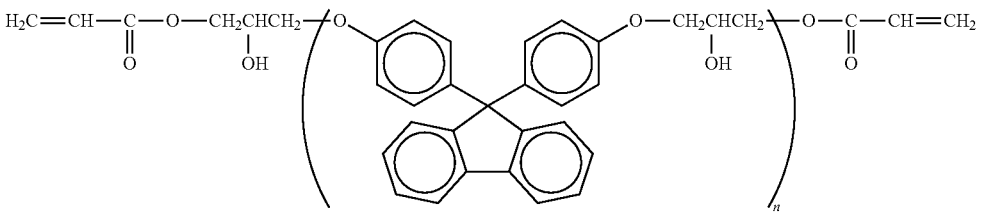
n = 1 - 3 (mixture)
D-1-7
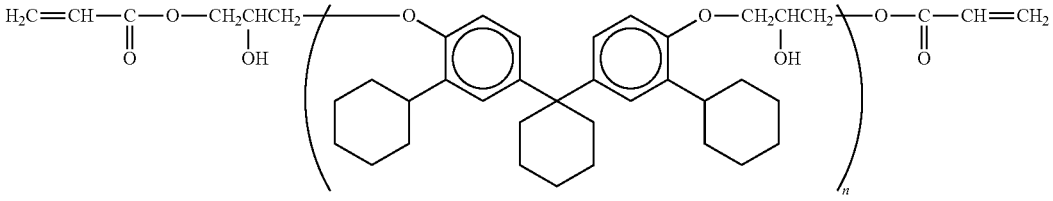
n = 1 - 5 (mixture)

-continued

D-1-8

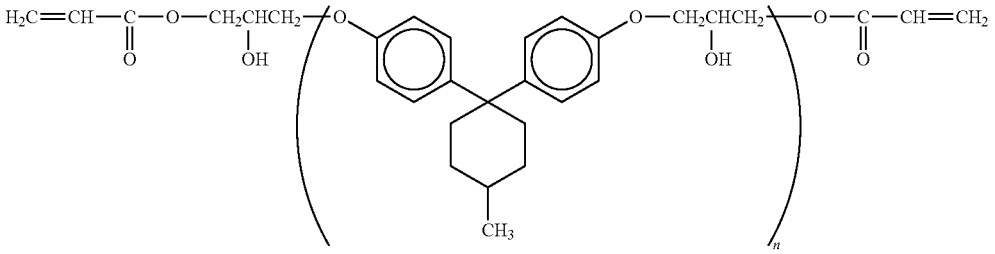

n = 1 - 10 (mixture)

D-1-9

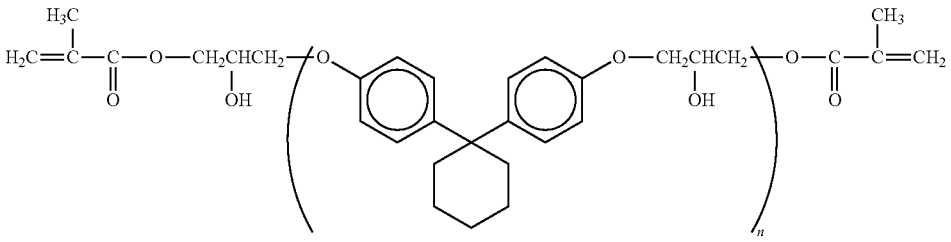

n = 1 - 5 (mixture)

D-1-10

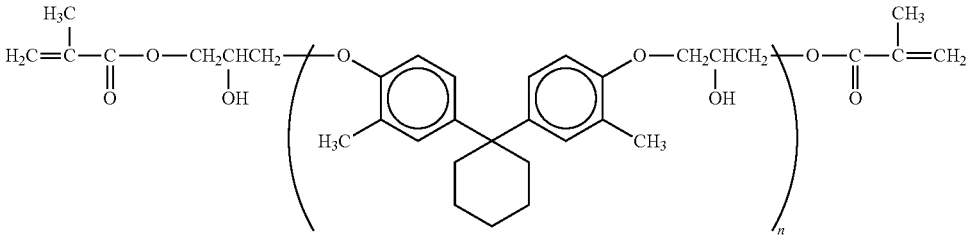

n = 1 - 10 (mixture)

D-1-10

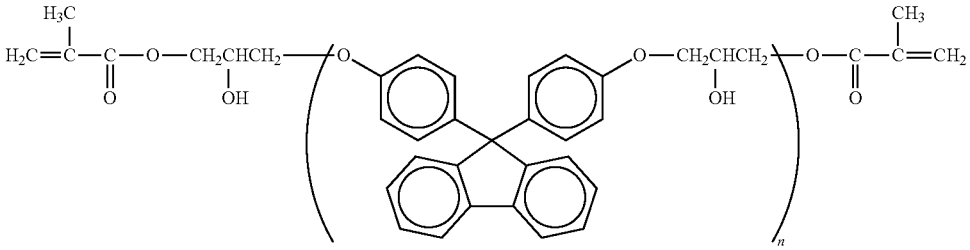

n = 1 - 3 (mixture)

The content of the radically polymerizable compounds (B), (C) and (D) in the solid components included in the coating liquid is preferably from 10 to 100% by weight, and preferably from 20 to 70% by weight, based on the total weight of the solid components included in the coating liquid. When the content is too low, the concentration of the unit (A) decreases, and the resistance to changes of environmental conditions and oxidation gasses cannot be improved, resulting in deterioration of electric properties and image qualities of the resultant photoreceptor. When the content is too high, problems that the mechanical strength of the resultant layer decreases and the resultant photoreceptor has a high residual potential when the layer is thick occurs due to decrease of the number of the crosslinkable functional groups.

Next, the photoreceptor having an outermost layer including a radically crosslinked material including a unit having the following formula (E) (i.e., a second example of the outermost layer) will be explained.

(E)

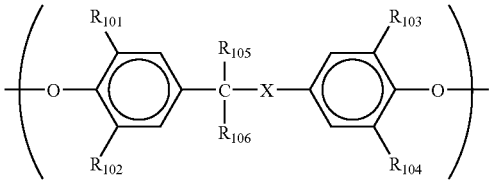

In formula (E), X is a direct bond or one of the following divalent groups:

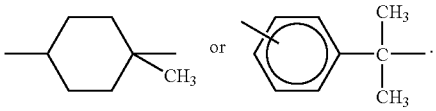

When X is a direct bond, each of $R_{101}$, $R_{102}$, $R_{103}$ and $R_{104}$ represents a hydrogen atom, a linear, branched or cyclic alkyl group having 1 to 6 carbon atoms, a halogen atom, or an aryl group; each of $R_{105}$ and $R_{106}$ represents a hydrogen atom, a methyl group, or an ethyl group, wherein a case where all of $R_{101}$ to $R_{104}$ is a hydrogen atom is excluded, and the number of total carbon atoms included in $R_{105}$ and $R_{106}$ is 0 to 2. When X is not a direct bond, each of $R_{101}$ to $R_{104}$ represents a hydrogen atom, an alkyl group having 1 to 4 carbon atoms or a halogen atom, and each of $R_{105}$ and $R_{106}$ is a methyl group.

Similarly to the case of the outermost layer including a crosslinked material having a unit (A), by incorporating a unit having formula (E) in the radically crosslinked material constituting the outermost layer, a photoreceptor which has a good combination of abrasion resistance and environmental stability (such as resistance to changes of temperature and humidity, and resistance to oxidation gasses such as ozone and NOx generated by chargers) can be provided, i.e., a photoreceptor which can produce high quality images with hardly causing problems such as change of image density, formation of tailed images and deterioration of resolution can be provided.

The reason why the outermost layer including a radically crosslinked material having a unit having the following formula (E) has a high abrasion resistance is considered to be almost the same as that mentioned above in the outermost layer including a radically crosslinked material having a unit having formula (A). In particular, when the group X is not a single bond, the bisphenol structure extends like a stick unlike the bisphenol A structure. Therefore, the internal movement is limited due to the steric hindrance. Thus, a structure like a thick and hard stick is included in tangled molecules, thereby producing the above-mentioned effects. As mentioned above in the outermost layer including a crosslinked material having a unit (A), when a unit (E) is incorporated in the crosslinked material, removal of materials having relatively low molecular weights can be prevented due to the tangling effect and stacking effect of the crosslinked material, resulting in prevention of abrasion of the layer.

The reason why the outermost layer including a radically crosslinked material having a unit having formula (E) has a high environmental stability is also considered to be almost the same as that mentioned above in the outermost layer including a radically crosslinked material having a unit having formula (A). In particular, when the group X is a single bond, adsorption of oxidation gasses on the oxygen atoms (which is a polar group) of the unit (E) can be prevented by substituting the hydrogen atoms of the benzene ring with a bulky group such as linear, branched or ring alkyl groups, halogen atoms, and aryl groups, thereby improving the resistance to oxidation gasses. This is different from the bisphenol A structure.

In this second example of the outermost layer, the radically crosslinked material included in the outermost layer includes a unit (E). The method for preparing such a radically polymerized material is the same as that mentioned above for use in the first example of the outermost layer.

When a layer including a crosslinked material having a unit (E) is formed, it is preferable to coat a photosensitive layer with a coating liquid including a radically polymerizable compound having the following formula (F), followed by radically crosslinking the formed layer.

(F)

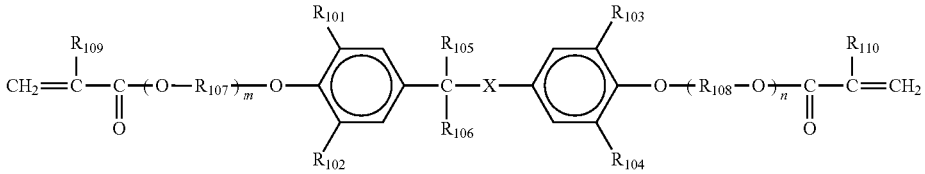

In formula (F), each of $R_{101}$ to $R_{104}$ represents a hydrogen atom, an alkyl group having 1 to 4 carbon atoms, a halogen atom; X represents one of the following divalent groups:

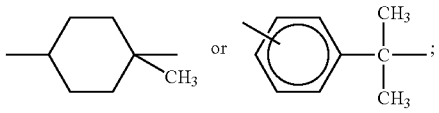

each of $R_{105}$ and $R_{106}$ is a methyl group; each of $R_{107}$ to $R_{108}$ represents a linear or branched alkylene group, a 1-ketohexylene group, or a phenylene group; each of $R_{109}$ to $R_{110}$ represents a hydrogen atom or a methyl group; and each of m and n is 0 or an integer of from 1 to 4.

The compounds having formula (F) can be prepared by, for example, a method including a process F1-1 or a combination process of F2-1 and F2-2, which are described below.

F1-1
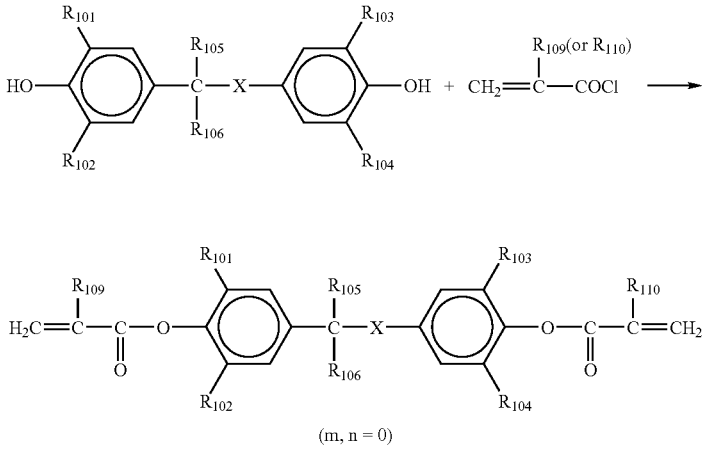
F2-1
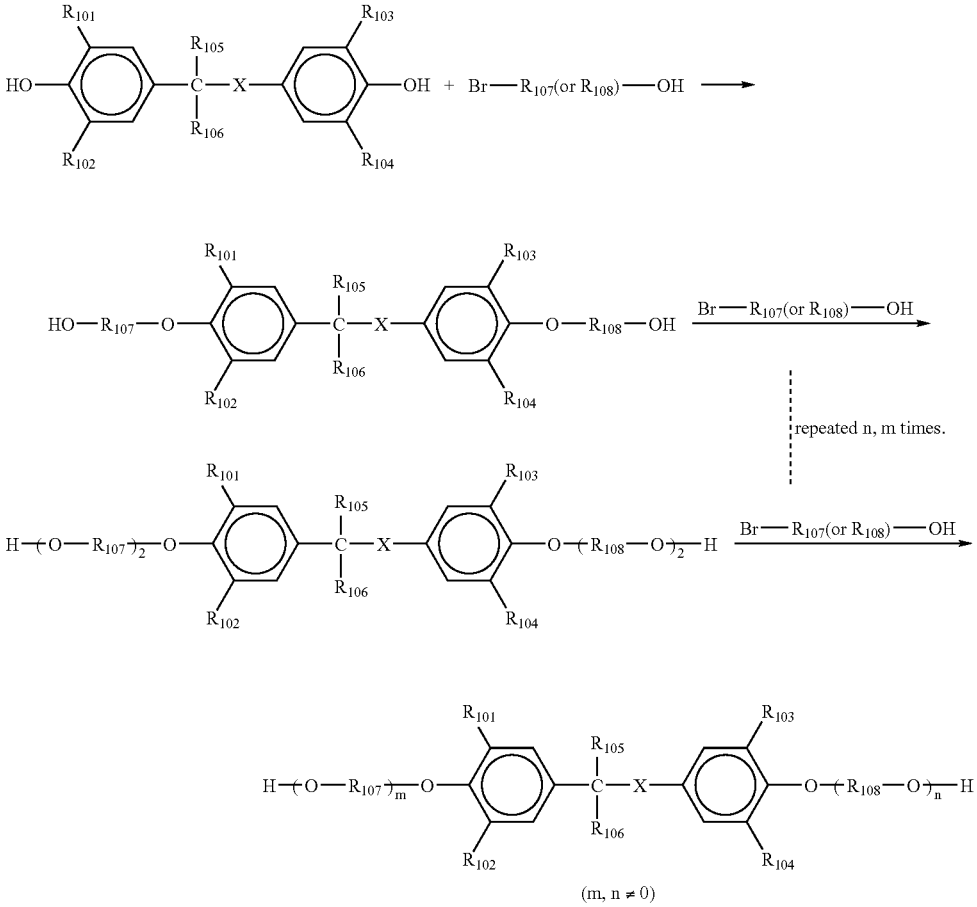
F2-2
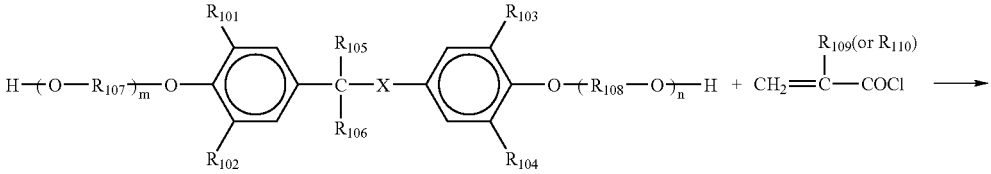

-continued
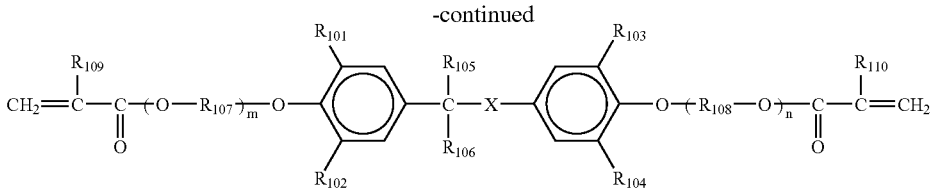
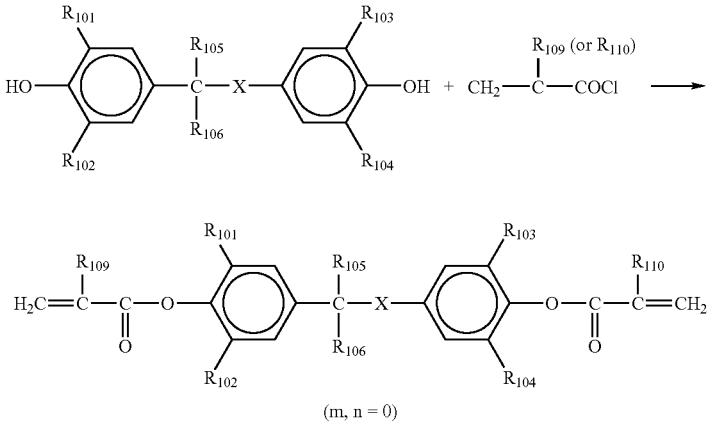
(m, n = 0)
Specific examples of the radically polymerizable compounds having formula (F) include the following, but are not limited thereto.
F-1-1
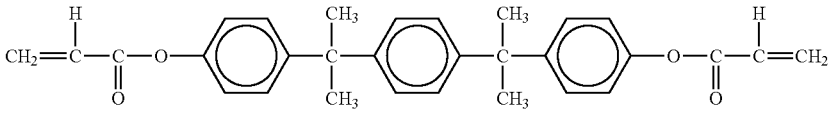
F-1-2
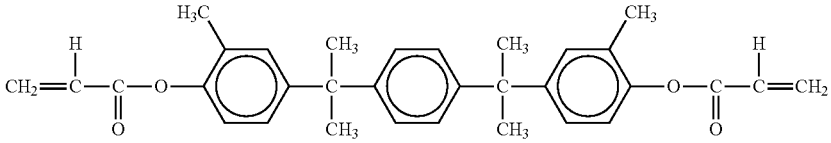
F-1-3
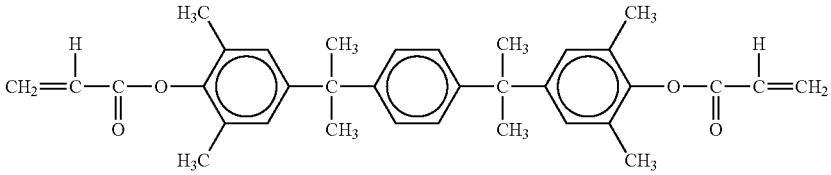
F-1-4
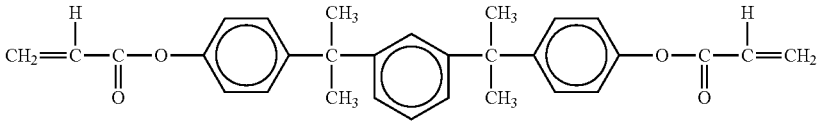

-continued
F-1-5
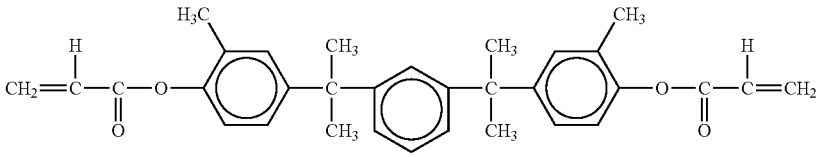
F-1-6
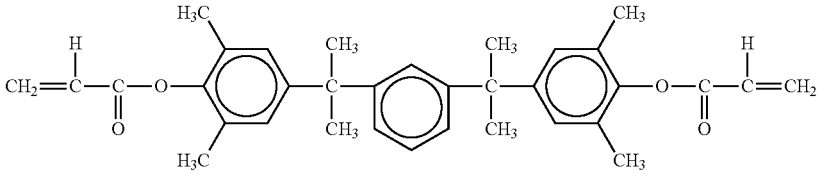
F-1-7
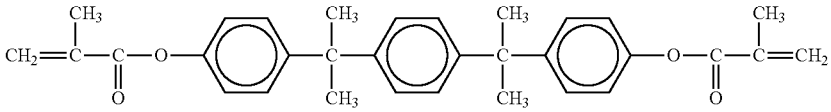
F-1-8
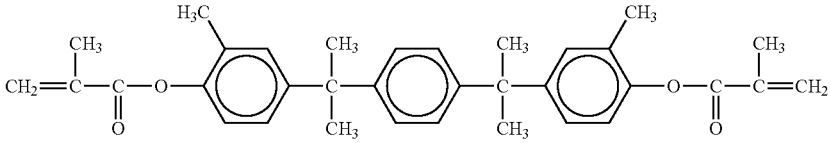
F-1-9
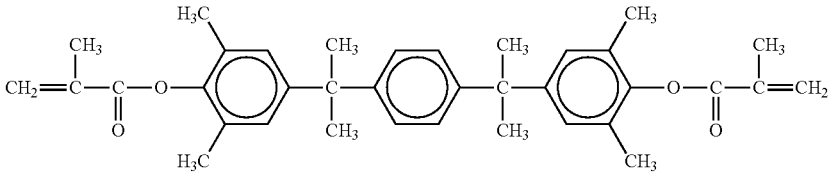
F-1-10
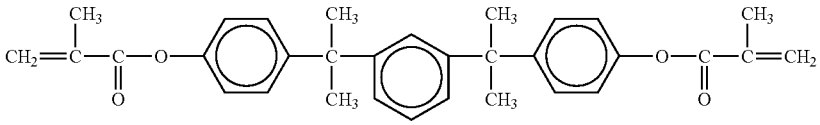
F-1-11
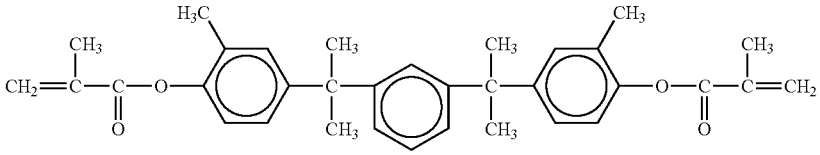
F-1-12
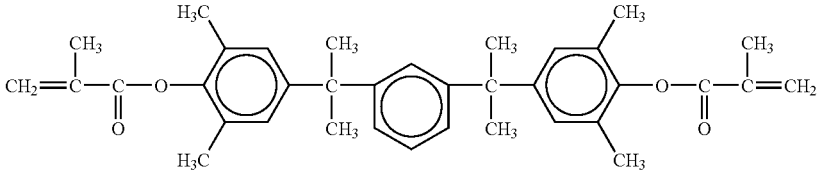
F-1-13
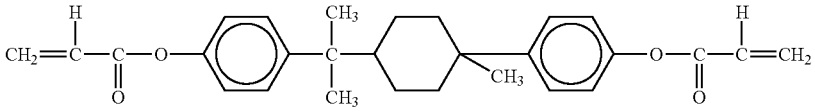
F-1-14
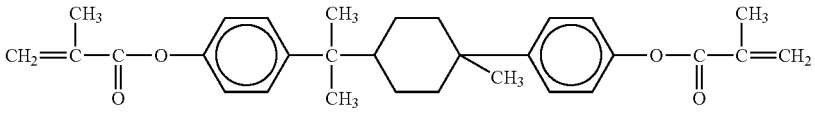

-continued
f-1-1
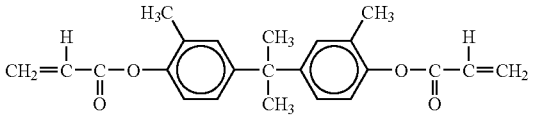
f-1-2
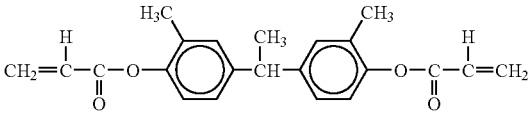
f-1-3
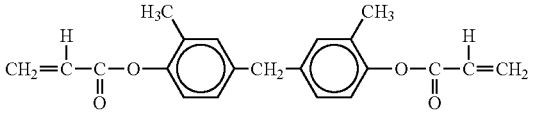
f-1-4
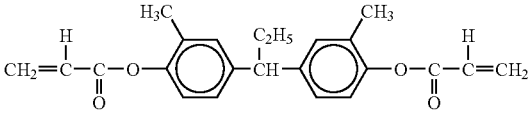
f-1-5
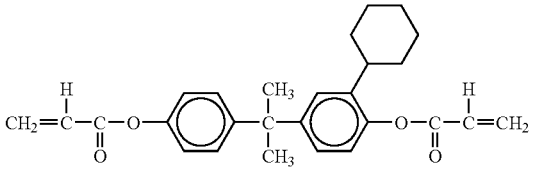
f-1-6
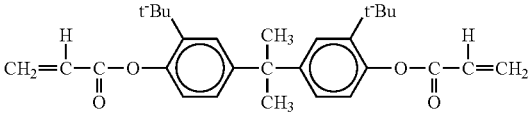
f-1-7
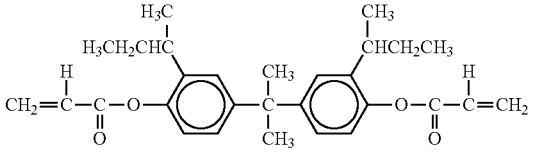
f-1-8
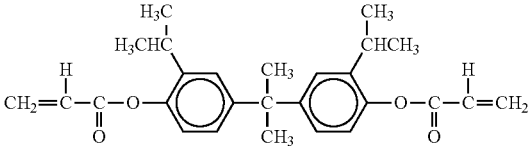
f-1-9
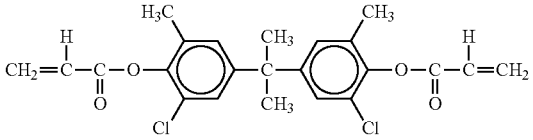
f-1-10
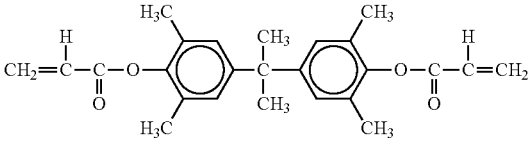
f-1-11
f-1-12
f-1-13
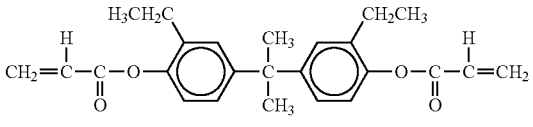
f-1-14
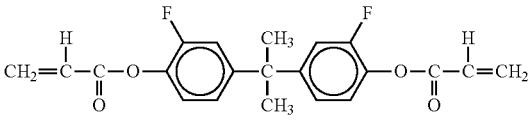
f-1-15
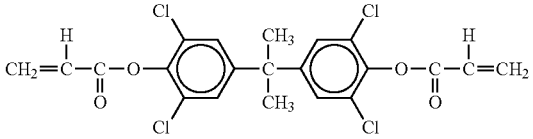
f-1-16
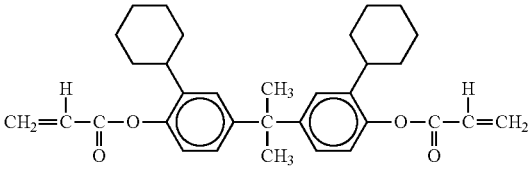
f-1-17
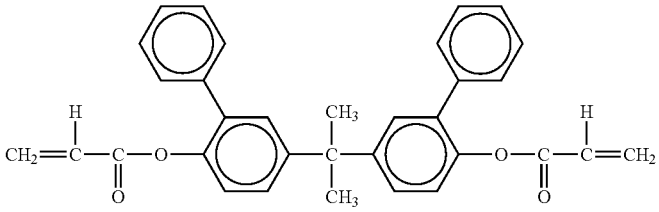

-continued
f-1-18
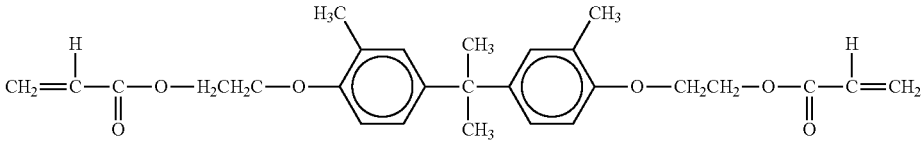
f-1-19
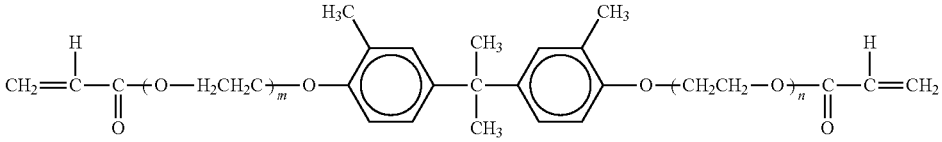
m + n = 3
f-1-20
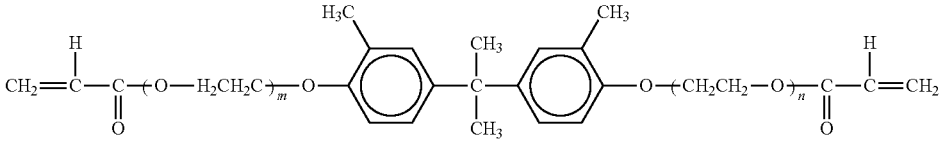
m + n = 8
f-1-21
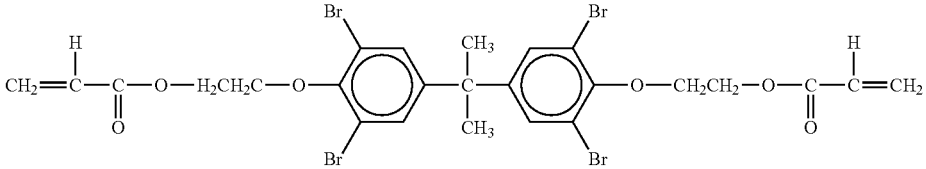
f-1-22
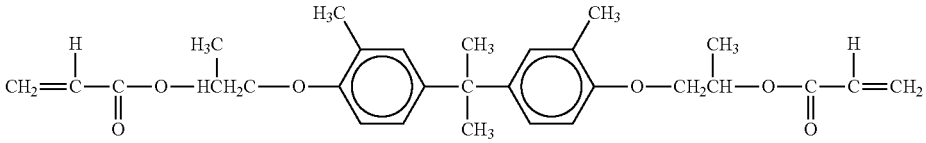
f-1-23
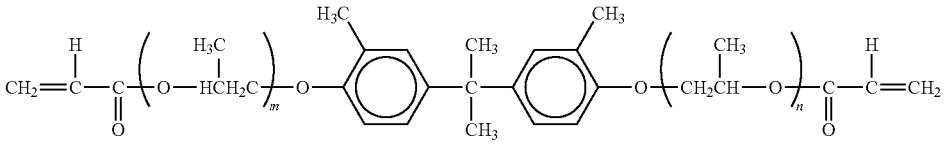
m + n = 4
f-1-24
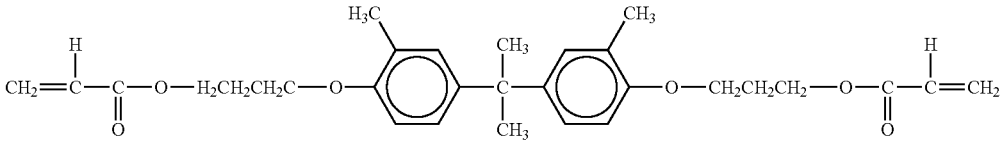
f-1-25
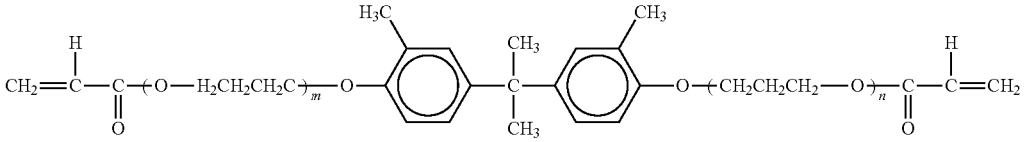
m + n = 4
f-1-26
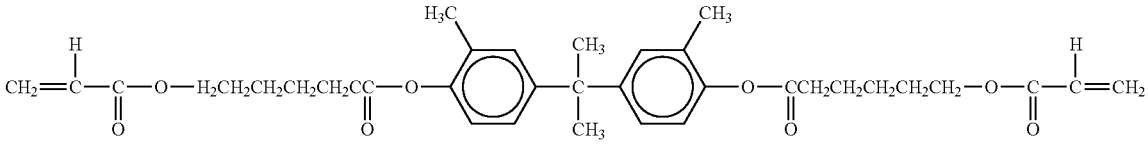

-continued
f-1-27
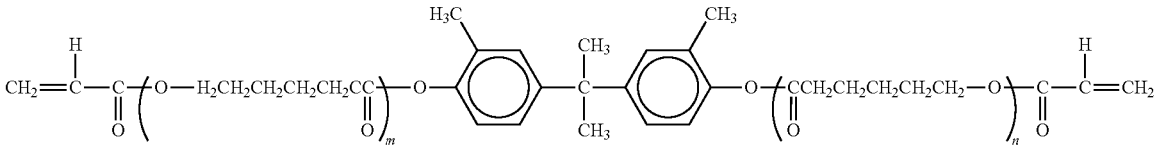
m + n = 4
f-1-28
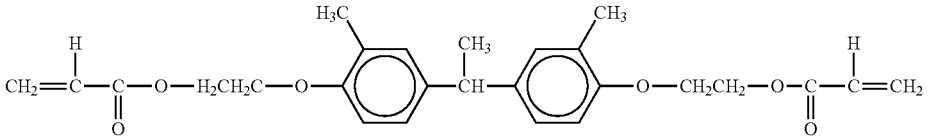
f-1-29
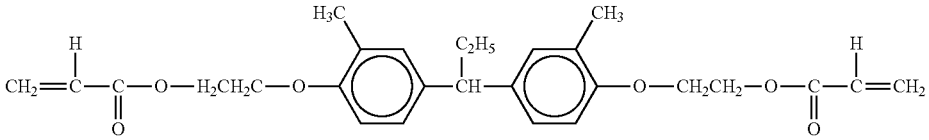
f-1-30
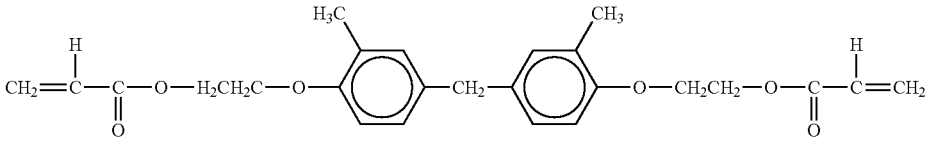
f-1-31
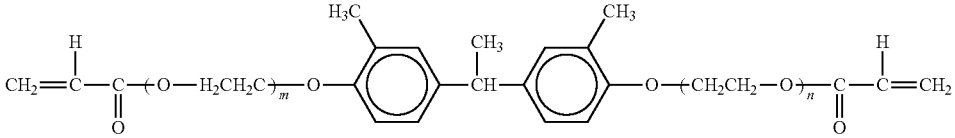
m + n = 3
f-1-32
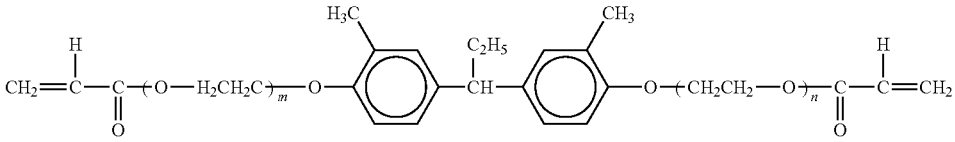
m + n = 3
f-1-33
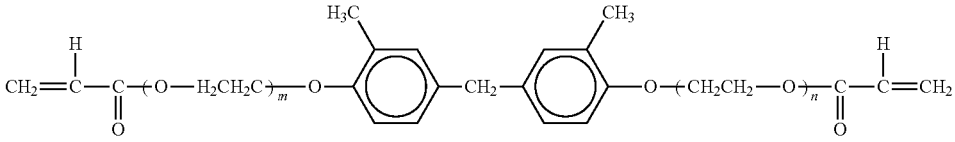
m + n = 3
f-1-34
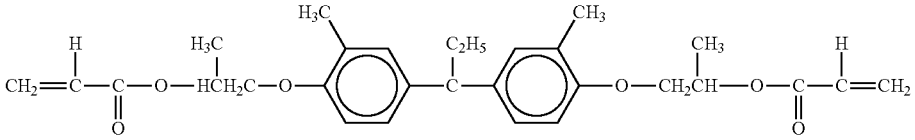
f-1-35
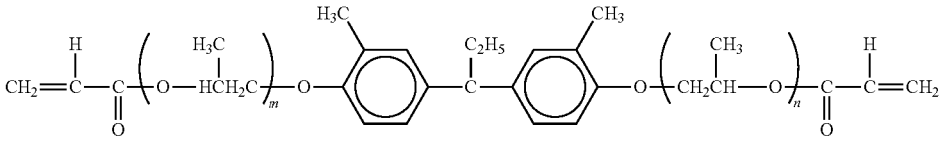
m + n = 3

-continued
f-1-36
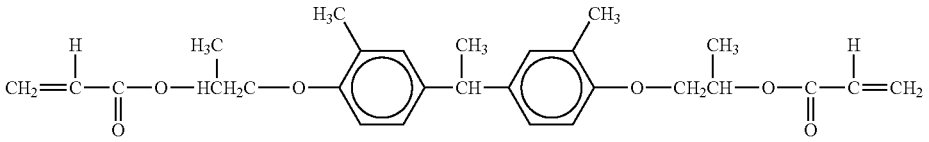
f-1-37
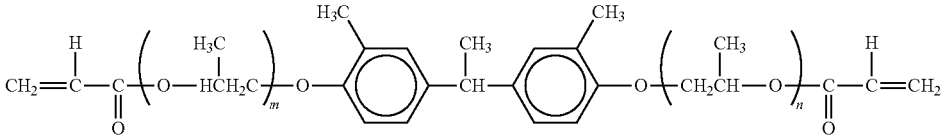
m + n = 3
f-1-38
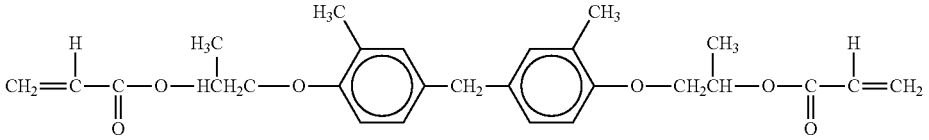
f-1-39
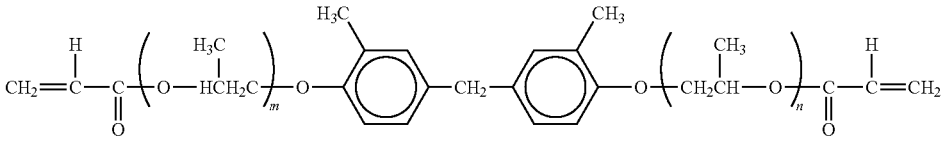
m + n = 3
f-1-40
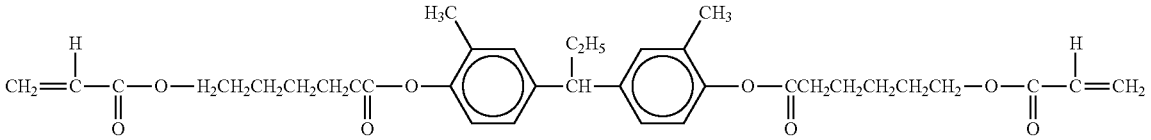
f-1-41
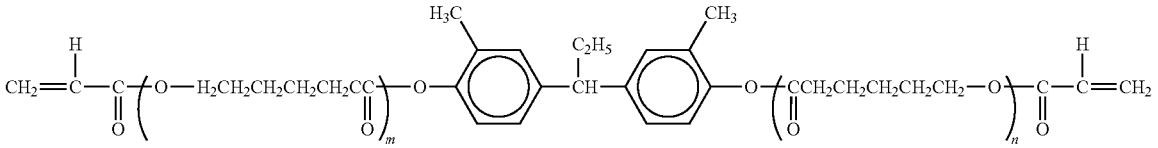
m + n = 4
f-1-42
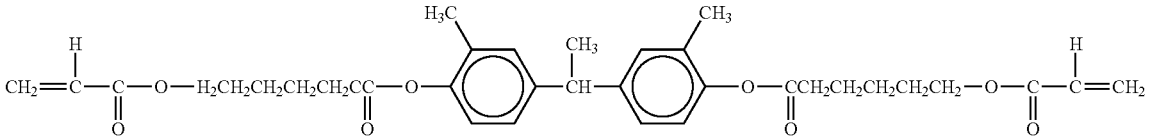
f-1-43
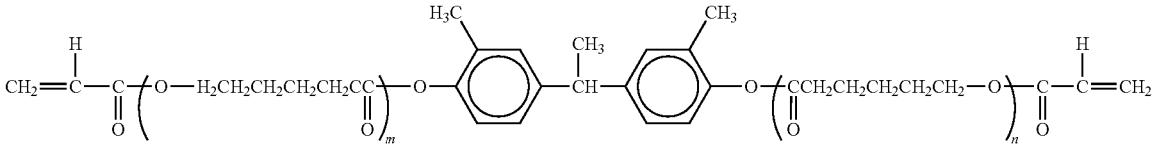
m + n = 4
f-1-44
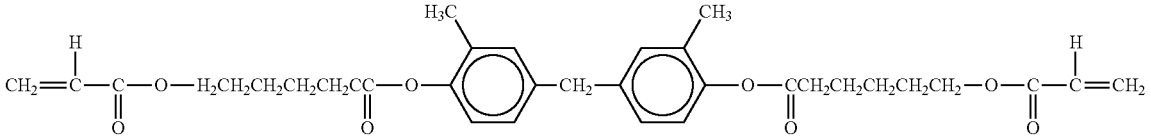

-continued
f-1-45
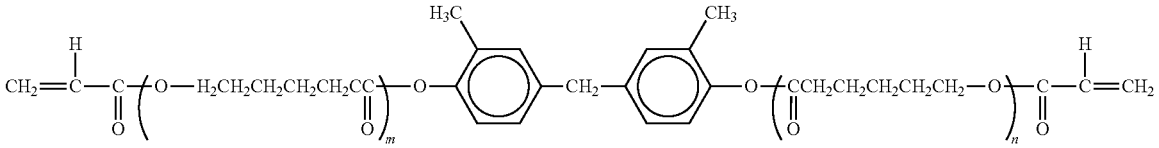
m + n = 4
F-2-1
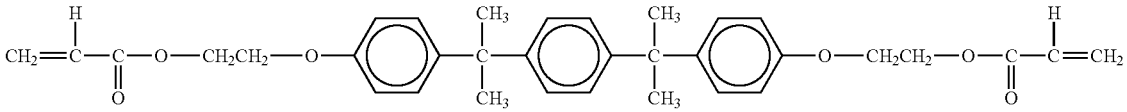
F-2-2
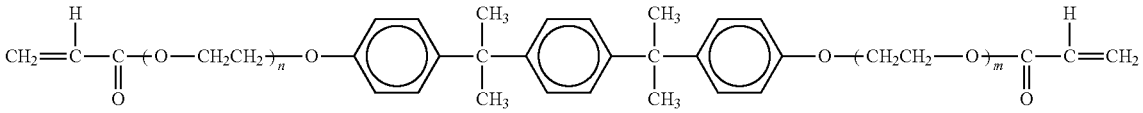
n = 2, m = 2
F-2-3
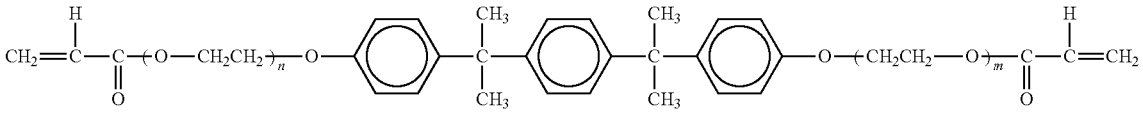
n = 4, m = 4
F-2-4
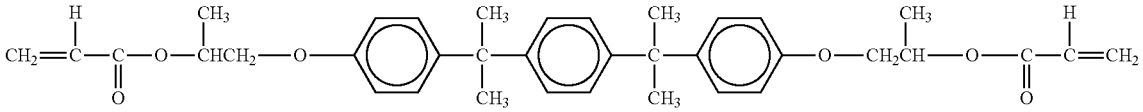
F-2-5
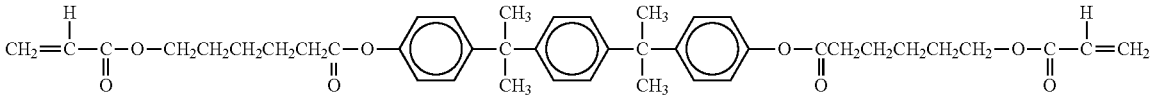
F-2-6
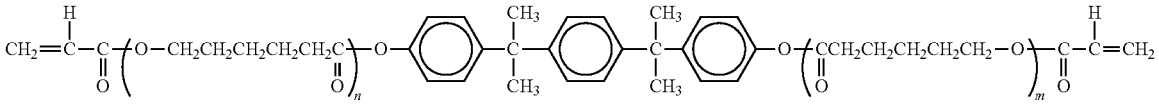
n = 2, m = 2
F-2-7
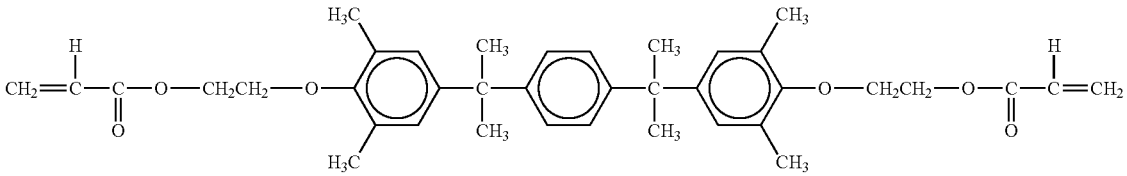
F-2-8
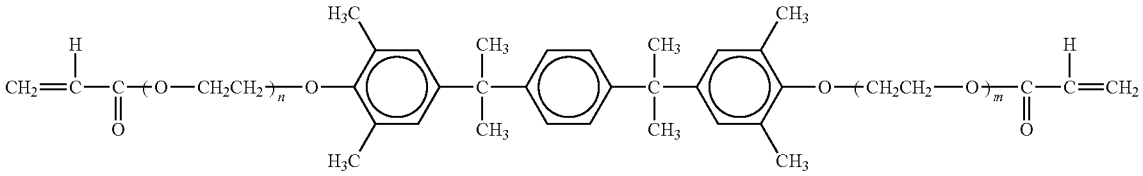
n = 3, m = 3

-continued
F-2-9
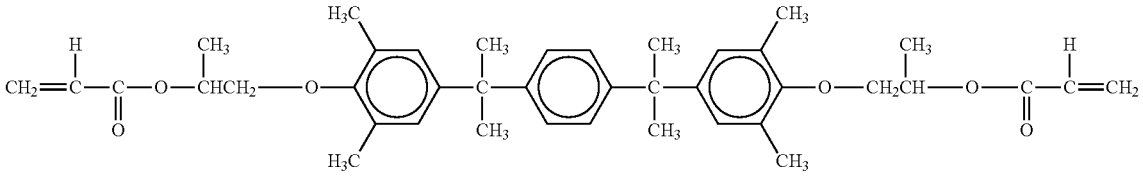
F-2-10
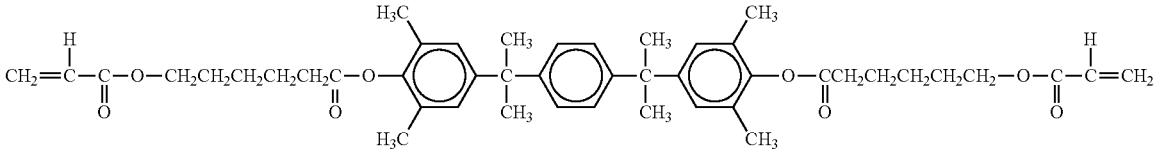
F-2-11
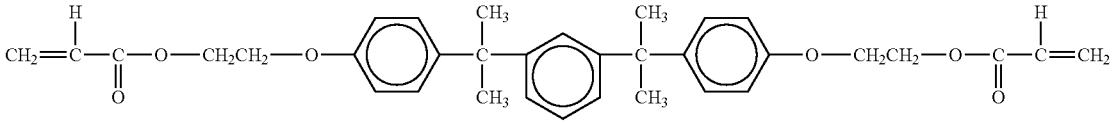
F-2-12
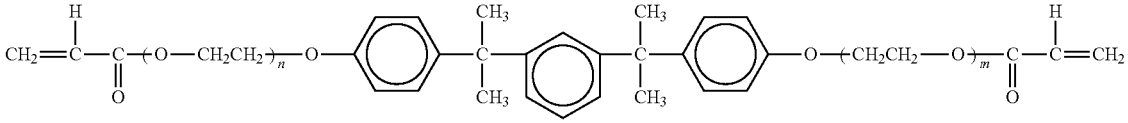
n = 2, m = 2
F-2-13
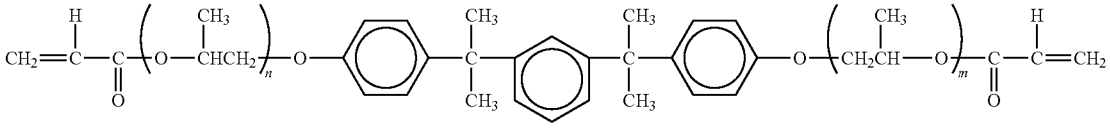
n = 2, m = 2
F-2-14
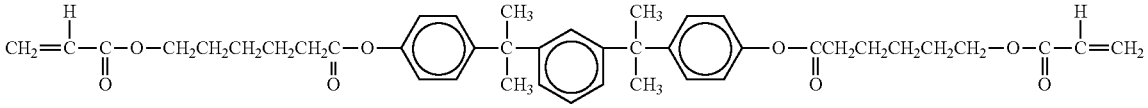
F-2-15
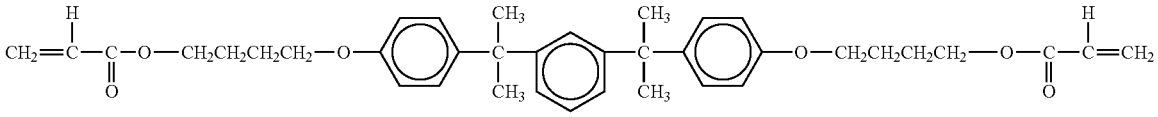
F-2-16
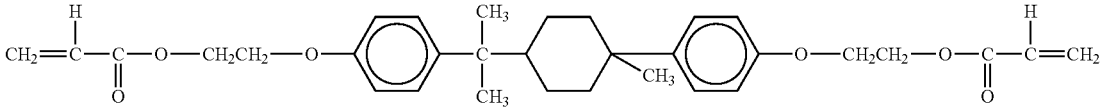
F-2-17
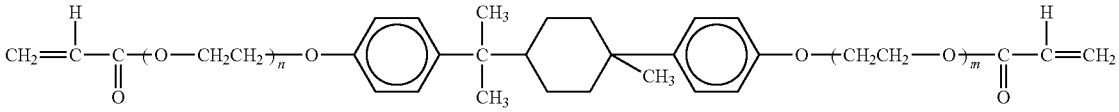
n = 2, m = 2

-continued
F-2-18
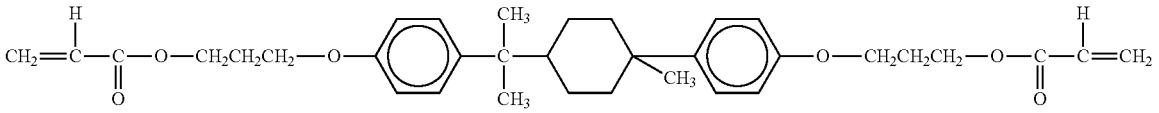
F-2-19
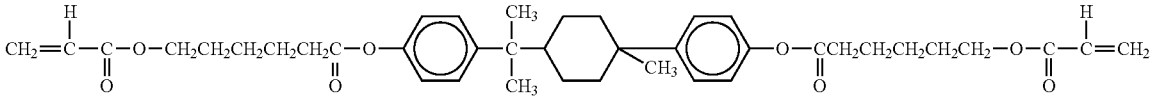
F-2-20
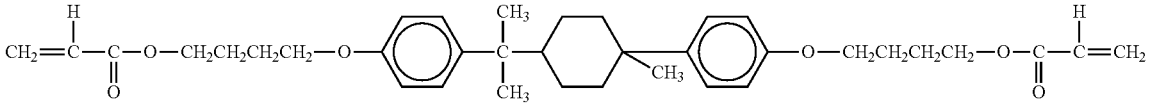
F-2-21
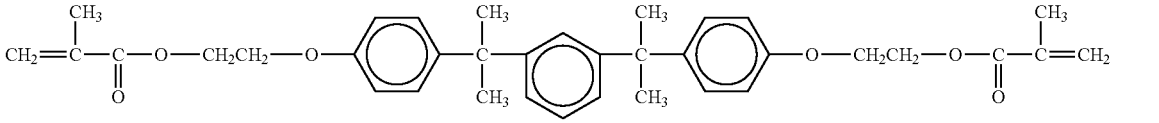
F-2-22
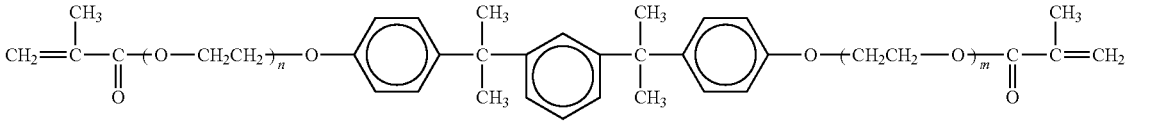
n = 2, m = 2
F-2-23
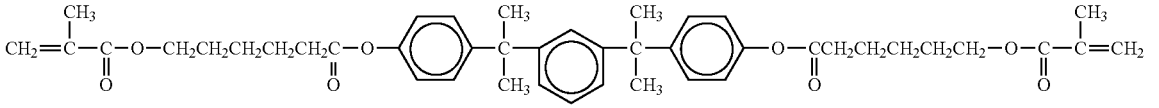
F-2-24
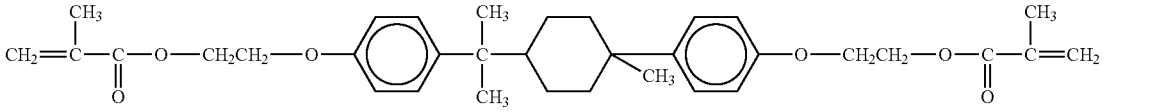
F-2-25
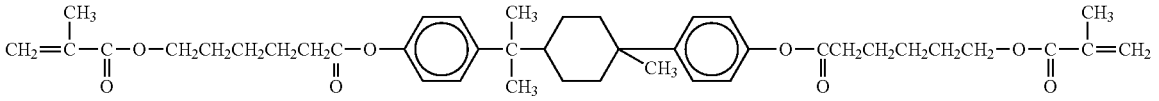
F-2-26
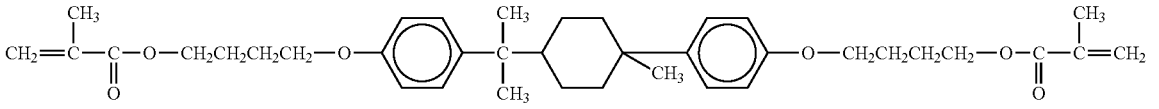
F-2-27
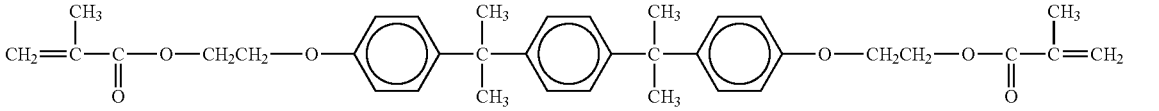

-continued
F-2-28
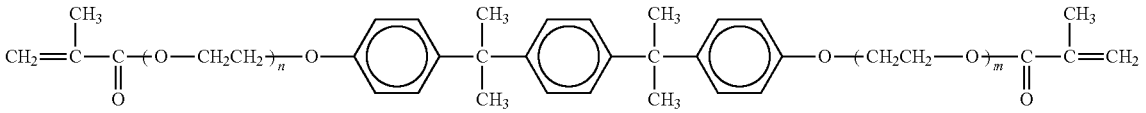
n = 2, m = 2
F-2-29
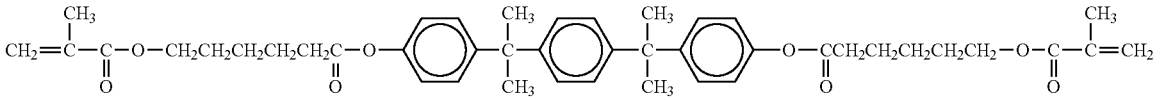
F-2-30
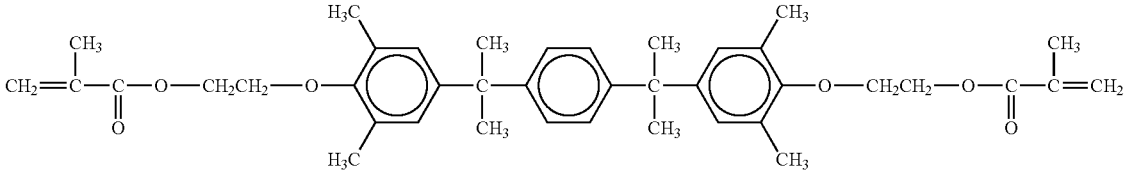
f-2-1
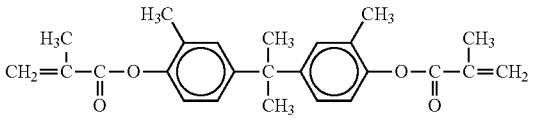
f-2-2
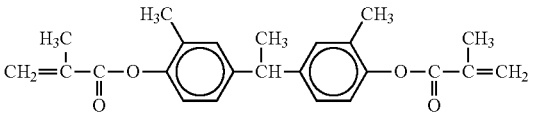
f-2-3
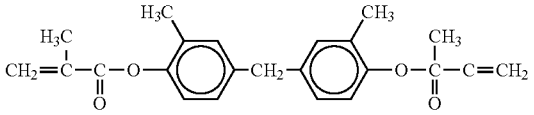
f-2-4
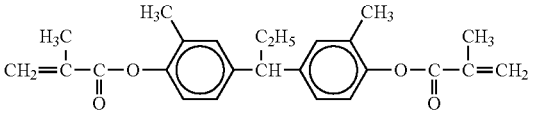
f-2-5
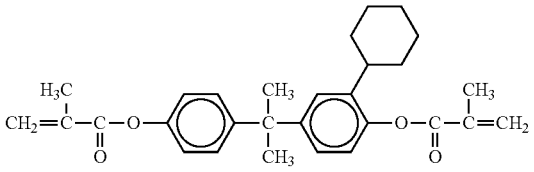
f-2-6
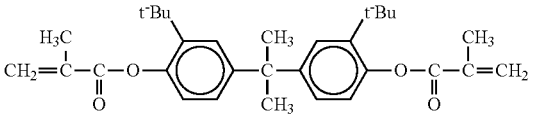
f-2-7
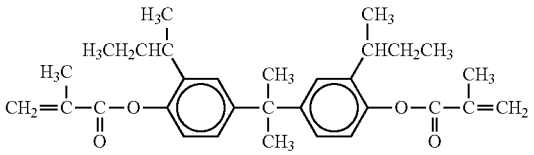
f-2-8
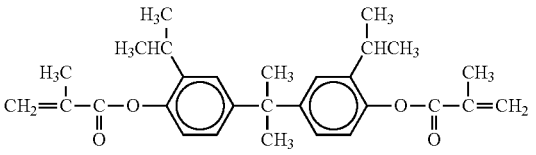
f-2-9
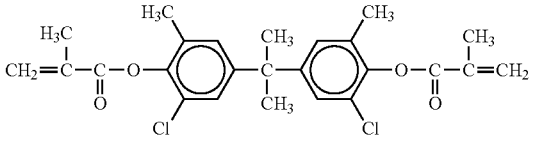
f-2-10
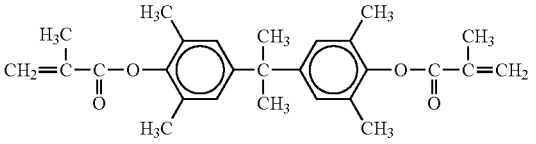
f-2-11
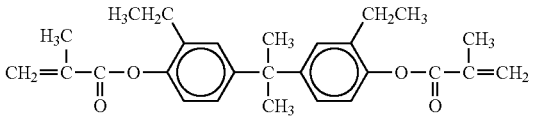
f-2-12
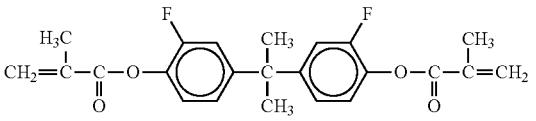

-continued
f-2-13
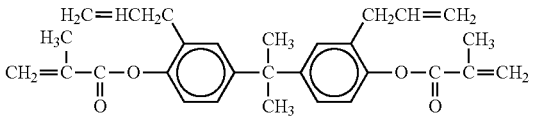
f-2-14
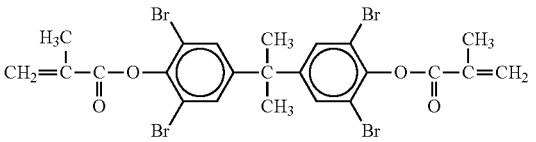
f-2-15
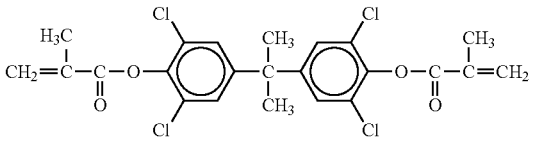
f-2-16
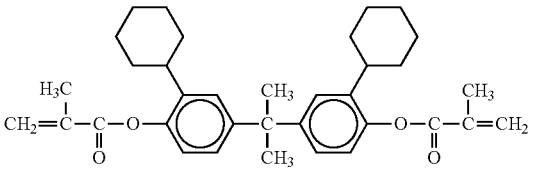
f-2-17
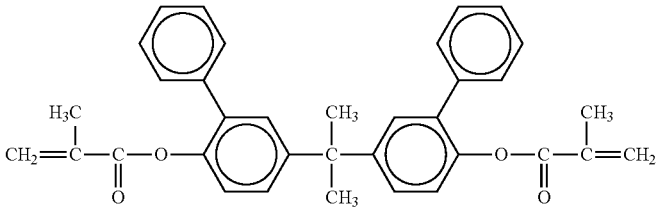
f-2-18
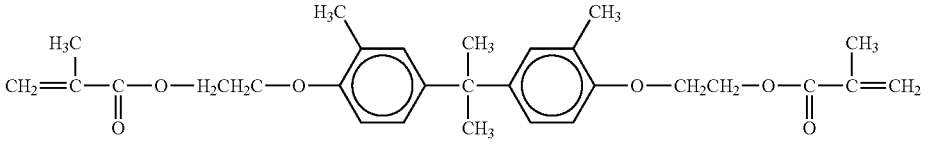
f-2-19
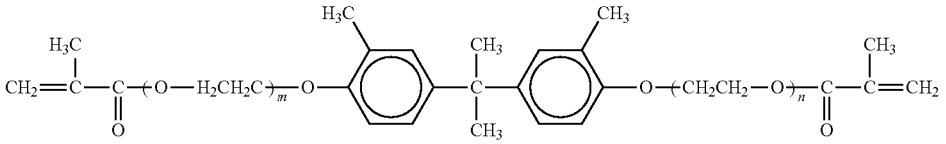
m + n = 3
f-2-20
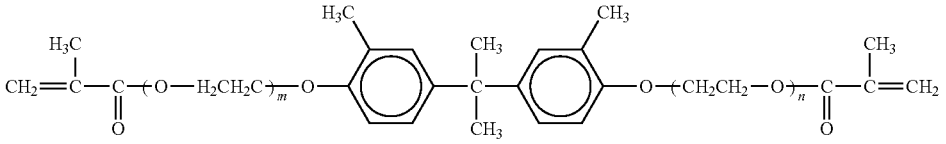
m + n = 8
f-2-21
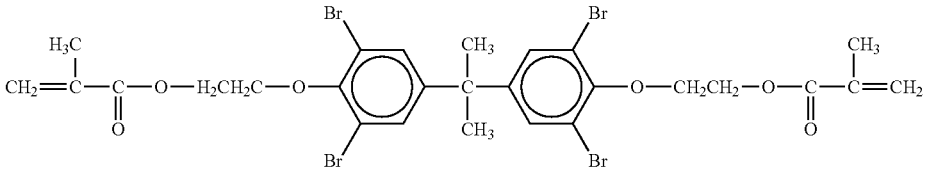
f-2-22
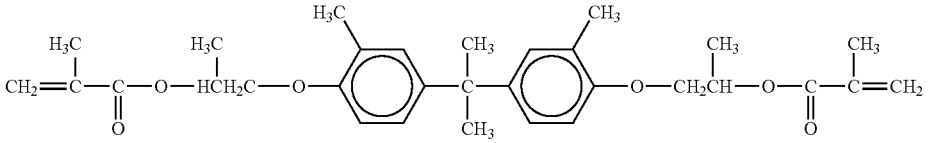
f-2-23
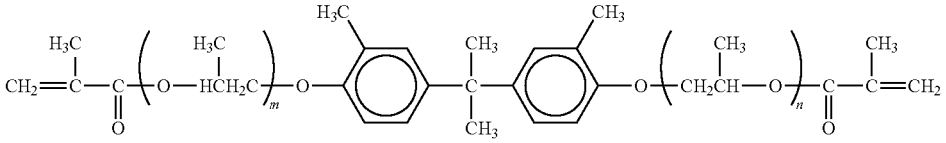
m + n = 4

-continued
f-2-24
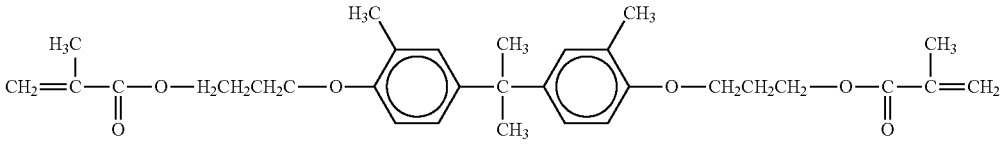
f-2-25
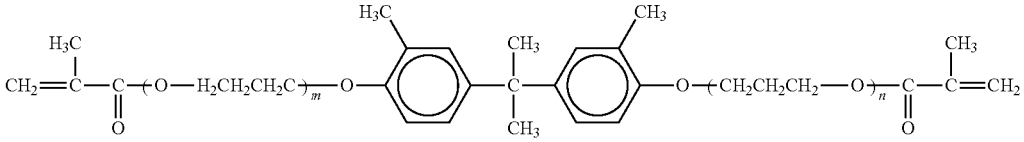
m + n = 4
f-2-26
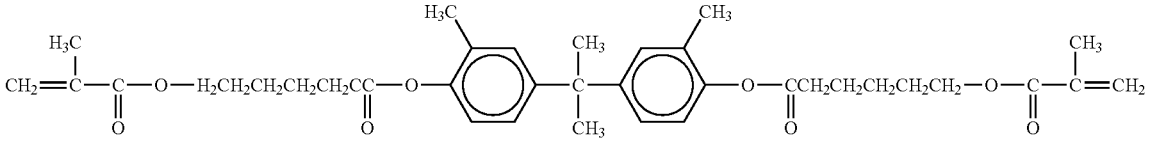
f-2-27
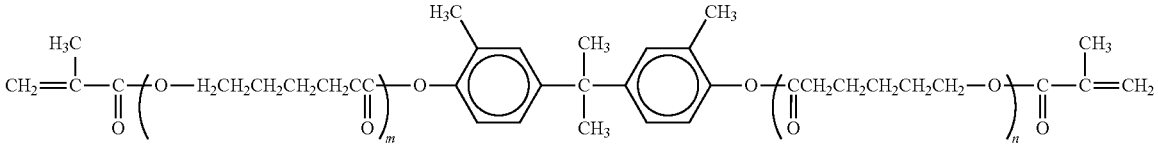
m + n = 4
f-2-28
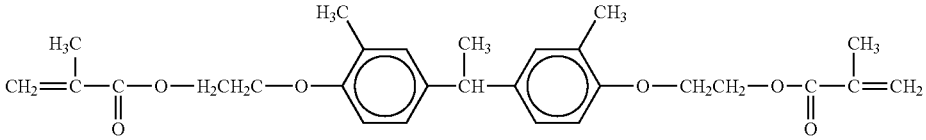
f-2-29
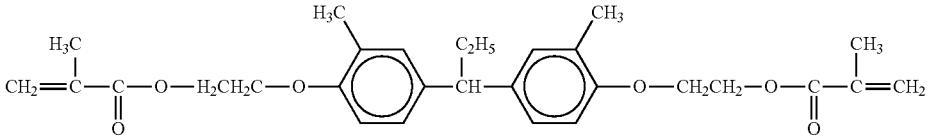
f-2-30
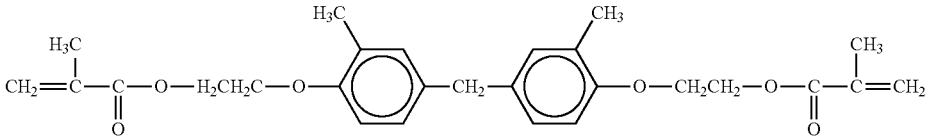
f-2-31
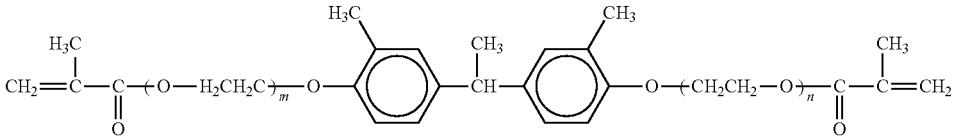
m + n = 3
f-2-32
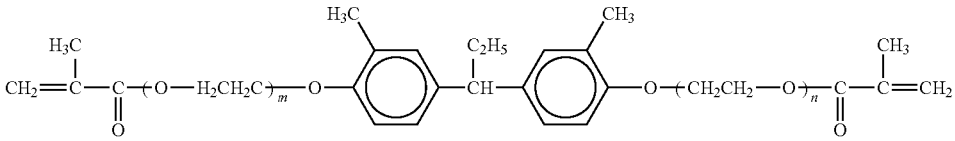
m + n = 3

-continued
f-2-33
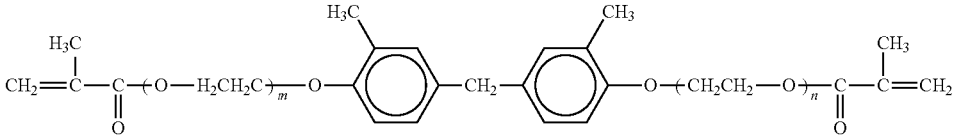
m + n = 3
f-2-34
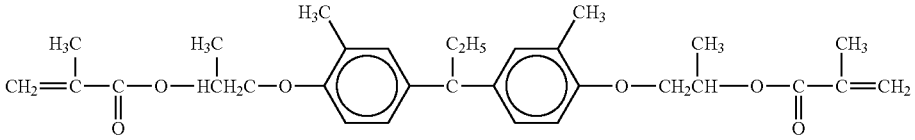
f-2-35
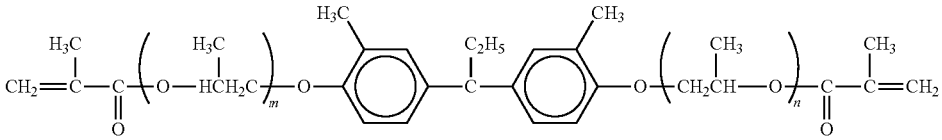
m + n = 3
f-2-36
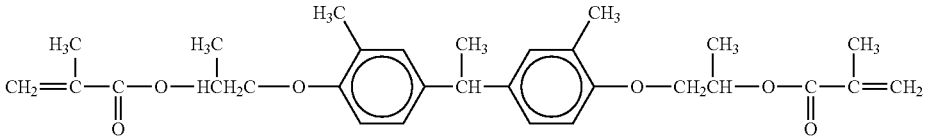
f-2-37
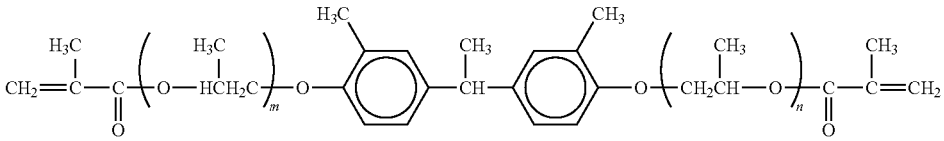
m + n = 3
f-2-38
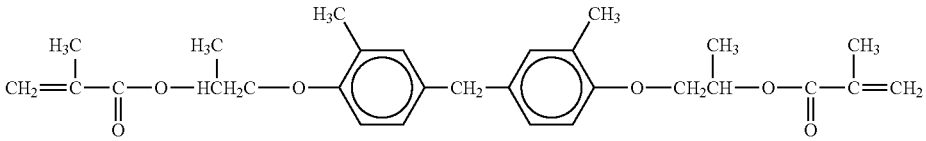
f-2-39
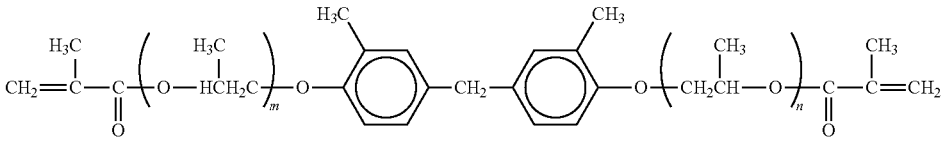
m + n = 3
f-2-40
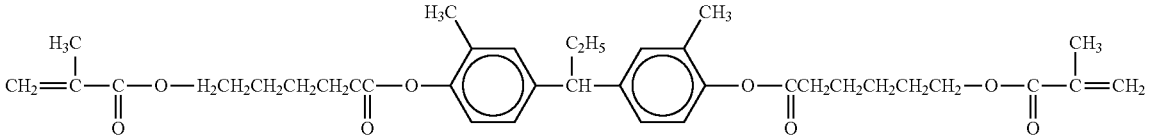
f-2-41
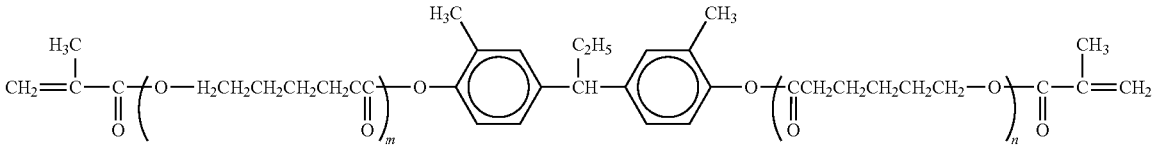
m + n = 4

-continued f-2-42

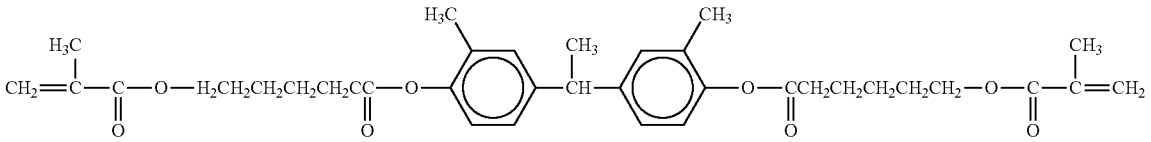

f-2-43

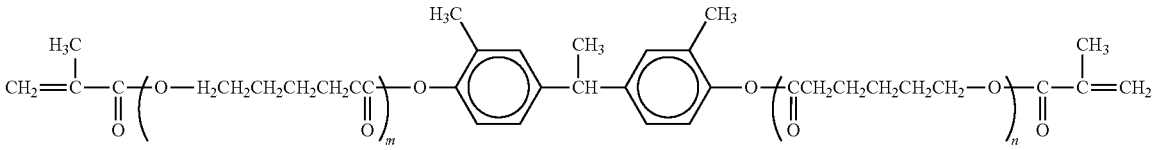

m + n = 4 f-2-44

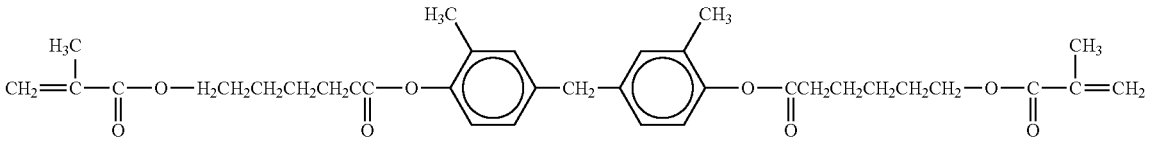

f-2-45

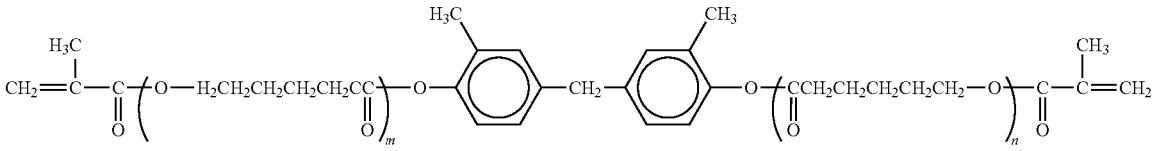

m + n = 4

When a layer including a crosslinked material having a unit (E) is formed, it is more preferable to coat a photosensitive layer with a coating liquid including a radically polymerizable compound having the below-mentioned formula (G), followed by radically crosslinking the formed layer.

(G)

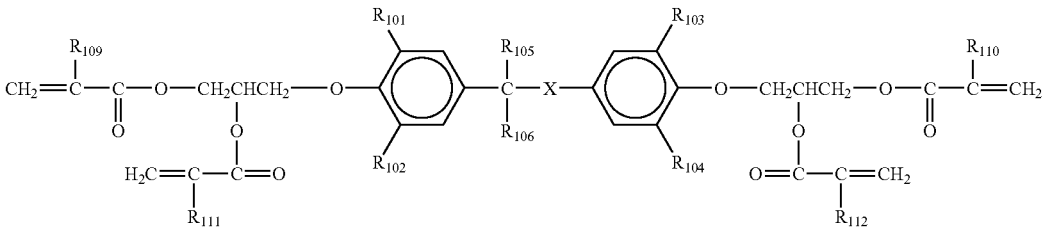

In formula (G), X represents single bond or one of the following divalent groups:

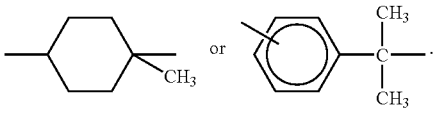

When the group X is a single bond, each of $R_{101}$ to $R_{104}$ represents a hydrogen atom, a linear, branched or cyclic alkyl group having 1 to 6 carbon atoms, a halogen atom or an aryl group, wherein a case where all the groups $R_{101}$ to $R_{104}$ are a hydrogen atom is excluded; each of $R_{105}$ and $R_{106}$ represents a hydrogen atom, a methyl group or an ethyl group, wherein the total of the carbon atoms of the groups $R_{105}$ and $R_{106}$ is from 0 to 2; and each of $R_{109}$ to $R_{112}$ represents a hydrogen atom or a methyl group.

When the group X is not a single bond, each of $R_{101}$ to $R_{104}$ represents a hydrogen atom, an alkyl group having 1 to 4 carbon atoms, or a halogen atom, each of $R_{105}$ and $R_{106}$ is a methyl group, and $R_{109}$ to $R_{112}$ are the same as those defined above.

The compounds having formula (G) can be prepared by, for example, a method including a combination process of G1-1 and G1-2, a combination process of G2-1 and G2-2, a combination process of G3-1 and G3-2 or a process G4, which are described below.

G1-1
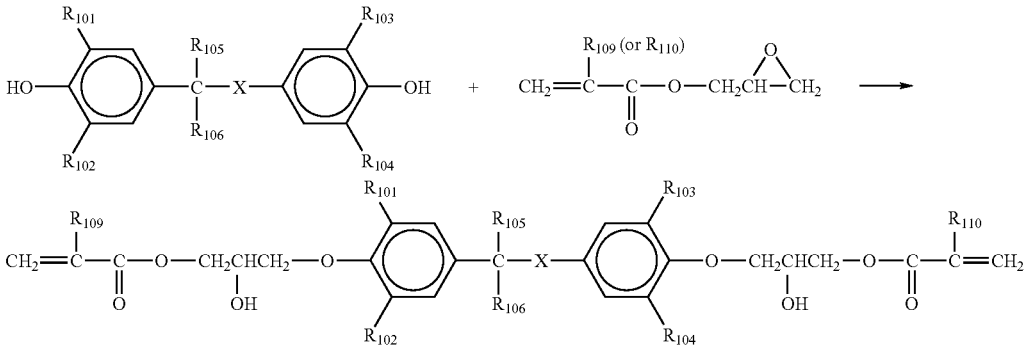
G1-2
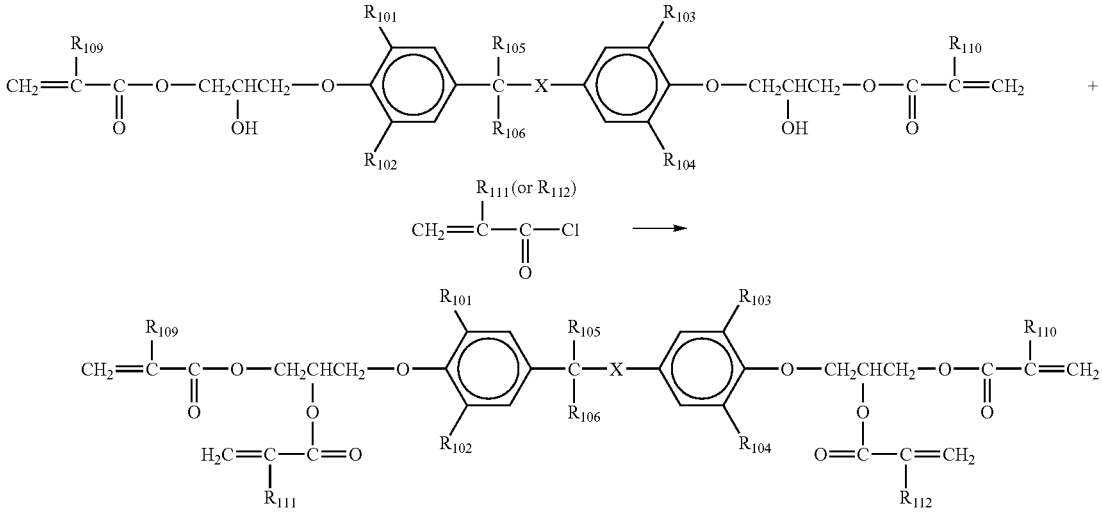
The combination process G1-1 can be replaced with the following combination process G2-1 and G2-2.
G2-1
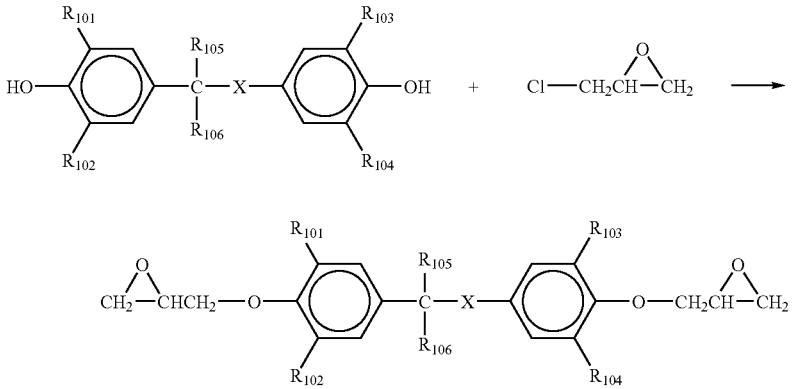
G2-2
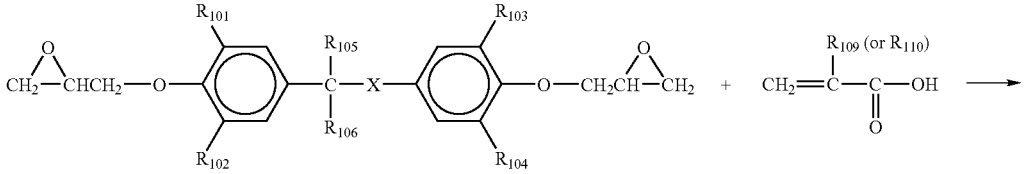

-continued

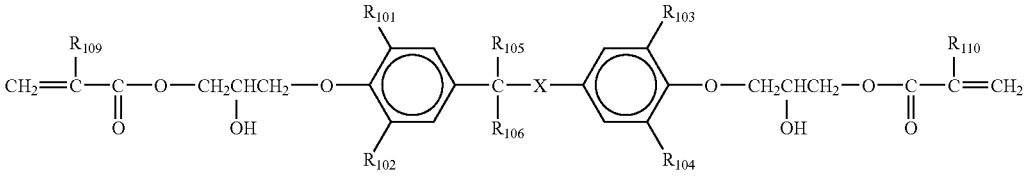

When the groups $R_{109}$ to $R_{112}$ are the same, a combination of the following processes G3-1 and G3-2 can be used.

G3-1

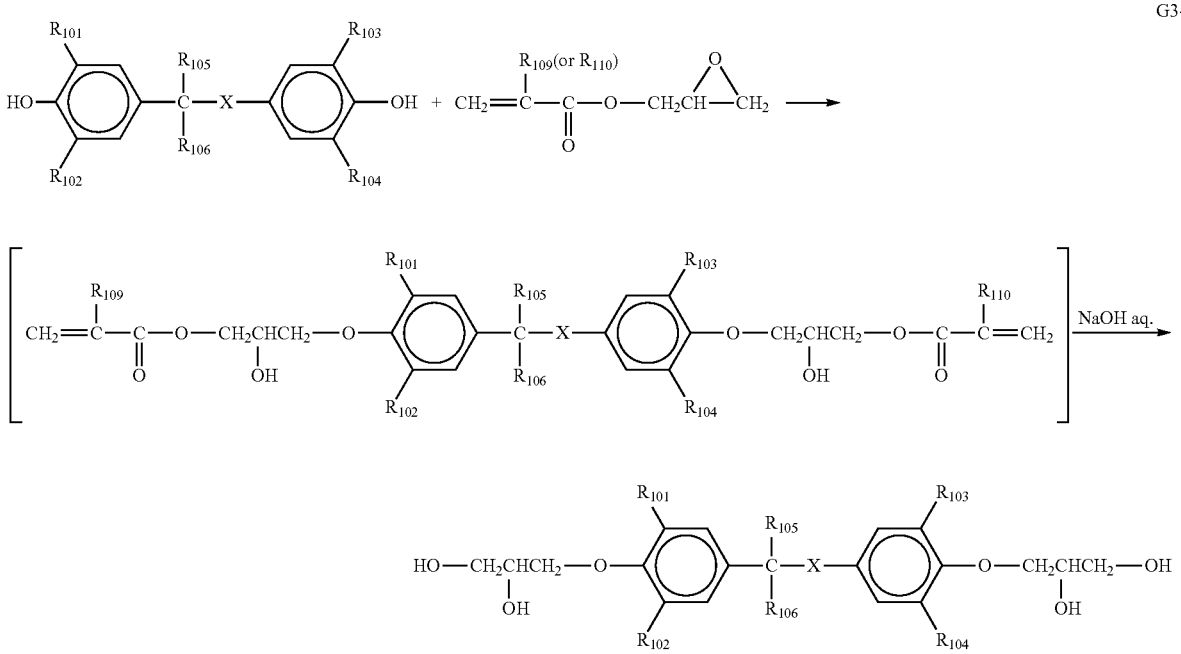

G3-2

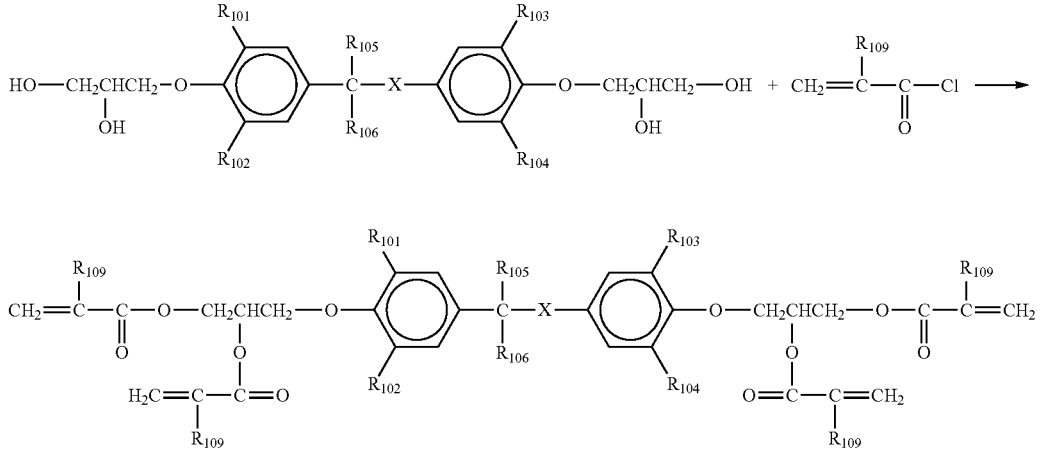

The reactions in the above-mentioned processes can be performed under conditions similar to the conditions under which conventional ring-opening addition reactions of an epoxy ring with a hydroxyl group, and conventional esterification reactions of an acid chloride with a hydroxyl group are performed.

In addition, conventional synthesis methods can also be used. For example, in the above-mentioned processes, an (meth)acryloyl compound is prepared by a reaction of an acid chloride with a hydroxyl group, but it is possible to use a dehydration condensation reaction of the corresponding acid with a hydroxyl group. Further, an acryloyl compound can be prepared by a reaction having the following process G4.
G4
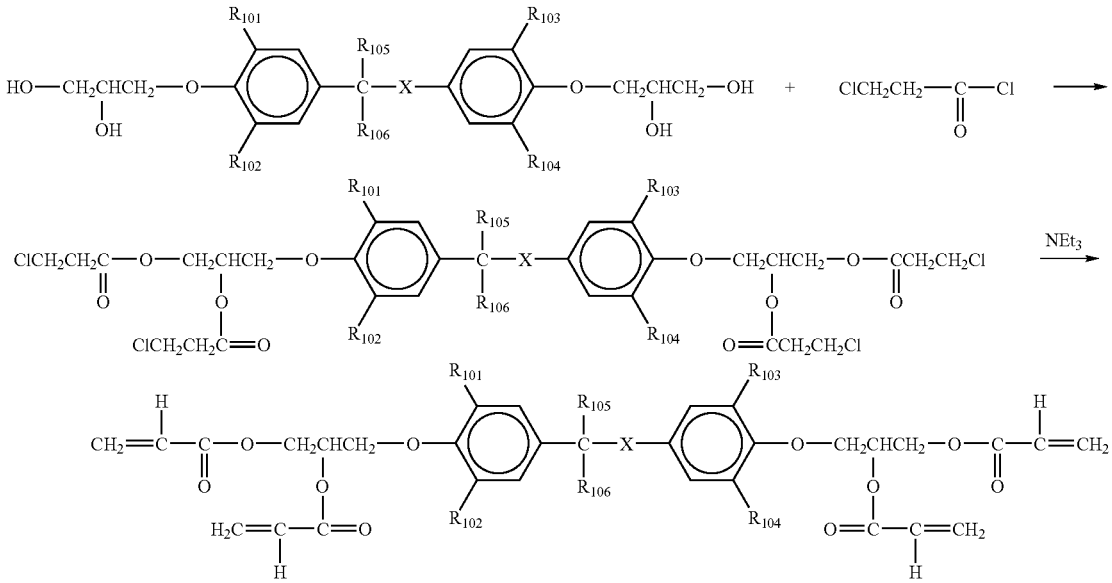
Specific examples of the radically polymerizable compounds having formula (G) include the following compounds, but are not limited thereto.
G-1-1
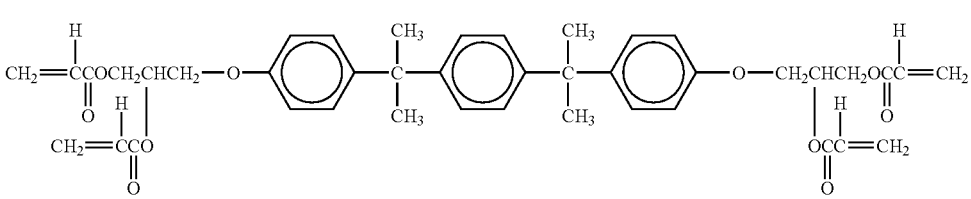
G-1-2
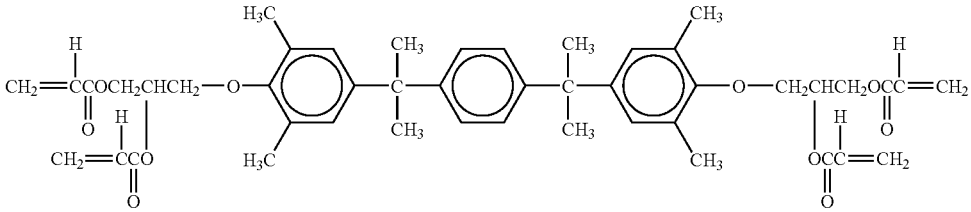
G-1-3
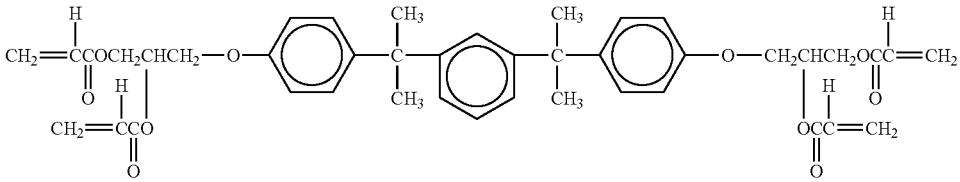
G-1-4
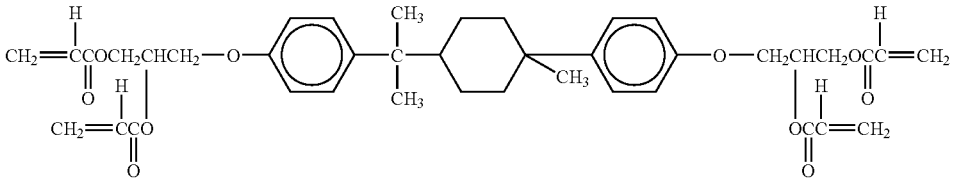

-continued
G-1-5
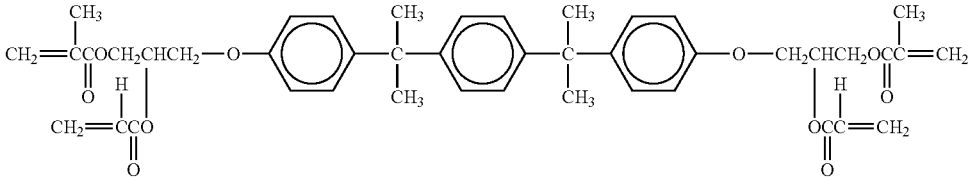
G-1-6
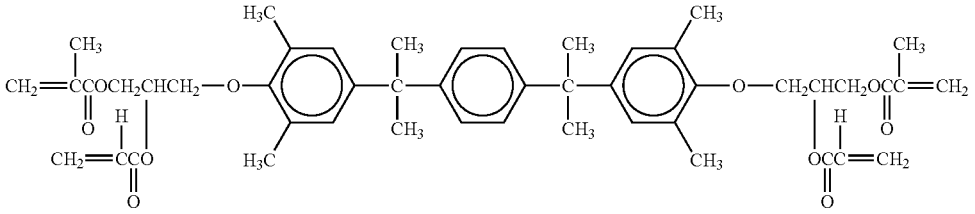
G-1-7
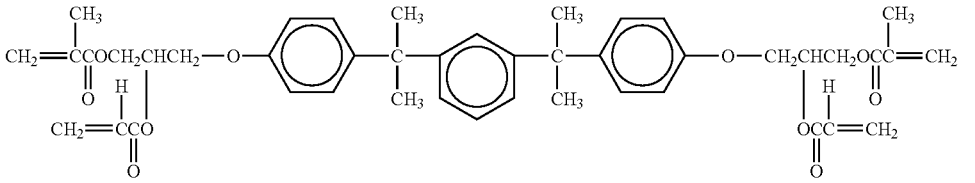
G-1-8
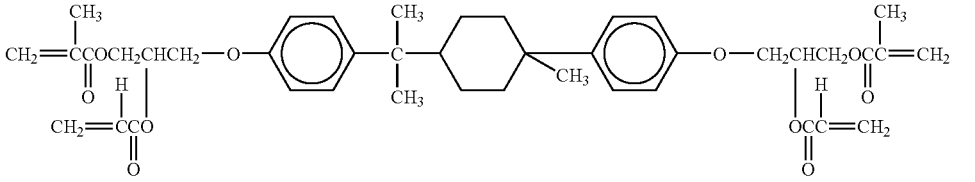
G-1-9
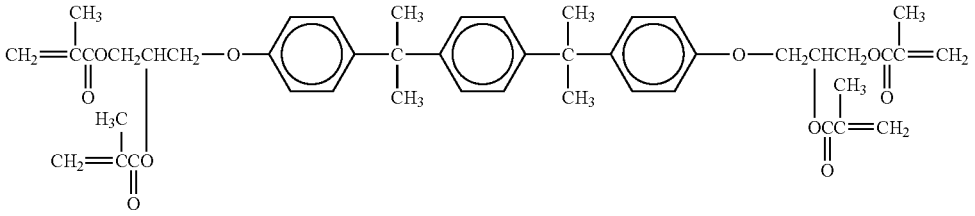
G-1-10
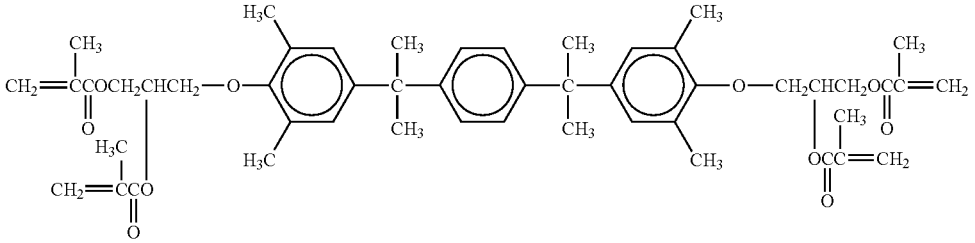
G-1-11
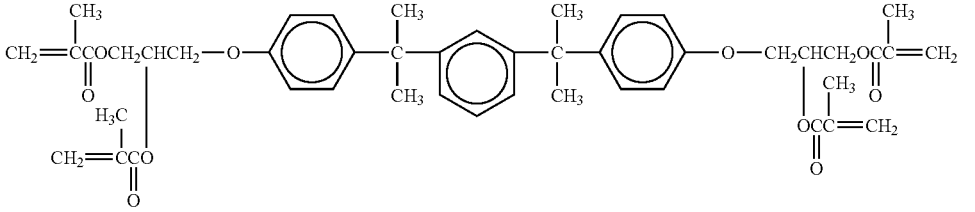

-continued
G-1-12
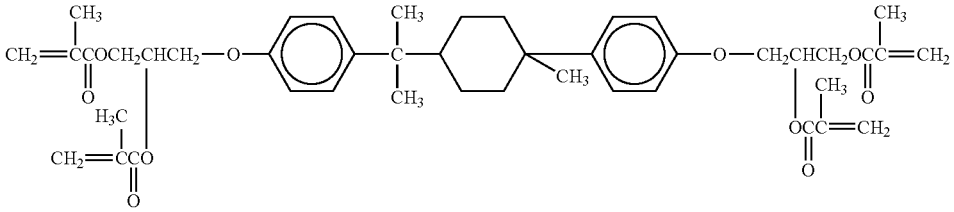
g-1-1
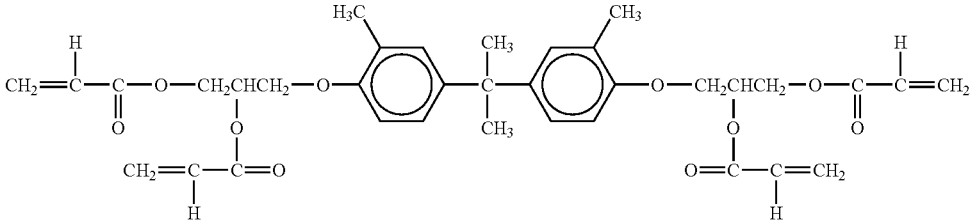
g-1-2
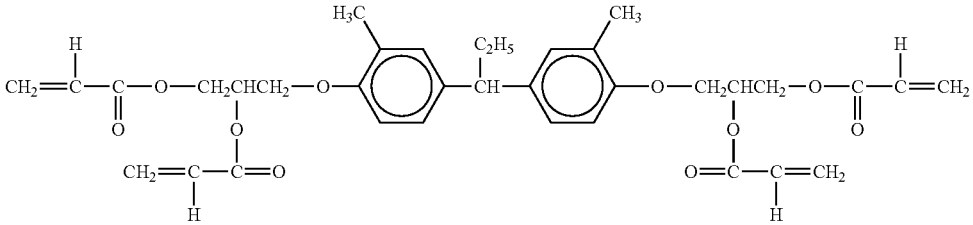
g-1-3
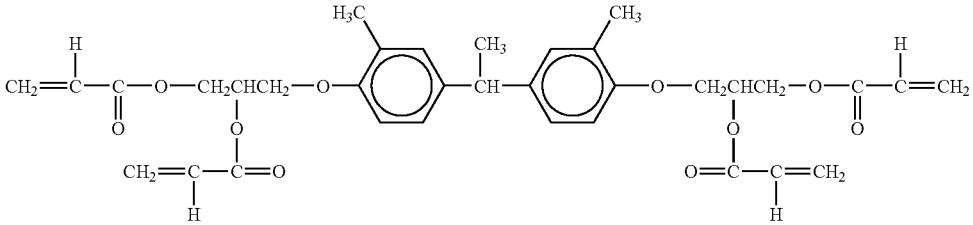
g-1-4
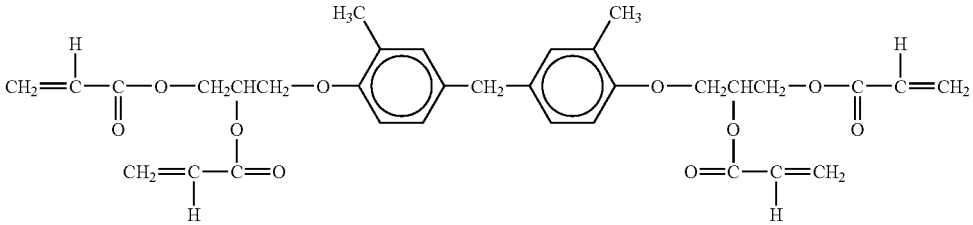
g-1-5
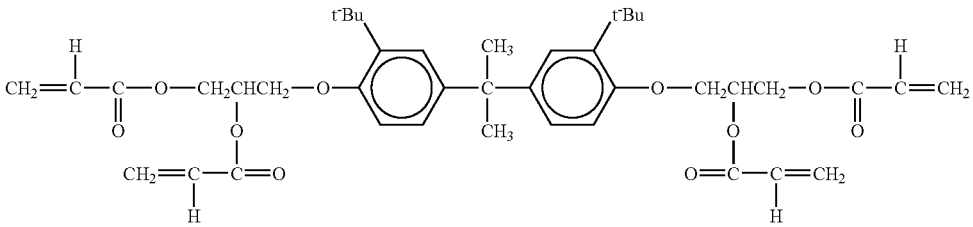

-continued
g-1-6
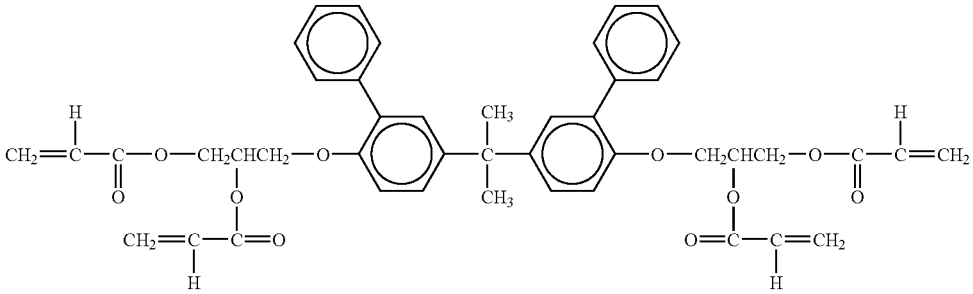
g-1-7
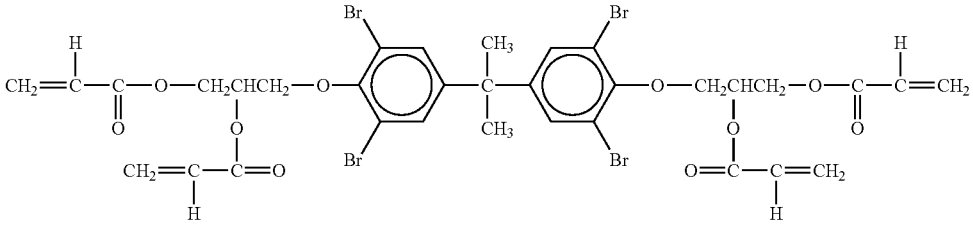
g-2-1
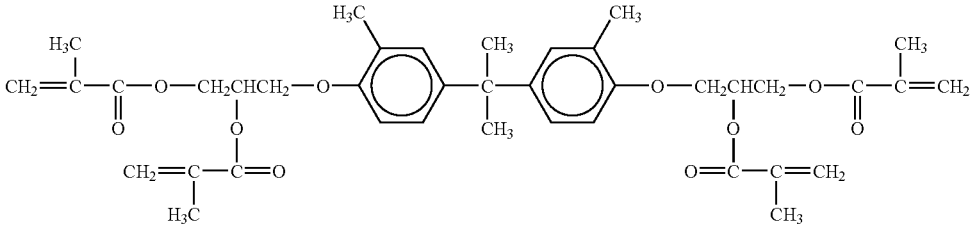
g-2-2
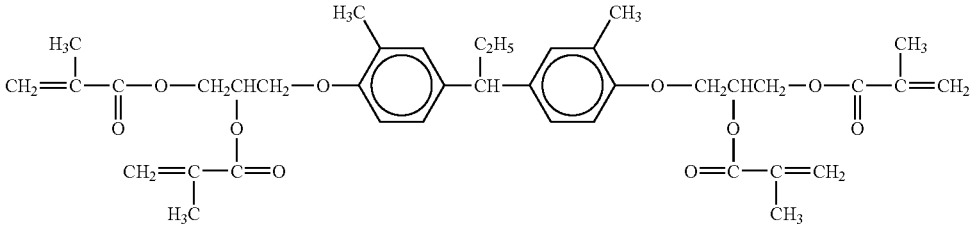
g-2-3
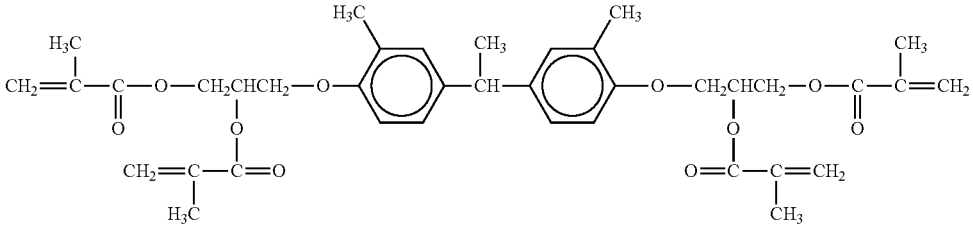
g-2-4
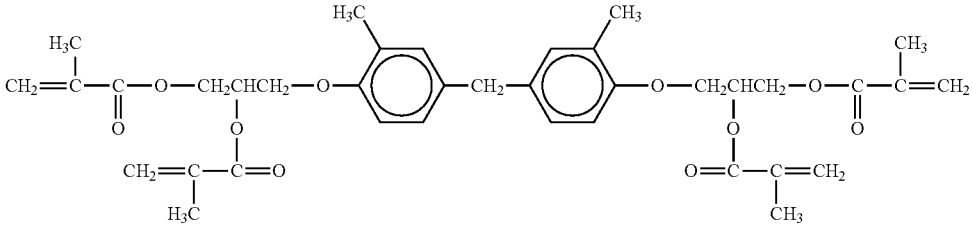

-continued g-2-5

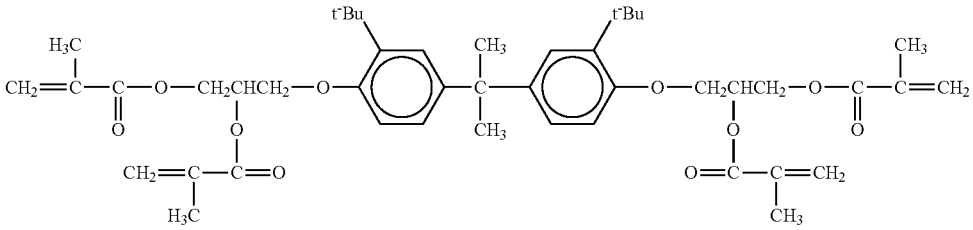

g-2-6

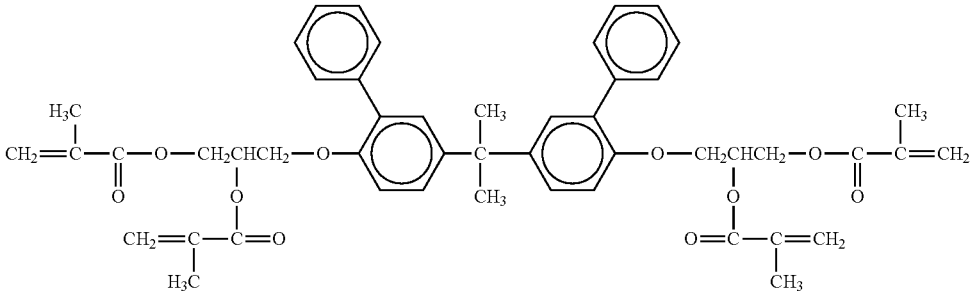

g-2-7

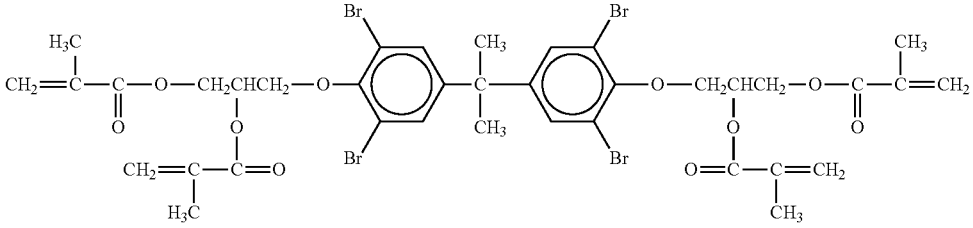

When a layer having a unit (E) is formed, it is more preferable to coat a photosensitive layer with a coating liquid including a radically polymerizable compound having the below-mentioned formula (H), followed by radically crosslinking the formed layer.

(H)

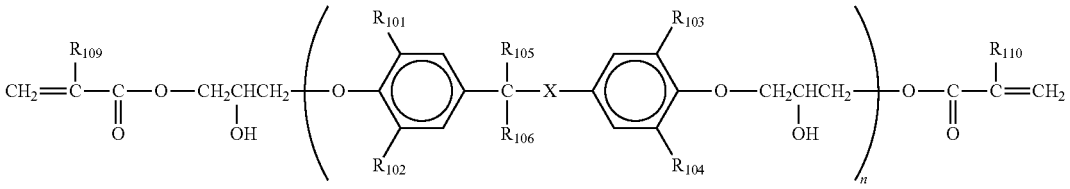

In formula (H), X represents single bond or one of the following divalent groups:

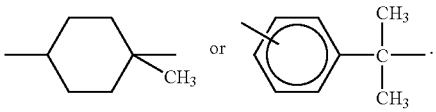

When the group X is a single bond, each of $R_{101}$ to $R_{104}$ represents a hydrogen atom, a linear, branched or cyclic alkyl group having 1 to 6 carbon atoms, a halogen atom or an aryl group, wherein a case where all the groups $R_{101}$ to $R_{104}$ are a hydrogen atom is excluded; each of $R_{105}$ and $R_{106}$ represents a hydrogen atom, a methyl group or an ethyl group, wherein the total of the carbon atoms of the groups $R_{105}$ and $R_{106}$ is from 0 to 2; each of $R_{109}$ and $R_{110}$ represents a hydrogen atom or a methyl group; n is an integer of from 1 to 50.

When the group X is not a single bond, each of $R_{101}$ to $R_{104}$ represents a hydrogen atom, an alkyl group having 1 to 4 carbon atoms, or a halogen atom, each of $R_{105}$ and $R_{106}$ is a methyl group, and $R_{109}$, $R_{110}$, and n are the same as those defined above.

The compounds having formula (H) can be prepared by, for example, a method including the following combination process of H1-1 and H1-2.

H1-1
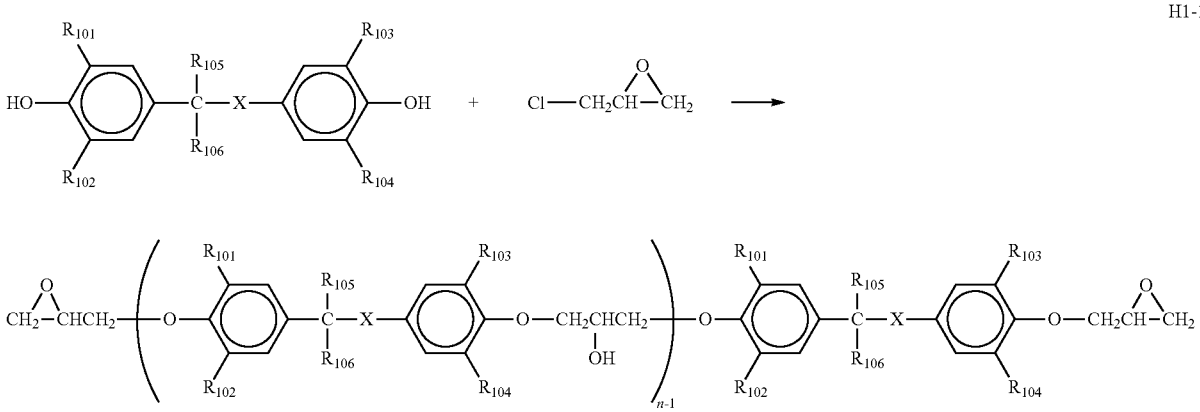
H1-2
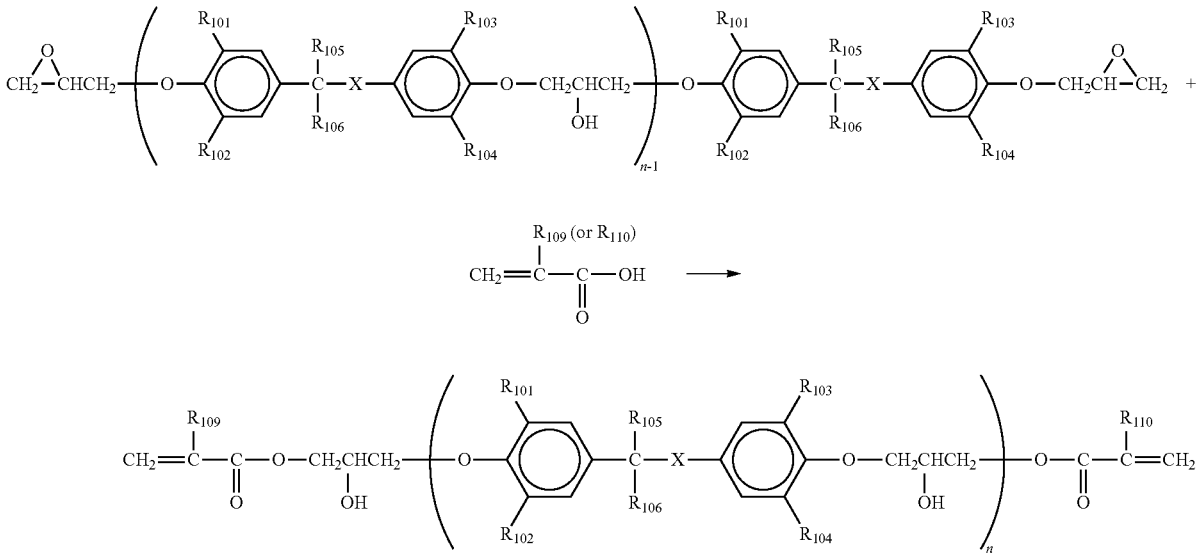
When n is 1, the compounds having formula (H) can also be prepared by a method including the process G1-1.
Specific examples of the compounds having formula (H) include the following compounds, but are not limited thereto.
H-1-1
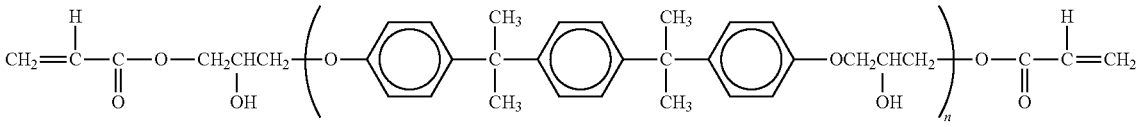
n = 1
H-1-2
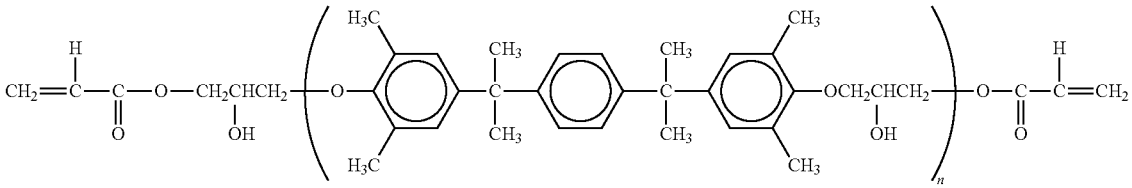
n = 1 - 5
(mixture)

-continued
H-1-3
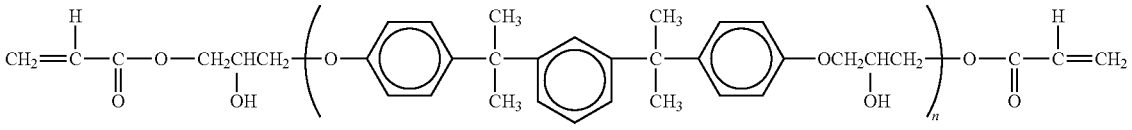
n = 1 - 5
(mixture)
H-1-4
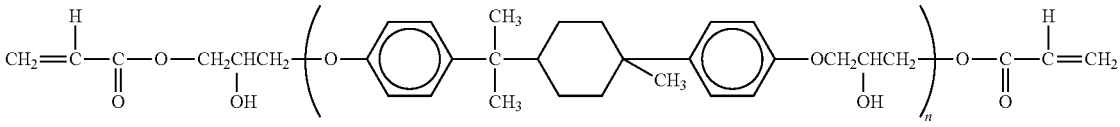
n = 1 - 3
(mixture)
H-1-5
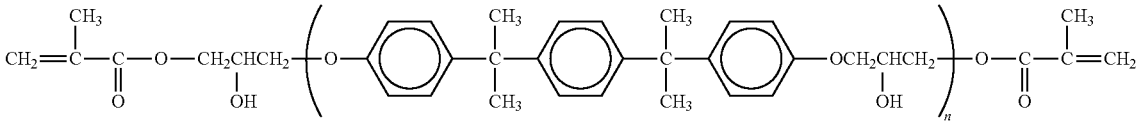
n = 1 - 10
(mixture)
H-1-6
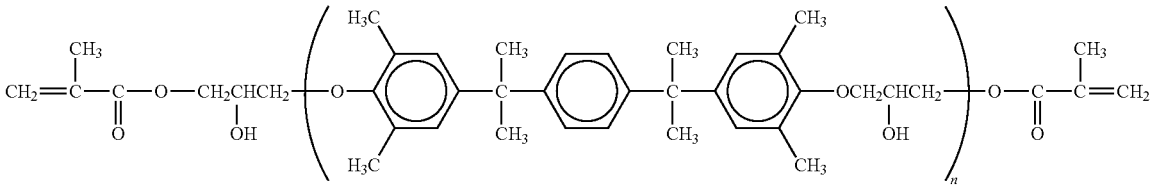
n = 3 - 10
(mixture)
H-1-7
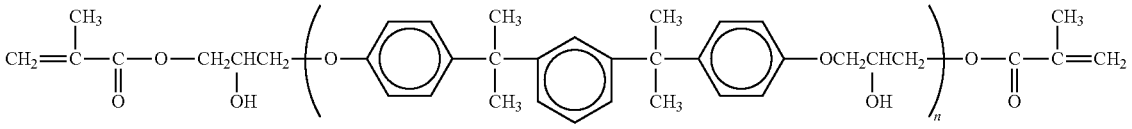
n = 1 - 5
(mixture)
H-1-8
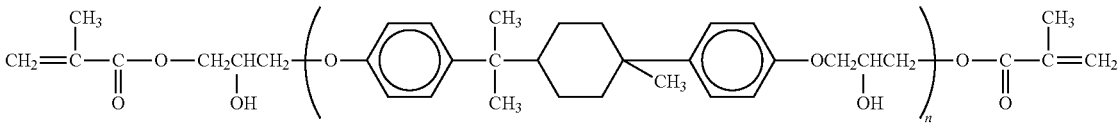
n = 1 - 10
(mixture)
h-1-1
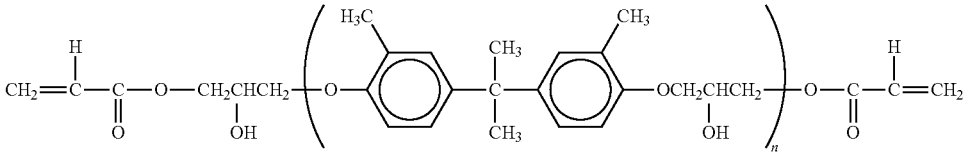
n = 3 - 10
(mixture)

-continued
h-1-2
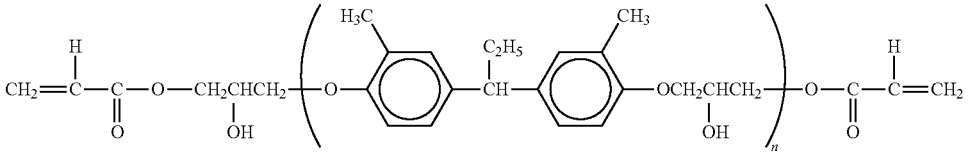
n = 3 - 10
(mixture)
h-1-3
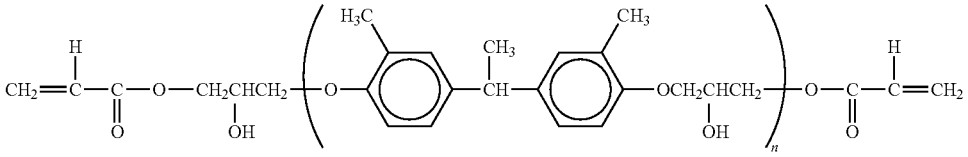
n = 3 - 10
(mixture)
h-1-4
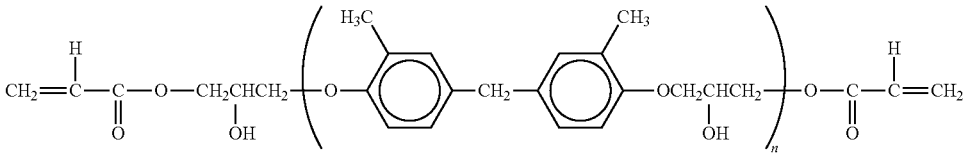
n = 3 - 10
(mixture)
h-1-5
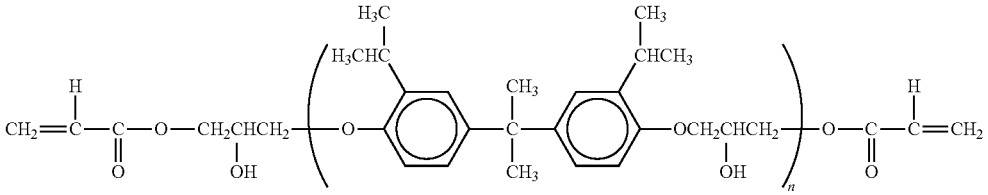
h-1-6
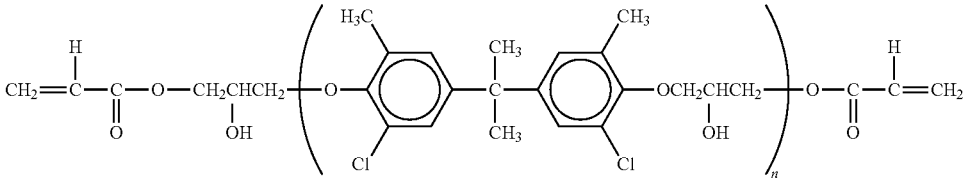
n = 3 - 10
(mixture)
h-1-7
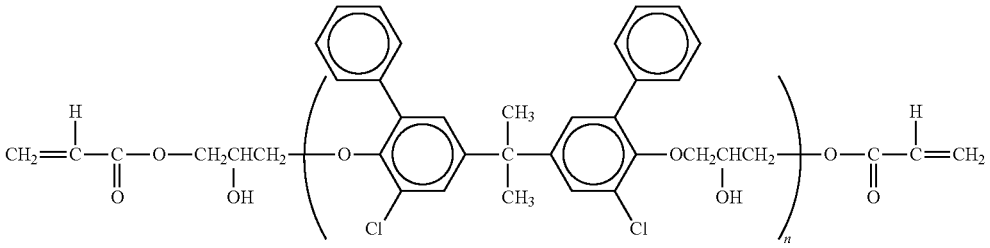
n = 3 - 10
(mixture)

-continued
h-2-1
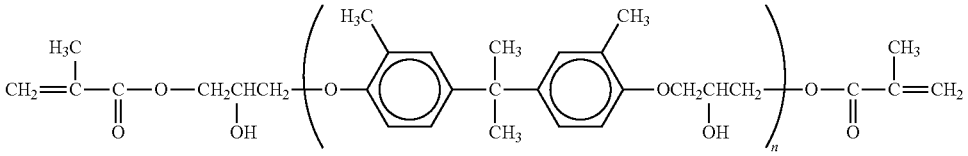
n = 3 - 10
(mixture)
h-2-2
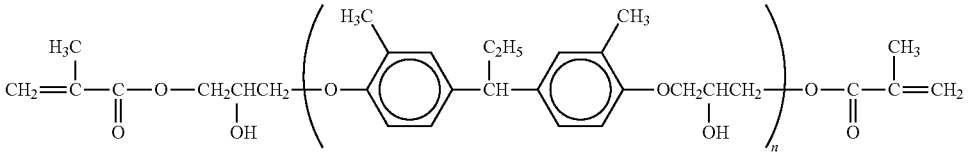
n = 3 - 10
(mixture)
h-2-3
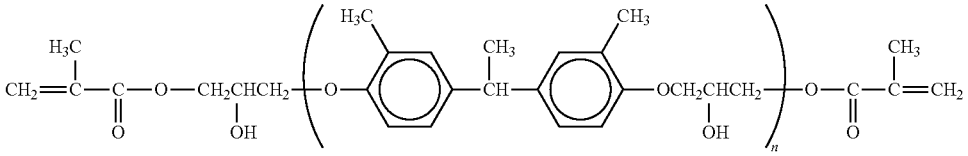
n = 3 - 10
(mixture)
h-2-4
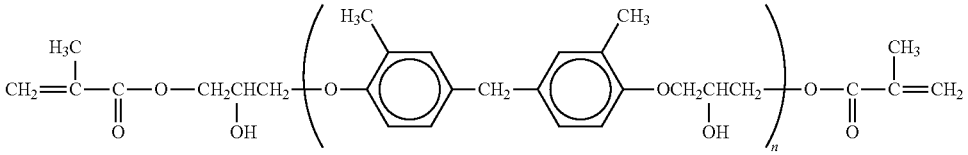
n = 3 - 10
(mixture)
h-2-5
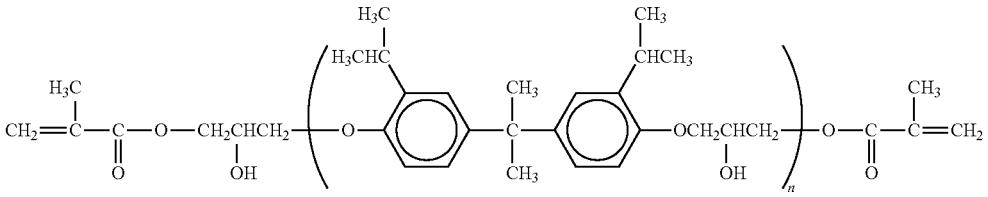
n = 3 - 10
(mixture)
h-2-6
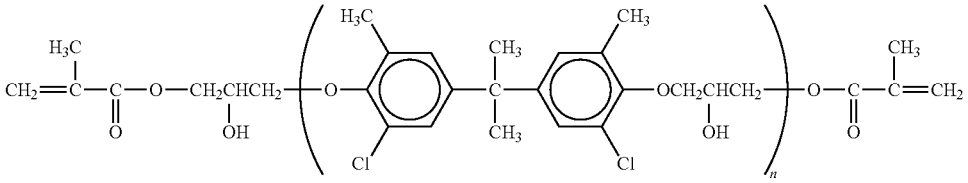
n = 3 - 10
(mixture)

-continued h-2-7

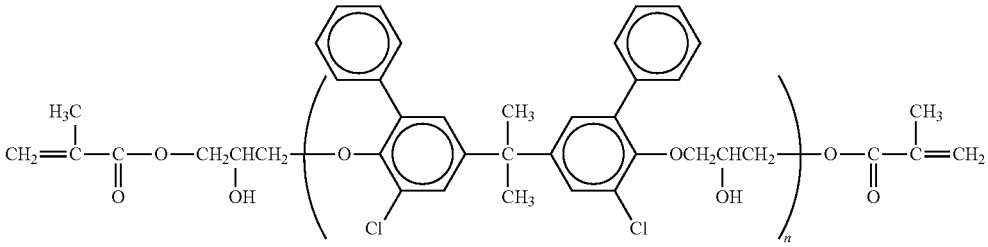

n = 3 - 10
(mixture)

The content of the radically polymerizable compounds (F), (G) and (H) in the solid components included in the coating liquid is preferably from 10 to 100% by weight, and preferably from 20 to 70% by weight, based on the total weight of the solid components included in the coating liquid. When the content is too low, the concentration of the unit (E) decreases, and the resistance to environmental changes and oxidation gasses cannot be improved, resulting in deterioration of electric properties and image qualities of the resultant photoreceptor. When the content is too high, problems which occur are that the mechanical strength of the resultant layer decreases, resulting in formation of scratches on the surface of the outermost layer and deterioration of the abrasion resistance of the outermost layer.

Specific examples of the radically polymerizable functional groups for use in preparing the crosslinked material including a unit (E) include those mentioned above for use in preparing the crosslinked material including a unit (A).

Next, the photoreceptor having an outermost layer including a radically crosslinked material including a unit having the following formula (I) (i.e., a third example of the outermost layer) will be explained.

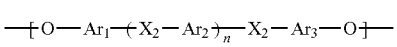

(I)

In formula (I), each of $Ar_1$, $Ar_2$ and $Ar_3$ represents a substituted or unsubstituted arylene group; $X_2$ represents an oxygen atom or a sulfur atom; and n is 0 or 1.

change of image density, formation of tailed images and deterioration of resolution can be provided.

The reason why the outermost layer including a radically crosslinked material including a unit having the following formula (I) has a high abrasion resistance is considered to be almost the same as that mentioned above in the outermost layer including a radically crosslinked material including a unit (A). In particular, since the unit (I) has an oxygen atom or a sulfur atom, which is present between two benzene rings, unlike the bisphenol A structure, the unit has good planarity, and thereby the stacking force can be increased, resulting in improvement of the abrasion resistance.

The reason why the outermost layer including a radically crosslinked material including a unit (I) has a high environmental stability is also considered to be almost the same as that mentioned above in the outermost layer including a radically crosslinked material including a unit (A) except that in the case of the unit (A), the two benzene rings can be twisted unlike bisphenol A compounds.

In this third example of the outermost layer, the radically polymerized material included in the outermost layer includes a unit (I). The method for preparing such a radically polymerized material is the same as that mentioned above for use in the first example of the outermost layer.

When a layer including a crosslinked material having a unit (I) is formed, it is preferable to coat a photosensitive layer with a coating liquid including a radically polymerizable compound having the following formula (J), followed by radically crosslinking the formed layer.

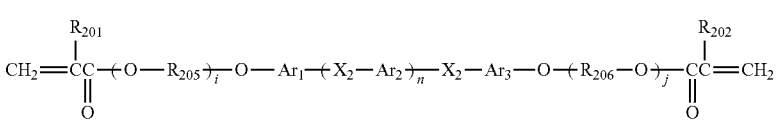

(J)

Similarly to the case of the outermost layer having a unit (A) or (E), by incorporating a unit having formula (I) in the radically crosslinked material constituting the outermost layer, a photoreceptor which has a good combination of abrasion resistance and environmental stability (such as resistance to changes of temperature and humidity, and resistance to oxidation gasses such as ozone and NOx generated by chargers) can be provided, i.e., a photoreceptor which can produce high quality images with hardly causing problems such as In formula (J), each of $Ar_1$, $Ar_2$ and $Ar_3$ represents a substituted or unsubstituted arylene group; $X_2$ represents an oxygen atom or a sulfur atom; each of $R_{201}$ and $R_{202}$ represents a hydrogen atom or a methyl group; each of $R_{205}$ and $R_{206}$ represents a linear or branched alkylene group having 1 to 6 carbon atoms, a 1-ketohexylene group or a phenylene group; each of i and j is 0 or an integer of from 1 to 4; and n is 0 or 1.

The compounds having formula (J) can be prepared by, for example, a method including a process J1-1 or a combination process of J2-1 and J2-2, which are described below.

J1-1 (i, j = 0)
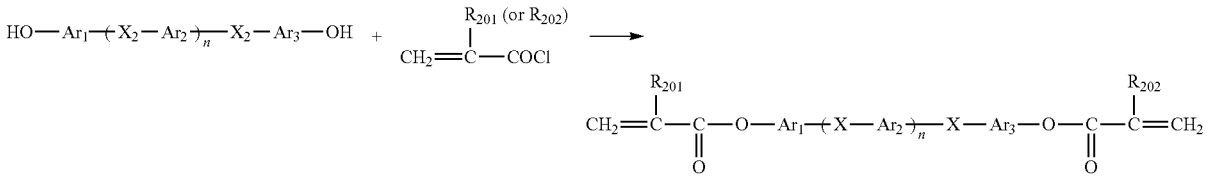
J2-1 (i, j ≠ 0)
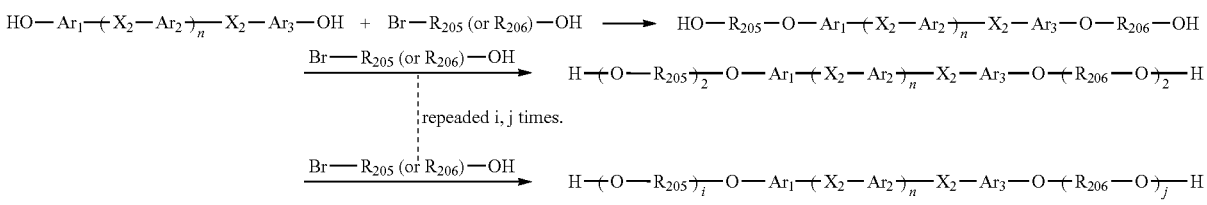
J2-2
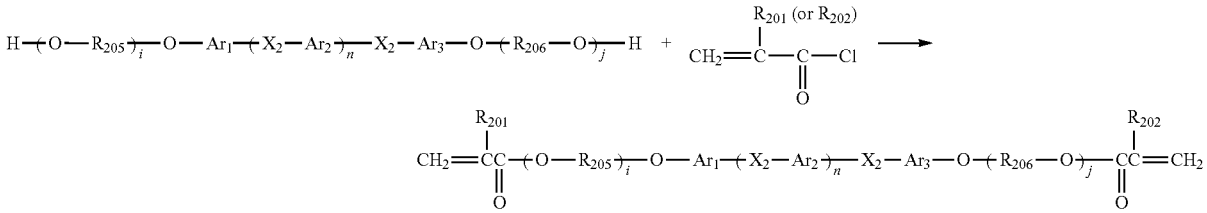
Specific examples of the compounds having formula (J) include the following compounds, but are not limited thereto.
J-1-1
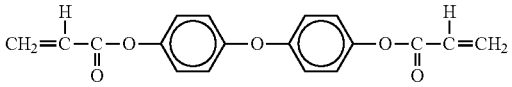
J-1-2
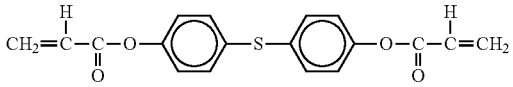
J-1-3
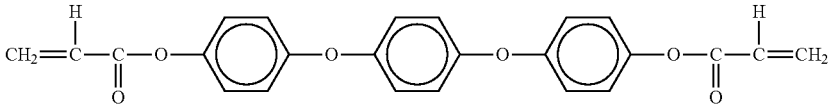
J-1-4
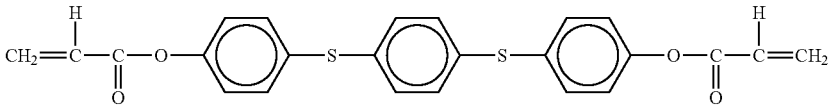
J-1-5
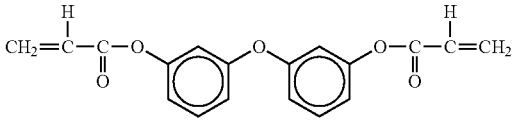
J-1-6
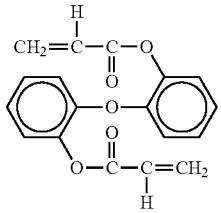
J-1-7
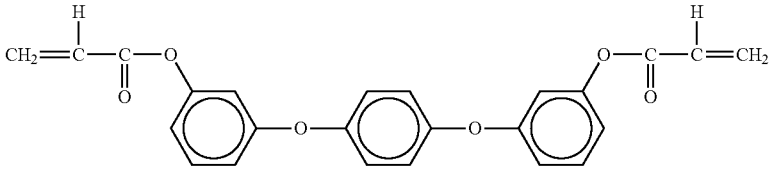

-continued
J-1-8
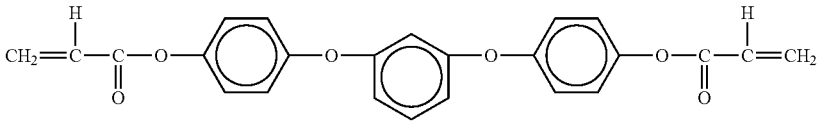
J-1-9
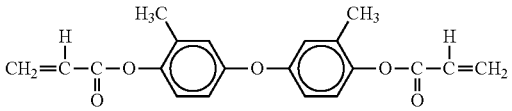
J-1-10
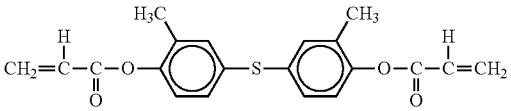
J-1-11
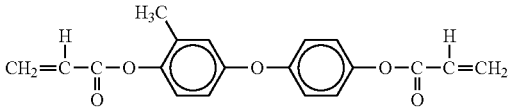
J-1-12
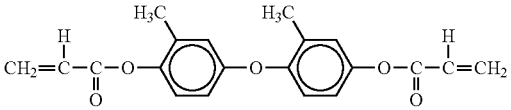
J-1-13
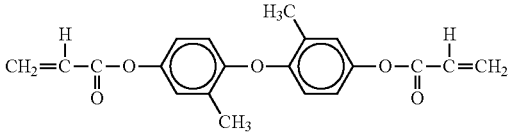
J-1-14
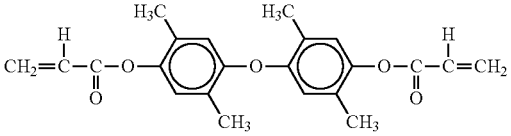
J-1-15
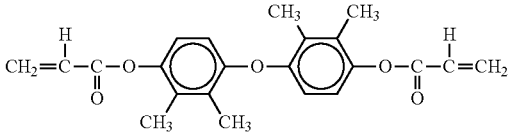
J-1-16
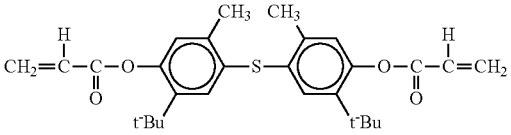
J-1-17
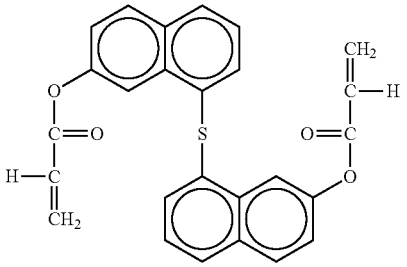
J-1-18
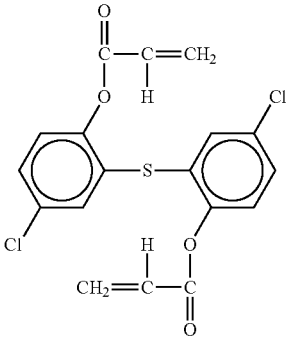
J-1-19
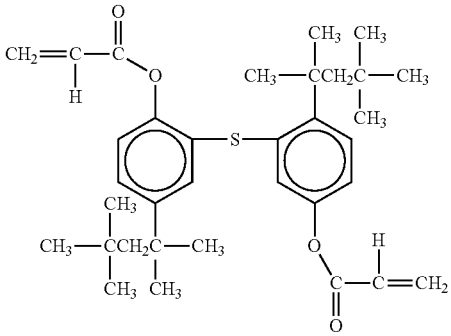
J-1-20
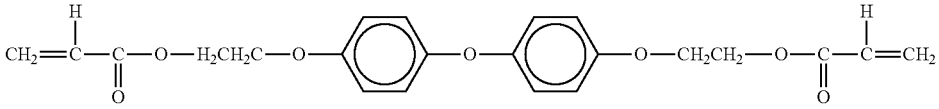

-continued
J-1-21
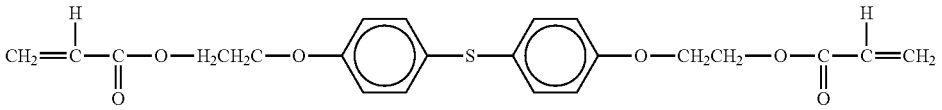
J-1-22
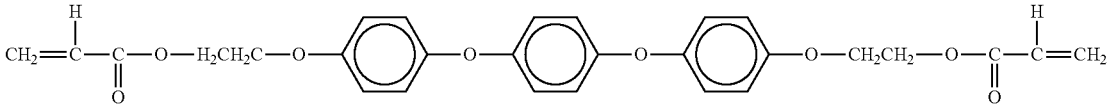
J-1-23
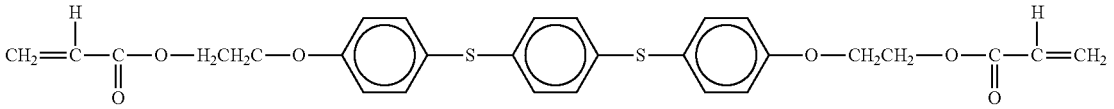
J-1-24
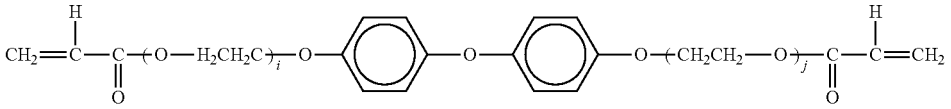
i + j = 3
J-1-25
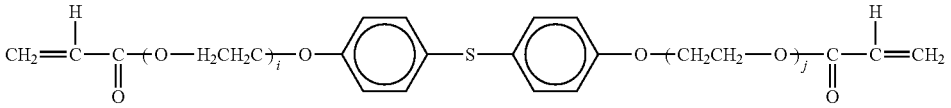
i + j = 2
J-1-26
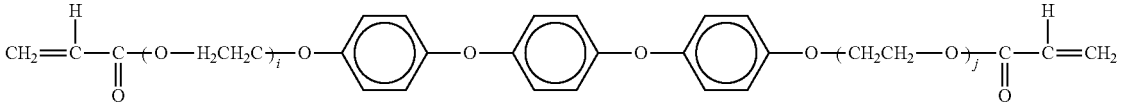
i + j = 2
J-1-27
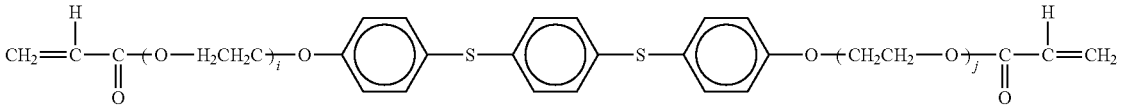
i + j = 2
J-1-28
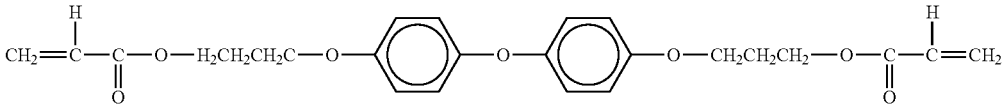
J-1-29
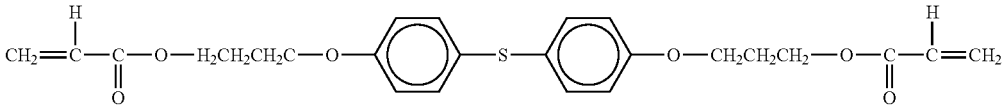
J-1-30
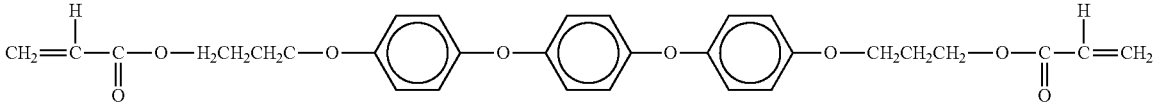
J-1-31
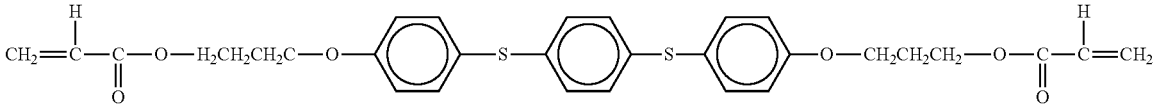

-continued
J-1-32
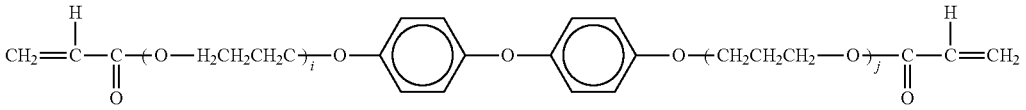
i + j = 4
J-1-33
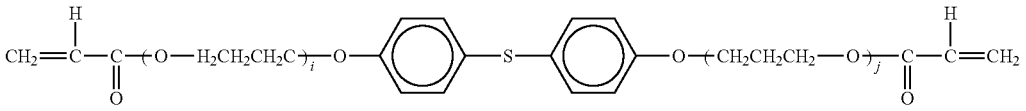
i + j = 4
J-1-34
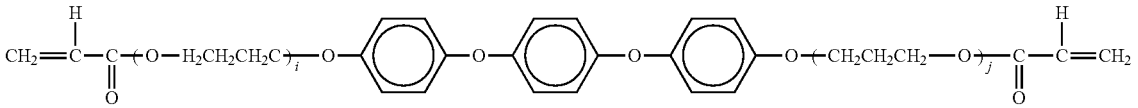
i + j = 4
J-1-35
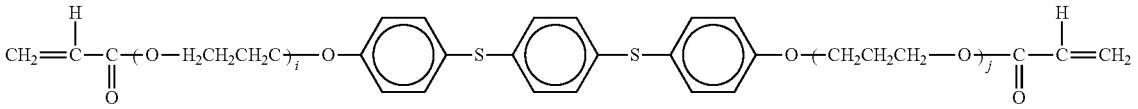
i + j = 8
J-1-36
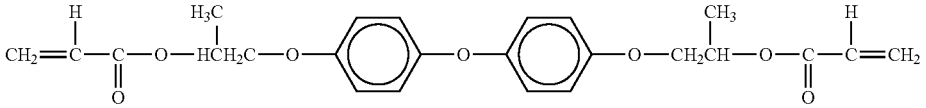
J-1-37
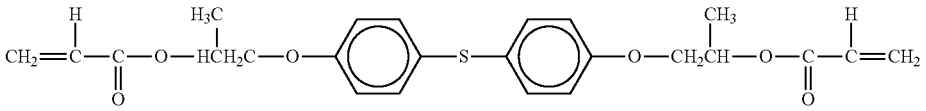
J-1-38
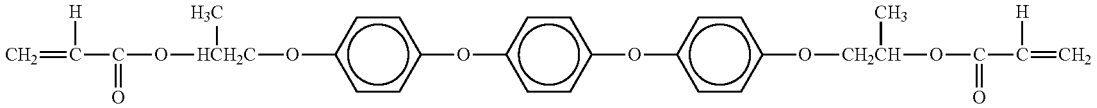
J-1-39
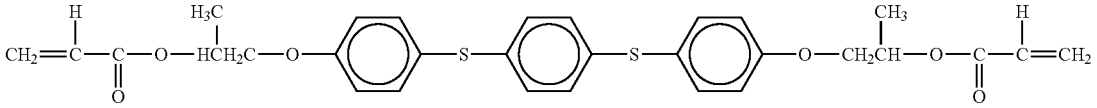
J-1-40
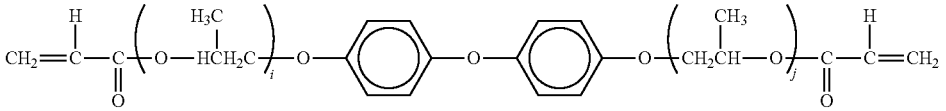
i + j = 8
J-1-41
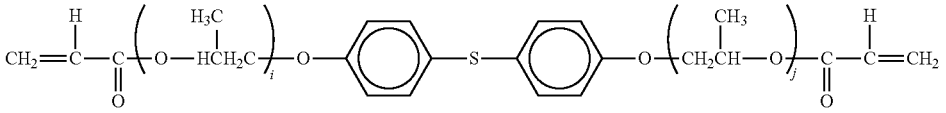
i + j = 3

-continued
J-1-42
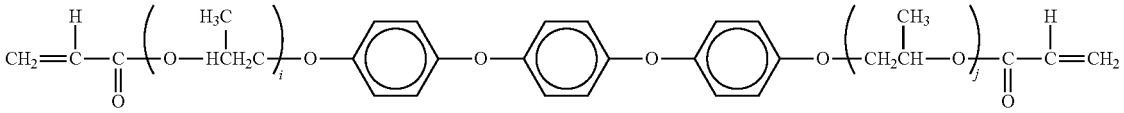
i + j = 4
J-1-43
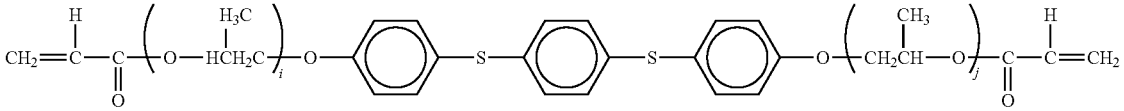
i + j = 4
J-1-44
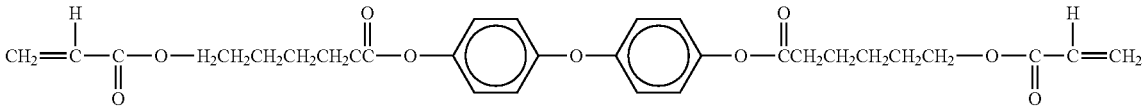
J-1-45
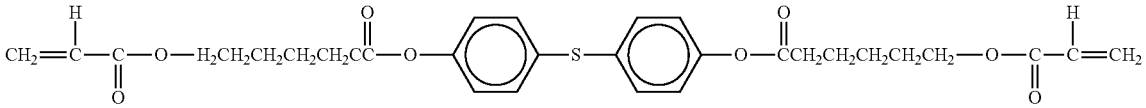
J-1-46
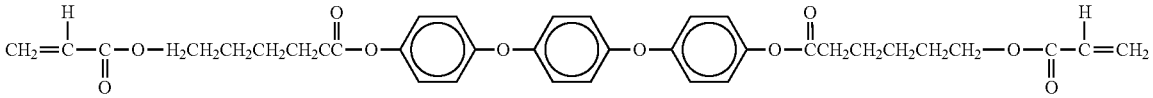
J-1-47
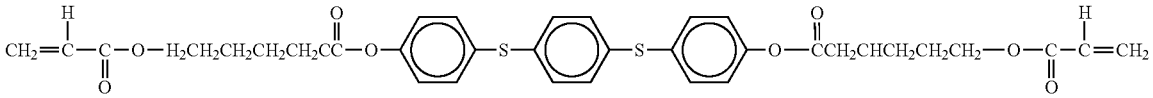
J-1-48
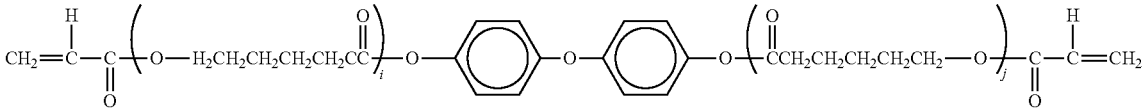
i + j = 3
J-1-49
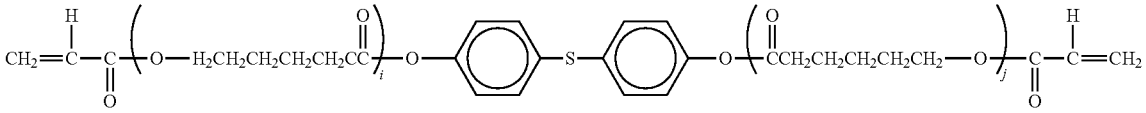
i + j = 4
J-1-50
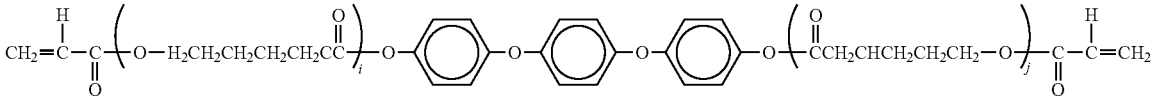
i + j = 8
J-1-51
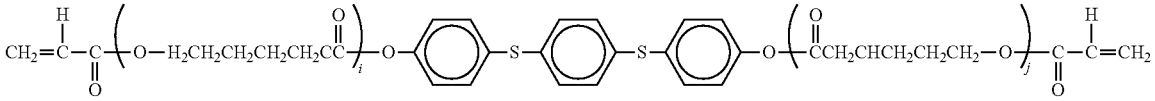
i + j = 4

-continued
J-2-1
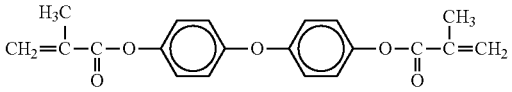
J-2-2
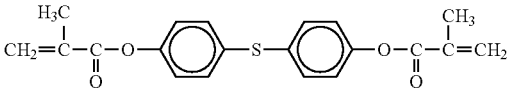
J-2-3
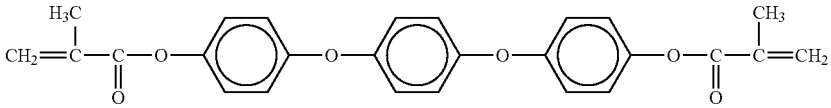
J-2-4
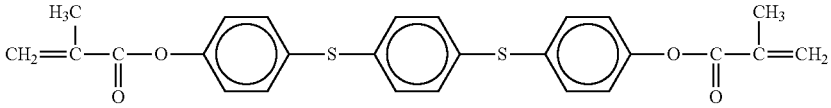
J-2-5
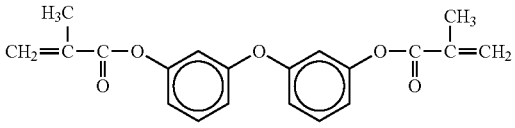
J-2-6
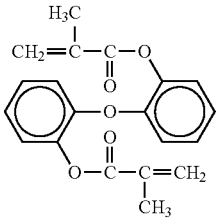
J-2-7
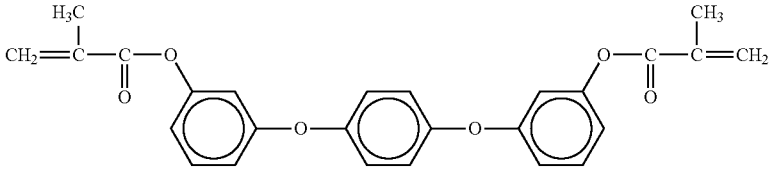
J-2-8
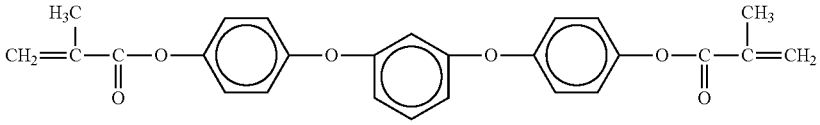
J-2-9
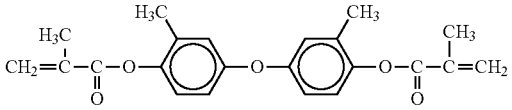
J-2-10
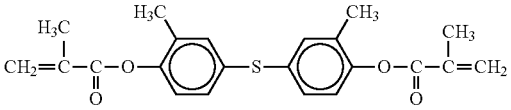
J-2-11
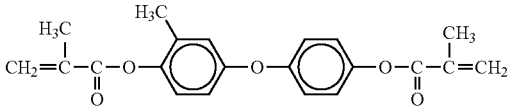
J-2-12
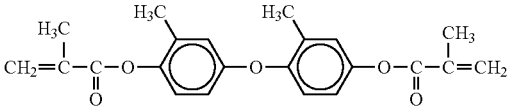
J-2-13
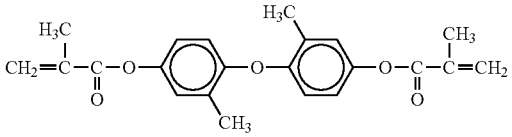
J-2-14
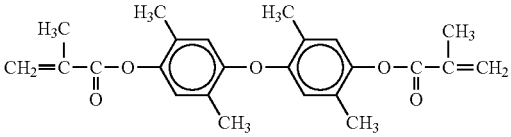
J-2-15
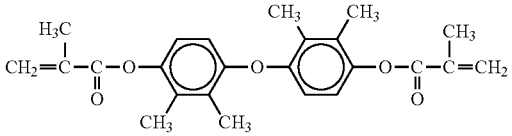
J-2-16
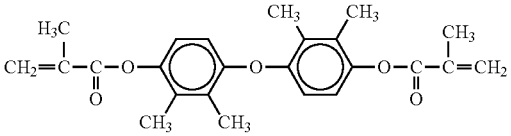

-continued
J-2-17
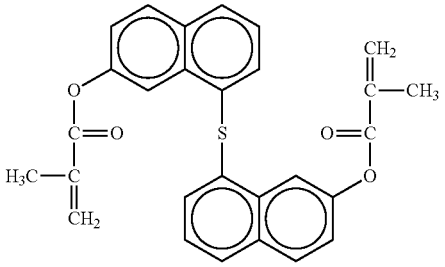
J-2-18
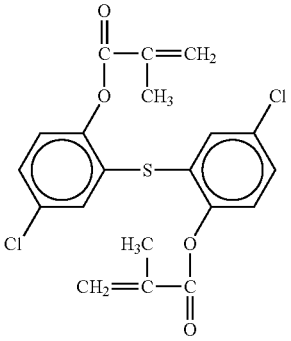
J-2-19
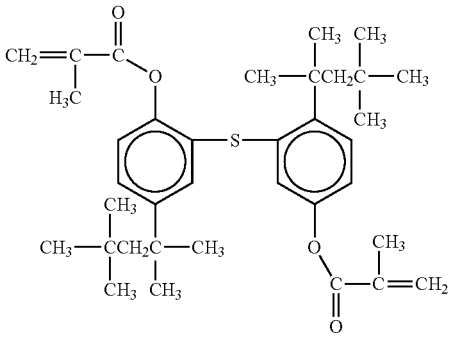
J-2-20
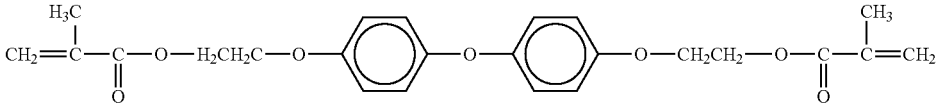
J-2-21
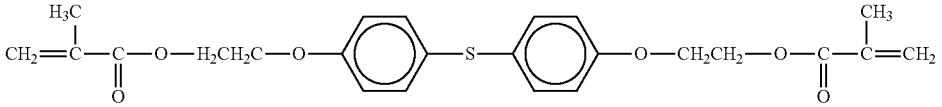
J-2-22
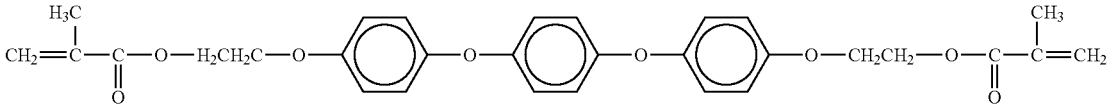
J-2-23
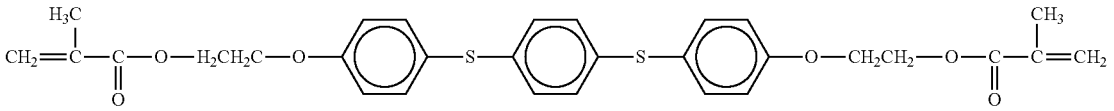
J-2-24
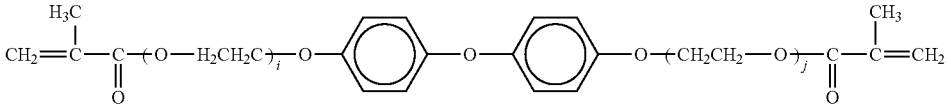
i + j = 3
J-2-25
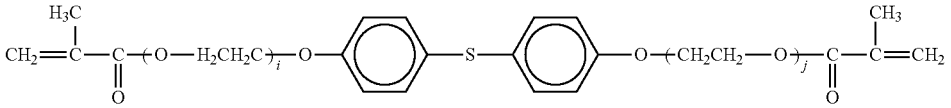
i + j = 2

-continued
J-2-26
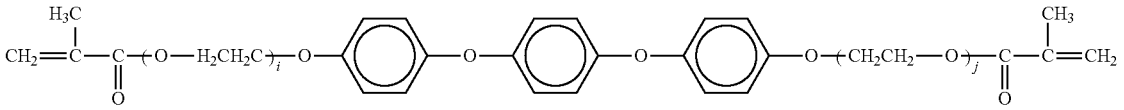
i + j = 2
J-2-27
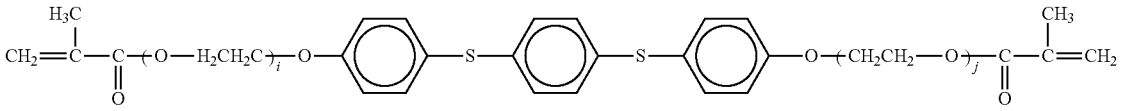
i + j = 2
J-2-28
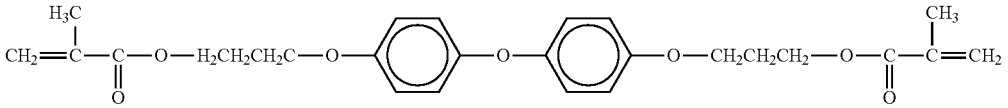
J-2-29
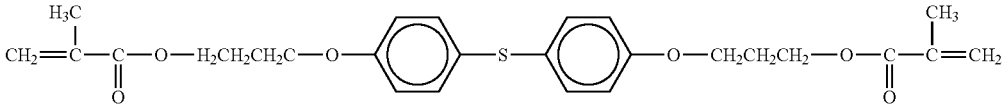
J-2-30
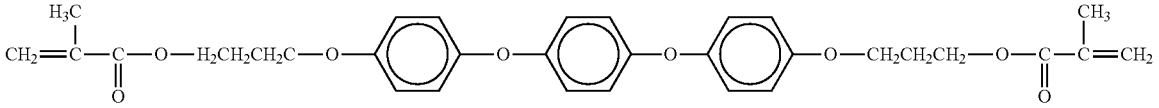
J-2-31
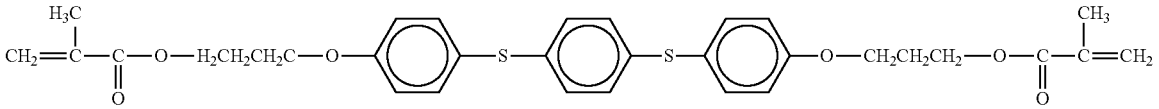
J-2-32
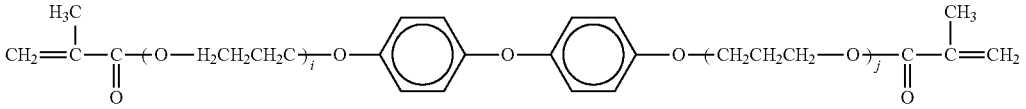
i + j = 4
J-2-33
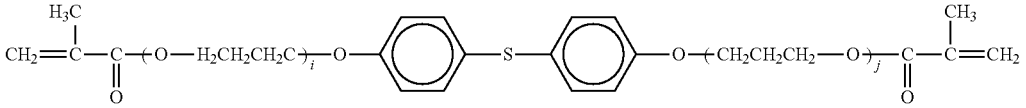
i + j = 4
J-2-34
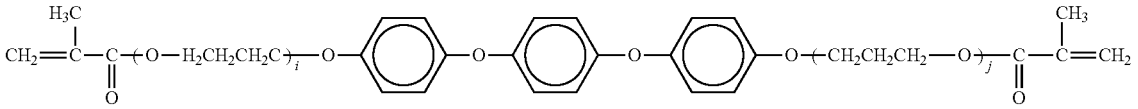
i + j = 4
J-2-35
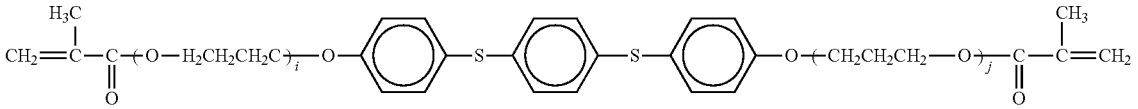
i + j = 8
J-2-36
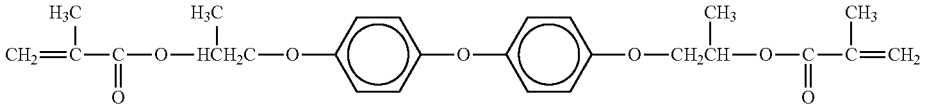

-continued
J-2-37
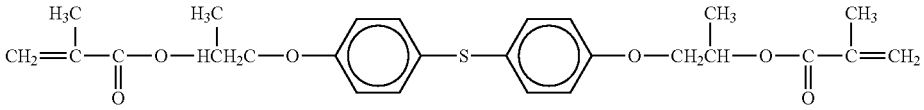
J-2-38
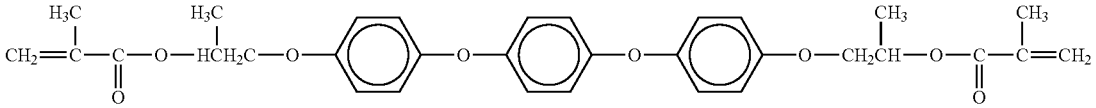
J-2-39
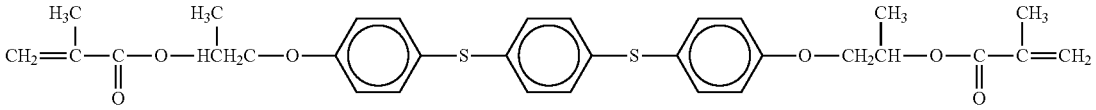
J-2-40
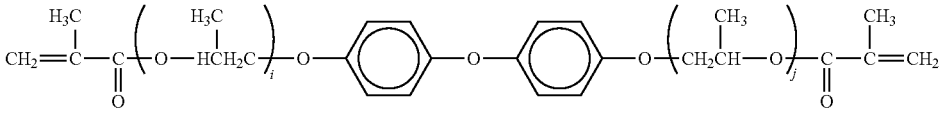
i + j = 8
J-2-41
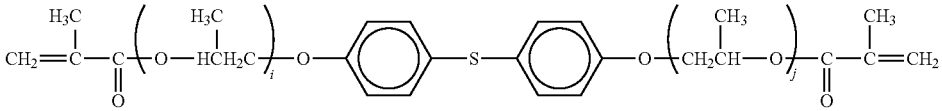
i + j = 3
J-2-42
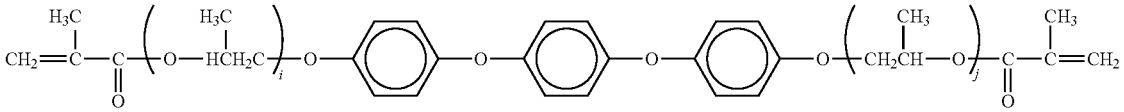
i + j = 4
J-2-43
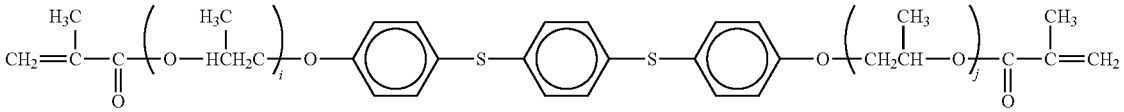
i + j = 4
J-2-44
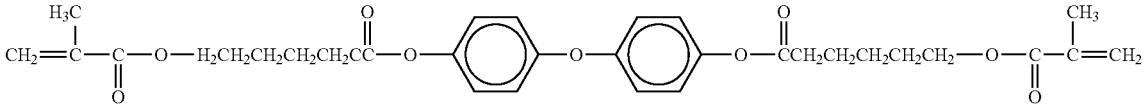
J-2-45
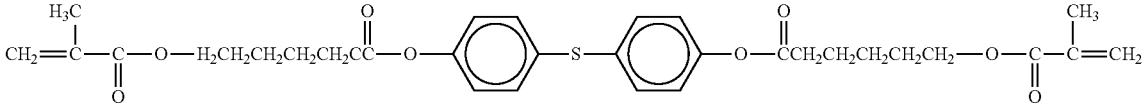
J-2-46
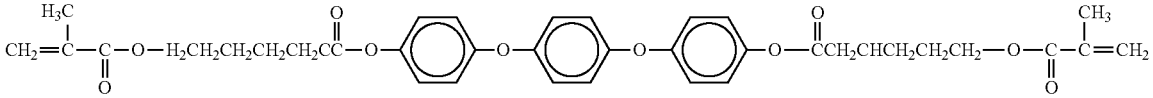
J-2-47
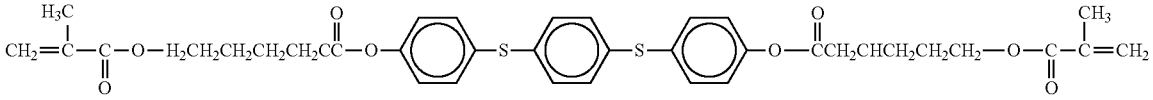

-continued

J-2-48

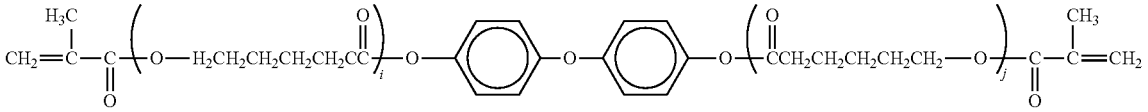

i + j = 3

J-2-49

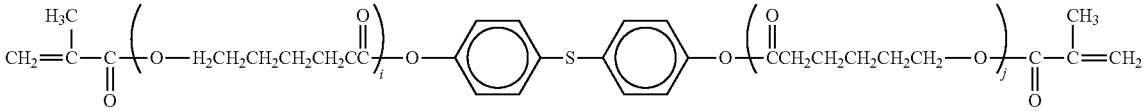

i + j = 4

J-2-50

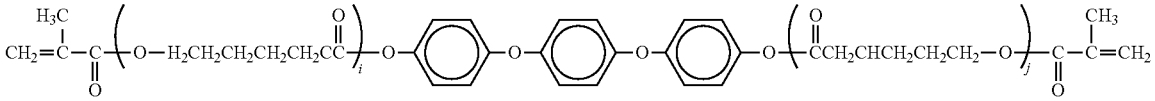

i + j = 8

J-2-51

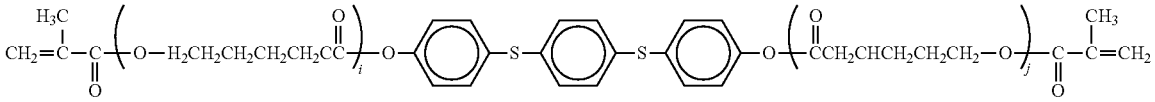

i + j = 4

When a layer having a unit (I) is formed, it is more preferable to coat a photosensitive layer with a coating liquid including a radically polymerizable compound having the below-mentioned formula (K) on, followed by radically crosslinking the formed layer.

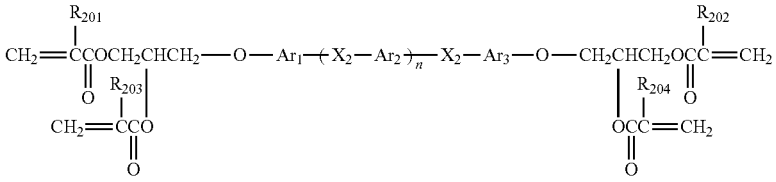

(K)

In formula (K), each of $Ar_1$, $Ar_2$ and $Ar_3$ represents a substituted or unsubstituted arylene group; $X_2$ represents an oxygen atom or a sulfur atom; each of $R_{201}$ to $R_{204}$ represents a hydrogen atom or a methyl group; and n is 0 or 1.

The compounds having formula (K) can be prepared by, for example, a method including a combination process of K1-1 and K1-2, or a combination process of K2-1 and K2-2, which are described below.

K1-1

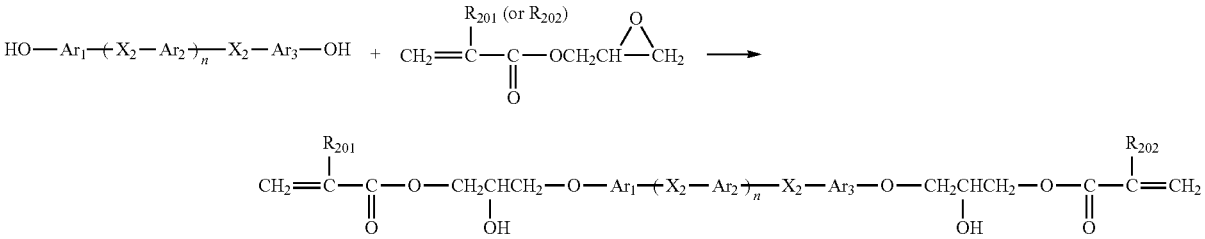

-continued
K1-2
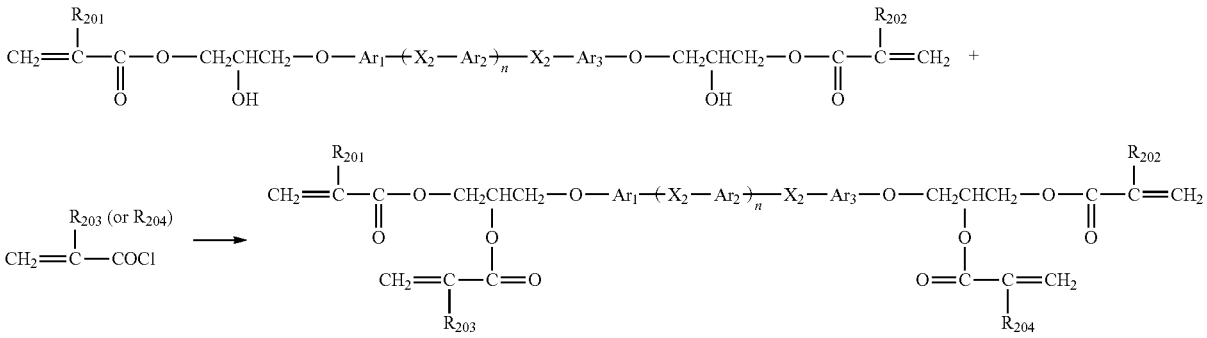
K2-1
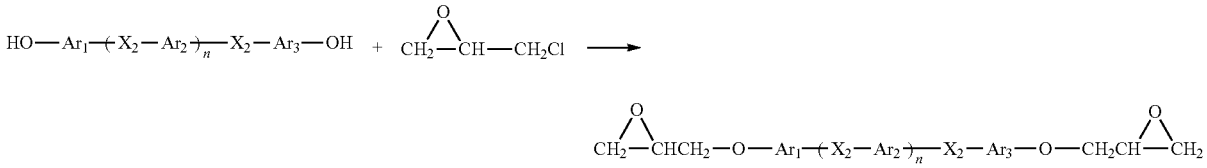
K2-2
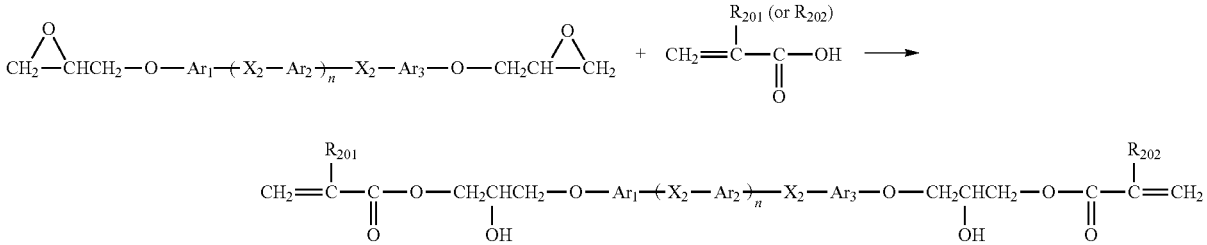
When all of the groups $R_{201}$ to $R_{204}$ are the same, the compounds can be synthesized by a method including a combination process of K3-1 and K3-2.
K3-1
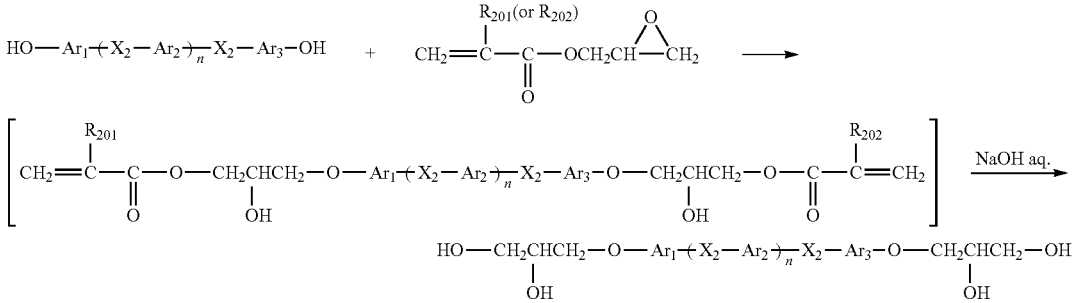
K3-2
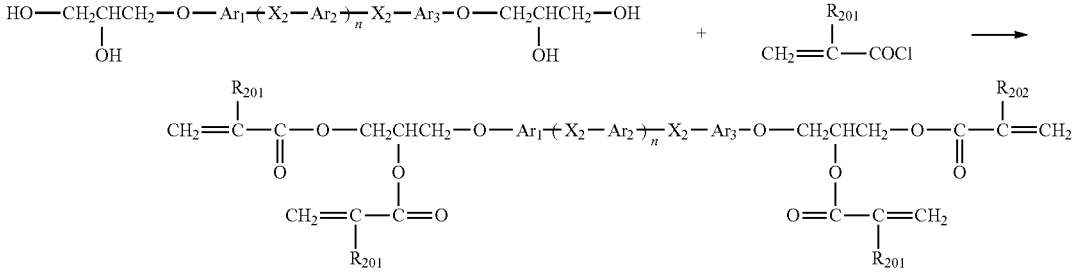

The reactions in the above-mentioned processes can be performed under conditions similar to the conditions under which conventional ring-opening addition reactions of an epoxy ring with a hydroxyl group, and conventional esterification reactions of an acid chloride with a hydroxyl group are performed.

In addition, conventional synthesis methods can also be used. For example, in the above-mentioned processes, an (meth)acryloyl compound is prepared by a reaction of an acid chloride with a hydroxyl group, but it is possible to use a dehydration condensation reaction of the corresponding acid with a hydroxyl group. Further, an acryloyl compound can be prepared by a reaction having the following process K4.

K4

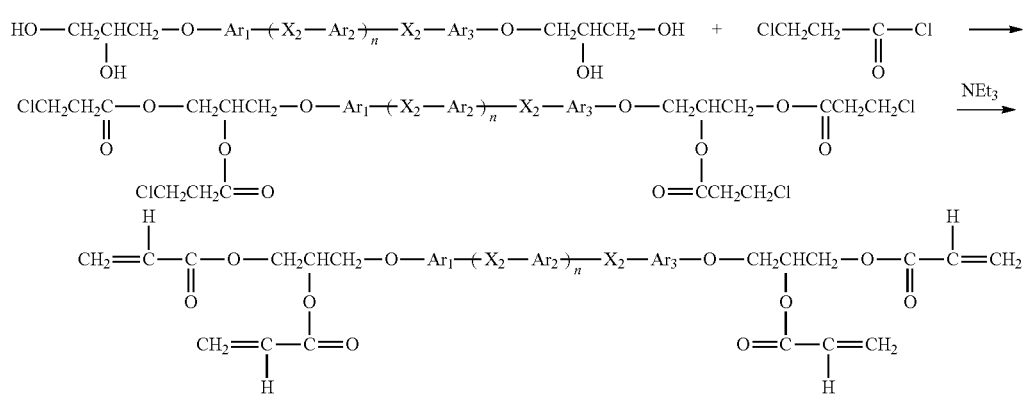

Specific examples of the radically polymerizable compounds having formula (K) include the following compounds, but are not limited thereto.

K-1-1

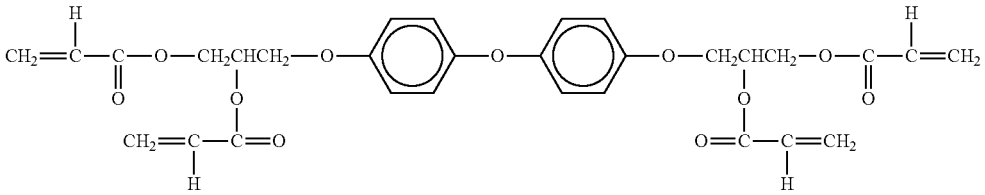

K-1-2

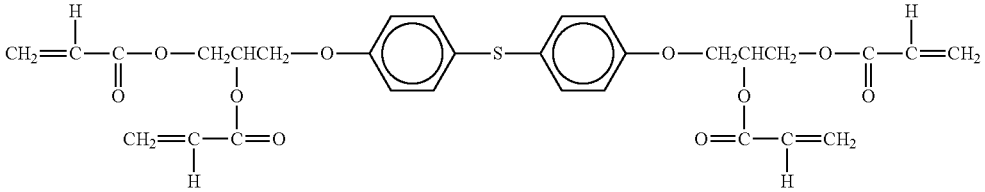

K-1-3

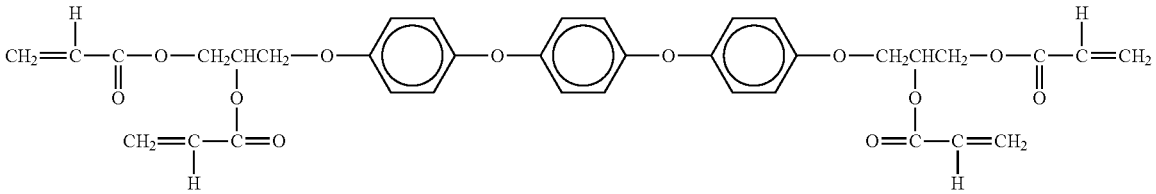

K-1-4

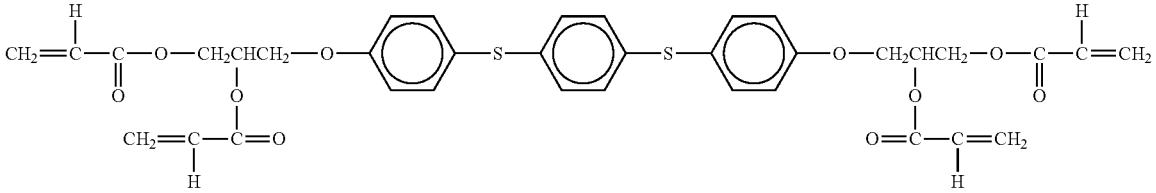

-continued
K-1-5
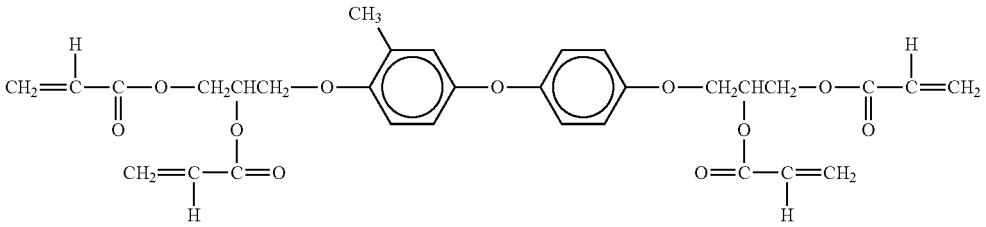
K-1-6
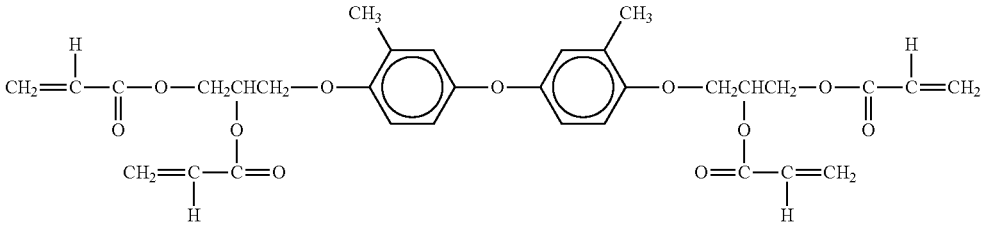
K-1-7
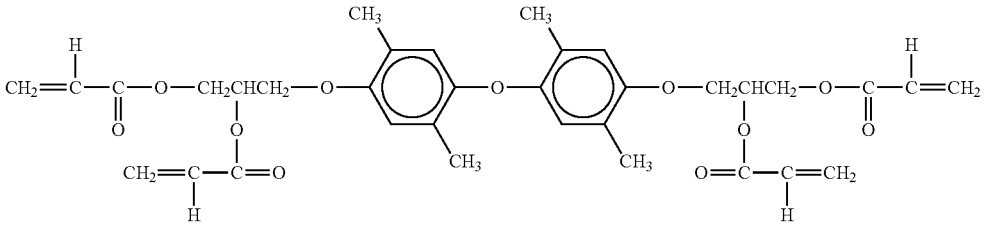
K-2-1
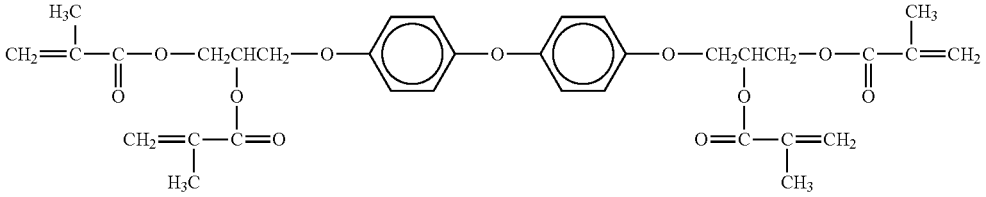
K-2-2
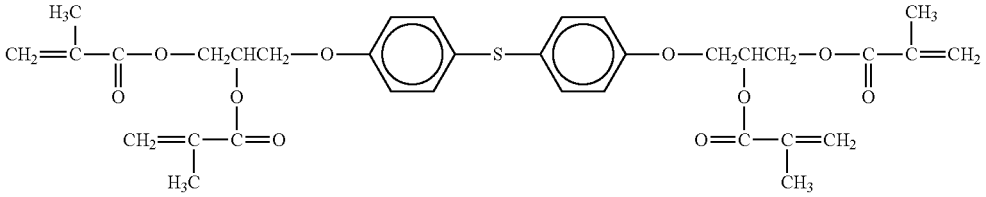
K-2-3
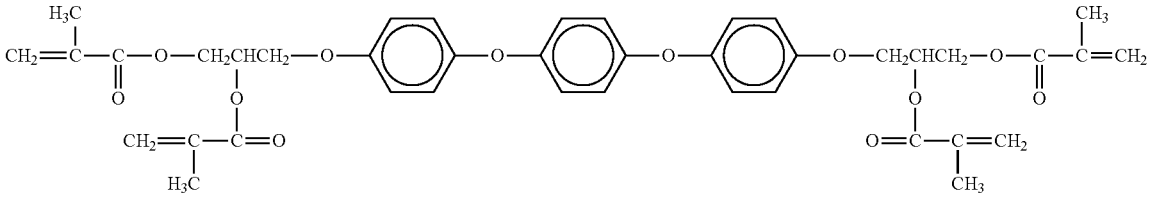
K-2-4
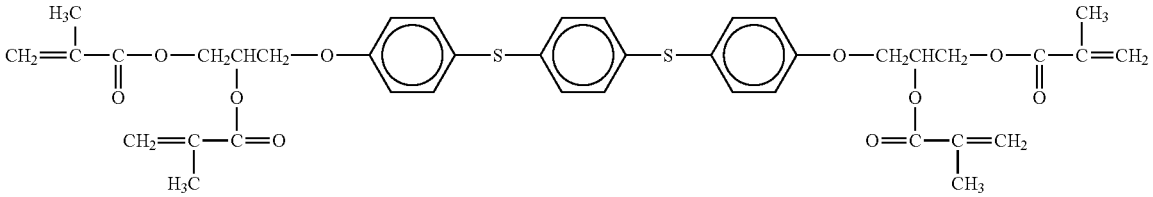

-continued

K-2-5

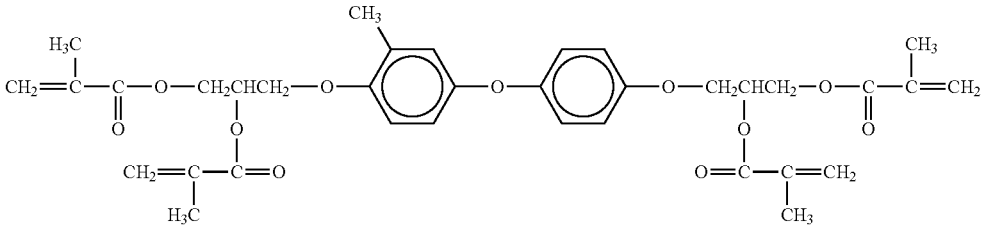

K-2-6

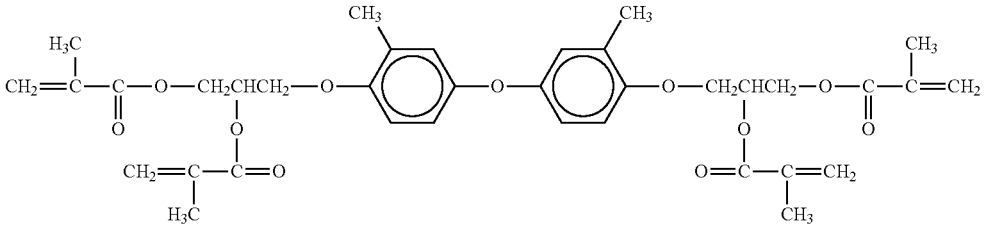

K-2-7

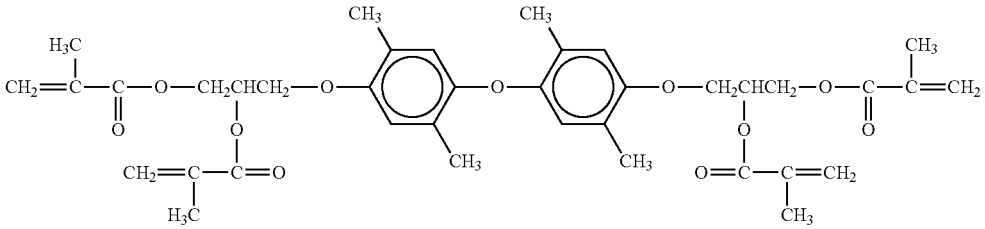

When a layer having a unit (I) is formed, it is more preferable to coat a photosensitive layer with a coating liquid including a radically polymerizable compound having the below-mentioned formula (L), followed by radically crosslinking the formed layer.

(L)

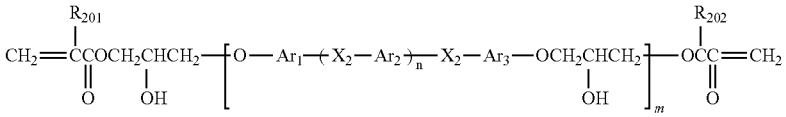

In formula (L), each of $Ar_1$, $Ar_2$ and $Ar_3$ represents a substituted or unsubstituted arylene group; $X_2$ represents an oxygen atom or a sulfur atom; each of $R_{201}$ and $R_{202}$ represents a hydrogen atom or a methyl group; and n is 0 or 1 and m is an integer of from 1 to 50.

The compounds having formula (L) can be prepared by, for example, a method including the following combination process of L1-1 and L1-2.

L1-1

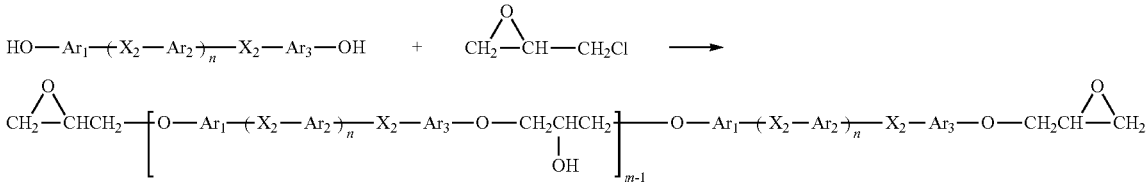

L1-2

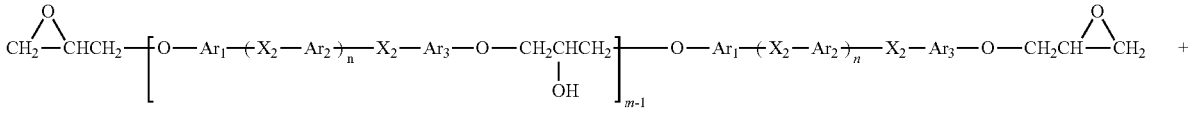

-continued
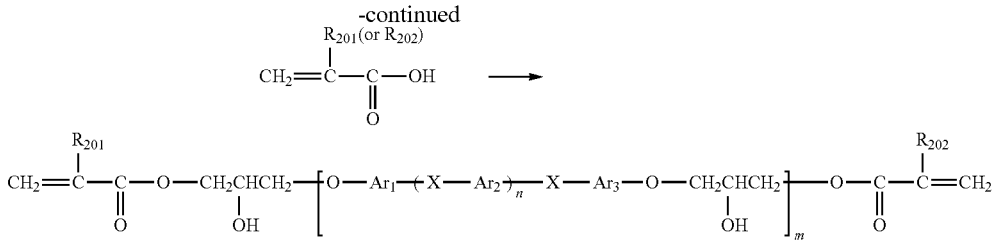
Specific examples of the compounds having formula (L) include the following compounds, but are not limited thereto.
L-1-1
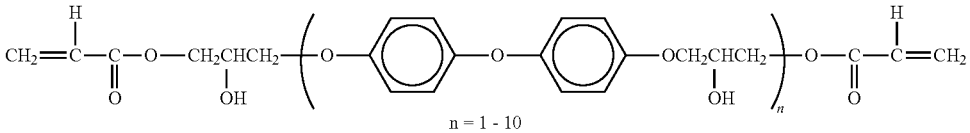
n = 1 - 10
(mixture)
L-1-2
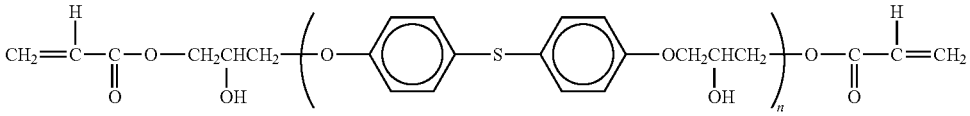
n = 1 - 3
(mixture)
L-1-3
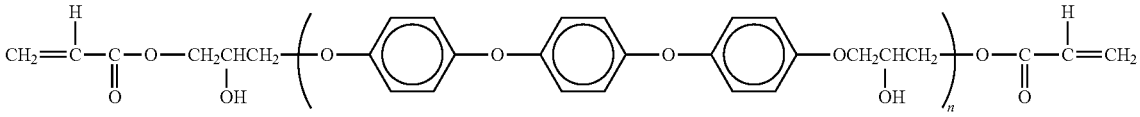
n = 1 - 5
(mixture)
L-1-4
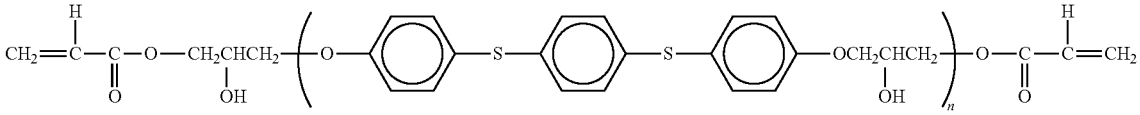
n = 1 - 5
(mixture)
L-1-5
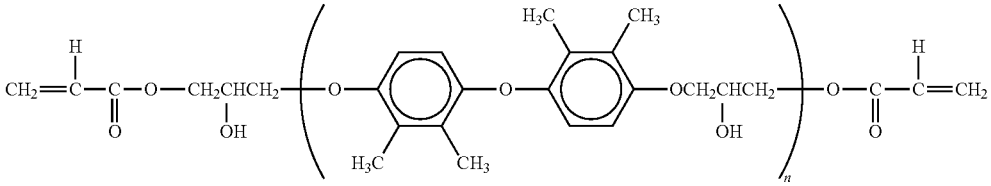
n = 3 - 10
(mixture)
L-1-6
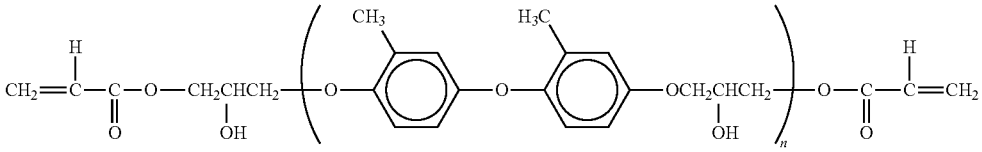
n = 3 - 10
(mixture)

-continued
L-1-7
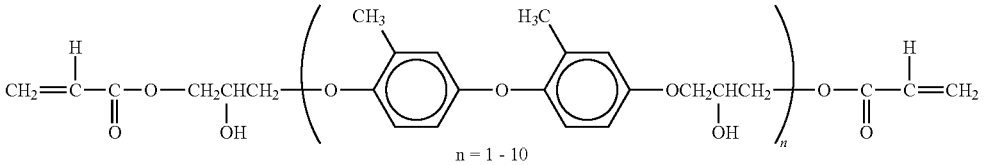
n = 1 - 10
(mixture)
L-1-8
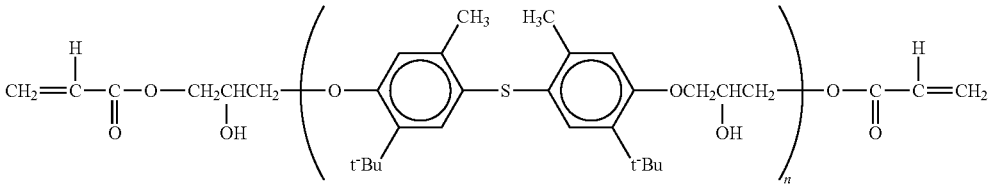
n = 1 - 5
(mixture)
L-2-1
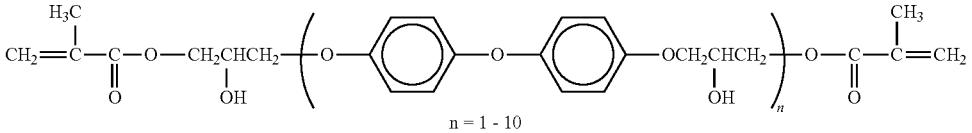
n = 1 - 10
(mixture)
L-2-2
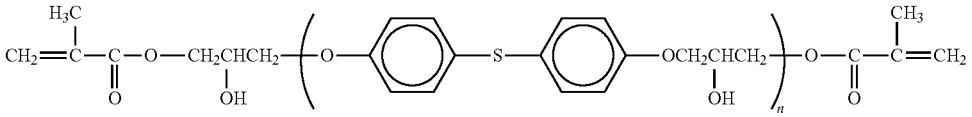
n = 1 - 3
(mixture)
L-2-3
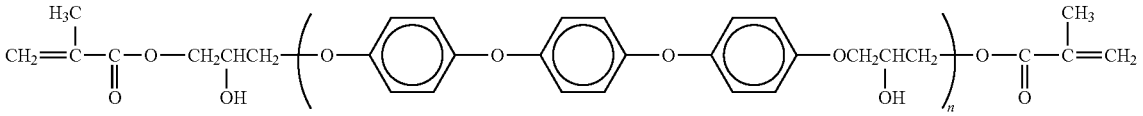
n = 1 - 5
(mixture)
L-2-4
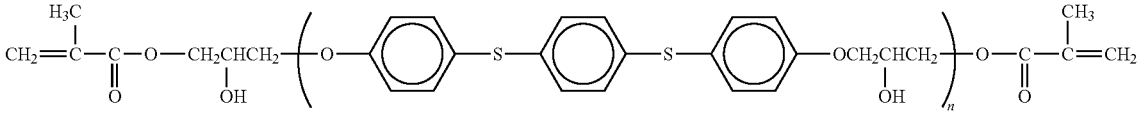
n = 1 - 5
(mixture)
L-2-5
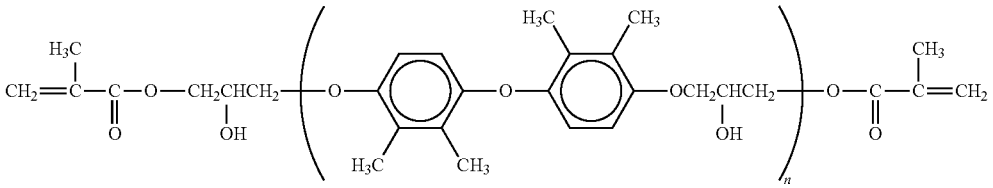
n = 3 - 10
(mixture)

-continued

L-2-6

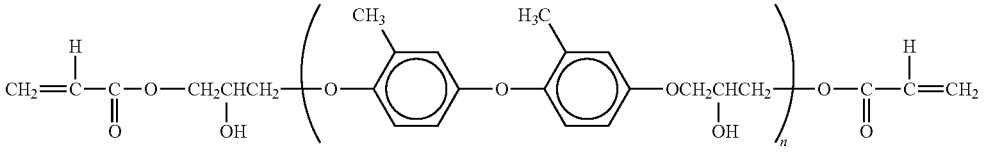

n = 3 - 10
(mixture)

L-2-7

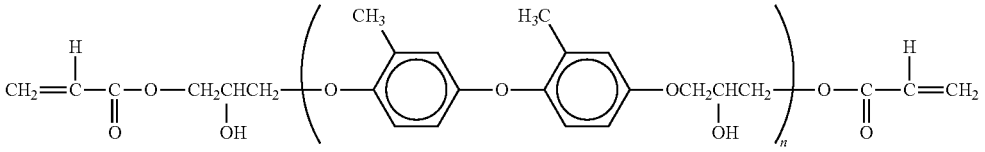

n = 1 - 10
(mixture)

L-2-8

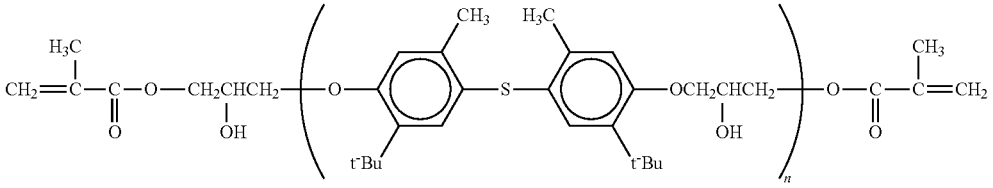

n = 1 - 5
(mixture)

The content of the radically polymerizable compounds (J), (K) and (L) in the solid components included in the coating liquid is preferably from 10 to 100% by weight, and preferably from 20 to 70% by weight, based on the total weight of the solid components included in the coating liquid. When the content is too low, the concentration of the unit (I) decreases, and the resistance to environmental changes and oxidation gasses cannot be improved, resulting in deterioration of electric properties and image qualities of the resultant photoreceptor. When the content is too high, problems which occur are that the mechanical strength of the resultant layer decreases, resulting in formation of scratches on the surface of the outermost layer and deterioration of the abrasion resistance of the outermost layer.

Specific examples of the radically polymerizable functional groups for use in preparing the crosslinked material including a unit (I) include those mentioned above for use in preparing the crosslinked material including a unit (A).

The outermost layer of the photoreceptor of the present invention is prepared by coating a photosensitive layer with a coating liquid including a radically polymerizable compound having formula (B), (C), (D), (F), (G), (H), (J), (K) or (L), followed by radically crosslinking the formed layer. In order to adjust the abrasion resistance and hardness of the layer, and the viscosity and crosslinking speed of the coating liquid, one or more radically polymerizable monomers having three or more radically polymerizable functional groups can be used in combination with the compound (B), (C), (D), (F), (G), (H), (J), (K) or (L).

Specific examples of the radically polymerizable monomers having three or more radically polymerizable functional groups include, but are not limited thereto, trimethylolpropane triacrylate (TMPTA), trimethylolpropane trimethacylate, trimethylolpropane alkylene-modified triacrylate, trimethylolpropane ethyleneoxy-modified triacrylate, trimethylolpropane propyleneoxy-modified triacrylate, trimethylolpropane caprolactone-modified triacrylate, trimethylolpropane alkylene-modified trimethacrylate, pentaerythritol triacrylate, pentaerythritol tetraacrylate (PETTA), glycerol triacrylate, glycerol epichlorohydrin-modified triacrylate, glycerol ethyleneoxy-modified triacrylate, glycerol propyleneoxy-modified triacrylate, tris(acryloxyethyl)isocyanurate, dipentaerythritol hexaacrylate (DPHA), dipentaerythritol caprolactone-modified hexaacrylate, dipentaerythritol hydroxypentaacrylate, alkylated dipentaerythritol tetraacrylate, alkylated dipentaerythritol triacrylate, dimethylolpropane tetraacrylate (DTMPTA), pentaerhythritol ethoxytriacrylate, ethyleneoxy-modified triacryl phosphate, 2,2,5,5-tetrahydroxymethylcyclopentanone tetraacrylate, etc. These monomers are used alone or in combination.

The added amount of such radically polymerizable monomers having three or more functional groups is from 0 to 90% by weight, and preferably from 0 to 50% by weight, based on the total weight of the solid components included in the coating liquid. In order to fully produce the effects of the present invention (i.e., to impart good resistance to environmental changes and oxidation gasses to the photoreceptor, i.e., to prepare a photoreceptor with good electric properties and image qualities), the added amount of the monomers is preferably not greater than that of the radically polymerizable compounds (B), (C), (D), (F), (G), (H), (J), (K) or (L).

The outermost layer of the photoreceptor of the present invention is prepared by coating a photosensitive layer with a coating liquid including a radically polymerizable compound having formula (B), (C), (D), (F), (G), (H), (J), (K) or (L), followed by radically crosslinking the formed layer. In order to improve the charge transportability of the outermost layer (which results in maintenance of good photosensitivity and low residual potential of the photoreceptor for a long period of time), a charge transport material having one or more radically polymerizable functional group can be used in combination with the compound (B), (C), (D), (F), (G), (H), (J), (K) or (L). By using such a charge transport material, the outermost layer can be thickened, and thereby the life of the photoreceptor can be extended and the outermost layer is hardly influenced by scratching on the surface thereof caused by carrier particles included in the developer or paper dust generated by the receiving papers.

Specific examples of the charge transport materials (hereinafter referred to as CTMs) having one or more radically polymerizable functional groups include compounds having both a radically polymerizable functional group and one of a charge transport structure (such as a positive hole transport structure (e.g., triarylamine, hydrazone, pyrazoline and carbazole structures) and an electron transport structure (e.g., condensed polycyclic quinone structure, diphenoquinone structure, a cyano group and a nitro group)).

Suitable groups for use as the radically polymerizable functional group of the CTMs include the groups mentioned above for use in the radically polymerizable compounds, and acryloyloxy and methacryloyloxy groups are preferably used. The number of radically polymerizable functional groups included in a molecule of a CTM is not less than 1, and preferably 1. In this case, increase of internal stress in the outermost layer can be prevented, resulting in formation of a layer having a smooth surface, and in addition the resultant photoreceptor can maintain good electric properties. When a CTM having two or more radically polymerizable functional groups is used, the problem which may occur is that the CTM, which is bulky, is fixed in the three dimensional network with two or more bonds, and thereby large strain is generated, resulting in deformation (such as waving) of the layer, formation of cracks in the layer, and peeling of the layer. When such large strain is generated, the CTM cannot stably maintain its intermediate structure (i.e., cation radical), and thereby charge trapping is caused, resulting in deterioration of photosensitivity of the photoreceptor and increase of residual potential of the photoreceptor. Among the charge transport groups, triarylamine groups are preferably used because of having a good charge transportability. Among the compounds having a triarylamine group, compounds having the following formula (1) or (2) are preferably used because of imparting good electric properties (i.e., high photosensitivity and low residual potential) to the photoreceptor.

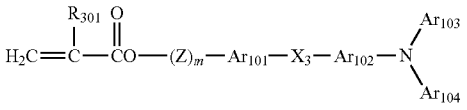

(1)

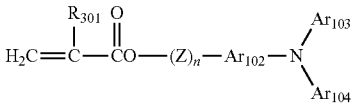

(2)

In formulae (1) and (2), $R_{301}$ represents a hydrogen atom, a halogen atom, a substituted or unsubstituted alkyl group, a substituted or unsubstituted aralkyl group, a substituted or unsubstituted aryl group, a cyano group, a nitro group, an alkoxy group, a —$COOR_{41}$ group (wherein $R_{41}$ represents a hydrogen atom, a substituted or unsubstituted alkyl group, a substituted or unsubstituted aralkyl group and a substituted or unsubstituted aryl group), a halogenated carbonyl group or a —$CONR_{42}R_{43}$ (wherein each of $R_{42}$ and $R_{43}$ represents a hydrogen atom, a halogen atom, a substituted or unsubstituted alkyl group, a substituted or unsubstituted aralkyl group and a substituted or unsubstituted aryl group); each of $Ar_{101}$ and $Ar_{102}$ represents a substituted or unsubstituted arylene group; each of $Ar_{103}$ and $Ar_{104}$ represents a substituted or unsubstituted aryl group; $X_3$ represents a direct bond, a substituted or unsubstituted alkylene group, a substituted or unsubstituted cycloalkylene group, a substituted or unsubstituted alkylene ether group, an oxygen atom, a sulfur atom or a vinylene group; Z represents a substituted or unsubstituted alkylene group, a substituted or unsubstituted divalent alkylene ether group, or a substituted or unsubstituted divalent alkyleneoxy carbonyl group; and each of m and n is 0 or an integer of from 1 to 3.

In formulae (1) and (2), specific examples of the alkyl, aryl, aralkyl, and alkoxy groups for use in $R_{301}$ include the following.

Alkyl Group

Methyl, ethyl, propyl and butyl groups.

Aryl Group

Phenyl and naphthyl groups.

Aralkyl Group

Benzyl, phenethyl and naphthylmethyl groups.

Alkoxy Group

Methoxy, ethoxy and propoxy groups.

These groups may be substituted with a halogen atom, a nitro group, a cyano group, an alkyl group (such as methyl and ethyl groups), an alkoxy group (such as methoxy and ethoxy groups), an aryloxy group (such as a phenoxy group), an aryl group (such as phenyl and naphthyl groups), an aralkyl group (such as benzyl and phenethyl groups), etc.

Among these groups, a hydrogen atom and a methyl group are preferable as $R_{301}$.

Suitable substituted or unsubstituted aryl groups for use as $Ar_{103}$ and $Ar_{104}$ include condensed polycyclic hydrocarbon groups, non-condensed cyclic hydrocarbon groups, and heterocyclic groups.

Specific examples of the condensed polycyclic hydrocarbon groups include compounds in which 18 or less carbon atoms constitute one or more rings, such as pentanyl, indecenyl, naphthyl, azulenyl, heptalenyl, biphenilenyl, as(asym)-indacenyl, s(sym)-indacenyl, fluorenyl, acenaphthylenyl, preiadenyl, acenaphthenyl, phenarenyl, phenanthoryl, anthoryl, fluorantenyl, acephenanthorylenyl, aceanthorylenyl, triphenylenyl, pyrenyl, chrysenyl, and naphthasenyl groups.

Specific examples of the non-condensed cyclic hydrocarbon groups include monovalent groups of benzene, diphenyl ether, polyethylene diphenyl ether, diphenyl thioether, and diphenyl sulfone; monovalent groups of non-condensed polycyclic hydrocarbon groups such as biphenyl, polyphenyl, diphenyl alkans, diphenylalkenes, diphenyl alkyne, triphenyl methane, distyryl benzene, 1,1-diphenylcycloalkanes, polyphenyl alkans, polyphenyl alkenes; and ring aggregation hydrocarbons such as 9,9-diphenyl fluorenone.

Specific examples of the heterocyclic groups include monovalent groups of carbazole, dibenzofuran, dibenzothiophene, oxadiazole, and thiadiazole.

The aryl groups for use as $Ar_{103}$ and $Ar_{104}$ may be substituted with the following groups.

(1) Halogen atoms, and cyano and nitro groups.

(2) Linear or branched alkyl groups which preferably have from 1 to 12 carbon atoms, more preferably from 1 to 8 carbon atoms and even more preferably from 1 to 4 carbon atoms. These alkyl groups can be further substituted with another group such as a fluorine atom, a hydroxyl group, a cyano group, an alkoxy group having 1 to 4 carbon atoms, and a phenyl group which may be further substituted with a halogen atom, an alkyl group having 1 to 4 carbon atoms, or an alkoxy group having 1 to 4 carbon atoms. Specific examples of the alkyl groups include methyl, ethyl, n-propyl, iso-propyl, n-butyl, sec-butyl, t-butyl, trifluoromethyl, 2-hydroxyethyl, 2-ethoxyethyl, 2-cyanoethyl, 2-methoxyethyl, benzyl, 4-chlorobenzyl, 4-methylbenzyl and 4-phenylbenzyl groups.

(3) Alkoxy groups (i.e., —OR44). R44 represents one of the alkyl groups defined above in paragraph (2). Specific examples of the alkoxy groups include methoxy, ethoxy, n-propoxy, iso-propoxy, t-butoxy, n-butoxy, s-butoxy, iso-butoxy, 2-hydroxyethoxy, benzyloxy and trifluoromethoxy groups.

(4) Aryloxy groups. Specific examples of the aryl-group of the acryloxy groups include phenyl and naphthyl groups. The aryloxy groups may be substituted with an alkoxy group having from 1 to 4 carbon atoms, an alkyl group having from 1 to 4 carbon atoms, or a halogen atom. Specific examples of the groups include phenoxy, 1-naphthyloxy, 2- naphthyloxy, 4-methoxyphenoxy, and 4-methylphenoxy groups.

(5) Alkylmercapto or arylmercapto group. Specific examples of the groups include methylthio, ethylthio, phenylthio, and p-methylphenylthio groups (6) Groups having the following formula.

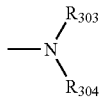

In the above formula, each of R303 and R304 represents a hydrogen atom, one of the alkyl groups defined in paragraph (2) or an aryl group (such as phenyl, biphenyl, and naphthyl groups). These groups may be substituted with another group such as an alkoxy group having from 1 to 4 carbon atoms, an alkyl group having from 1 to 4 carbon atoms, and a halogen atom. In addition, R303 and R304 optionally share bond connectivity to form a ring.

Specific examples of the groups having the formula include amino, diethylamino, N-methyl-N-phenylamino, N,N-diphenylamino, N,N-di(tolyl)amino, dibenzylamino, piperidino, morpholino, and pyrrolidino groups.

(7) Alkylenedioxy or alkylenedithio groups such as methylenedioxy and methylenedithio groups.

(8) Substituted or unsubstituted styryl groups, substituted or unsubstituted β-phenylstyryl groups, diphenylaminophenyl groups, and ditolylaminophenyl groups.

Suitable arylene groups for use in $Ar_{101}$, and $Ar_{102}$ include divalent groups delivered from the aryl groups mentioned above for use in $Ar_{103}$ and $Ar_{104}$.

The group $X_3$ is a substituted or unsubstituted alkylene group, a substituted or unsubstituted cycloalkylene group, a substituted or unsubstituted alkylene ether, an oxygen atom, a sulfur atom, and a vinylene group.

Suitable groups for use as the substituted or unsubstituted alkylene group include linear or branched alkylene groups which preferably have from 1 to 12 carbon atoms, more preferably from 1 to 8 carbon atoms and even more preferably from 1 to 4 carbon atoms. These alkylene groups can be further substituted with another group such as a fluorine atom, a hydroxyl group, a cyano group, an alkoxy group having 1 to 4 carbon atoms, and a phenyl group which may be further substituted with a halogen atom, an alkyl group having 1 to 4 carbon atoms, or an alkoxy group having 1 to 4 carbon atoms. Specific examples of the alkylene groups include methylene, ethylene, n-propylene, iso-propylene, n-butylene, sec-butylene, t-butylene, trifluoromethylene, 2-hydroxyethylene, 2-ethoxyethylene, 2-cyanoethylene, 2-methoxyethylene, benzylidene, phenylethylene, 4-chlorophenylethylene, 4-methylphenylethylene and 4-biphenylethylene groups.

Suitable groups for use in the substituted or unsubstituted cycloalkylene groups include cyclic alkylene groups having from 5 to 7 carbon atoms, which may be substituted with a fluorine atom or another group such as a hydroxyl group, alkyl groups having from 1 to 4 carbon atoms, and alkoxy groups having 1 to 4 carbon atoms. Specific examples of the substituted or unsubstituted cycloalkylene groups include cyclohexylidene, cyclohexylene, and 3,3-dimethylcyclohexylidene groups.

Specific examples of the substituted or unsubstituted alkylene ether groups include ethyleneoxy, propyleneoxy, ethylene glycol, propylene glycol, diethylene glycol, tetraethylene glycol, and tripropylene glycol groups. The alkylene group of the alkylene ether groups may be substituted with another group such as hydroxyl, methyl and ethyl groups.

As the vinylene group, groups having one of the following formulae can be preferably used.

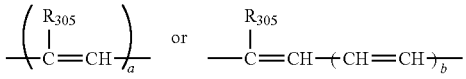

In the above-mentioned formulae, R305 represents a hydrogen atom, one of the alkyl groups mentioned above for use in paragraph (2), or one of the aryl groups mentioned above for use in $Ar_{103}$ and $Ar_{104}$, wherein a is 1 or 2, and b is 1, 2 or 3.

In formulae (1) and (2), Z represents a substituted or unsubstituted alkylene group, a substituted or unsubstituted divalent alkylene ether group, a divalent alkyleneoxycarbonyl group. Specific examples of the substituted or unsubstituted alkylene group include the alkylene groups mentioned above for use as $X_3$. Specific examples of the substituted or unsubstituted alkylene ether group include the divalent alkylene ether groups mentioned above for use as $X_3$. Specific examples of the divalent alkyleneoxycarbonyl group include divalent groups modified by caprolactone.

More preferably, compounds having the following formula (3) are used as charge transport materials having a radically polymerizable functional group.

formula (3)

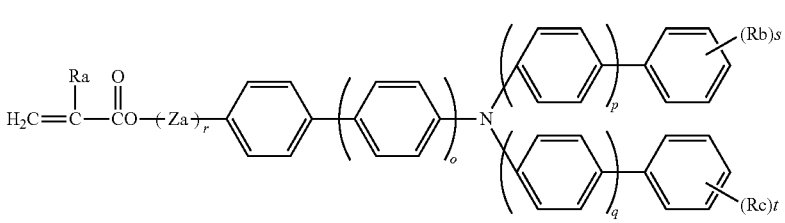

In formula (3), each of o, p and q is 0 or 1; Ra represents a hydrogen atom, or a methyl group; each of Rb and Rc represents an alkyl group having from 1 to 6 carbon atoms, wherein each of Rb and Rc can include plural groups which are the same as or different from each other; each of s and t is 0, 1, 2 or 3; r is 0 or 1; Za represents a methylene group, an ethylene group or a group having one of the following formulae.

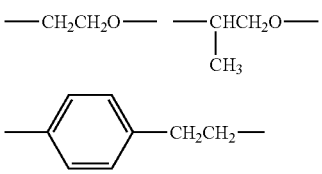

In formula (3), each of Rb and Rc is preferably a methyl group or an ethyl group.

The charge transport materials having a radically polymerizable monofunctional group having formula (1) or (2) (preferably formula (3)) have the following property. Specifically, such a monofunctional charge transport material is polymerized while the double bond of a molecule is connected with the double bonds of other molecules. Therefor, the charge transport material is incorporated in a polymer chain, i.e., in a main chain or a side chain of the crosslinked polymer chain, which is formed by the charge transport material and a radically polymerizable monomer. The side chain of the unit obtained from the charge transport material having a radically polymerizable functional group is present between two main polymer chains, which are connected by crosslinked chains. In this regard, the crosslinked chains are classified into intermolecular crosslinked chains and intramolecular crosslinked chains.

In any of these case, the triarylamine group which is a pendant of the main chain of the unit obtained from the charge transport material is bulky (because of having three aryl groups) and is connected with the main chain with a carbonyl group therebetween while not being fixed (i.e., while being fairly free three-dimensionally). Therefore, the crosslinked polymer has little strain, and in addition the crosslinked protective layer has good charge transport property.

Specific examples of the charge transport material having one or more radically polymerizable functional groups include the following compounds, but are not limited thereto.

No. 1

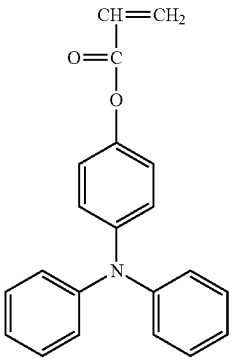

-continued

No. 2

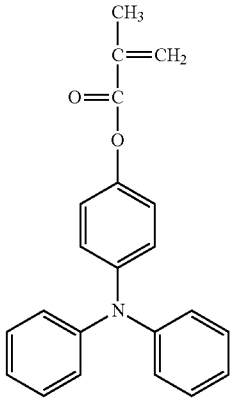

No. 3

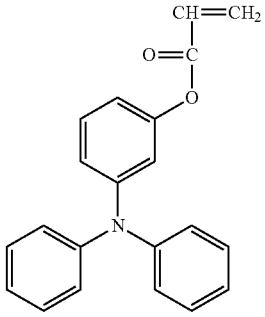

No. 4

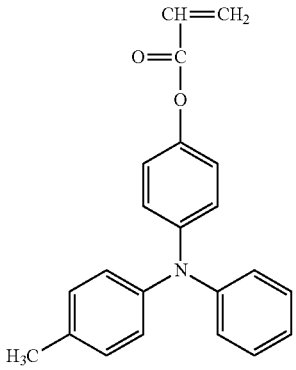

No. 5

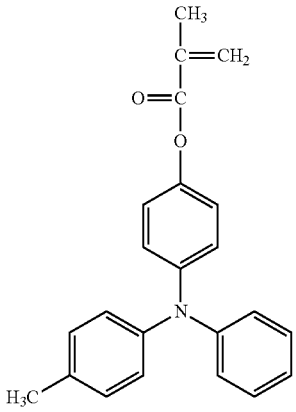

-continued
No. 6
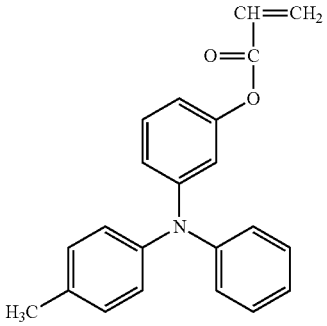
No. 7
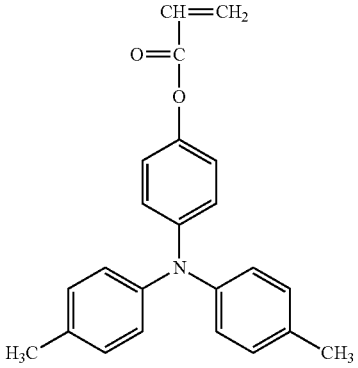
No. 8
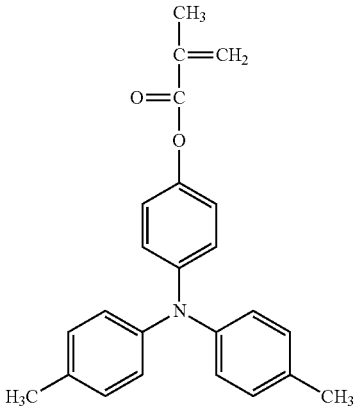
No. 9
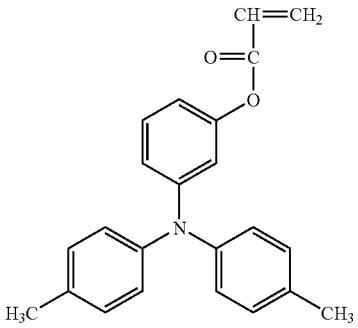
-continued
No. 10
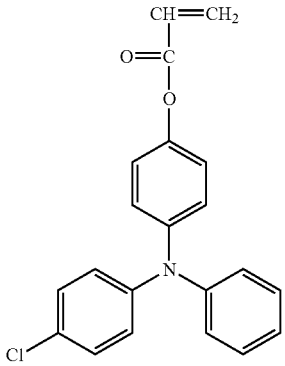
No. 11
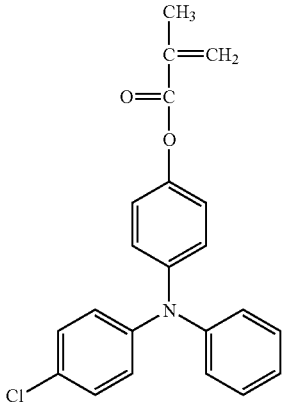
No. 12
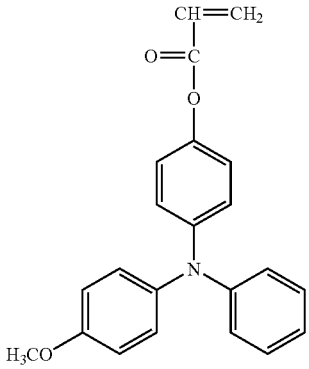
No. 13
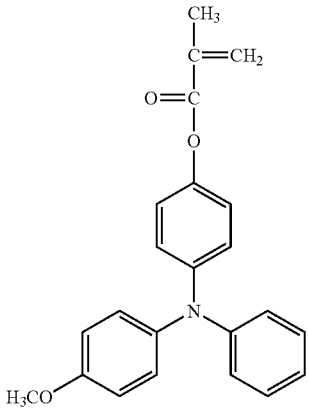

-continued
No. 14
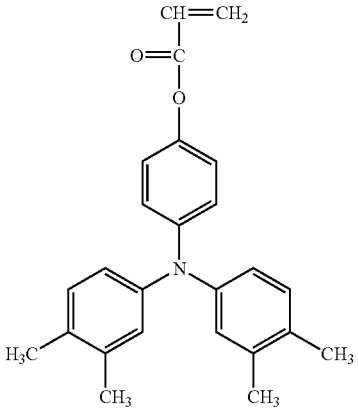
No. 15
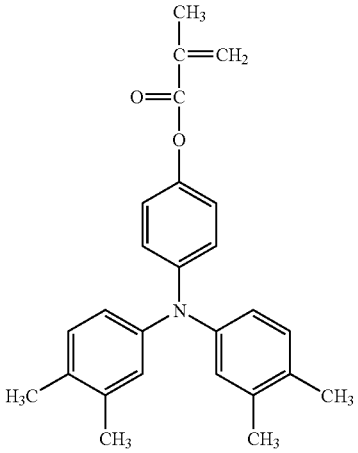
No. 16
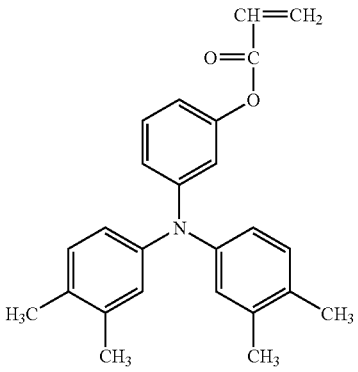
-continued
No. 17
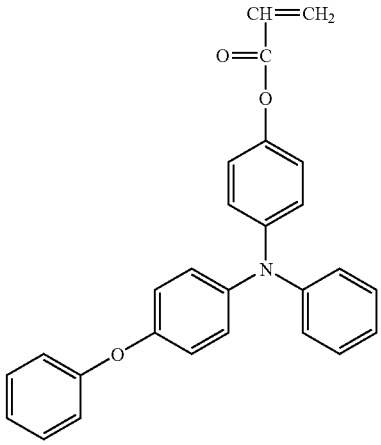
No. 18
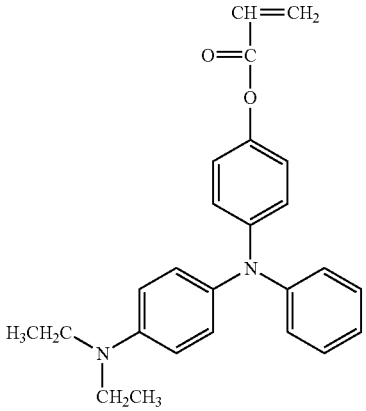
No. 19
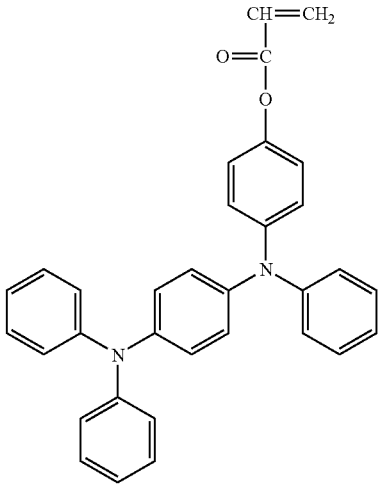

-continued
No. 20
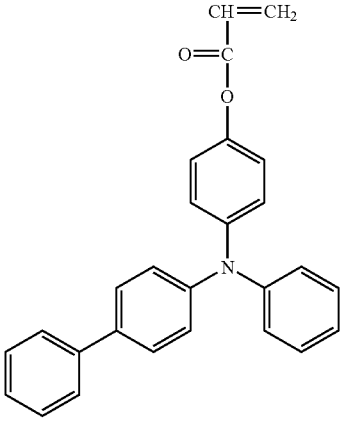
No. 21
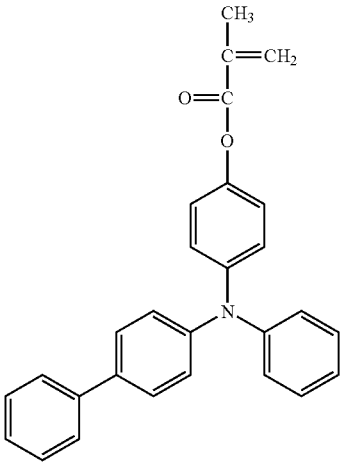
No. 22
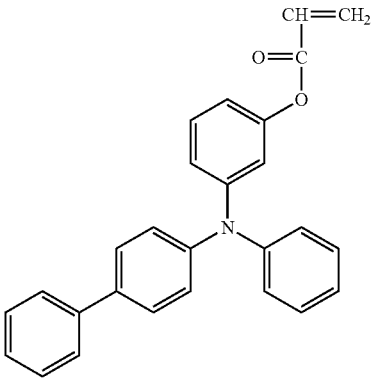
-continued
No. 23
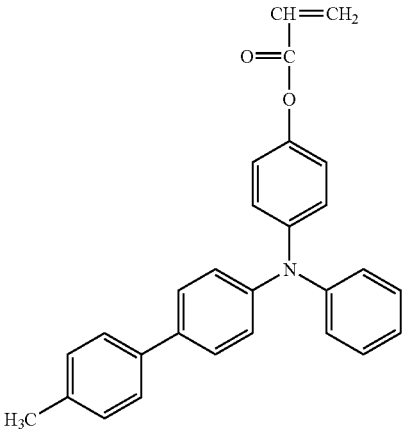
No. 24
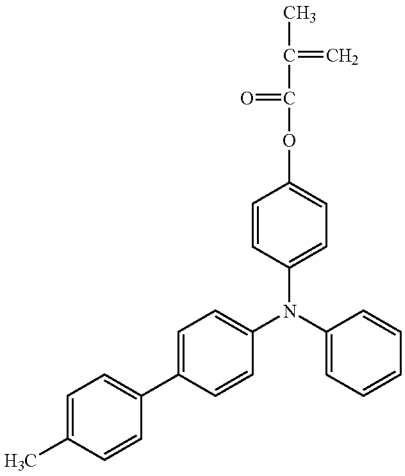
No. 25
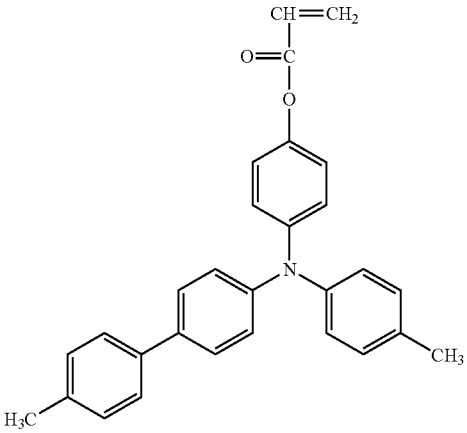

-continued
No. 26
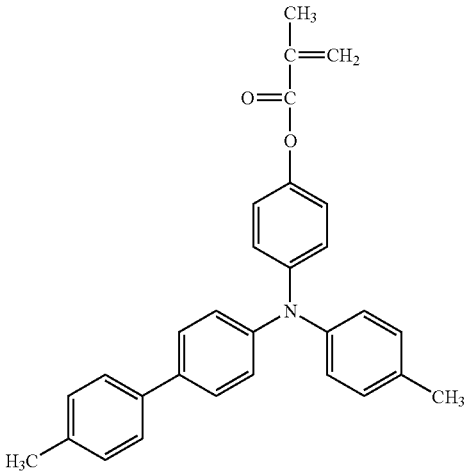
No. 27
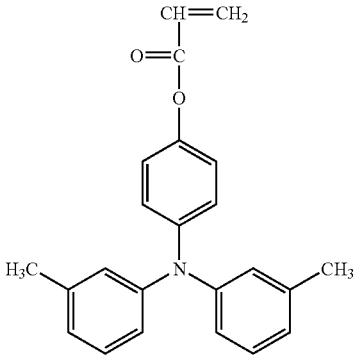
No. 28
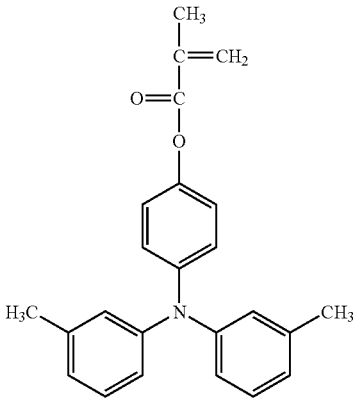
-continued
No. 29
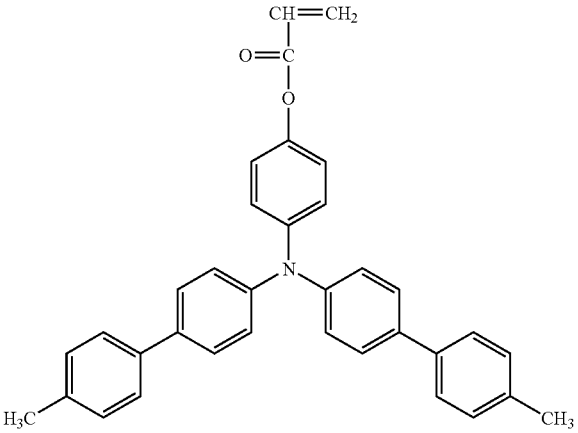
No. 30
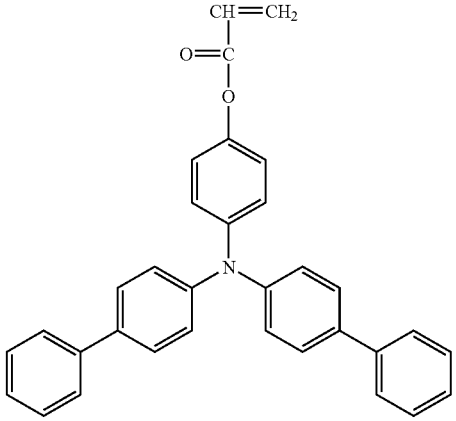
No. 31
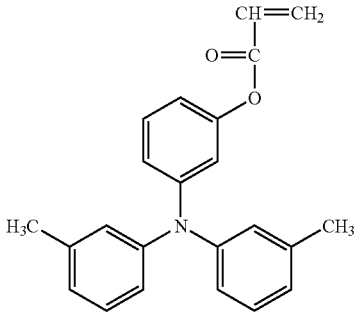
No. 32
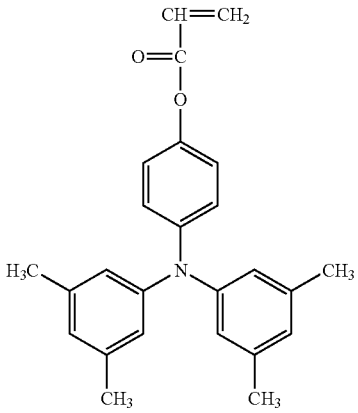

-continued
No. 33
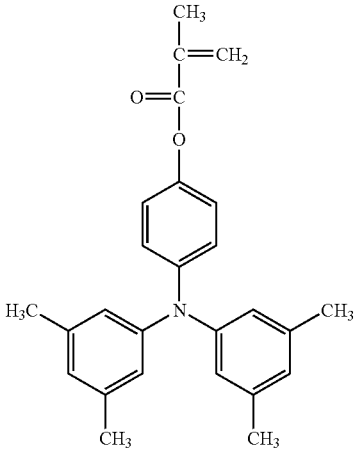
No. 34
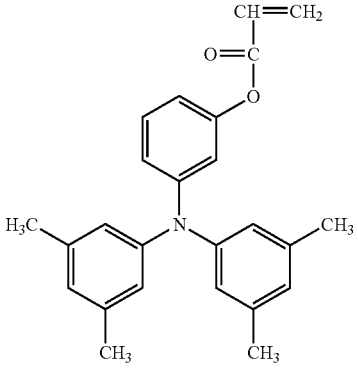
No. 35
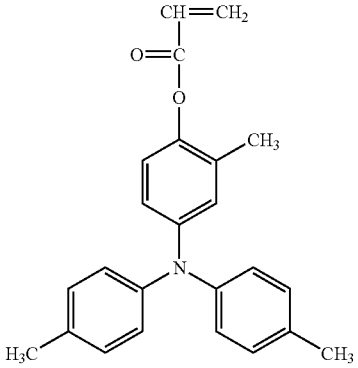
No. 36
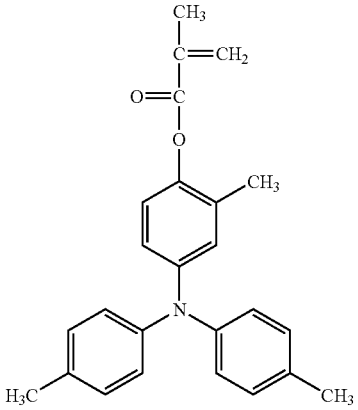
-continued
No. 37
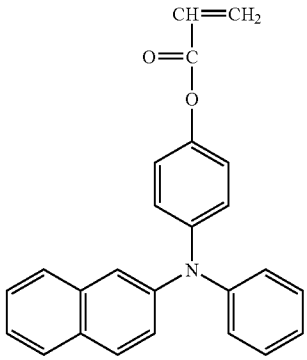
No. 38
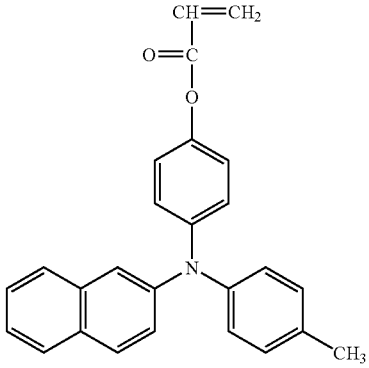
No. 39
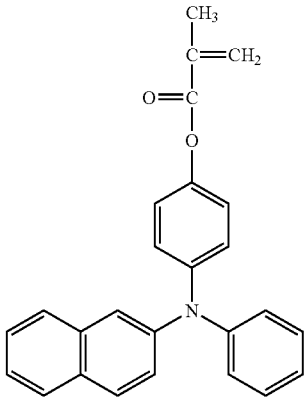
No. 40
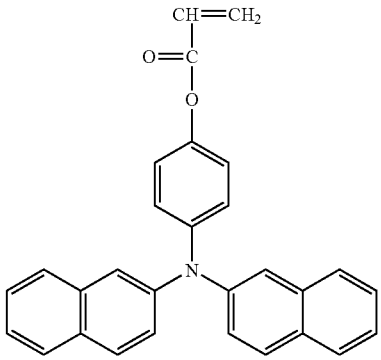

-continued
No. 41
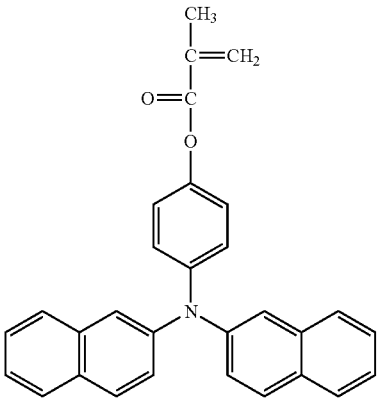
No. 42
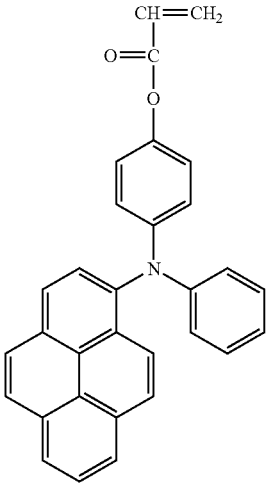
No. 43
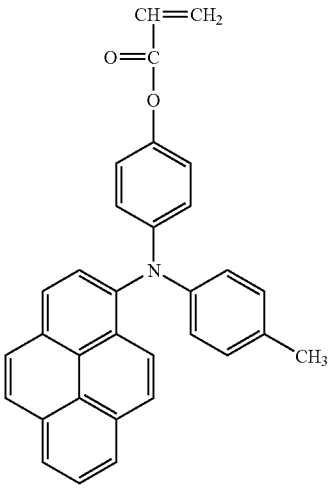
-continued
No. 44
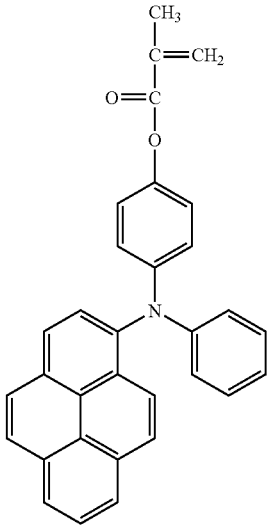
No. 45
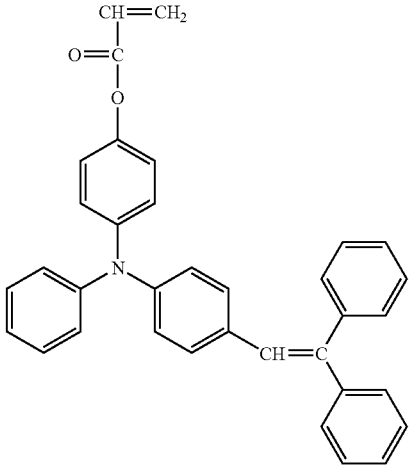
No. 46
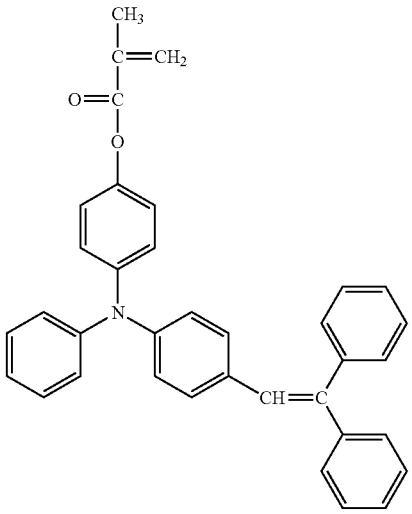

-continued
No. 47
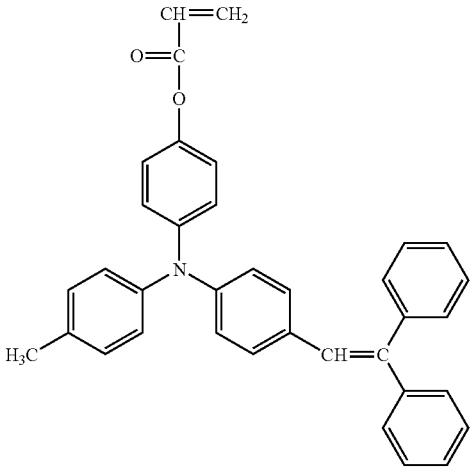
No. 48
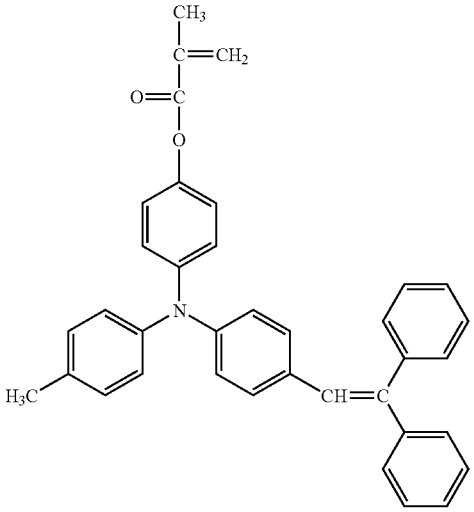
No. 49
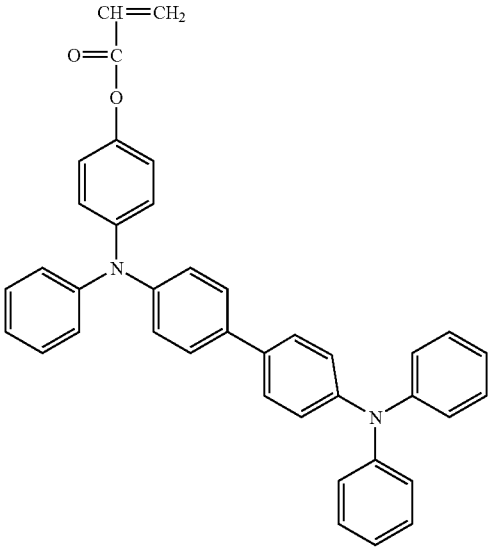
-continued
No. 50
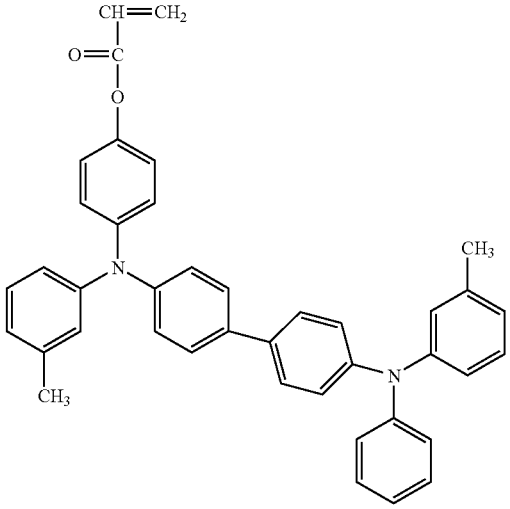
No. 51
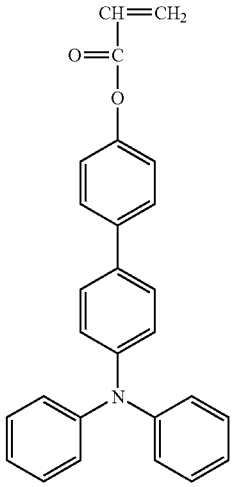
No. 52
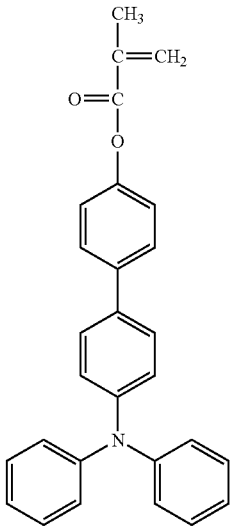

-continued
No. 53
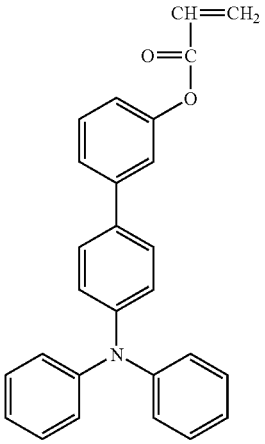
No. 54
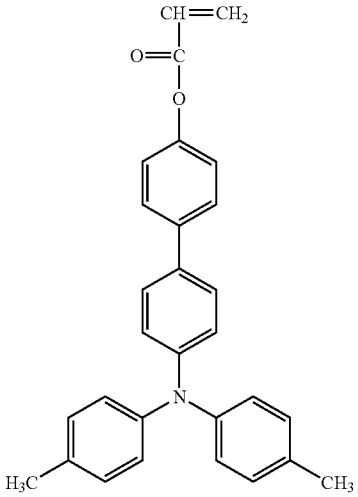
No. 55
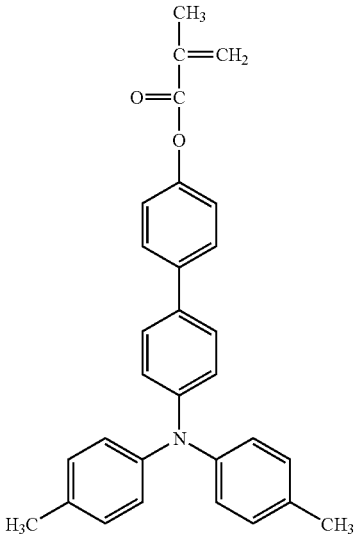
-continued
No. 56
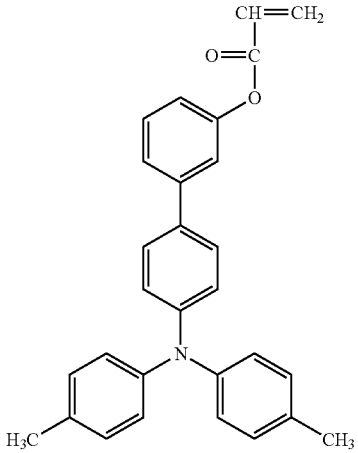
No. 57
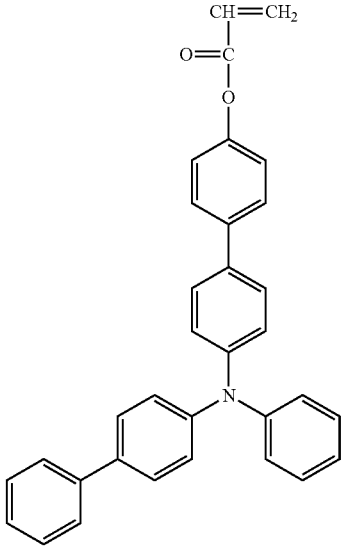
No. 58
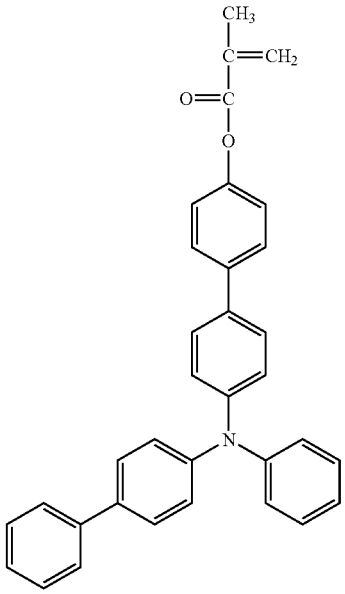

-continued
No. 59
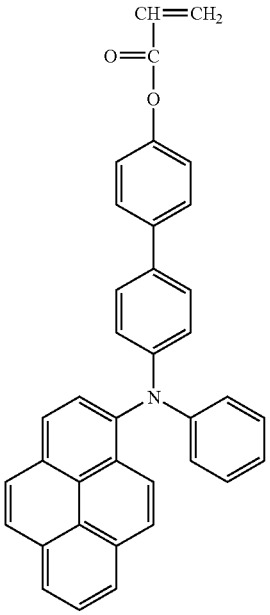
No. 60
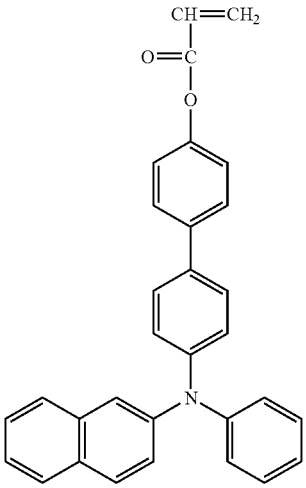
No. 61
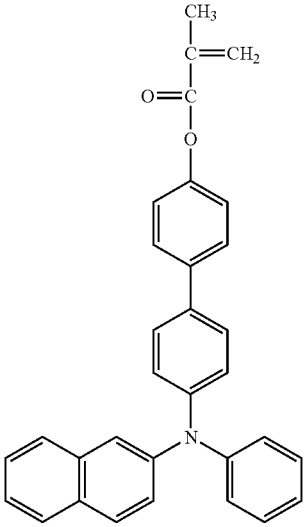
-continued
No. 62
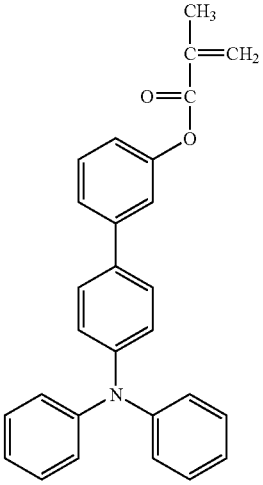
No. 63
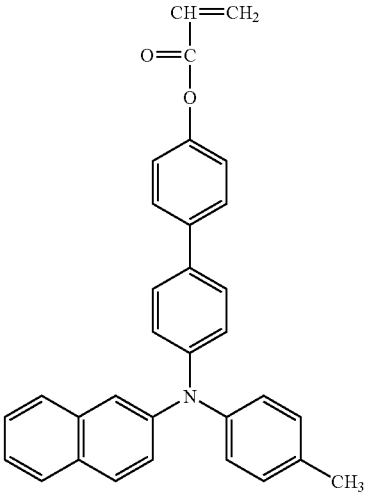
No. 64
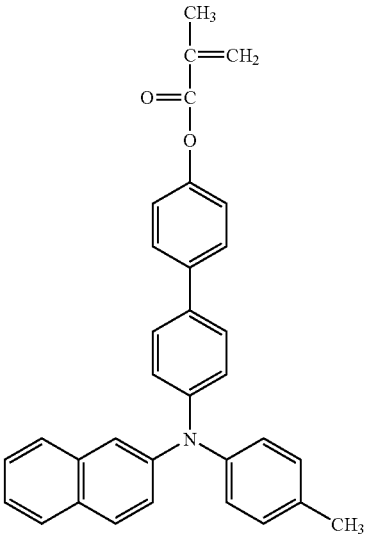

-continued
No. 65
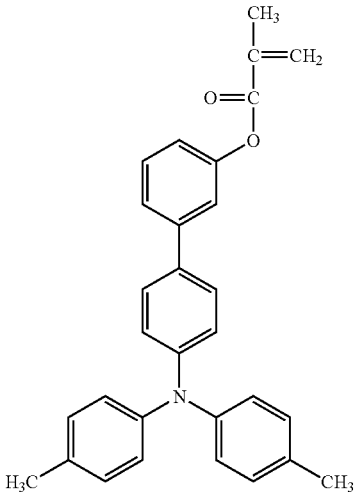
No. 66
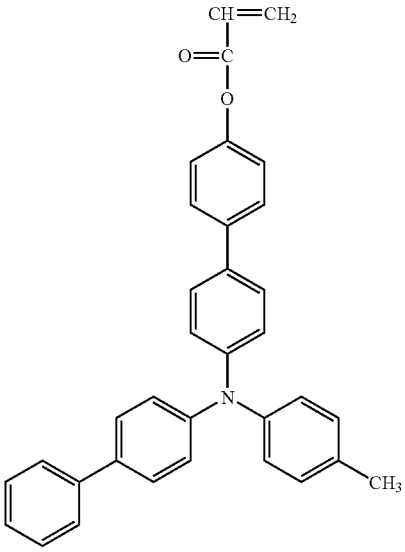
No. 67
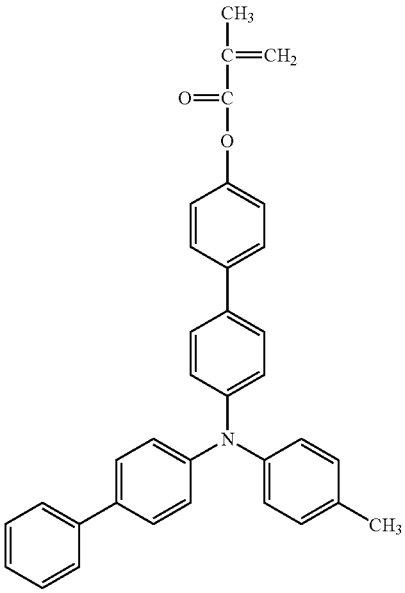
-continued
No. 68
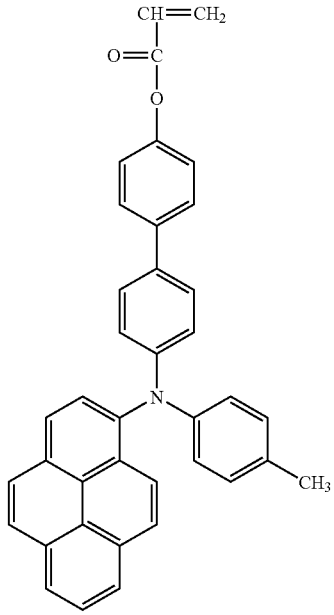
No. 69
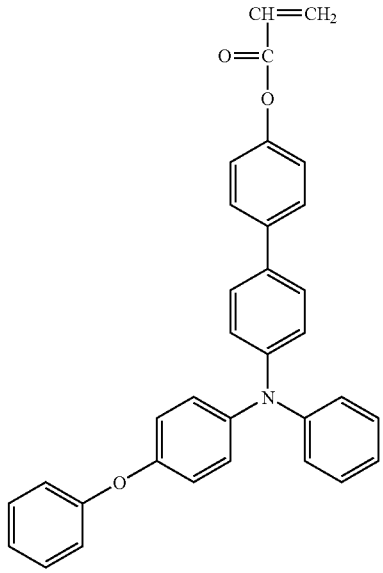

No. 70
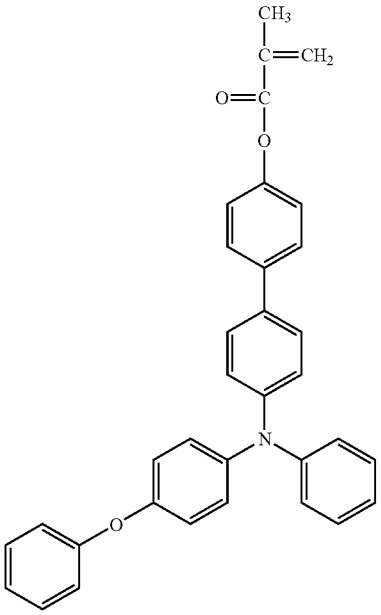
No. 71
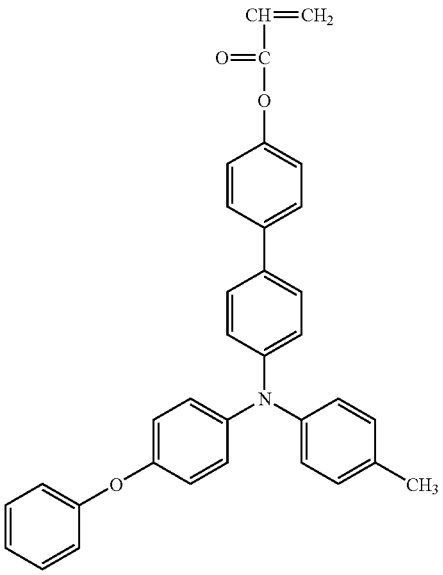
No. 72
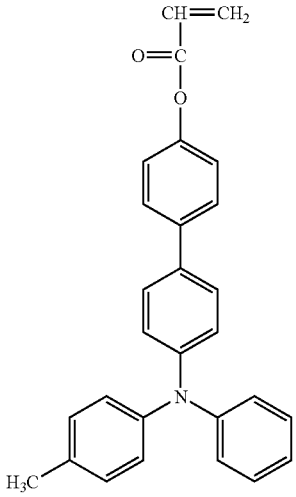
No. 73
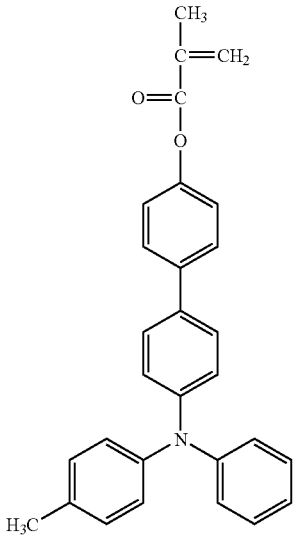
No. 74
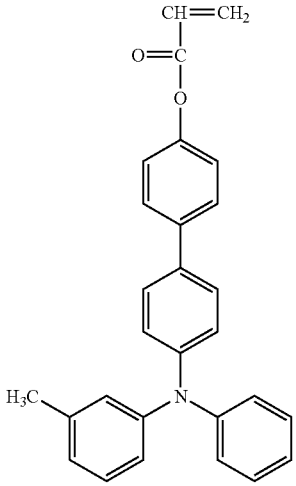

-continued
No. 75
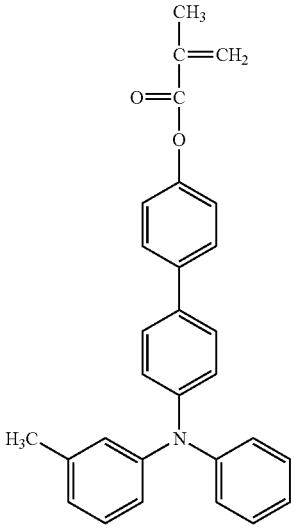
No. 76
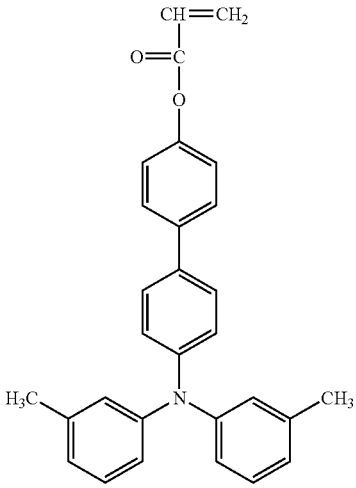
No. 77
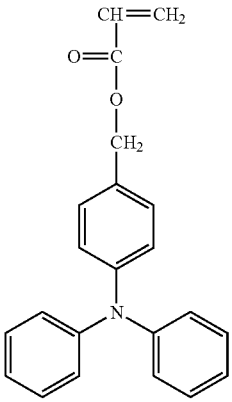
-continued
No. 78
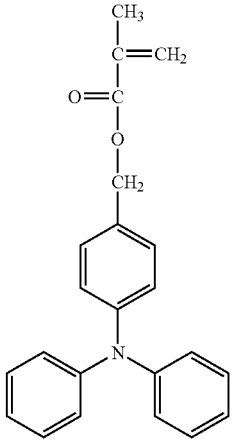
No. 79
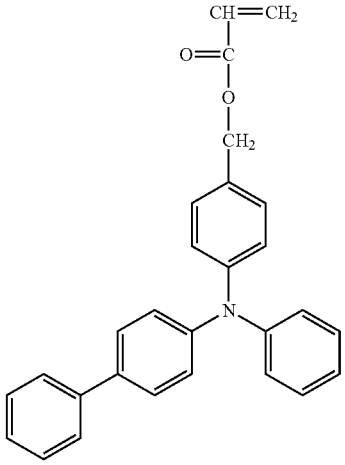
No. 80
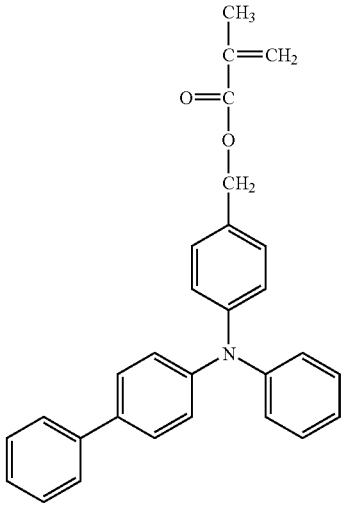

-continued
No. 81
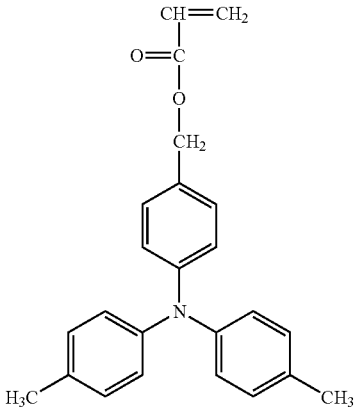
No. 82
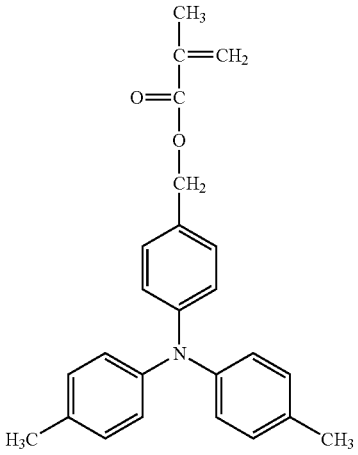
No. 83
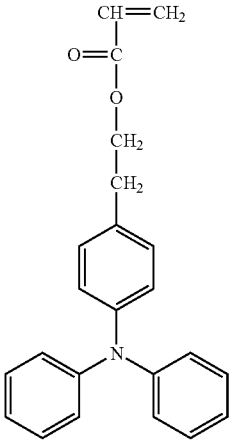
-continued
No. 84
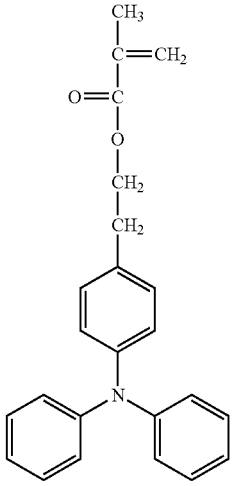
No. 85
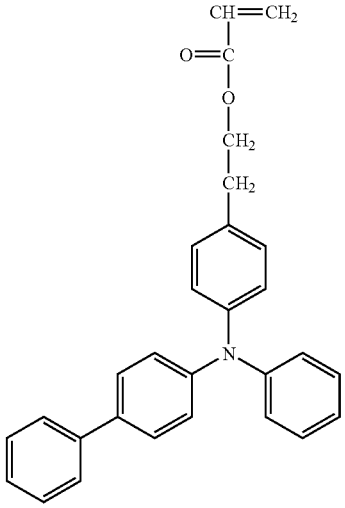
No. 86
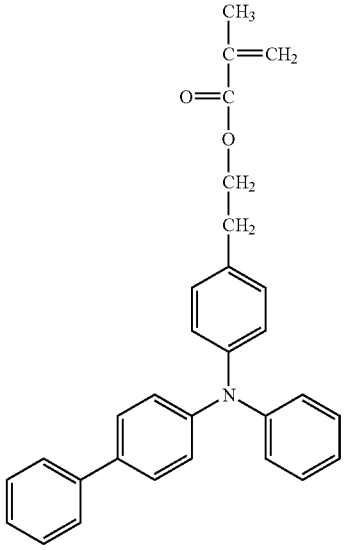

-continued
No. 87
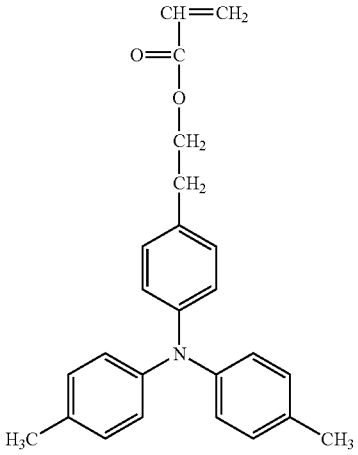
No. 88
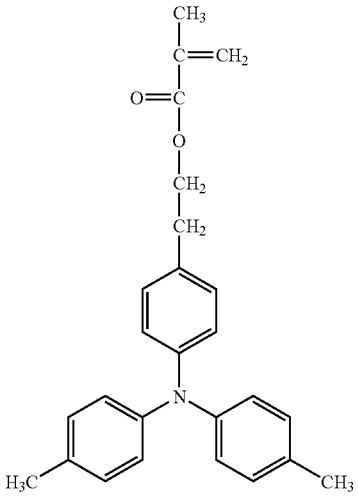
No. 89
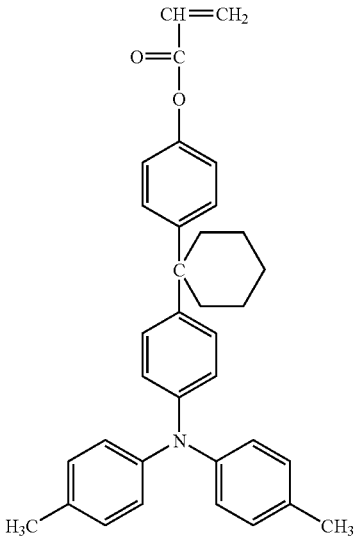
-continued
No. 90
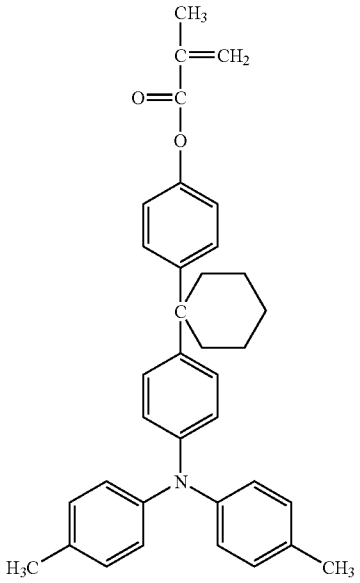
No. 91
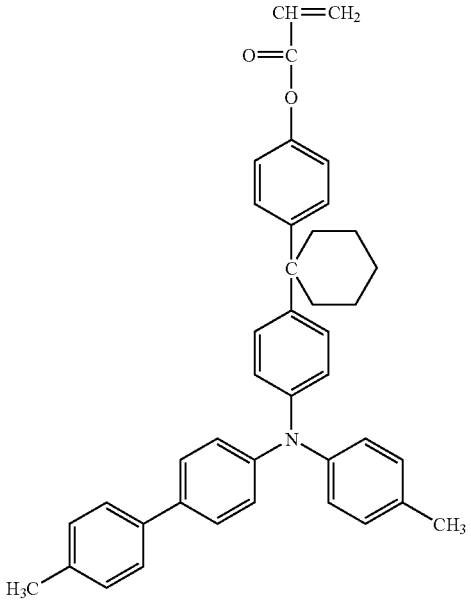

No. 92
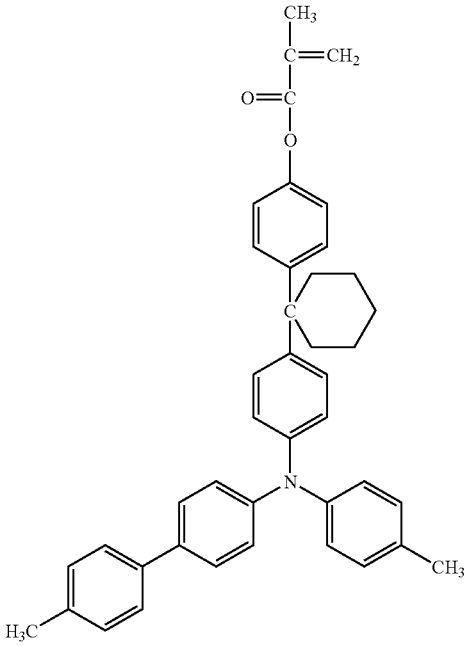
No. 93
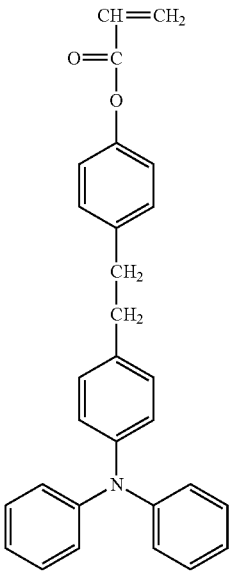
No. 94
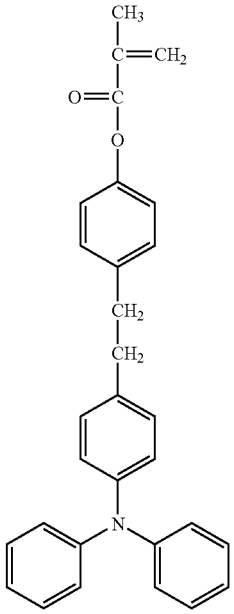
No. 95
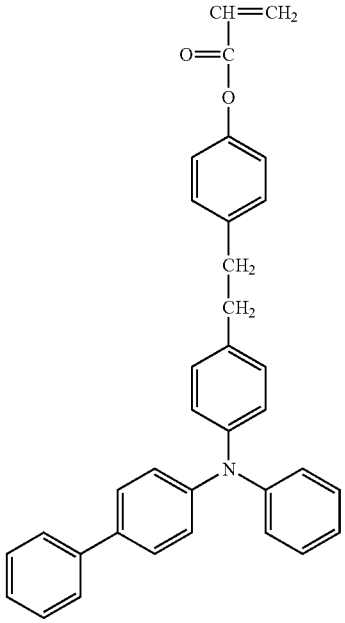

No. 96
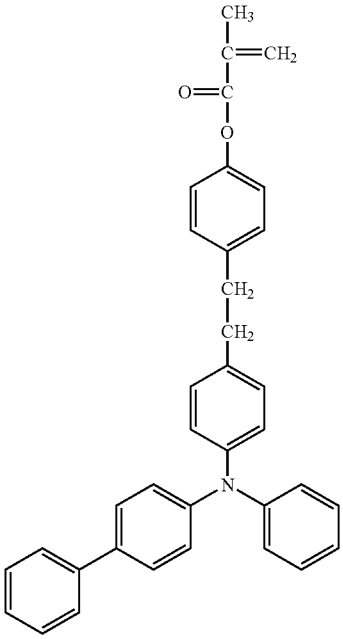
No. 97
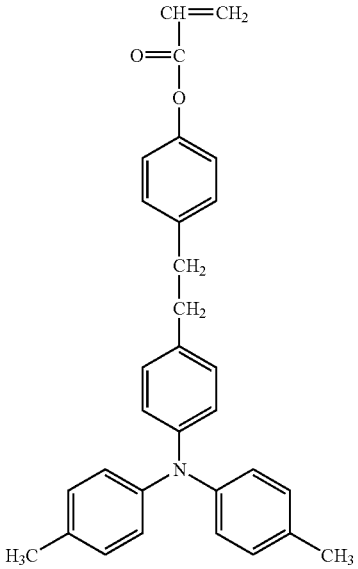
No. 98
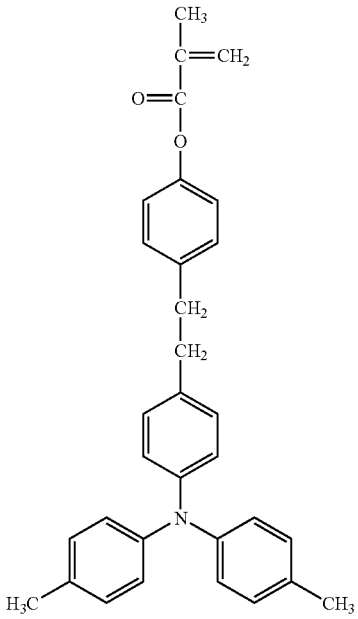
No. 99
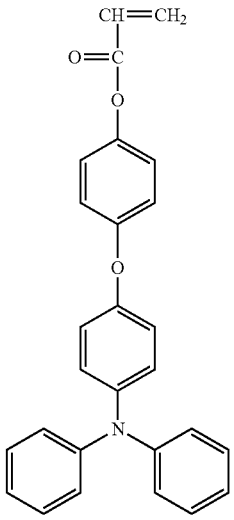

No. 100
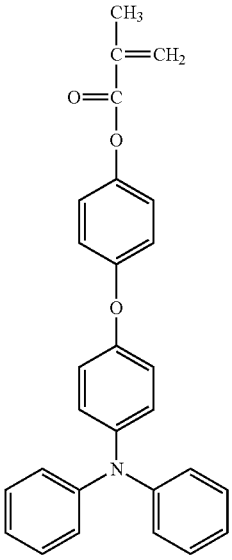
No. 101
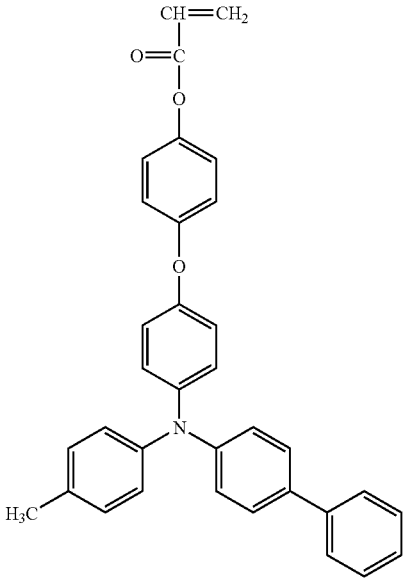
No. 102
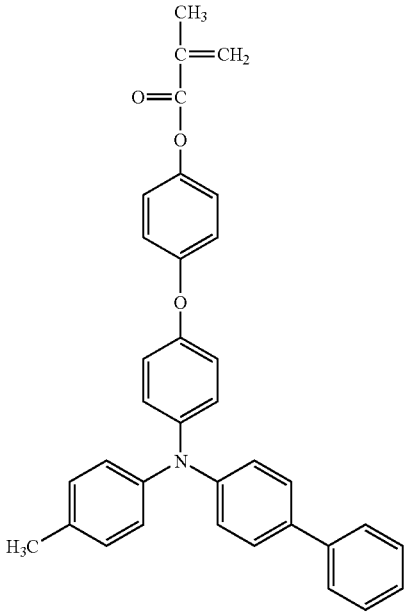
No. 103
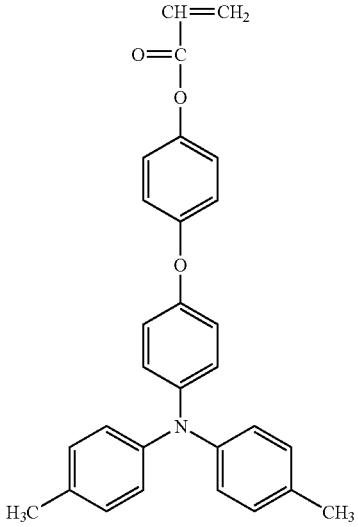

No. 104
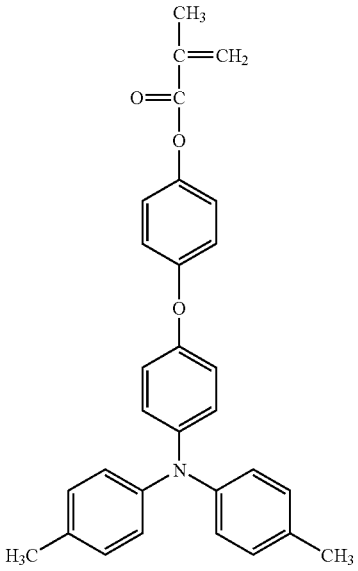
No. 105
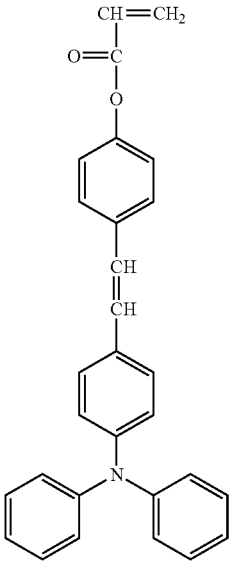
No. 106
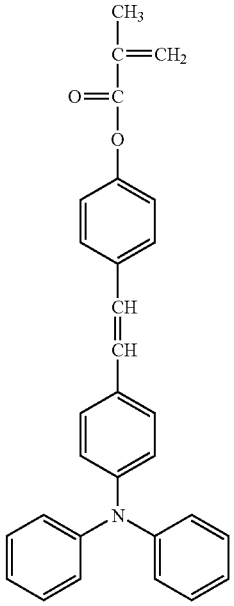
No. 107
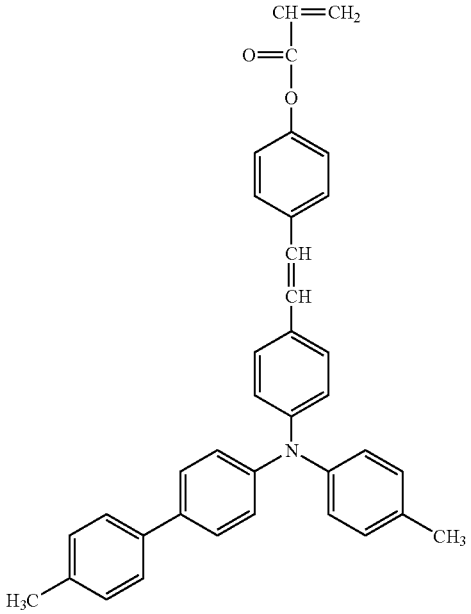

No. 108
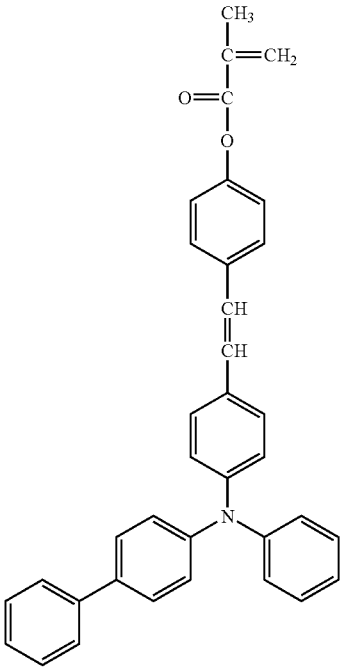
No. 109
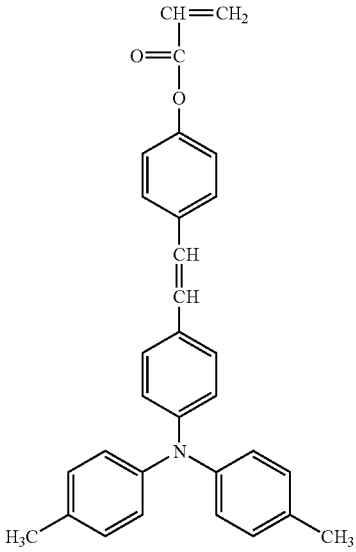
No. 110
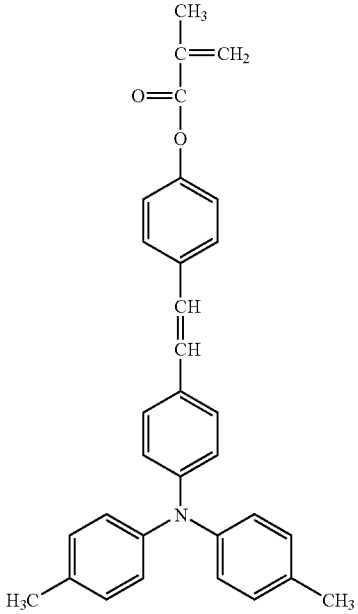
No. 111
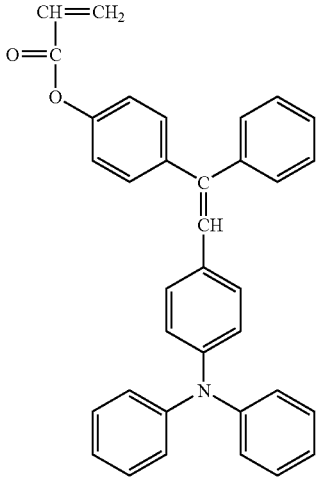
No. 112
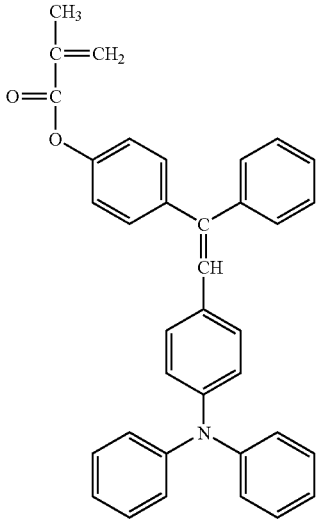

No. 113
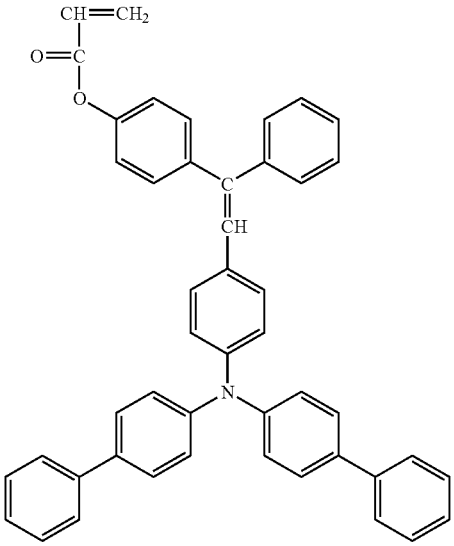
No. 114
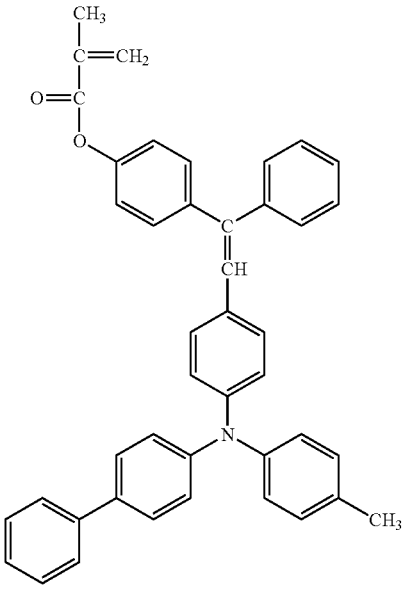
No. 115
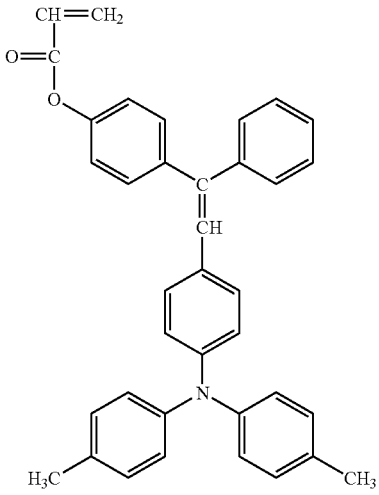
No. 116
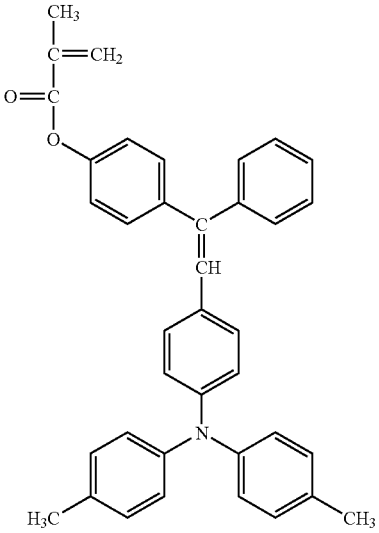
No. 117
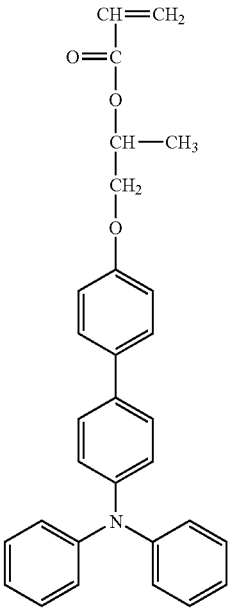

No. 118
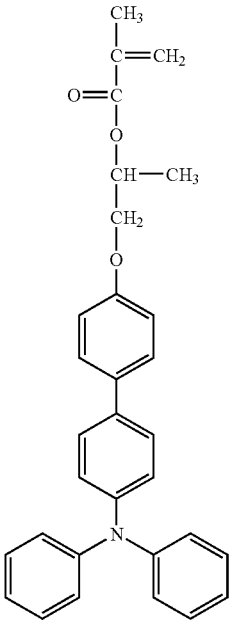
No. 119
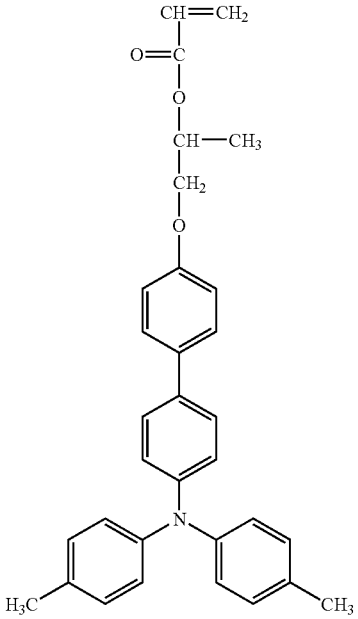
No. 120
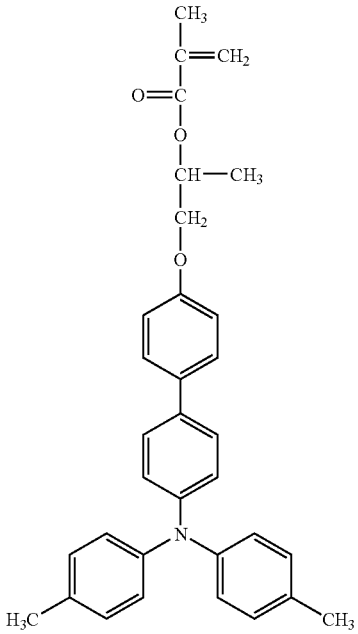
No. 121
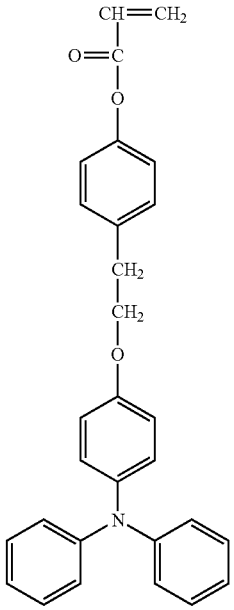

No. 122
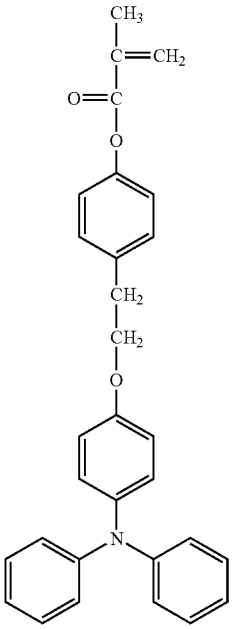
No. 123
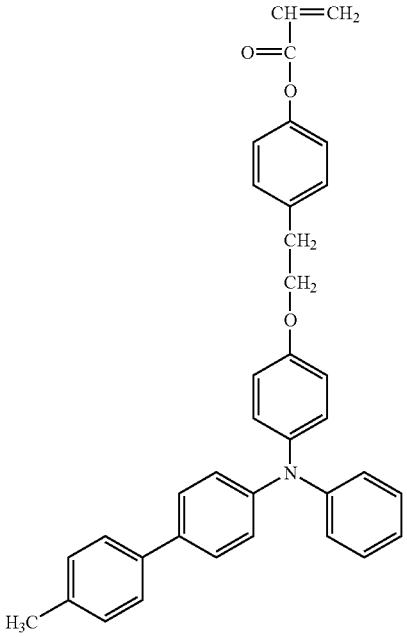
No. 124
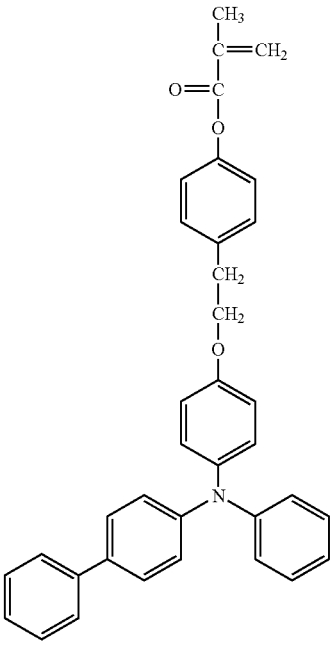
No. 125
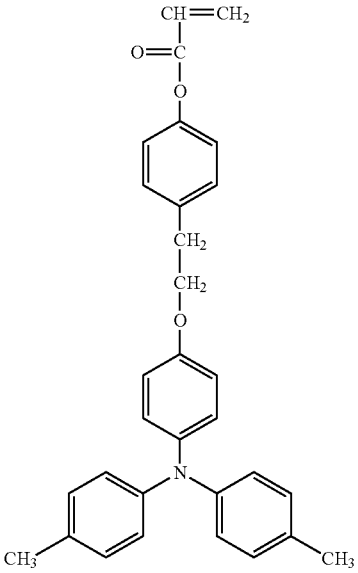

No. 126
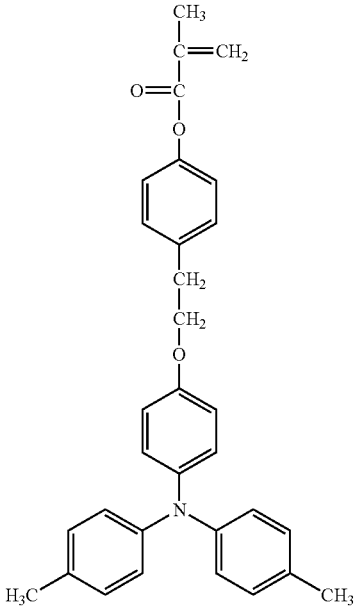
No. 127
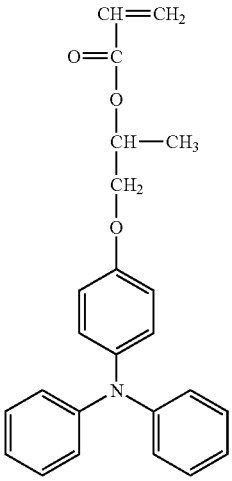
No. 128
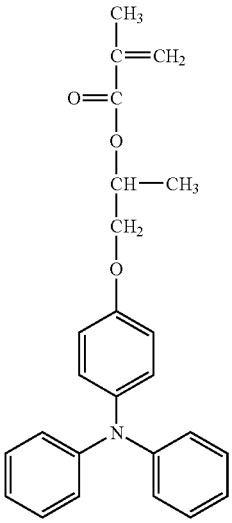
No. 129
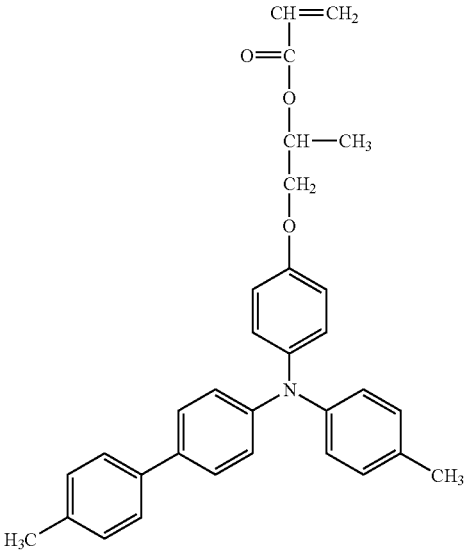
No. 130
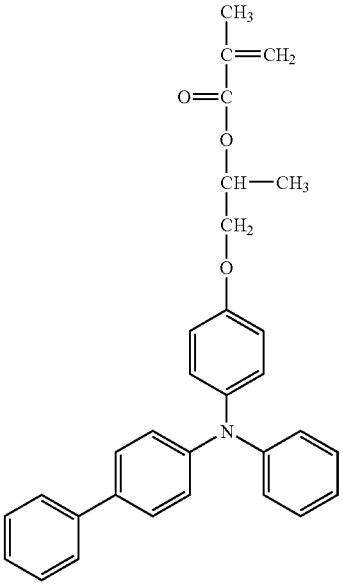
No. 131
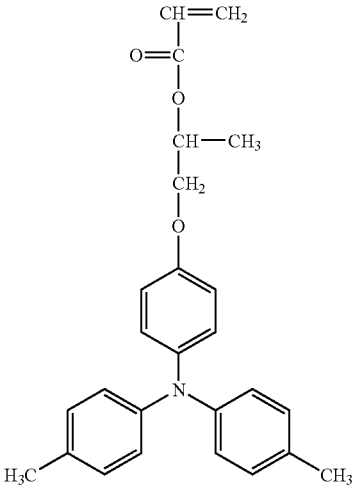

-continued
No. 132
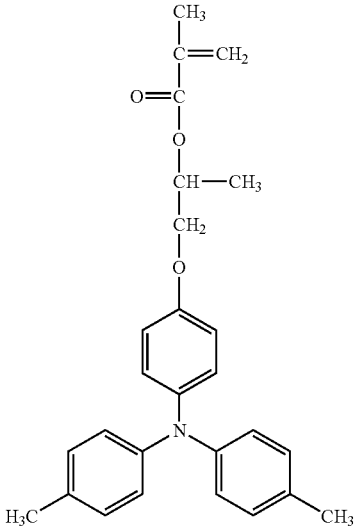
No. 133
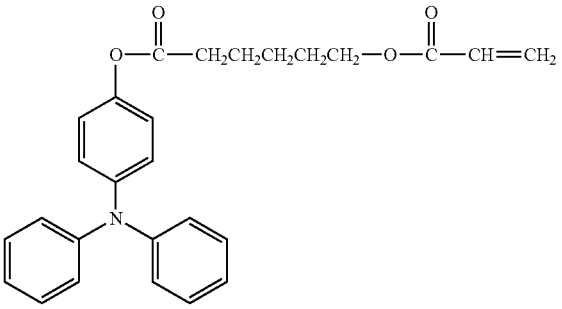
No. 134
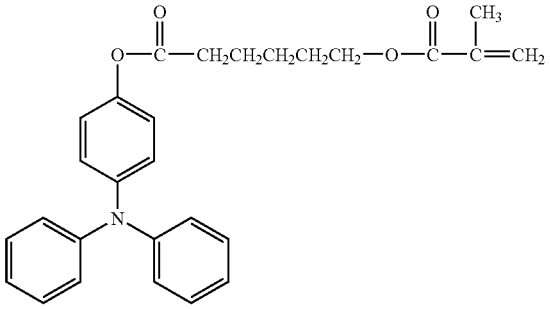
No. 135
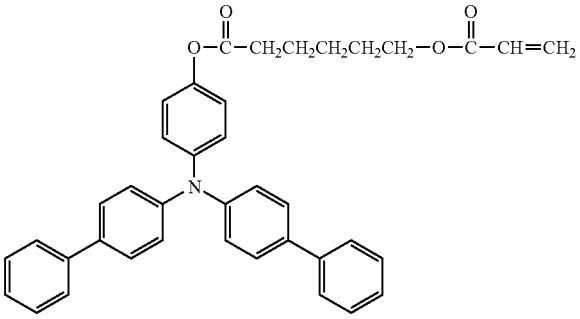
-continued
No. 136
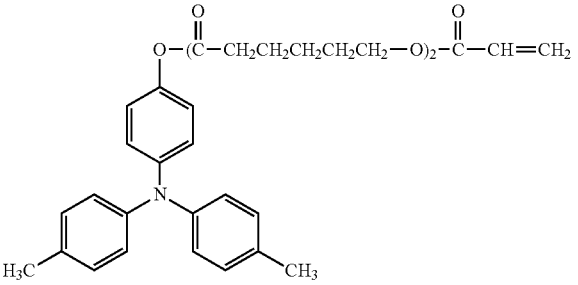
No. 137
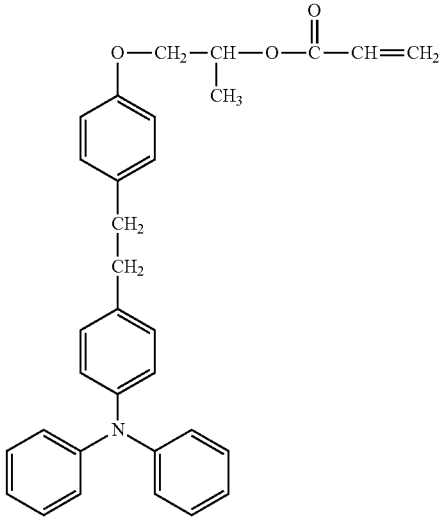
No. 138
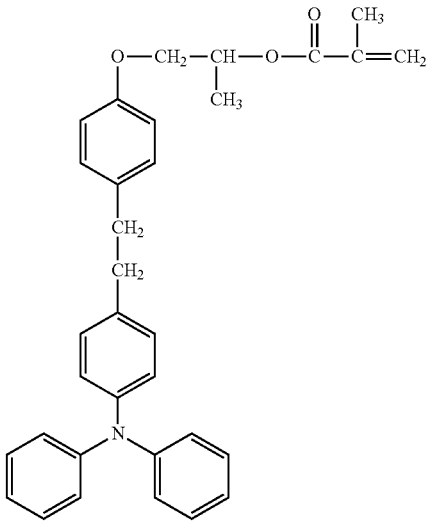

No. 139
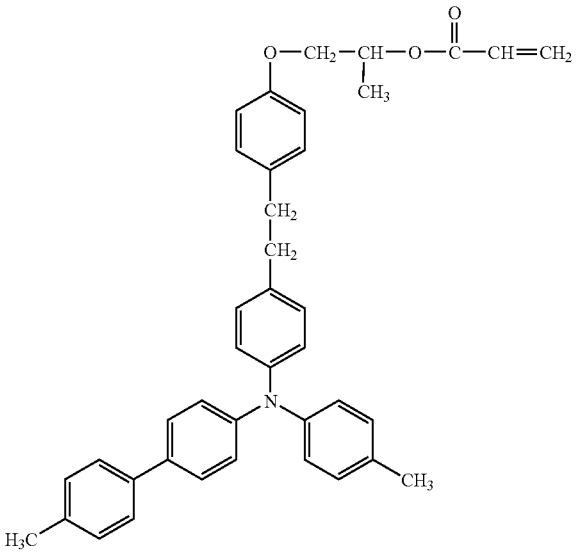
No. 140
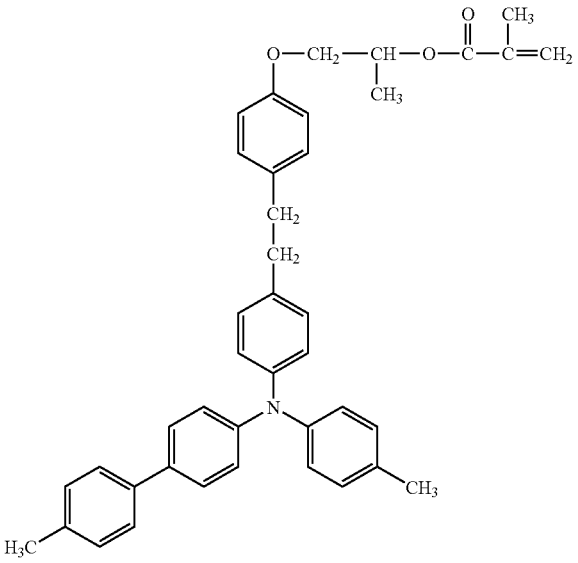
No. 141
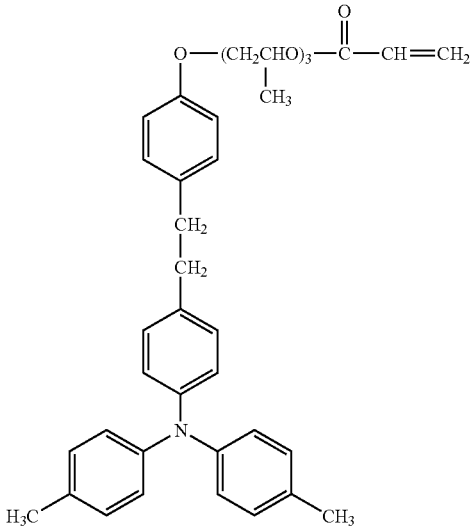
No. 142
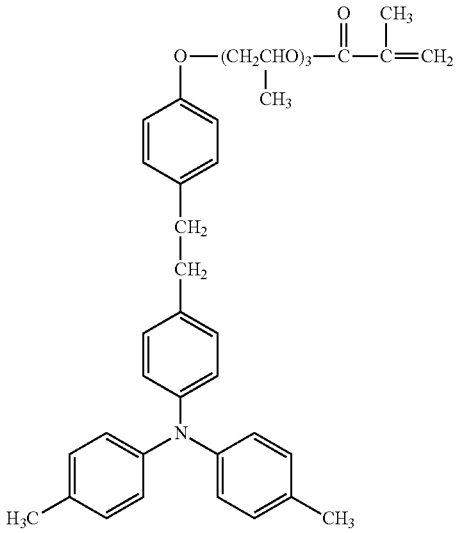
No. 143
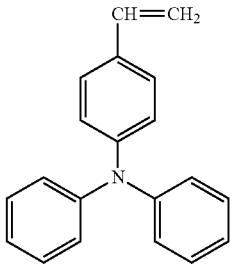
No. 144
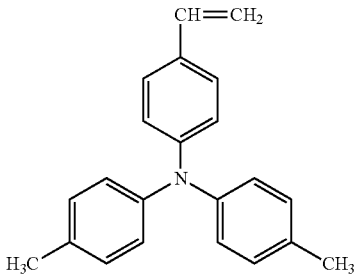

-continued
No. 145
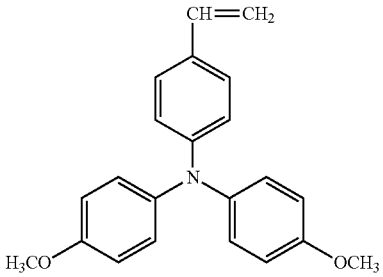
No. 146
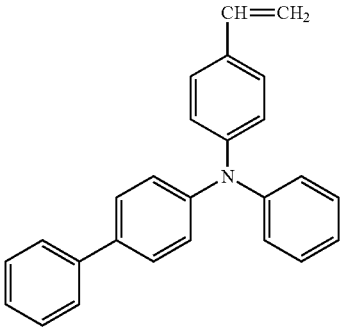
No. 147
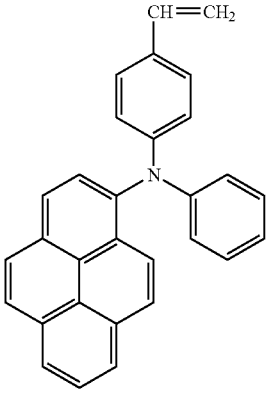
No. 148
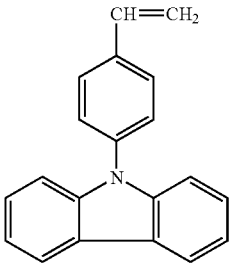
No. 149
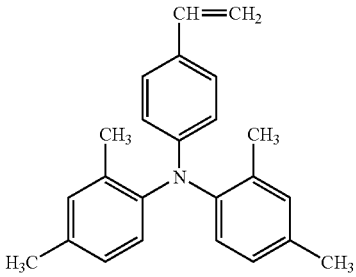
-continued
No. 150
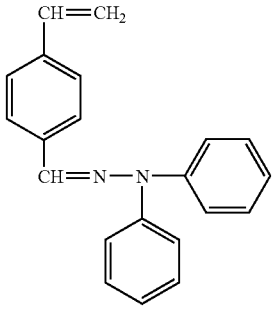
No. 151
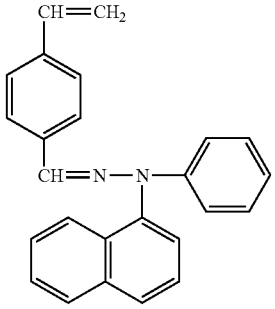
No. 152
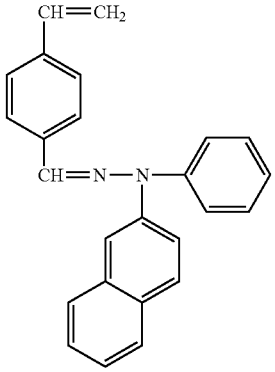
No. 153
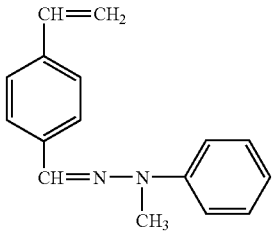
No. 154
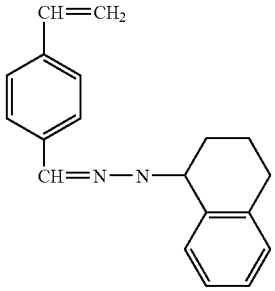

-continued
No. 155
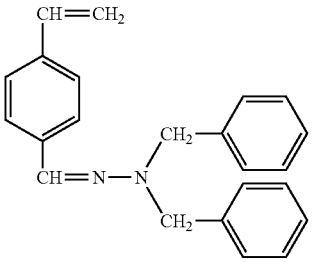
No. 156
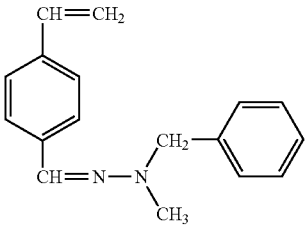
No. 157
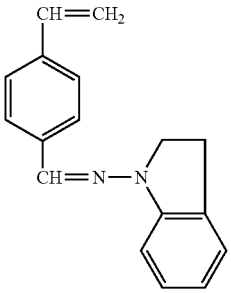
No. 158
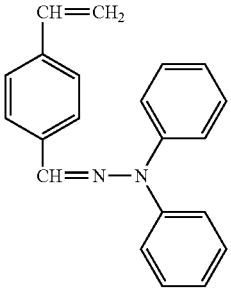
No. 159
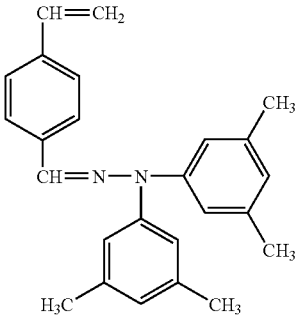
-continued
No. 160
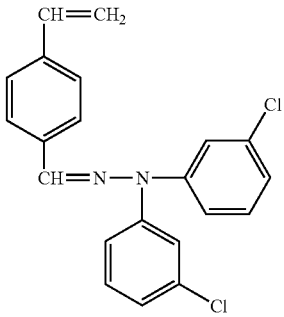
No. 161
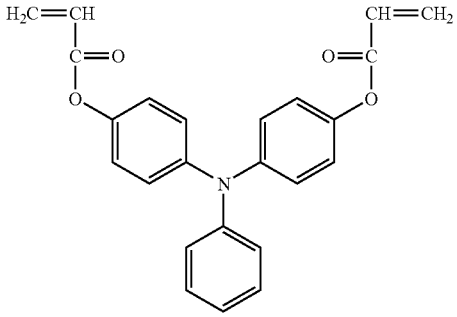
No. 162
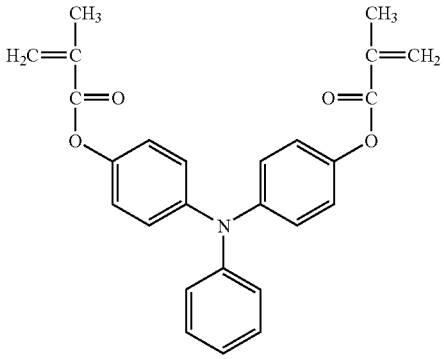
No. 163
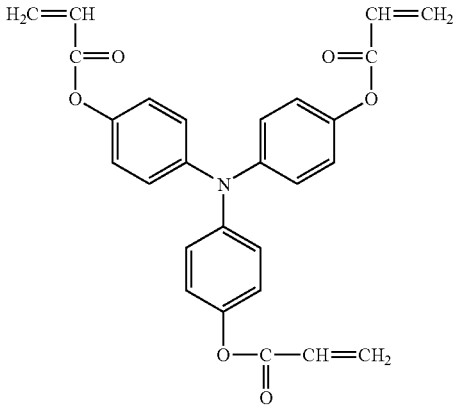

-continued
No. 164
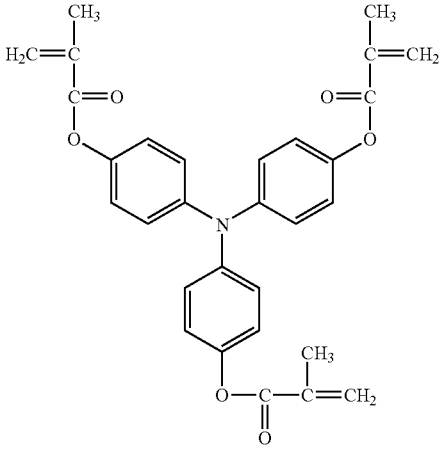
No. 165
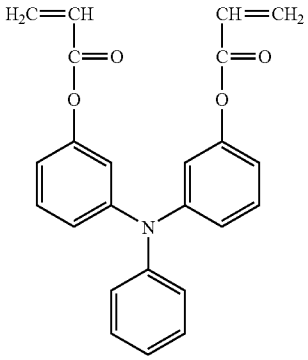
No. 166
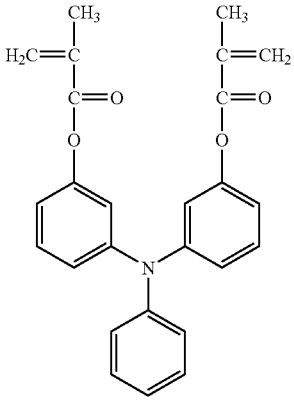
No. 167
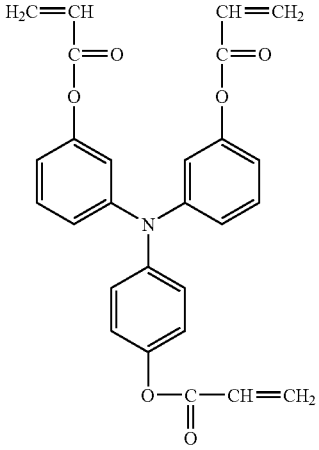
-continued
No. 168
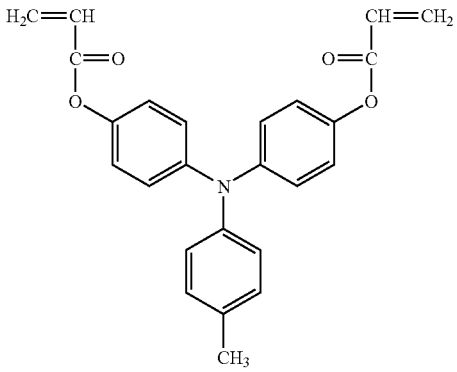
No. 169
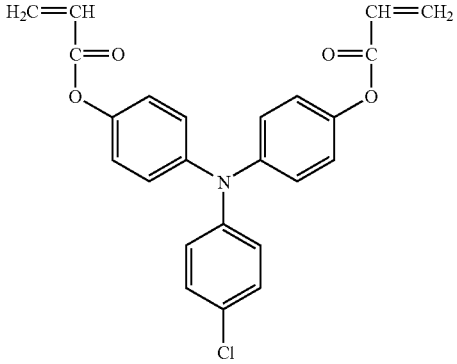
No. 170
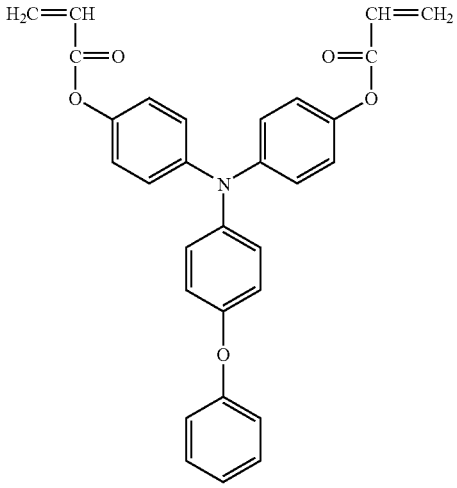

-continued
No. 171
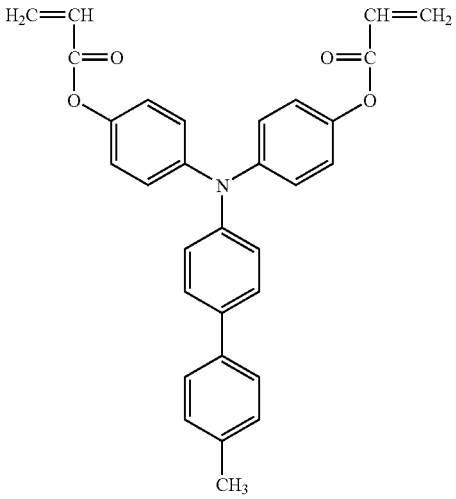
No. 172
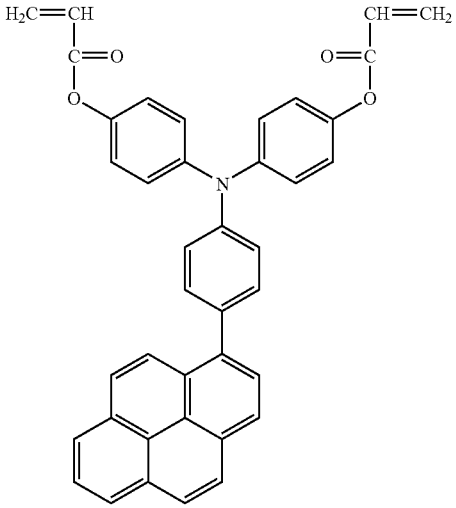
-continued
No. 173
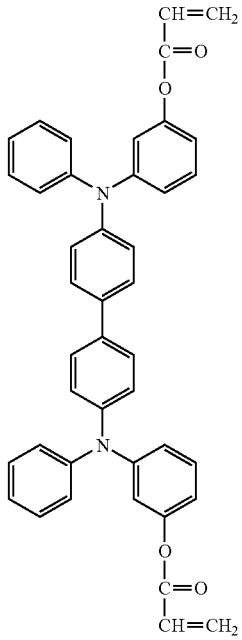
No. 174
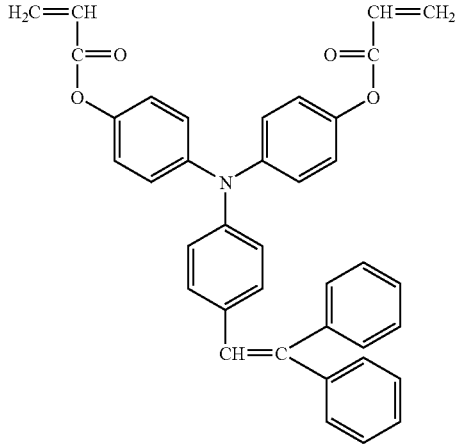
No. 175
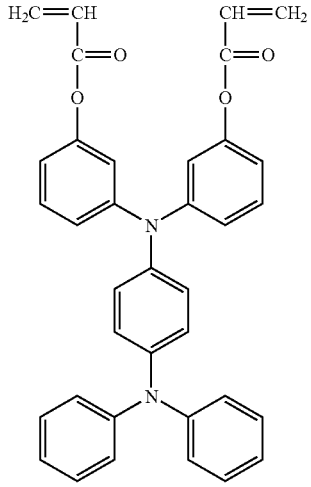

-continued
No. 176
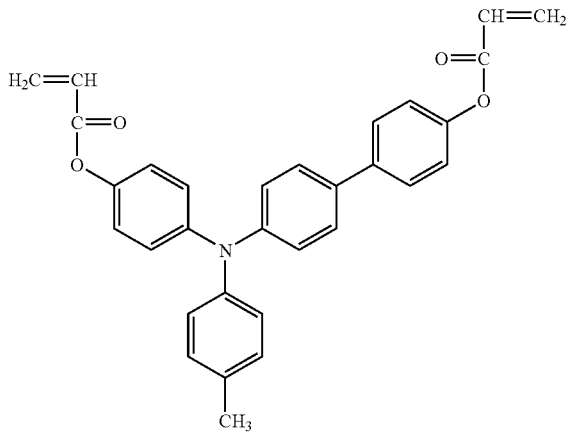
No. 177
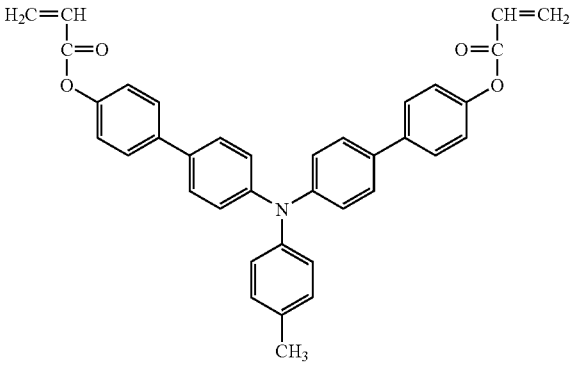
No. 178
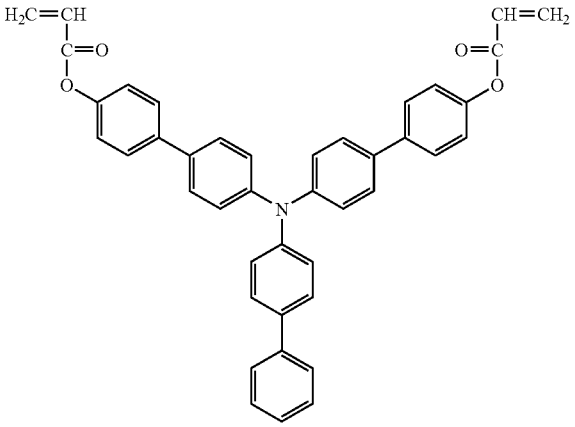
-continued
No. 179
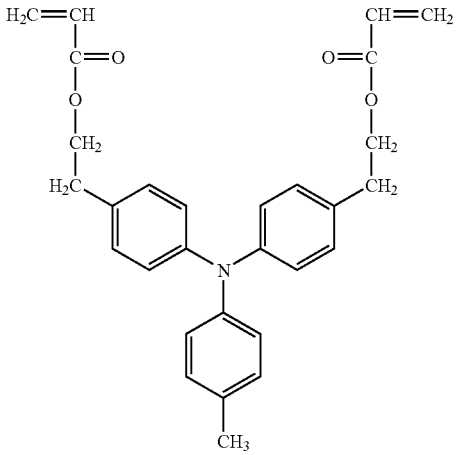
No. 180
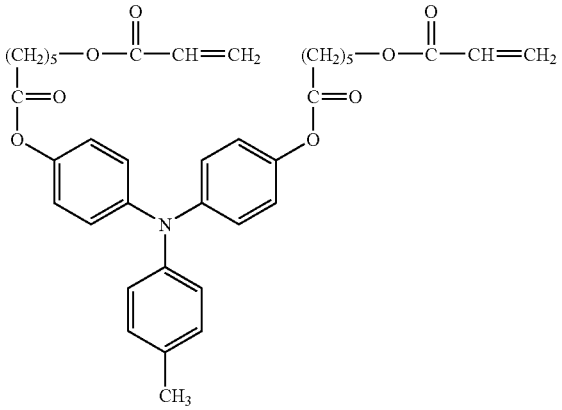
No. 181
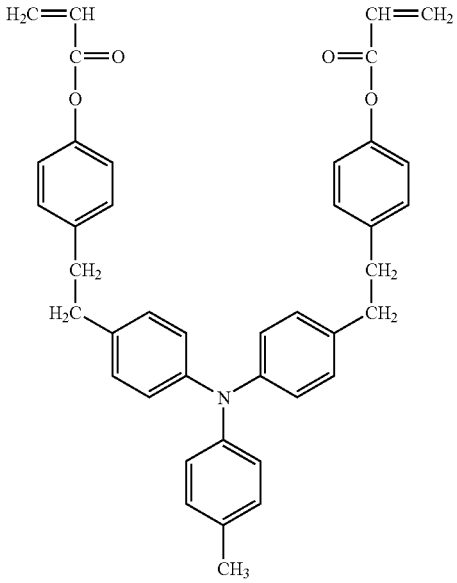

-continued
No. 182
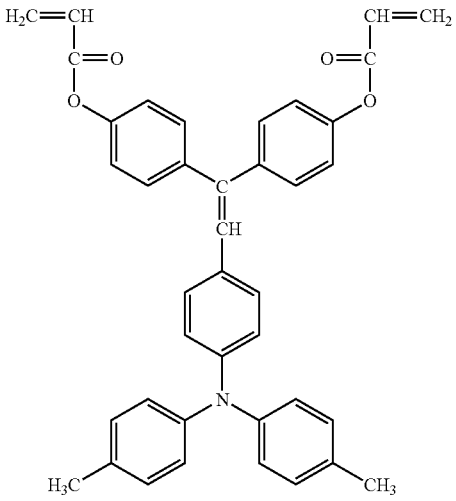
No. 183
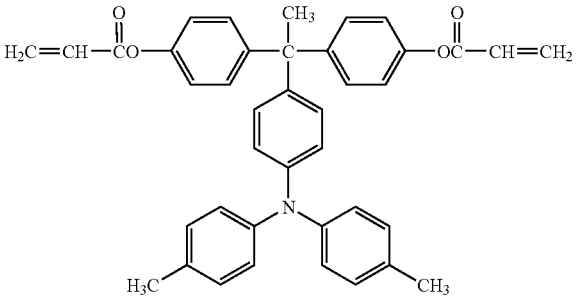
No. 184
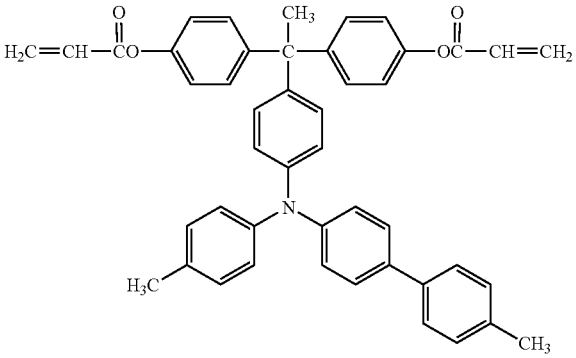
No. 185
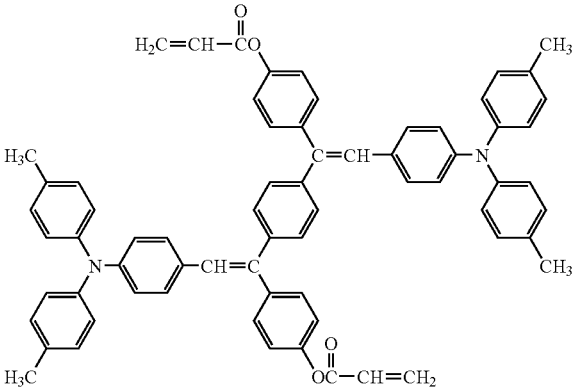
-continued
No. 186
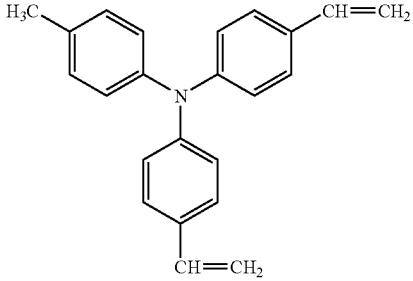
No. 187
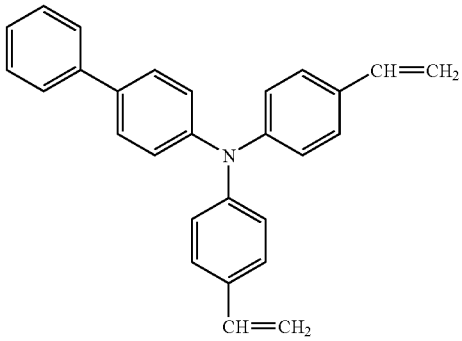
No. 188
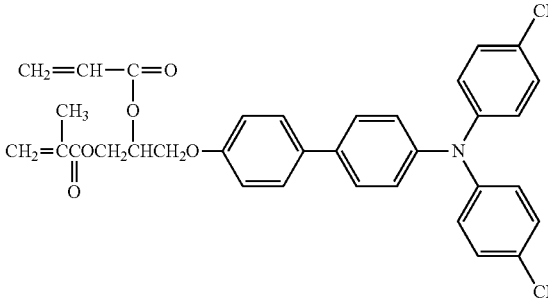
No. 189
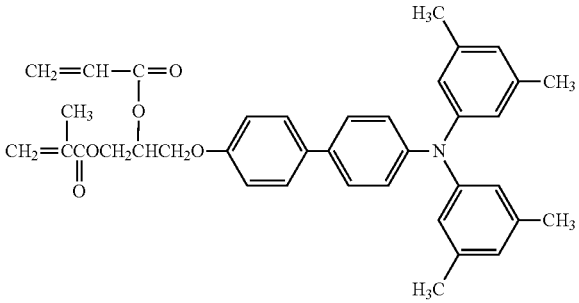
No. 190
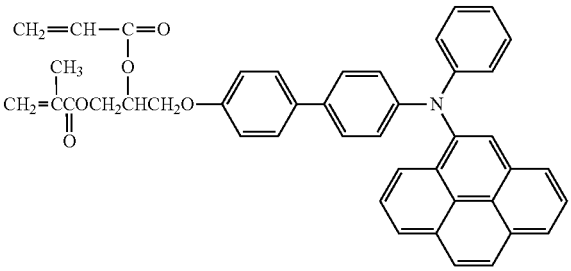

When the thickness of the crosslinked outermost layer is not less than 4 μm, addition of a charge transport material having a radically polymerizable functional group to the layer is preferable because a charge transport function can be imparted to the layer. The added amount of such a charge transport material in the outermost layer coating liquid is adjusted so that the content of the units formed by the charge transport material is from 20 to 80% by weight, and preferably from 30 to 70% by weight, based on the total weight of the crosslinked layer. When the added amount is too small, the resultant outermost layer has insufficient charge transportability, and thereby the electric properties of the photoreceptor deteriorate, resulting in occurrence of problems in that the photosensitivity of the photoreceptor deteriorates and the residual potential thereof increases. In contrast, when the added amount is too large, the content of the unit (A), (E) or (I) in the crosslinked layer decreases, and thereby good abrasion resistance cannot be imparted to the photoreceptor. The added amount cannot be unambiguously determined because the desired abrasion resistance and electric properties of the photoreceptor change depending on the image forming apparatus and processes, for which the photoreceptor is used, but is generally from 30 to 70% by weight based on the total weight of the crosslinked layer.

The outermost layer includes a crosslinked material having the unit (A), (E) or (I). In order to reduce the viscosity of the coating liquid, to relax the stress of the outermost layer, and to reduce the surface energy and friction coefficient of the layer, known radical polymerizable mono- or di-functional monomers and radically polymerizable oligomers can be used in combination with radically polymerizable monomers, oligomers or polymers having the unit (A), (E) or (I).

Specific examples of the radically polymerizable monofunctional monomers include 2-ethylhexyl acrylate, 2-hydroxyethyl acrylate, 2-hydroxypropyl acrylate, tetrahydrofurfuryl acrylate, 2-ethylhexylcarbitol acrylate, 3-methoxybutyl acrylate, benzyl acrylate, cyclohexyl acrylate, isoamyl acrylate, isobutyl acrylate, methoxytriethyleneglycol acrylate, phenoxytetraethyleneglycol acrylate, cetyl acrylate, isostearyl acrylate, stearyl acrylate, styrene, etc.

Specific examples of the radically polymerizable difunctional monomers include 1,3-butanediol diacrylate, 1,4-butanediol diacrylate, 1,4-butanediol dimethacrylate, 1,6-hexanediol diacrylate, 1,6-hexanediol dimethacrylate, diethylene glycol diacrylate, neopentylglycol diacrylate, binsphenol A-ethyleneoxide-modified diacrylate, bisphenol F-ethyleneoxide-modified diacrylate, neopentylglycol diacrylate, etc.

Specific examples of the mon- or di-functional monomers for use in imparting a function such as low surface energy and/or low friction coefficient to the layer include flurine-containing monomers such as octafluoropentyl acrylate, 2-perfluorooctylethyl acrylate, 2-perfluorooctylethyl methacrylate, and 2-perfluoroisononylethyl acrylate; and vinyl monomers, acrylates and methacrylates having a polysiloxane group such as siloxane units having a repeat number of from 20 to 70 which are described in JP-B 05-60503 and 06-45770 (e.g., acryloylpolydimethylsiloxaneethyl, methacryloylpolydimethylsiloxaneethyl, acryloylpolydimethylsiloxanepropyl, acryloylpolydimethylsiloxanebutyl, and diacryloylpolydimethylsiloxanediethyl).

Specific examples of the radically polymerizable oligomers include epoxyacryalte oligomers, urethane acrylate oligomers, polyester acrylate oligomers, etc.

The added amount of such mono- and di-functional monomers and oligomers is not greater than 30% by weight, and more preferably not greater than 20% by weight, based on the total weight of the crosslinkable materials included in the outermost layer coating liquid. When the added amount is too large, the crosslinking density decreases, and thereby the abrasion resistance of the resultant outermost layer deteriorates.

In addition, in order to efficiently crosslink the outermost layer, a polymerization initiator can be added to the outermost layer coating liquid. Suitable polymerization initiators include photo polymerization initiators and heat polymerization initiators. The polymerization initiators can be used alone or in combination.

Specific examples of the photopolymerization initiators include acetophenone or ketal type photopolymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl) ketone, 2-benzyl-2-dimethylamino-1-(4-morpholinophenyl) butanone-1,2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl) oxime; benzoin ether type photopolymerization initiators such as benzoin, benzoin methyl ether, benzoin ethyl ether, benzoin isobutyl ether, and benzoin isopropyl ether; benzophenone type photopolymerization initiators such as benzophenone, 4-hydroxybenzophenone, o-benzoylbenzoic acid methyl ester, 2-benzoyl naphthalene, 4-benzoyl biphenyl, 4-benzoyl phenyl ether, acryalted benzophenone, and 1,4-benzoyl benzene; thioxanthone type photopolymerization initiators such as 2-isopropylthioxanthone, 2-chlorothioxanthone, 2,4-dimethylthioxanthone, 2,4-diethylthioxanthone, and 2,4-dichlorothioxanthone; and other photopolymerization initiators such as ethylanthraquinone, 2,4,6-trimethylbenzoyldiphenylphosphineoxide, 2,4,6-trimethylbenzoylphenylethoxyphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds, imidazole compounds, etc.

Photopolymerization accelerators can be used alone or in combination with the above-mentioned photopolymerization initiators. Specific examples of the photopolynmerization accelerators include triethanolamine, methyldiethanolamine, ethyl 4-dimethylaminobenzoate, isoamyl 4-dimethylaminobenzoate, 2-dimethylaminoethyl benzoate, 4,4'-dimethylaminobenzophenone, etc.

Specific examples of the heat polymerization initiators include peroxide initiators such as 2,5-dimethylhexane-2,5-dihydroperoxide, dicumyl peroxide, benzoyl peroxide, t-butylcumyl peroxide, 2,5-dimethyl-2,5-di(peroxybenzoyl)hexyne-3, di-t-butylperoxide, t-butylhydroperoxide, cumenehydroperoxide, lauroyl peroxide, and 2,2-bis(4,4-di-t-butylperoxycyclohexy)propane; and azo type initiators such as azobisisobutyronitrile, azobiscyclohexanecarbonitrile, azobisbutyric acid methyl ester, hydrochloric acid salt of azobisisobutylamidine, and 4,4'-azobis-cyanovaleric acid.

The added amount of the polymerization initiators is preferably from 0.5 to 40 parts by weight, and more preferably from 1 to 20 parts by wewight, per 100 parts by weight of the total weight of the radically polymerizable monomers used.

In order to relax stress of the crosslinked outermost layer and to improve adhesion of the layer to the lower layer, the outermost layer coating liquid can include additives such as plasticizers, leveling agent, and low molecular weight charge transport materials having no radical polymerizability.

Specific examples of the plasticizers include known plasticizers for use in general resins, such as dibutyl phthalate, and dioctyl phthalate. The added amount of the plasticizers in the outermost layer coating liquid is preferably not greater than 20% by weight, and more preferably not greater than 10% by weight, based on the total solid components included in the coating liquid.

Specific examples of the leveling agents include silicone oils (such as dimethylsilicone oils,and methylphenylsilicone oils), and polymers and oligomers having a perfluoroalkyl group in their side chains. The added amount of the leveling agents is preferably not greater than 3% by weight based on the total solid components included in the coating liquid.

Addition of low molecular weight charge transport materials is effective for improving the charge transportability of the outermost layer and to reduce residual potential of the photoreceptor. However, when the added amount is increased, the content of the crosslinking materials decreases, resulting in deterioration of the abrasion resistance. Therefore, the added amount of such low molecular weight charge transport materials, which is determined depending on the process for which the photoreceptor is used, is not greater than 50% by weight, and preferably not greater than 30% by weight, based on the total weight of the materials constituting the outermost, layer.

Addition of a binder resin reduces the internal stress of the outermost layer and improves the uniformity of the layer, resulting in prevention of formation of cracks and scratches on the surface of the photoreceptor. However, when the added amount is increased, the content of the crosslinked materials decreases, resulting in deterioration of the abrasion resistance. Therefore, the added amount of such binder resins is generally not greater than 20% by weight, and preferably not greater than 10% by weight, based on the total weight of the materials constituting the outermost layer.

The crosslinked outermost layer is typically prepared by coating the photosensitive layer (mentioned below) with a coating liquid including a radically crosslinkable compound having a unit (A), (E) or (I) and then crosslinking the formed layer. When the compound is liquid, it may be possible to dissolve other components in the compound, resulting in preparation of the outermost layer coating liquid. The coating liquid can optionally include a solvent to well dissolve the other components and/or to reduce the viscosity of the coating liquid.

Specific examples of the solvents include alcohols such as methanol, ethanol, propanol, and butanol; ketones such as acetone, methyl ethyl ketone, methyl isobutyl ketone, and cyclohexanone; esters such as ethyl acetate, and butyl acetate; ethers such as tetrahydrofuran, dioxane, and propyl ether; halogenated solvents such as dichloromethane, dichloroethane, trichloroethane, and chlorobenzene; aromatic solvents such as benzene, toluene, and xylene; cellosolves such as methyl cellosolve, ethyl cellosolve and cellosolve acetate; etc. These solvents can be used alone or in combination.

The added amount of the solvents is determined depending on the solubility of the solid components, the coating method used, and the target thickness of the outermost layer. Coating methods such as dip coating methods, spray coating methods, bead coating methods, and ring coating methods can be used for forming the outermost layer.

After coating an outermost layer coating liquid, energy such as heat energy, photo energy and radiation energy is applied to the coated layer to crosslink the layer.

Specific examples of the light source for use in photocrosslinking the coated layer include ultraviolet light emitting devices such as high pressure mercury lamps and metal halide lamps. In addition, visible light emitting lamps can also be used if the radically polymerizable compounds and the photopolymerization initiators used can absorb the visible light. The illuminance is preferably from 50 to 1000 mW/cm$^2$. When the illuminance is too low, it takes a long time until the coated layer is crosslinked. In contrast, when the illuminance is too high, a problem in that the crosslinking reaction is unevenly performed, thereby forming wrinkles in the resultant outermost layer, or the layer includes non-reacted reaction groups therein is caused. In addition, a problem in that due to rapid crosslinking, the resultant outermost layer causes cracks or peeling occurs. The irradiation time is determined depending on the optical properties (such as permeability) of the materials used, and the thickness of the outermost layer, but is generally from 5 seconds to 5 minutes. When the irradiation time is too short, the layer is insufficiently crosslinked. In contrast, when the irradiation time is too long, the constitutional materials are decomposed, thereby deteriorating the electric properties of the resultant outermost layer. When the outermost layer is crosslinked, increase of the temperature of the layer is preferably not higher than 50° C. to prevent occurrence of problems in that the constitutional materials are decomposed and the layer is unevenly crosslinked.

When heat crosslinking is performed, the temperature at which the coated outermost layer is heated to be crosslinked is preferably from 100 to 170° C. and the crosslinking time is preferably from 10 minutes to 3 hours. When the crosslinking temperature is too low and/or the crosslinking time is too short, the formed layer is not sufficiently crosslinked. When the temperature is too high and/or the crosslinking time is too long, problems in that the constitutional materials are decomposed and the layer is unevenly crosslinked occur. Therefore, the desired outermost layer cannot be prepared.

Electron beams are typically used for radiation crosslinking. The accelerated voltage of electron beams is generally not greater than 300 KV, and preferably not greater than 150 KV. The dose of electron beams is preferably from 1 to 100 Mrad. When the accelerated voltage and/or the dose are too high, a problem in that the constitutional materials are decomposed occur, and therefore the effects of the present invention cannot be well produced.

The thickness of the outermost layer is determined depending on the properties of the lower layer, e.g., a non-crosslinked photosensitive layer. Therefore, the thickness of the outermost layer will be explained after the photosensitive layer is explained.

Next, the structure of the photosensitive layer will be explained.

Figure 1B:
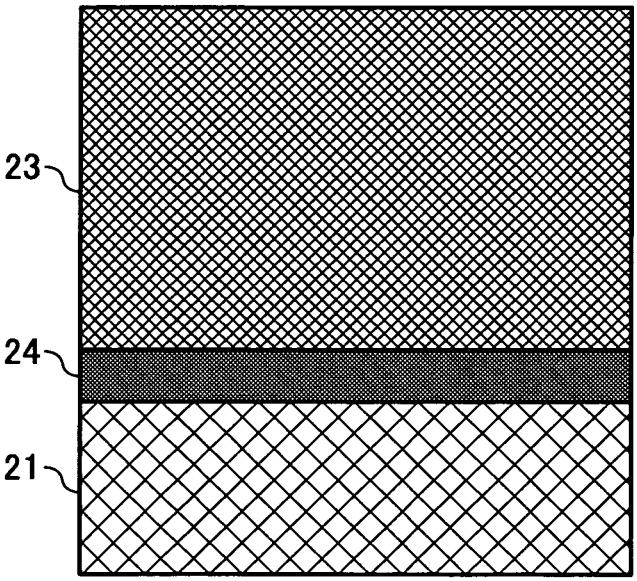
Figure 2:
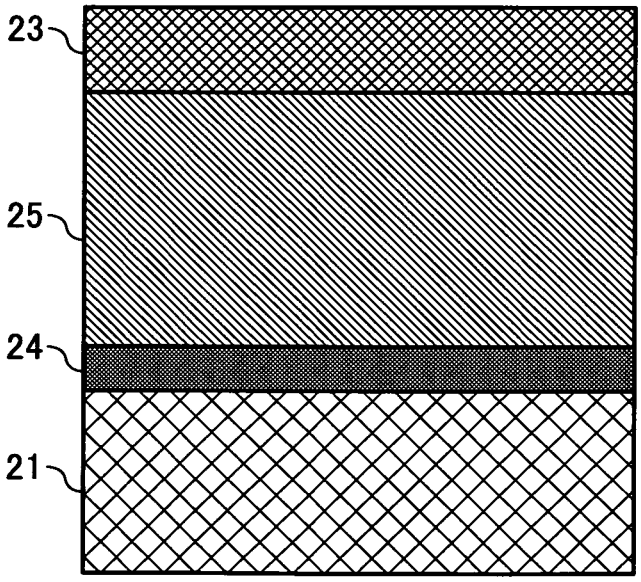
FIG. 2 is a schematic view illustrating the cross section of another example of the photoreceptor of the present invention, which has a multilayered photosensitive layer.

FIGS. 1 and 2 illustrate the cross sections of examples of the photoreceptor of the present invention.

FIG. 1A illustrates the cross section of an example having a single-layered photosensitive layer having both a charge generation function and a charge transport function. Specifically, the photoreceptor has an electroconductive substrate 21, a photosensitive layer 22 which is located on the electroconductive substrate 21 and has both a charge generation fiuction and a charge transport function, and an outermost layer 23 which is located on the photosensitive layer 22 and serves as a surface portion of the photosensitive layer. In this regard, the photosensitive layer 22 is not crosslinked, and the outermost layer 23 is crosslinked.

FIG. 1B illustrates the cross section of an example having a single-layered photosensitive layer having a charge generation function. Specifically, the photoreceptor has the electroconductive substrate 21, a charge generation layer 24 (hereinafter referred to as a CGL) which is located on the electroconductive substrate 21 and has a charge generation function, and the outermost layer 23 which is located on the CGL 24 and serves as a surface portion of the photosensitive layer and which has a charge transport function. In this regard, the CGL 24 and the outermost layer 23 constitute a photosensitive layer, and the outermost layer is crosslinked while the CGL 24 is not crosslinked.

FIG. 2 illustrates the cross section of another example of the photoreceptor, which has a multilayered photosensitive layer. Specifically, the photoreceptor has the electroconductive substrate 21, and the CGL 24, a charge transport layer 25 (hereinafter referred to as a CTL) having a charge transport function, and the outermost layer 23, which are overlaid on the electroconductive substrate 21 in this order. In this regard, the CGL 24, CTL 25 and outermost layer 23 constitute a photosensitive layer, and the outermost layer is a surface portion of the CTL. The outermost layer is crosslinked while the CGL 24 and CTL 25 are not crosslinked.

The structure of the photoreceptor of the present invention is not limited thereto. For example, an intermediate layer can be formed between the outermost layer and the photosensitive layer and an undercoat layer can be formed between the electroconductive substrate and the photosensitive layer.

Suitable materials for use as the electroconductive substrate 21 include materials having a volume resistivity not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is formed by deposition or sputtering. In addition, a plate of a metal such as aluminum, aluminum alloys, nickel and stainless steel can be used. A metal cylinder can also be used as the substrate 21, which is prepared by tubing a metal such as aluminum, aluminum alloys, nickel and stainless steel by a method such as impact ironing or direct ironing, and then treating the surface of the tube by cutting, super finishing, polishing and the like treatments. Further, endless belts of a metal such as nickel, stainless steel and the like (such as those disclosed in JP-A 52-36016) can also be used as the substrate 21.

Furthermore, substrates, in which a coating liquid including a binder resin and an electroconductive powder is applied on the supports mentioned above, can be used as the substrate 21. Specific examples of such an electroconductive powder include carbon black, acetylene black, powders of metals such as aluminum, nickel, iron, nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins.

Such an electroconductive layer can be formed by applying a coating liquid in which an electroconductive powder and a binder resin are dispersed or dissolved in a proper solvent such as tetrahydrofuran, dichloromethane, methyl ethyl ketone, toluene and the like solvent, and then drying the applied liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins (such as TEFLON), with an electroconductive material, can also be used as the substrate 21.

Next, the photosensitive layer will be explained. The photosensitive layer may be a single-layered photosensitive layer or a multilayered photosensitive layer. When the photosensitive layer has a multilayered structure, the photosensitive layer typically includes a CGL having a charge generation function and a CTL having a charge transport function. When the photosensitive layer has a single-layered structure, the photosensitive layer has a charge generation function or both a charge generation function and a charge transport function.

At first, the multilayered photosensitive layer will be explained.

The multilayered photosensitive layer typically includes a CGL which includes a charge generation material (hereinafter referred to as a CGM) having a charge generation function, and optionally includes a binder resin. CGMs are classified into inorganic CGMs and organic CGMs.

Specific examples of the inorganic CGMs include crystalline selenium, amorphous selenium, selenium-tellurium, selenium-tellurium-halogen, selenium-arsenic compound, amorphous silicon, etc. In addition, amorphous silicon in which a dangling bond is terminated with a hydrogen atom or a halogen atom or in which a boron atom, a phosphorous atom is doped can be preferably used.

Suitable organic CGMs include any known organic CGMs. Specific examples of such organic CGMs include phthalocyanine pigments such as metal phthalocyanine and metal-free phthalocyanine; azulenium salt type pigments; squaric acid methyne pigments; azo pigments having a carbazole skeleton; azo pigments having a triphenyl amine skeleton; azo pigments having a diphenyl amine skeleton; azo pigments having a dibenzothiophene skeleton; azo pigments having a fluorenone skeleton; azo pigments having an oxadiazole skeleton; azo pigments having a bisstilbene skeleton; azo pigments having a distyryloxadiazole skeleton; azo pigments having a distyrylcarbazole skeleton; perylene pigments; anthraquinone pigments, polycyclic quinone pigmients, quinone imine pigments, diphenylmethane pigments, triphenylmethane pigments, benzoquinone pigments, naphthoquinone pigments, cyanine pigments, azomethine pigments, indigoide pigments, bisbenzimidazole pigments, and the like organic pigments. These CGMs are used alone or in combination.

Suitable binder resins, which are optionally included in the CGL, include polyamide, polyurethane, epoxy resins, polyketone, polycarbonate, polyarylate, silicone resins, acrylic resins, polyvinyl butyral, polyvinyl formal, polyvinyl ketone, polystyrene, poly-N-vinylcarbazole, polyacrylamide, and the like resins. These resins can be used alone or in combination.

In addition, charge transport polymers having a charge transport function such as polycarbonates, polyesters, polyurethanes, polyethers, polysiloxanes, and acrylic resins, which have an arylamine skeleton, a benzidine skeleton, a hydrazone skeleton, a carbazole skeleton, a stilbene skeleton, and/or a pyrazoline skeleton, and polymers having a polysilane skeleton can also be used alone or in combination as the binder resin.

Specific examples of the charge transport polymers are described in JP-As 01-001728, 01-009964, 01-013061, 01-019049, 01-241559, 04-011627, 04-175337, 04-183719, 04-225014, 04-230767, 04-320420, 05-232727, 05-310904, 06-234836, 06-234837, 06-234838, 06-234839, 06-234840, 06-234841, 06-236050, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085, and 09-328539. Specific examples of the polysilylene polymers are described in JP-As. 63-285552, 05-19497, 05-70595 and 10-73944.

The CGL can include a low molecular weight charge transport material (the charge transport material is hereinafter referred to as a CTM).

Low molecular weight CTMs are broadly classified into electron transport materials and positive hole transport materials.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, diphenoxy derivatives, etc. These electron transport materials can be used alone or in combination.

Specific examples of the positive hole transport materials include electron donating materials such as oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, etc. These positive hole transport materials can be used alone or in combination.

Suitable methods for forming the CGL include vacuum thin film forming methods and casting methods.

Specific examples of such vacuum thin film forming methods include vacuum evaporation methods, glow discharge decomposition methods, ion plating methods, sputtering methods, reaction sputtering methods, CVD (chemical vapor deposition) methods, and the like methods. Layers of the above-mentioned inorganic and organic materials can be preferably formed by one of these methods.

The casting methods useful for forming the CGL include, for example, the following steps;

(1) preparing a coating liquid by mixing and dispersing one or more inorganic or organic charge generation materials mentioned above in a solvent such as tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, butyl acetate, etc., using a dispersion machine such as ball mills, attritors, sand mills, and bead mills;

(2) coating the surface of a substrate with the coating liquid, which is diluted if necessary, by a dip coating method, a spray coating method, a bead coating method, a ring coating method or the like method, wherein the coating liquid optionally includes a leveling agent such as dimethylsilicone oils, and methyl phenyl silicone oils; and (3) drying the coated liquid to form a CGL.

The thickness of the CGL is preferably from 0.01 to 5 μm, and more preferably from 0.05 to 2 μm.

Next, the CTL will be explained.

The CTL of the photoreceptor typically includes a CTM having a charge transport function and a binder resin. The CTL is typically prepared by coating the CGL with a coating liquid, which is prepared by dissolving or dispersing a CTM and a binder resin in a solvent, and then drying the formed liquid. Suitable CTMs for use in the CTL include electron transporting materials and positive hole transporting materials mentioned above for use in the CGL. Charge transport polymers can be preferably used for the CTL because the resultant CTL is hardly dissolved by an outermost layer coating liquid to be applied on the CTL.

Specific examples of the binder resin for use in the CTL include thermoplastic resins such as polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyarylate resins, phenoxy resins, polycarbonate resins, cellulose acetate resins, ethyl cellulose resins, polyvinyl butyral resins, polyvinyl formal resins, polyvinyl toluene resins, poly-N-vinylcarbazole resins, acrylic resins, silicone resins, epoxy resins, melamine resins, urethane resins, phenolic resins, alkyd resins and the like resins.

The added amount of a CTM is preferably from 20 to 300 parts by weight, and more preferably from 40 to 150 parts by weight, per 100 parts by weight of the binder resin included in the CTL. Charge transport polymers can be used alone or in combination with a binder resin.

Suitable solvents for use in the CTL coating liquid include the solvents mentioned above for use in the CGL coating liquid. Among these solvents, solvents which can well dissolve the binder resin and CTM to be included in the CTL are preferable. The solvents can be used alone or in combination.

When the CTL coating liquid is coated, one of the coating methods mentioned above for use in preparing the CGL can be used.

The CTL can optionally include one or more additives such as plasticizers and leveling agents.

Suitable plasticizers for use in the CTL include known plasticizers such as dibutyl phthalate, and dioctyl phthalate, which have been used as plasticizers for popular resins. The added amount of a plasticizer in the CTL is preferably from 0 to 30 parts by weight per 100 parts by weight of the binder resin included in the CTL.

Suitable leveling agents for use in the. CTL include silicone oils such as dimethylsilicone oils and methylphenylsilicone oils; and polymers and oligomers having a perfluoroalkyl group in a side chain thereof. The added amount of a leveling agent in the CTL is preferably from 0 to 1 part by weight per 100 parts by weight of the binder resin included in the CTL.

The thickness of the CTL is not particularly limited, and is preferably from 5 to 40 μm, and more preferably from 10 to 30 μm.

Next, the outermost layer will be explained.

The outermost layer is typically prepared by coating a photosensitive layer with a coating liquid including a radically polymerizable compound having the unit (A), (E) or (I), followed by radically crosslinking the formed layer using light, heat or radiation energy. When the photosensitive layer is a multilayered photosensitive layer, the outermost layer may be a layer including a CTM having a charge transport function, which can optionally include a radically polymerizable functional group, or a layer (i.e., a protective layer) including no CTM. When the outermost layer has a charge transport function, the layer preferably has a thickness of from 1 to 15 μm, and more preferably from 2 to 13 μm. When the outermost layer is too thick, problems in that cracks are formed in the resultant layer, and the layer is peeled from the photoreceptor occur.

When the outermost layer has no charge transport function and serves as a protective layer, the thickness of the protective layer is preferably from 1 to 5 μm, and more preferably from 2 to 4 μm because the protective layer can have a higher crosslinking density, and abrasion resistance than the layer including a charge generation material. When the thickness of the protective layer is from 2 to 4 μm, formation of cracks and peeling in the protective layer and deterioration of photosensitivity can be prevented. In contrast, when the protective layer is too thin, the layer has uneven thickness, thereby deteriorating the durability of the resultant photoreceptor.

Next, the single-layered photosensitive layer will be explained.

The single-layered photosensitive layer has both a charge generation function and a charge transport function, or only a charge generation function.

When the single-layered photosensitive layer has both a charge generation function and a charge transport function, the photosensitive layer is typically prepared by coating a substrate with a coating liquid, which is prepared by dissolving or dispersing a CGM, a CTM, and a binder resin in a solvent, and then drying the coated liquid. The coating liquid can optionally include additives such as plasticizers and leveling agents.

The materials mentioned above for use as the CGM, CTM, plasticizer and leveling agent in the CGL and CTL can be used for the single-layered photosensitive layer. In addition, the methods for dispersing CGMs mentioned above for use in preparing the CGL coating liquid can also be used for preparing a single-layered photosensitive layer coating liquid.

With respect to the binder resin, the resins mentioned above for use in the CTL can be used in combination with the resins mentioned above for use in the CGL. Further, the above-mentioned charge transport polymers can also be used for the single-layered photosensitive layer. In this case, a problem in that one or more components included in the photosensitive layer migrate into the outermost layer can be avoided.

The contents of the CGM, and binder resin in the single-layered photosensitive layer is from 1 to 30% by weight, from 10 to 70% by weight, and from 20 to 80% by weight, respectively, based on the total weight of the photosensitive layer.

The thickness of the single-layered photosensitive layer is generally from 5 to 30 μm, and preferably from 10 to 25 μm.

When the outermost layer serves as a surface portion of the single-layered photosensitive layer, the outermost layer is typically prepared by coating the photosensitive layer with a coating liquid including a radically polymerizable material and a CTM, followed by drying (optionally performed) and then crosslinking the formed layer using light, heat or radiation energy. When the photosensitive layer is a single-layered photosensitive layer, the outermost layer may be a layer including a CTM (with or without a radically polymerizable functional group) or a layer (i.e., a protective layer) including no CTM. When the layer has a charge transport function, the outermost layer preferably has a thickness of from 1 to 15 μm, and more preferably from 2 to 13 μm. When the outermost layer is too thick, problems in that cracks are formed in the resultant layer, and the layer is peeled from the photoreceptor occur.

When the outermost layer has no charge transport function and serves as a protective layer, the thickness of the protective layer is preferably from 1 to 5 μm, and more preferably from 2 to 4 μm because the protective layer can have a higher crosslinking density and abrasion resistance than the layer including a CGM. When the protective layer is too thick, problems in that cracks are formed in the resultant layer, and the layer is peeled from the photoreceptor occur. In contrast, when the protective layer is too thin, the layer has uneven thickness, thereby deteriorating the durability of the resultant photoreceptor.

When the photosensitive layer is a CGL having only a charge generation function, the materials mentioned above for use in the CGL of the multilayered photosensitive layer can be used therefor. In this case, the outermost layer formed on the CGL has to have a charge transport function and therefore includes a CTM with or without a radically polymerizable functional group. However, CTMs having a radically polymerizable functional group are preferably used to enhance the abrasion resistance of the photoreceptor. The outermost layer having a charge transport function is typically prepared by applying a coating liquid including a radically crosslinkable compound and a CTM on the CGL, followed by drying (optionally performed) and crosslinking the coated layer using light, heat or radiation energy. In this case, the thickness of the outermost layer is from 10 to 30 μm, and preferably from 10 to 25 μm. When the outermost layer is too thin, a desired potential cannot be formed on the resultant photoreceptor in the charging process. When the outermost layer is too thick, a peeling problem in that the layer is peeled from the lower layer due to volume contraction in the crosslinking process.

The photoreceptor of the present invention can have an intermediate layer between the outermost layer and the photosensitive layer to prevent occurrence of a problem in that one or more materials constituting the photosensitive layer migrate into the outermost layer, resulting in hindrance of the crosslinking reaction or formation of an outermost layer with rough surface, and/or to improve adhesion of the outermost layer to the photosensitive layer.

Such an intermediate layer includes a binder resin as a main component. Specific examples of the materials for use as the binder resin include polyamides, alcohol-soluble nylons, water-soluble polyvinyl butyrals, polyvinyl butyrals, and polyvinyl alcohols. The intermediate layer is typically formed by a coating method. The thickness of the intermediate layer is from 0.05 to 2 μm.

The photoreceptor of the present invention can have an undercoat layer between the photosensitive layer and the electroconductive substrate. Such an undercoat layer includes a binder resin as a main component. Since a photosensitive layer coating liquid including an organic solvent is coated thereon, the resins included in the undercoat layer preferably have a good resistance to organic solvents. Specific examples of the resins include water-soluble resins such as polyvinyl alcohols, casein, and polyacrylic acid sodium salts; alcohol-soluble resins such as nylon copolymers and methoxymethylated nylons; crosslinked resins having a three dimensional network such as polyurethanes, melamine resins, phenolic resins, alkyd-melamine resins, and epoxy resins; etc. The undercoat layer may include a fine powder of metal oxides such as titanium oxide, silica, alumina, zirconium oxide, tin oxide and indium-oxide to prevent occurrence of moiré in the recorded images and to decrease residual potential of the photoreceptor.

The undercoat layer can be formed by applying a coating liquid using a proper solvent and a proper coating method mentioned above for use in preparing the photosensitive layer.

The undercoat layer may be formed using a silane coupling agent, titanium coupling agent or a chromium coupling agent.

In addition, a layer of aluminum oxide which is formed by an anodic oxidation method and a layer of an organic compound such as polyparaxylylene or an inorganic compound such as SiO, SnO2, TiO2, indium tin oxide (ITO) or CeO2 which is formed by a vacuum evaporation method is also preferably used as the undercoat layer.

The thickness of the undercoat layer is preferably 0 to 5 μm.

In order to impart high stability to withstand environmental conditions to the resultant photoreceptor (particularly, to prevent deterioration of photosensitivity and increase of residual potential under high temperature and high humidity conditions), an antioxidant can be included in the above-mentioned layers (i.e., the outermost layer, CTL, CGL, intermediate layer and undercoat layer).

Specific examples of the antioxidants for use in the layers include the following.

Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, etc.

Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, etc.

Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, etc.

Sulfur Containing Organic Compounds

Dilauryl-3,3'-thiodipropionate, distearyl-3,3'-thiodipropionate, dimyristyl-3,3'-thiodipropionate, ditetradecyl-3,3'-thiodipropionate, pentaerythritoltetrakis(3-laurylthio-propionate), etc.

Phosphorus-Containing Compounds

Triphenyl phosphite, tris(nonylphenyl) phosphite, tri(dinonylphenyl) phosphite, tris(2-ethylhexyl) phosphite, tridecyl phosphite, tris(tridecyl) phosphite, diphenylmono(2-ethylhexyl) phosphite, diphenylmonodecyl phosphite, tris(2,4-di-t-butylphenyl) phosphite, distearylpentaerythritol diphosphite, bis(2,4-dit-butylphenyl)pentaerythritol phosphite, 2,2-methylenebis(4,6-di-t-butylphenyl)octyl phosphite, tetrakis(2,4-dit-butylphenyl)-4,4'-biphenylenediphosphonite, dilaurylhydrogen phosphite, diphenylhydrogen phosphite, tetraphenyldipropyleneglycol diphosphite, tetraphenyltetra(tridecyl)pentaerythritol tetraphosphite, tetra(tridecyl)-4,4'-isoprpylidenediphenyl diphosphite, bis(nonylphenyl)pentaerythritol diphosphite, hydrogenated bisphenol A-pentaerythritol phosphite polymers, etc.

Since these compounds are used as antioxidants for rubbers, plastics and oils and fats, the compounds are easily available. The content of an antioxidant in the layers is from 0.01 to 10% by weight based on the total weight of the layer.

Next, the image forming method and apparatus of the present invention will be explained by reference to drawings.

FIG. 1 is a schematic view illustrating the image forming section of an embodiment of the image forming apparatus of the present invention. The image forming apparatus includes the photoreceptor including the crosslinked outermost layer having a smooth surface. The image forming method and apparatus perform at least a charging process in which the photoreceptor is charged; a light irradiating process in which imagewise light irradiates the charged photoreceptor to form an electrostatic image thereon; a developing process in which the electrostatic image is developed with a developer including a toner to prepare a toner image on the photoreceptor; a transfer process in which the toner image is transferred to a receiving material; a fixing process in which the toner image is fixed to the receiving material; and a cleaning process in which the surface of the photoreceptor is cleaned. The image forming apparatus of the present invention is not limited thereto, and, for example, the modified embodiments mentioned below are also included therein.

Figure 3:
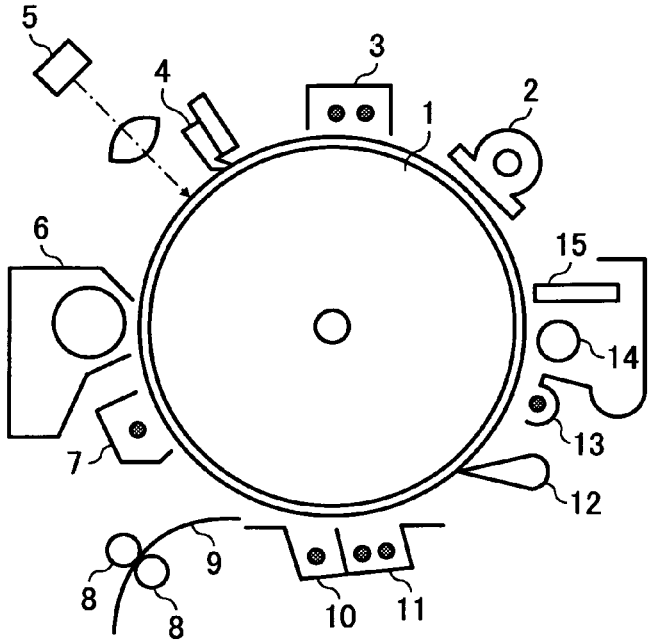
FIG. 3 is a schematic view illustrating an example of the image forming apparatus of the present invention.

In FIG. 3, a photoreceptor 1 is the photoreceptor of the present invention.

Around the photoreceptor 1, a charger 3 (a charging roller) configured to charge the photoreceptor 1 which rotates in a direction indicated by an arrow; an eraser 4 configured to erase an undesired image; a light irradiator 5 configured to irradiate the photoreceptor 1 with imagewise light to form an electrostatic latent image thereon; a developing device 6 configured to develop the latent image with a developer including a toner to form a toner image on the photoreceptor 1; a transfer device including a transfer charger 10 and configured to transfer the toner image onto a receiving material 9; a cleaner including a fur brush 14 and a blade 15 and configured to clean the surface of the photoreceptor 1; and a discharger 2 configured to discharge the charge remaining on the photoreceptor 1, are arranged. Numerals 7, 8, 11, 12 and 13 respectively denote a pre-transfer charger configured to charge the photoreceptor and toner image before transferring the toner image, a pair of registration rollers configured to perform registration of the receiving material; a separation charger configured to separate the receiving material 9 from the photoreceptor 1; a separation pick configured to separate the receiving material 9 from the photoreceptor 1; and a pre-cleaning charger configured to charge the photoreceptor and residual toner particles thereon to well clean the surface of the photoreceptor.

The photoreceptor has a drum form, however, sheet-form or endless-belt-form photoreceptors can also be used in the present invention.

Suitable chargers for use as the charger 3 include known chargers capable of uniformly charging the photoreceptor, such as corotrons, scorotrons, solid state dischargers, needle electrodes, charging rollers, electroconductive brushes, etc.

Suitable light sources for use in the light irradiator 5 include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wave length range, filters such as sharp-cut filters, band pass filters, near-infrared cutting filters, dichroic filters, interference filters, color temperature converting filters and the like can be used.

The developing device 6 develops the electrostatic latent image formed on the photoreceptor 1 with a developer including a toner. Suitable developing methods include dry developing methods (such as one component developing methods using a toner as the developer and two component developing methods using a developer including a carrier and a toner), and wet developing methods.

When the photoreceptor 1 which is previously charged positively (or negatively) is exposed to imagewise light, an electrostatic latent image having a positive or negative charge is formed on the photoreceptor 1. When the latent image having a positive (or negative) charge is developed with a toner having a negative (or positive) charge, a positive image can be obtained. In contrast, when the latent image having a positive (negative) charge is developed with a toner having a positive (negative) charge, a negative image (i.e., a reversal image) can be obtained.

The toner image formed on the photoreceptor is transferred to the receiving material 9 by the transfer charger 10. In order to well perform the transfer operation, the pre-transfer charger 7 can be used. Suitable transfer methods include transfer methods using a transfer charger, electrostatic transfer methods using a bias roller, mechanical transfer methods such as adhesion transfer methods and pressure transfer methods, magnetic transfer methods, etc. The above-mentioned chargers can be preferably used for the electrostatic transfer methods.

The receiving material 9, on which the toner image has been transferred, is separated from the photoreceptor by the separation charger 11 and the separation pick 12. Other separation devices such as separation methods utilizing electrostatic attraction, separation methods using a belt end, separation methods including griping tip of receiving materials, separation methods utilizing curvature, etc. The above-mentioned chargers can be used for the separation charger 11.

When the toner image formed on the photoreceptor 1 by the developing device 6 is transferred onto the receiving material 9, all of the toner image is not transferred onto the receiving material 9, and toner particles remain on the surface of the photoreceptor 1. The residual toner is removed from the photoreceptor 1 by the fur brush 14 and cleaning blade 15. In order to well clean the surface of the photoreceptor 1, the pre-cleaning charger 13 can be used. Other cleaning methods such as web cleaning methods, and magnet brush cleaning methods can also be used. These cleaning methods can be used alone or in combination.

The image forming apparatus optionally includes the discharger 2 to remove a residual electrostatic image on the photoreceptor 1. Suitable dischargers include discharging lamps and discharging chargers. The above-mentioned light sources and chargers can be used for the discharger 2.

With respect to other devices of the image forming apparatus of the present invention such as image reading devices, receiving material feeding devices, fixing devices and receiving material discharging devices, any known devices can be used therefor.

Thus, the image forming method and apparatus of the present invention produce images using the photoreceptor of the present invention mentioned above.

The image forming section illustrated in FIG. 3 can be fixedly set in an image forming apparatus such as copiers, facsimiles and printers. However, the image forming section can be detachably attached to an image forming apparatus as a process cartridge.

Figure 4:
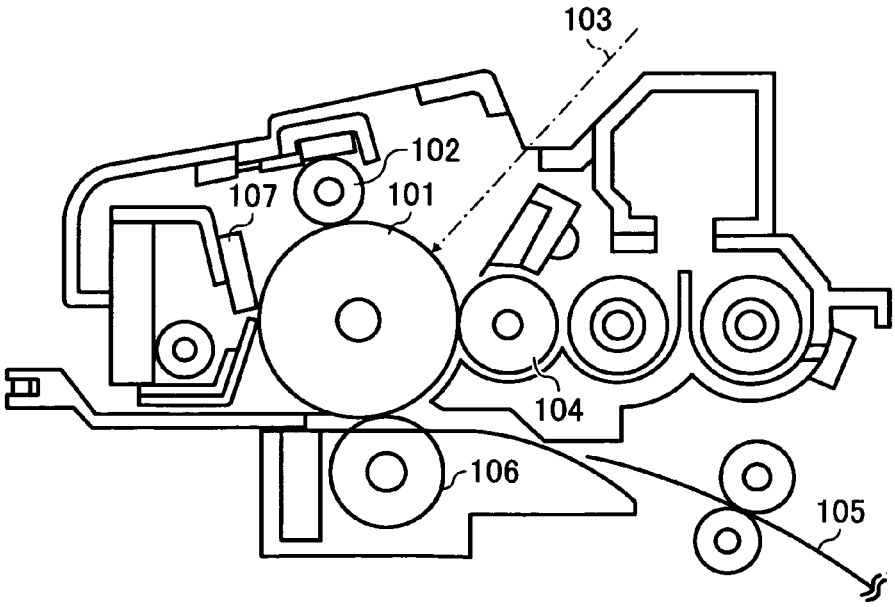
FIG. 4 is a schematic view illustrating an example of the process cartridge of the present invention.

FIG. 4 illustrates an example of the process cartridge of the present invention.

Referring to FIG. 4, the process cartridge includes a photoreceptor 101, which is the photoreceptor of the present invention, a charger 102 configured to charge the photoreceptor 101, a developing device 104 configured to develop an electrostatic latent image on the photoreceptor 101 to form a toner image thereon, a transfer device 106 configured to transfer the toner image onto a receiving material 105, and a cleaning device 107 configured to clean the surface of the photoreceptor 101.

The process cartridge of the present invention is not limited thereto, and any process cartridges can be used as long as the process cartridges include at least the photoreceptor, and at least one of chargers, developing devices, transfer devices, cleaning devices, and discharging devices.

The image forming process will be explained by reference to FIG. 4. The photoreceptor 101 is charged by the charger 102 while rotated, and is exposed to imagewise light 103 emitted from a light irradiator (not shown), resulting in formation of an electrostatic latent image on the photoreceptor 101. The electrostatic latent image is developed with the developing device 104, thereby forming a toner image on the photoreceptor 101. The toner image is then transferred to the receiving material 105 by the transfer device 106. The receiving material bearing a toner image is output as a copy after the toner image is fixed. The surface of the photoreceptor 101 is cleaned with the cleaner 107, and then discharged with a discharger (not shown). This image forming operation is repeated to produce images.

Thus, the photoreceptor of the present invention can be used for not only electrophotographic copiers, but also other image forming apparatuses utilizing electrophotography such as laser beam printers, CRT printers, LED printers, liquid crystal display (LCD) printers, and laser plate making machines.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis Example 1

The radically polymerizable compound having formula B-1-1 was synthesized as follows.

Specifically, 6 g (0.0224 mol) of 1,1-bis(4-hydroxyphenyl) cyclohexane (B1586 from Tokyo Kaei Kogyo Co., Ltd.) was dissolved in 70 ml of tetrahydrofuran. An aqueous solution of sodium hydroxide, which had been prepared by dissolving 3.76 g of sodium hydroxide in 32 ml of water, was dropped in the above-prepared solution under nitrogen gas flow. After the mixture was cooled to 2° C., 8.26 g (0.0456 mol) of acryl chloride was added thereto over 30 minutes. The mixture was agitated for 5 hours in a temperature range of from 2 to 5° C. to complete the reaction. The reaction product was fed into water to cause a precipitate, followed by filtering. The thus prepared crude product (white powder) was washed with water, followed by filtering. This washing operation was repeated several times. The crude product was then subjected to a column chromatographic treatment using a silica gel as an absorbent, and a mixture solvent oftoluene/ethyl acetate (10/1) as a developing solvent. Further, the product was recrystallized using ethanol. Thus, 4.99 g of the compound having formula B-1-1, which is a white crystal, was prepared. In this regard, the yield was 59.3%.

The melting point of the compound B-1-1 was from 117.5 to 118.0° C. In addition, the compound was subjected to an elementary analysis. The results (i.e., the amounts (%) of the elements (C, H and N) in the crystal) are as follows.

| | C | H | N |
|---|---|---|---|
| Found value | 76.65 | 6.40 | 0.00 |
| Calculated value | 76.57 | 6.43 | 0.00 |

Figure 5:
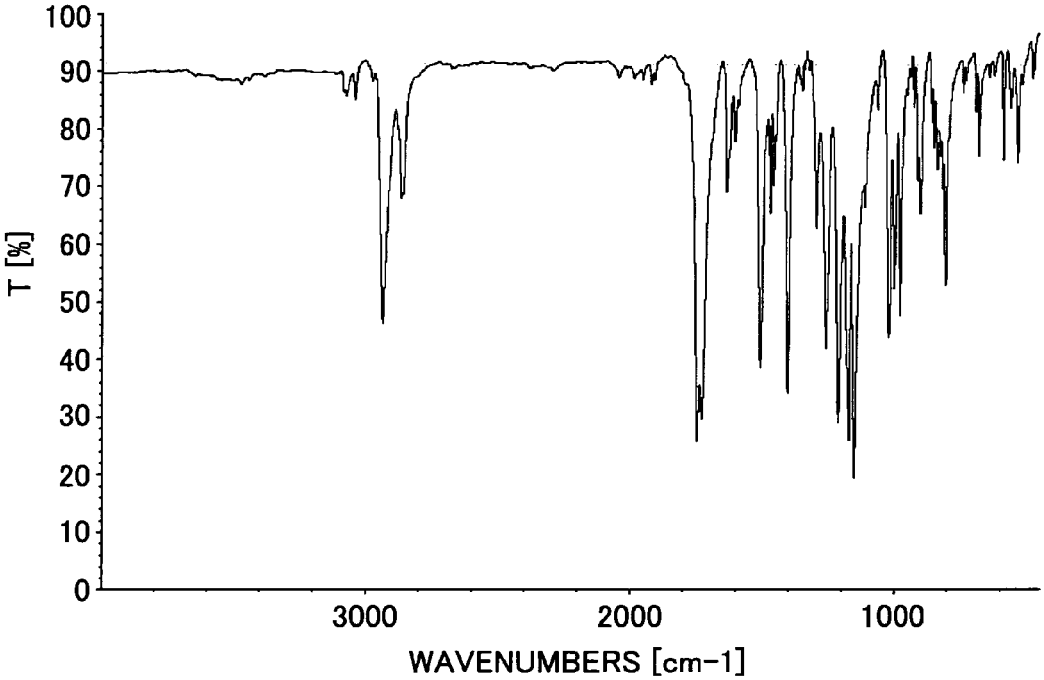
FIGS. 5 to 17 are schematic views illustrating the infrared spectra of radically polymerizable compounds or intermediate thereof for use in preparing the outermost layer of the photoreceptor of the present invention.

Further, the compound was subjected to an infrared spectroscopic analysis using KBr. The spectrum is shown in FIG. 5.

Synthesis Example 2

The radically polymerizable compound having formula B-2-4 was synthesized as follows.

Specifically, 6 g (0.0137 mol) of 9,9-bis[4-(2-hydroxyethoxy)phenyl]fluorene (F0447 from Tokyo Kaei Kogyo Co., Ltd.) was dissolved in 70 ml of dimethylacetamide. After the mixture was cooled to 3° C., 6.95 g (0.0548 mol) of 3-chloropropionylchloride was added thereto under a nitrogen gas flow. The mixture was agitated for 3.5 hours at room temperature. Next, 11.08 g of triethylamine was added thereto over 40 minutes at room temperature under a nitrogen gas flow. The mixture was agitated for 4 ours at 60° C. to complete the reaction. The reaction product was fed into water, and the mixture was subjected to an extraction treatment using ethyl acetate. The thus extracted liquid was repeatedly washed with water. After the solvent was removed from the extracted liquid, the reaction product was refined by a column chromatographic treatment using a silica gel as an absorbent, and a mixture solvent of toluene/ethyl acetate (3/1) as a developing solvent.

Thus, 6.18 g of the compound having formula B-2-4, which is a clear and colorless oily material, was prepared. In this regard, the yield was 82.6%.

The compound was subjected to an elementary analysis. The results (i.e., the amounts (%) of the elements (C, H and N) in the oily material) are as follows.

| | C | H | N |
|---|---|---|---|
| Found value | 76.70 | 6.51 | 0.00 |
| Calculated value | 76.91 | 5.53 | 0.00 |

Figure 6:
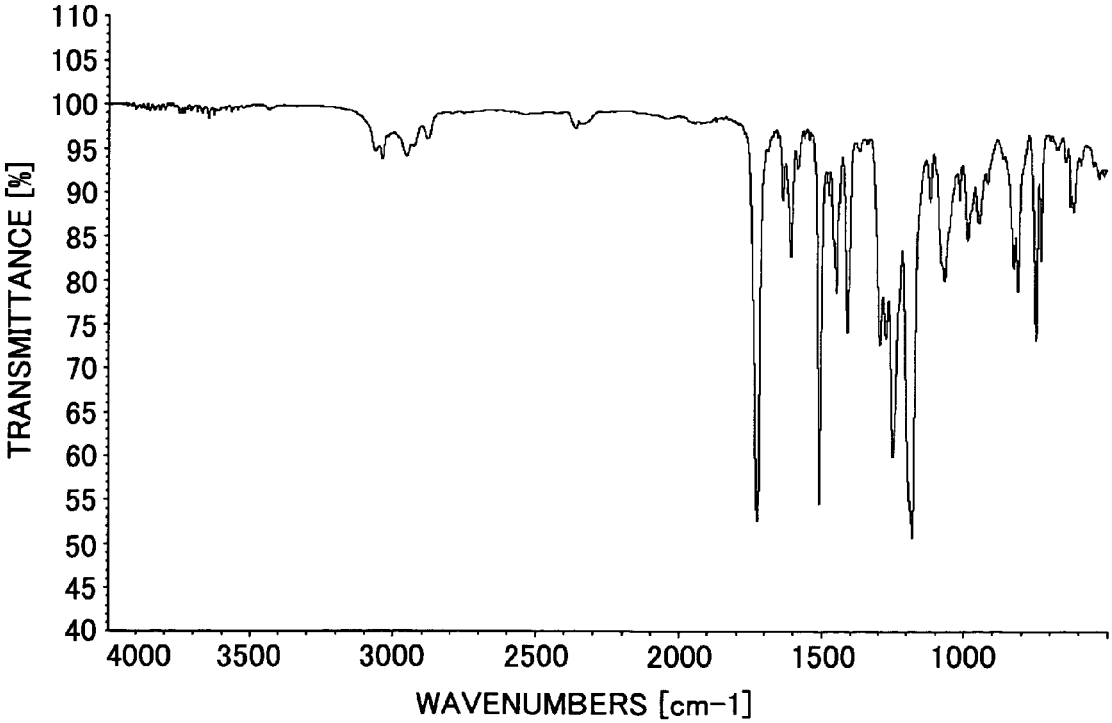

Further, the compound was subjected to an infrared spectroscopic analysis by forming a layer of the compound on a NaCl plate. The spectrum is shown in FIG. 6.

Synthesis Example 3

The radically polymerizable compound having formula C-1-1 was synthesized as follows.

(1) Synthesis of Intermediate Compound having the Following Formula

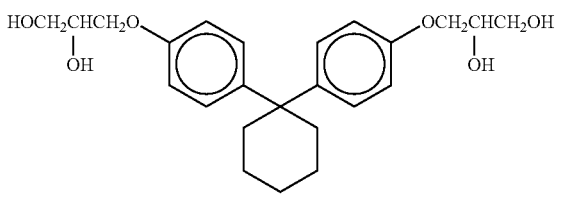

At first, 9.83 g (0.0366 mol) of 1,1-bis(4-hydroxyphenyl) cyclohexane (B1568 from Tokyo Kaei Kogyo Co., Ltd.) and 12.06 g (0.0806 mol) of glycidyl methacrylate were dissolved in 50 ml of toluene. After 0.3 ml of triethylamine was added thereto, the mixture was agitated for 9 hours at 95° C. under an argon gas flow. Next, 37 ml of a 10% aqueous solution of sodium hydroxide and 30 ml of toluene were added thereto at room temperature. The mixture was agitated for 6 hours at 92° C. to complete the reaction. The reaction product was neutralized with hydrochloric acid to cause a precipitate. The thus precipitated crystal was separated by filtering, followed by washing with water. The crystal was refined by a column chromatographic treatment using a silica gel as an absorbent, and a mixture solvent of ethyl acetate/tetrahydrofuran (1/1) as a developing solvent.

Thus, 9.16 g of the intermediate compound, which is a white powder, was prepared. In this regard, the yield was 60.1%.

Figure 7:
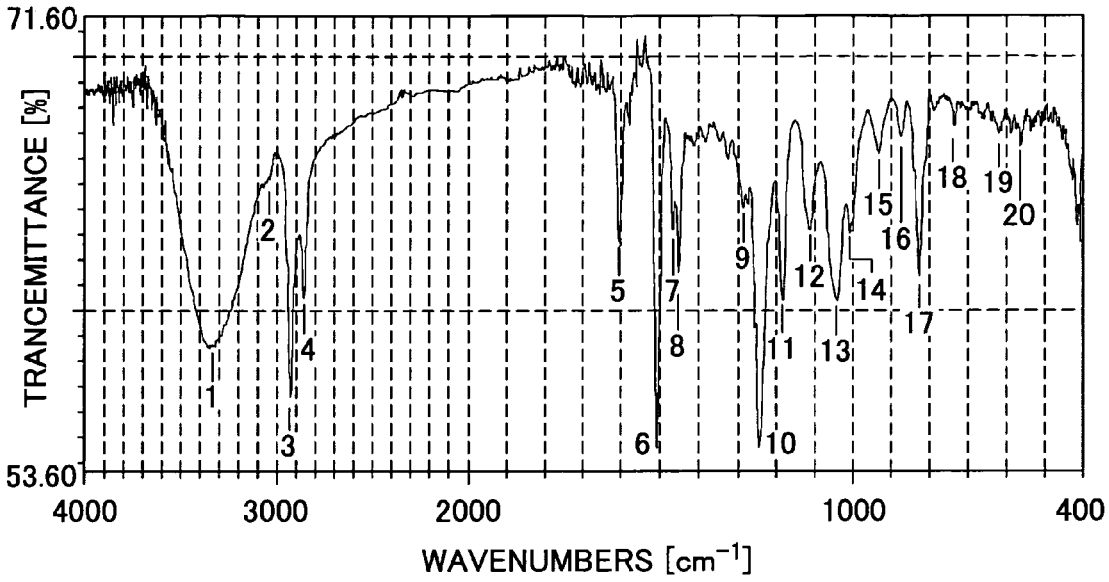

Further, the intermediate compound was subjected to an infrared spectroscopic analysis. The spectrum is shown in FIG. 7.

(2) Synthesis of the Compound having Formula C-1-1

At first, 9.16 g (0.0220 mol) of the above-prepared intermediate compound was dissolved in 87 ml of dimethylacetamide. Next, 16.75 g (0.132 mol) of 3-chloropropionylchloride was added thereto at 3° C. under an argon gas flow, and the mixture was agitated for 7 hours at room temperature. After the reaction product was cooled to 3° C., 37 ml of triethylamine was added thereto. The mixture was agitated for 5 hours at 60° C. to complete the reaction. The reaction product was fed into water, followed by an extraction treatment using dichloromethane. The thus extracted liquid was repeatedly washed with water. After the solvent was removed from the extracted liquid, the reaction product was refined by a column chromatographic treatment using a silica gel as an absorbent, and a mixture solvent of n-hexane/ethyl acetate (2/1) as a developing solvent.

Thus, 11.9 g of the compound having formula C-1-1, which is an oily material, was prepared. In this regard, the yield was 85.5% based on the intermediate compound.

Figure 8:
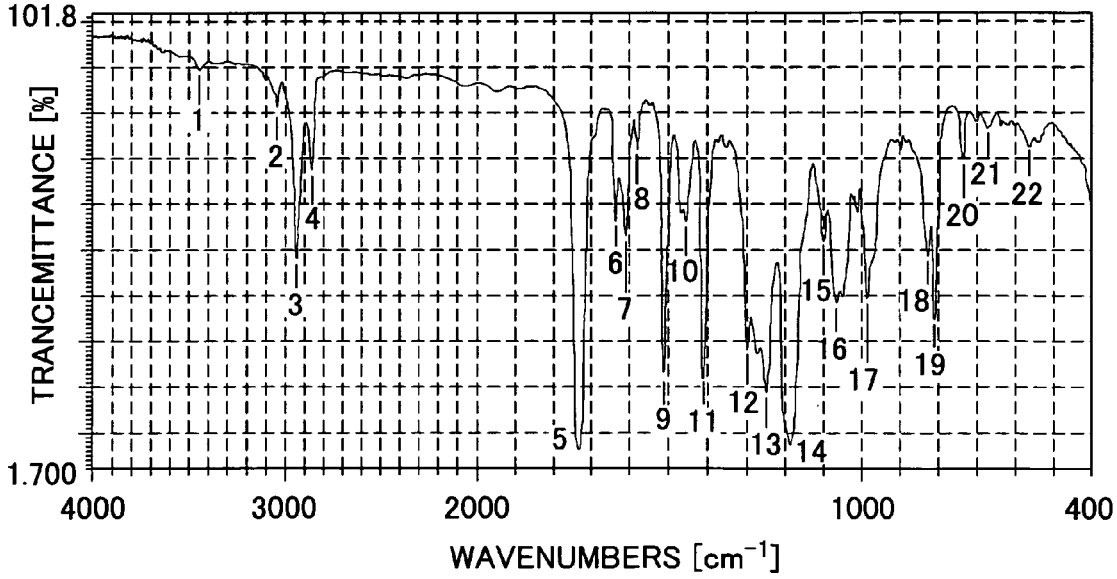

Further, the compound was subjected to an infrared spectroscopic analysis. The spectrum is shown in FIG. 8.

By using this method, other diphenol materials can also be synthesized.

Synthesis Example 4

The radically polymerizable compound having formula D-1-4 was synthesized as follows.

In a reaction vessel equipped with an agitator, a thermometer, and a dropping funnel, 5.93 g (20 mmol) of 1,1-bis(4-hydroxy-3-methylphenyl)cyclohexane, 18.51 g (200 mmol) of epichlorohydrin and 20 ml of toluene were mixed. The mixture was heated to 110° C. under a nitrogen gas flow while agitated. While controlling the temperature of the reaction system in a range of from 100 to 120° C., 9.60 g (48 mmol) of a 20% by weight aqueous solution of sodium hydroxide was dropped thereinto over 30 minutes. The mixture was reacted for 4 hours at 110° C. After the reaction product was cooled to room temperature, excess of epichlorohydrin was collected under a reduced pressure. Next, toluene was added to the reaction product, and the organic phase liquid was washed with water. The thus prepared toluene solution was mixed with anhydrous magnesium sulfate to remove water therefrom, followed by condensation under a reduced pressure. The reaction product was subjected to a column chromatographic treatment using a silica gel as an absorbent, and a mixture solvent of toluene/ethyl acetate (1/1) as a developing solvent to remove raw materials and polymer components therefrom. Thus, 6.92 g of a clear and colorless oily material was obtained.

The oily material was then dissolved in 80 ml of toluene. The toluene solution, 2.88 g (40 mmol) of acrylic acid, and 0.2 ml of triethylarnine were fed into a reaction vessel, and the mixture was reacted for 3 hours at 80° C. After cooled, the reaction product was washed with water. The washed reaction product was mixed with anhydrous magnesium sulfate to remove water therefrom, followed by condensation under a reduced pressure. The condensed reaction product was dissolved again in toluene. After the toluene solution was mixed with 5 g of activated earth to be subjected to an absorptive treatment for 5 minutes, the reaction product was subjected to a column chromatographic treatment using a silica gel as an absorbent, and a mixture solvent of toluene/ethyl acetate (3/1) as a developing solvent to remove raw materials and polymer components therefrom. Thus, 6.53 g of a clear and colorless oily material (i.e., the compound D-1-4) was obtained.

It was found by measurement of the molecular weight by gel permeation chromatography that the oily material includes components having a repeat number of from 1 to 5 as main components.

Synthesis Example 5

The radically polymerizable compound having formula F-1-1 was synthesized as follows.

At first, 30 g (0.087 mol) of 4,4'-(2,2'-(1,4-phenylene)bis(propoane-2,2-diyl)diphenol was dissolved in 200 ml of tetrahydrofuran. An aqueous solution of sodium hydroxide, which had been prepared by dissolving 88.3 g of sodium hydroxide in 56 ml of water, was dropped into the solution under a nitrogen gas flow. After the mixture was cooled to 6° C., 31.5 g (0.348 mol) of acryl chloride was dropped into the mixture over one hour. The mixture was agitated for 2.5 hours to complete the reaction. The reaction product was fed into water, and the mixture was subjected to an extraction treatment using toluene. The extracted liquid was repeatedly washed with water. After the solvent (toluene) was removed from the toluene solution, the reaction product was subjected to a column chromatographic treatment using a silica gel as an absorbent, and a mixture solvent of toluene/ethyl acetate (1/1) as a developing solvent to be refined. The thus prepared colorless oily material was mixed with methanol to precipitate a crystal. Thus, 24.12 g of a white crystal 4,4'-(2,2'-(1,4-phenylene)bis(propoane-2,2-diyl)bis(4,1-phenylene)diacrylate (i.e., the compound F-1-1) was obtained. In this regard, the yield was 61.0%.

The melting point ofthe compound F-1-1 was from 155.0 to 156.5° C. In addition, the compound was subjected to an elementary analysis. The results (i.e., the amounts (%) of the elements (C, H and N) in t he crystal) are as follows.

| | C | H | N |
|---|---|---|---|
| Found value | 79.30 | 6.61 | 0.00 |
| Calculated value | 79.27 | 6.65 | 0.00 |

Figure 9:
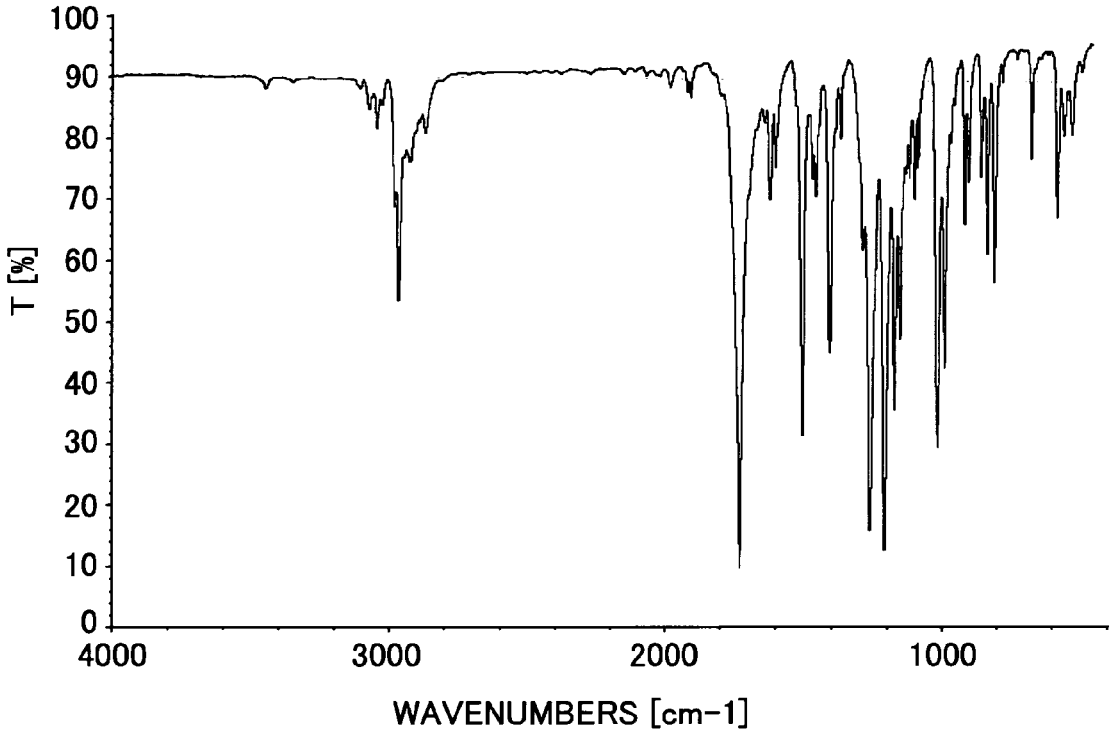

Further, the compound was subjected to an infrared spectroscopic analysis. The spectrum is shown in FIG. 9.

Synthesis Example 6

The radically polymerizable compound having formula F-1-4 was synthesized as follows.

At first, 30 g (0.087 mol) of 4,4'-(2,2'-(1,3-phenylene)bis(propoane-2,2-diyl)diphenol was dissolved in 200 ml of tetrahydrofuran. An aqueous solution of sodium hydroxide, which had been prepared by dissolving 88.3 g of sodium hydroxide in 56 ml of water, was dropped into the solution under a nitrogen gas flow. After the mixture was cooled to 6° C., 31.5 g (0.348 mol) of acryl chloride was dropped into the mixture over one hour. The mixture was agitated for 2.5 hours to complete the reaction. The reaction product was fed into water, and the mixture was subjected to an extraction treatment using toluene. The extracted liquid was repeatedly washed with water. After the solvent (toluene) was removed from the toluene solution, the reaction product was subjected to a column chromatographic treatment using a silica gel as an absorbent, and a mixture solvent of toluene/ethyl acetate (1/1) as a developing solvent to be refined. The thus prepared colorless oily material was mixed with methanol to precipitate a crystal. Thus, 31.83 g of a white crystal 4,4'-(2,2'-(1,3-phenylene)bis(propoane-2,2-diyl)bis(4,1-phenylene)diacrylate (i.e., the compound F-1-4) was obtained. In this regard, the yield was 80.5%.

The melting point of the compound F-1-4 was from 106.0 to 107.5° C. In addition, the compound was subjected to an elementary analysis. The results (i.e., the amounts (%) of the elements (C, H and N) in the crystal) are as follows.

| | C | H | N |
|---|---|---|---|
| Found value | 79.33 | 6.62 | 0.00 |
| Calculated value | 79.27 | 6.65 | 0.00 |

Figure 10:
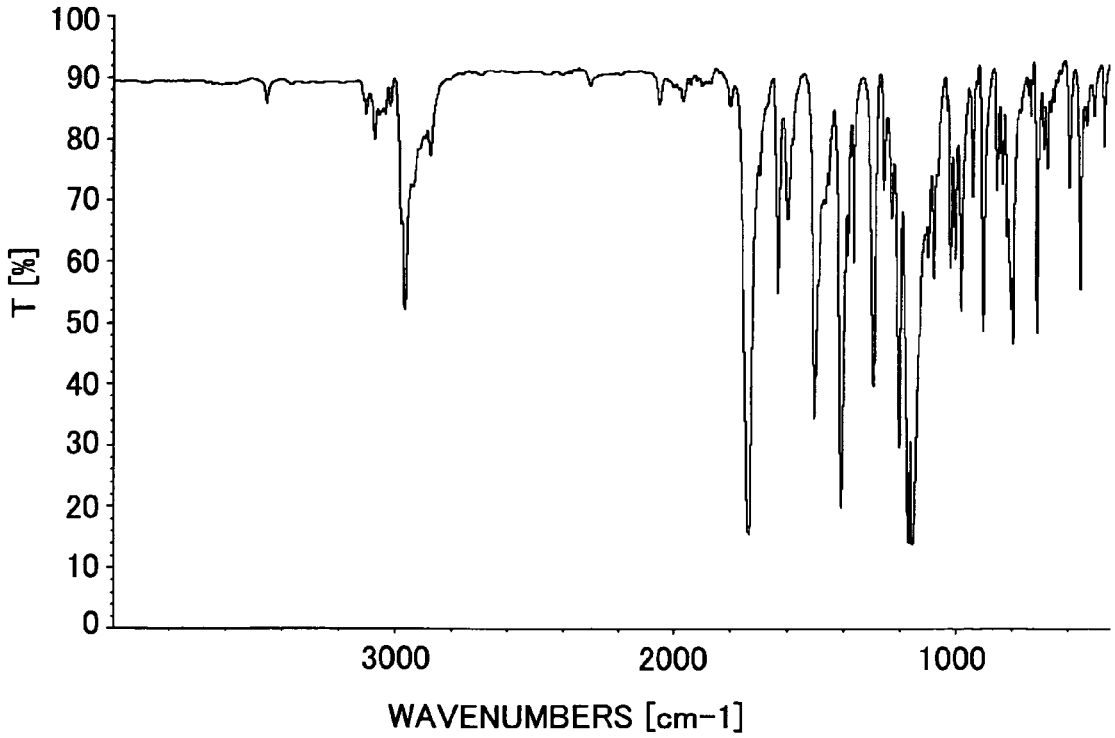

Further, the compound was subjected to an infrared spectroscopic analysis. The spectrum is shown in FIG. 10.

By using this method, other diphenol compounds can also be prepared.

Synthesis Example 7

The radically polymerizable compound having formula G-1-3 was synthesized as follows.

(1) Synthesis of Intermediate Compound

At first, 10 g (28.9 mmol) of 4,4'-(2,2'-(1,3-phenylene)bis(propoane-2,2-diyl)diphenol and 9.5 g (63.5 mmol) of glycidyl methacrylate were dissolved in 50 ml of toluene. After 0.25 ml of triethylamine was added thereto, the mixture was agitated for 10 hours at 95° C. under an argon gas flow. Next, 29 ml of a 10% by weight aqueous solution of sodium hydroxide and 20 ml of toluene were added thereto, and the mixture was agitated for 8 hours at 91° C. The reaction product was neutralized with hydrochloric acid to precipitate a crystal. After filtering, the crystal was washed with water. The crystal was subjected to a column chromatographic treatment using a silica gel as an absorbent, and a mixture solvent of ethyl acetate/tetrahydrofuran (1/1) as a developing solvent to be refined. Thus, 12.05 g of 3,3'-(4,4'-(2,2'-(1,3-phenylene)bis(propoane-2,2-diyl))bis(4,1-phenylene))bis(oxy)-dirpopane-1,2-diol was prepared. In this regard, the yield was 84.4%.

Figure 11:
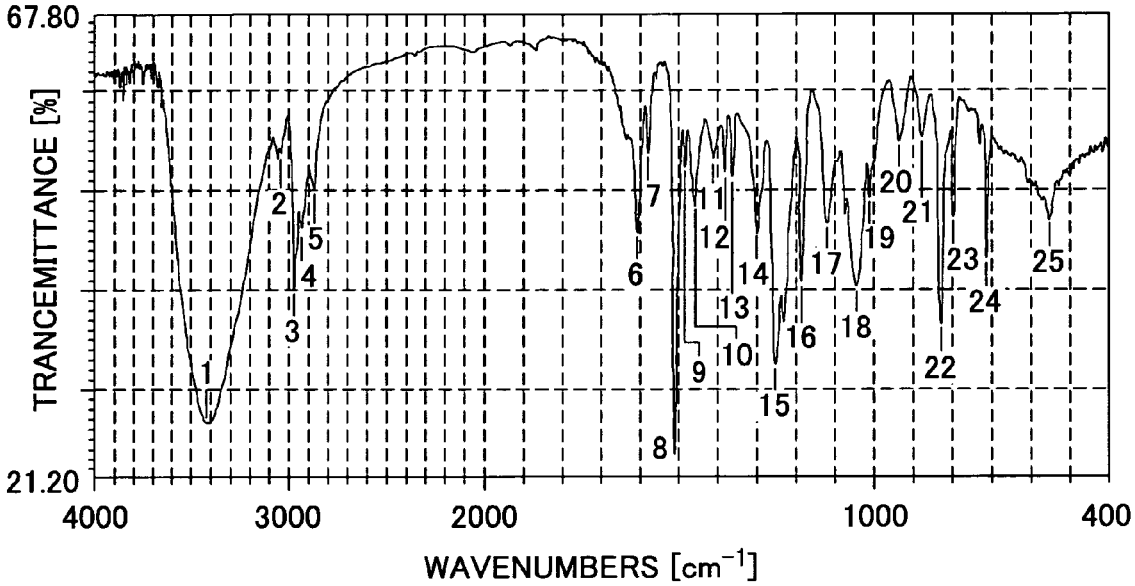

Further, the intermediate compound was subjected to an infrared spectroscopic analysis. The spectrum is shown in FIG. 11.

(2) Synthesis of the Compound having Formula G-1-3

At first, 5.0 g (10.1 mmol) of the above-prepared intermediate compound was dissolved in 40 ml of dimethylacetamide. After 7.7 g (60.7 mmol) of 3-chloropropionylchloride was added thereto at 3° C. under an argon gas flow, the mixture was agitated for 5 hours at room temperature. Next, 17 ml of triethylamine was added thereto at 3° C., and the mixture was agitated for 5 hours at 60° C. to complete the reaction. After the reaction product was fed into water, the mixture was subjected an extraction treatment using dichloromethane. The extracted liquid was repeatedly washed with water. After the solvent (dichloromethane) was removed therefrom, the reaction product was subjected to a column chromatographic treatment using a silica gel as an absorbent, and a mixture solvent of n-hexane/ethyl acetate (2/1) as a developing solvent to be refmed. Thus, 5.55 g of an oily material (i.e., the compound having formula G-1-3) was obtained. In this regard, the yield was 77.3%.

Figure 12:
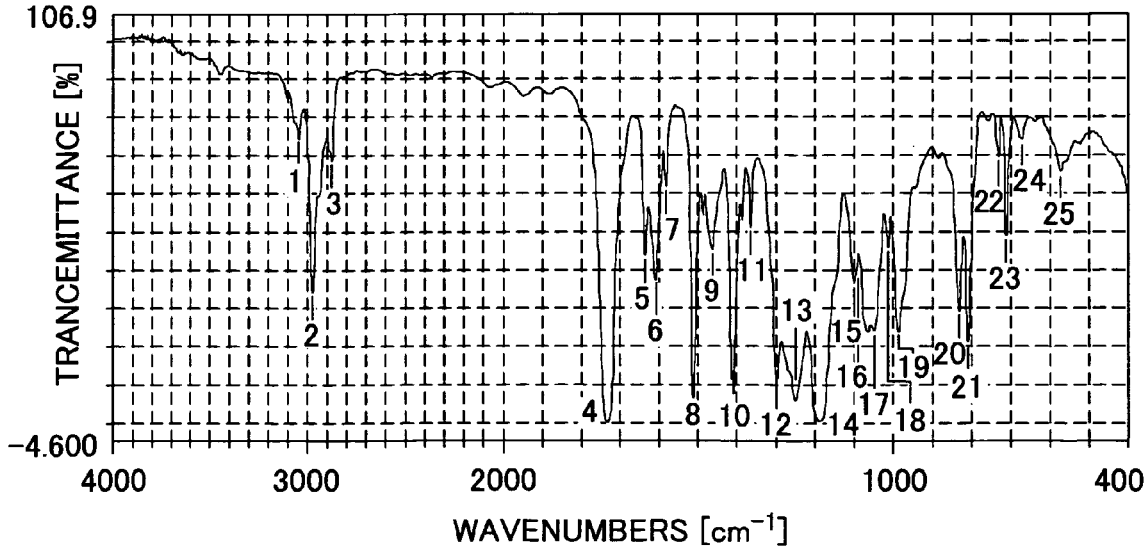

Further, the compound was subjected to an infrared spectroscopic analysis. The spectrum is shown in FIG. 12.

By using this method, other diphenol compounds can also be prepared.

Synthesis Example 8

The radically polymerizable compound having formula H-1-3 was synthesized as follows.

In a reaction vessel equipped with an agitator, a thermometer, and a dropping funnel, 6.9 g (20 mmol) of 4,4'-(2,2'-(1,3-phenylene)bis(propane-2,2-diyl))diphenol, 18.51 g (200 mmol) of epichlorohydrin and 20 ml of toluene were mixed. The mixture was heated to 110° C. under a nitrogen gas flow while agitated. While controlling the temperature of the reaction system in a range of from 100 to 120° C., 9.60 g (48 mmol) of a 20% by weight aqueous solution of sodium hydroxide was dropped thereinto over 30 minutes. The mixture was reacted for 4 hours at 110° C. After the reaction product was cooled to room temperature, excess of epichlorohydrin was collected under a reduced pressure. Next, toluene was added to the reaction product, and the organic phase liquid was washed with water. The thus prepared toluene solution was mixed with anhydrous magnesium sulfate to remove water therefrom, followed by condensation under a reduced pressure. The reaction product was added to methanol to be re-precipitated, followed by filtering. Thus, 8.05 g of a colorless powder was obtained. As a result of measurement of the melting point of the powder, it was found that the powder is amorphous.

The powder was then dissolved in 80 ml of toluene. The toluene solution, 0.72 g (10 mmol) of acrylic acid, and 0.2 ml of triethylamine were fed into a reaction vessel, and the mixture was reacted for 3 hours at 80° C. After cooled, the reaction product was washed with water, followed by condensation under a reduced pressure. Further, the condensed reaction product was fed into methanol to be re-precipitated, followed by filtering. Thus, 7.85 g of a colorless powder was prepared. The powder was dissolved in toluene. The toluene solution was mixed with 5 g of activated earth to be subjected to an absorptive treatment for 30 minutes, and then the activated earth was removed therefrom. The reaction product was fed into methanol to be re-precipitated, followed by filtering. Thus, 7.6 g of a colorless powder (i.e., the compound having formula H-1-3) was prepared.

It was found by measurement of the molecular weight by gel permeation chromatography that the compound includes components having a repeat number of from 1 to 5 as main components.

Synthesis Example 9

The radically polymerizable compound having formula f-1-1 was synthesized as follows.

At first, 30 g of 2,2-bis(3-methyl-4-hydroxyphenyl)propane was dissolved in 200 ml of tetrahydrofuran. An aqueous solution of sodium hydroxide, which had been prepared by dissolving 118.7 g of sodium hydroxide in 75 ml of water, was dropped into the solution under a nitrogen gas flow. After the solution was cooled to 6° C., 42.4 g of acryl chloride was dropped thereinto over one hour. The mixture was agitated for 2.5 hours to complete the reaction. After the reaction product was fed into water, the mixture was subjected to an extraction treatment using toluene. The extracted liquid was repeatedly washed with water. After toluene was removed therefrom, the reaction product was subjected to a column chromatographic treatment using a silica gel as an absorbent, and a mixture solvent of toluene/ethyl acetate (1/1) as a developing solvent to be refined. The thus obtained oily material was mixed with methanol to precipitate a crystal. Thus, 21.43 g of a white crystal (i.e., the compound having formula f-1-1) was obtained. In this regard, the yield was 50.2%.

The melting point of the compound f-1-1 was from 50.5 to 51.5° C. In addition, the compound was subjected to an elementary analysis. The results (i.e., the amounts (%) of the elements (C, H and O) in the crystal) are as follows.

| | C | H | O |
|---|---|---|---|
| Found value | 76.20 | 6.52 | 17.42 |
| Calculated value | 75.80 | 6.64 | 17.56 |

Figure 13:
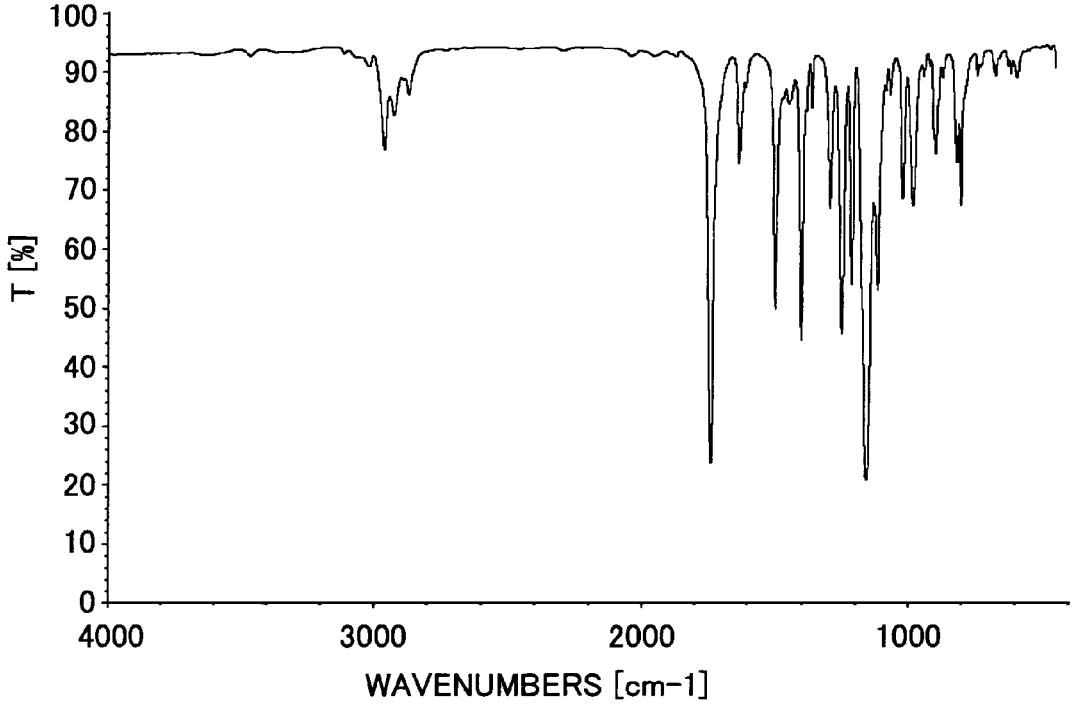

Further, the compound was subjected to an infrared spectroscopic analysis. The spectrum is shown in FIG. 13.

Synthesis Example 10

The radically polymerizable compound having formula g-1-1 was synthesized as follows.

(1) Synthesis of Intermediate Compound having the Following Formula

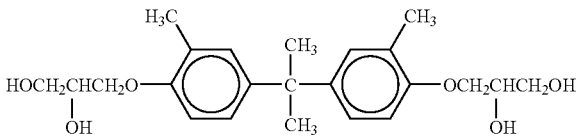

(i.e., 2,2-bis{3-methyl-4-(2,3-dihydroxypropyloxy)phenyl}propane)

At first, 8.57 g of 2,2-bis(3-methyl-4-hydroxyphenyl)propane and 11.01 g of glycidyl methacrylate were dissolved in 50 ml of toluene. After 0.3 ml of triethylamine was added thereto, the mixture was agitated for 9 hours at 95° C. under an argon gas flow. Next, 33 ml of a 10% by weight aqueous solution of sodium hydroxide and 30 ml of toluene were added thereto, and the mixture was agitated for 6 hours at 92° C. The reaction product was neutralized with hydrochloric acid, followed by an extraction treatment using ethyl acetate. The extracted liquid was repeatedly washed with water. After removing the solvent from the solution, the reaction product was subjected to a column chromatographic treatment using a silica gel as an absorbent, and a mixture solvent of ethyl acetate/tetrahydrofuran (1/1) as a developing solvent to be refined. Thus, 8.64 g of a colorless powder (i.e., the intermediate compound, 2,2-bis{3-methyl-4-(2,3-dihydroxypropyloxy)phenyl}propane) was obtained. In this regard, the yield was 87%.

Figure 14:
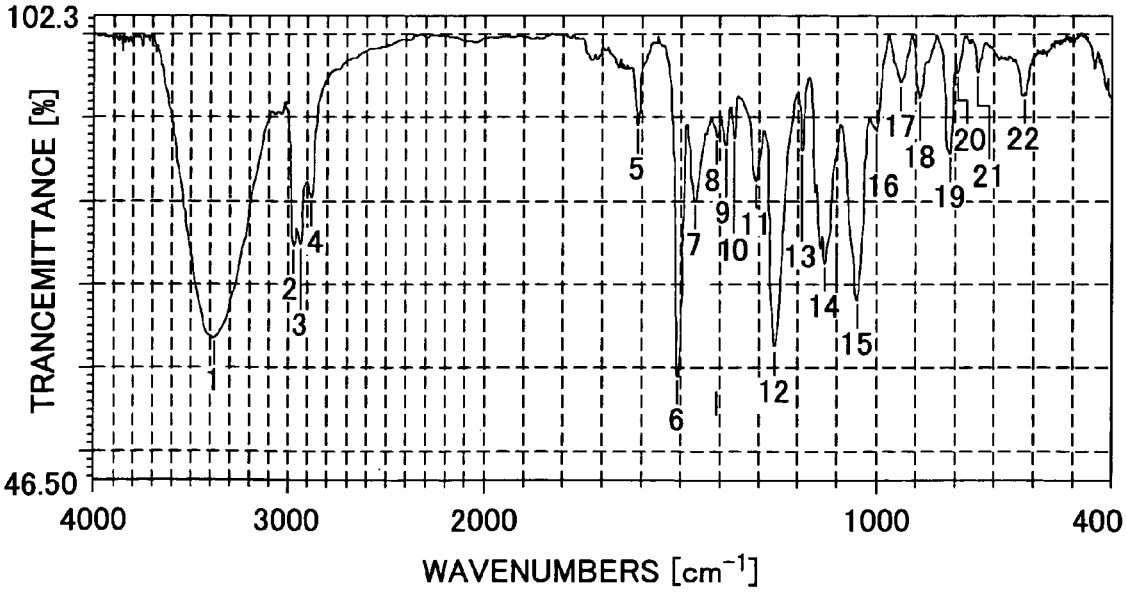

Further, the intermediate compound was subjected to an infrared spectroscopic analysis. The spectrum is shown in FIG. 14.

(2) Synthesis of the Compound having Formula g-1-1

At first, 8.64 g of the above-prepared intermediate compound was dissolved in 87 ml of dimethylacetamide. After 16.75 g of 3-chioropropionyl chloride was added thereto at 3° C. under an argon gas flow, the mixture was agitated for 7 hours at room temperature. Next, 29 ml of triethylamine was added thereto at 3° C., and the mixture was agitated for 5 hours at 60° C. to complete the reaction. After the reaction product was fed into water, the mixture was subjected an extraction treatment using dichloromethane. The extracted liquid was repeatedly washed with water. After the solvent (dichloromethane) was removed therefrom, the reaction product was subjected to a column chromatographic treatment using a silica gel as an absorbent, and a mixture solvent of n-hexane/ethyl acetate (2/1) as a developing solvent to be refined. Thus, 10.19 g of an oily material (i.e., the compound having formula g-1-1) was obtained. In this regard, the yield was 77%.

Figure 15:
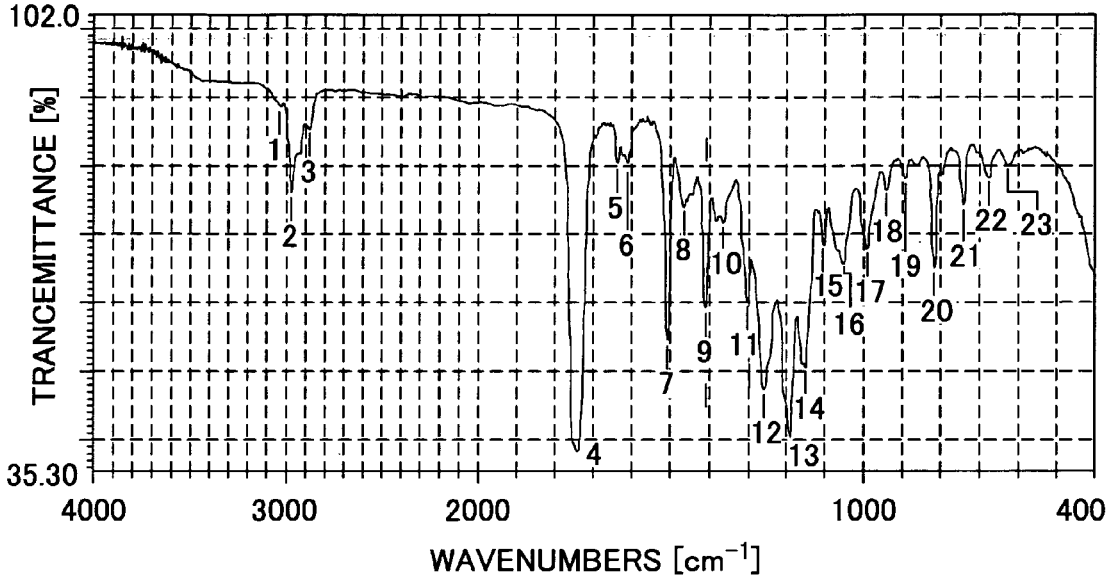

Further, the compound was subjected to an infrared spectroscopic analysis. The spectrum is shown in FIG. 15.

In addition, the compound was subjected to an elementary analysis. The results (i.e., the amounts (%) of the elements (C, H and O) in the oily material) are as follows.

| | C | H | O |
|---|---|---|---|
| Found value | 67.23 | 6.55 | 25.70 |
| Calculated value | 67.73 | 6.50 | 25.78 |

Synthesis Example 11

The radically polymerizable compound having formula h-1-1 was synthesized as follows.

In a reaction vessel equipped with an agitator, a thermometer, and a dropping funnel, 5.1 g (20 mmol) of 2,2-bis(3-methyl-4-hydroxydiphenyl)propane, 18.51 g (200 mmol) of epichlorohydrin and 20 ml of toluene were mixed. The mixture was heated to 110° C. under a nitrogen gas flow while agitated. While controlling the temperature of the reaction system in a range of from 100 to 120° C., 9.60 g (48 mmol) of a 20% by weight aqueous solution of sodium hydroxide was dropped thereinto over 30 minutes. The mixture was reacted for 4 hours at 110° C. After the reaction product was cooled to room temperature, excess of epichlorohydrin was collected under a reduced pressure. Next, toluene was added to the reaction product, and the organic phase liquid was washed with water. The thus prepared toluene solution was mixed with anhydrous magnesium sulfate to remove water therefrom, followed by condensation under a reduced pressure. The reaction product was fed into methanol to be re-precipitated, followed by filtering. Thus, 6.2 g of a colorless powder was obtained. As a result of measurement of the melting point of the powder, it was found that the powder is amorphous.

The powder was then dissolved in 80 ml of toluene. The toluene solution, 0.72 g (10 mmol) of acrylic acid, and 0.2 ml of triethylamine were fed into a reaction vessel, and the mixture was reacted for 3 hours at 80° C. After cooled, the reaction product was washed with water, followed by condensation under a reduced pressure. Further, the condensed reaction product was fed into methanol to be re-precipitated, followed by filtering. Thus, 7.85 g of a colorless powder was prepared. The powder was dissolved in toluene. The toluene solution was mixed with 5 g of activated earth to be subjected to an absorptive treatment for 30 minutes, and then the activated earth was removed therefrom. The reaction product was fed into methanol to be re-precipitated, followed by filtering. Thus, 5.9 g of a colorless powder (i.e., the compound having formula h-1-1) was prepared.

It was found by measurement of the molecular weight by gel permeation chromatography that the powder includes components having a repeat number of from 1 to 10 as main components.

By using this method, other diphenol compounds can be synthesized.

Synthesis Example 12

The radically polymerizable compound having formula J-1-2 was synthesized as follows.

At first, 19 g (0.087 mol) of 4,4'-thiobisphenol was dissolved in 200 ml of tetrahydrofuran. An aqueous solution of sodium hydroxide, which had been prepared by dissolving 13.92 g of sodium hydroxide in 56 ml of water, was dropped into the solution under a nitrogen gas flow. After the solution was cooled to 6° C., 22.10 g (0.348 mol) of acryl chloride was dropped thereinto over one hour. The mixture was agitated for 2.5 hours to complete the reaction. After the reaction product was fed into water, the mixture was subjected to an extraction treatment using toluene. The extracted liquid was repeatedly washed with water. After toluene was removed therefrom, the reaction product was subjected to a column chromatographic treatment using a silica gel as an absorbent, and a mixture solvent of toluene/ethyl acetate (1/1) as a developing solvent to be refined. The thus obtained colorless oily material was mixed with methanol to precipitate a crystal. Thus, 15.04 g of a white crystal (i.e., the compound having formula J-1-2) was obtained. In this regard, the yield was 53.0%.

The melting point of the compound J-1-2 was from 50.5 to 51.5° C. In addition, the compound was subjected to an elementary analysis. The results (i.e., the amounts (%) of the elements (C, H, O and S) in the crystal) are as follows.

| | C | H | O | S |
|---|---|---|---|---|
| Found value | 66.33 | 4.21 | 19.55 | 9.79 |
| Calculated value | 66.24 | 4.32 | 19.61 | 9.82 |

Figure 16:
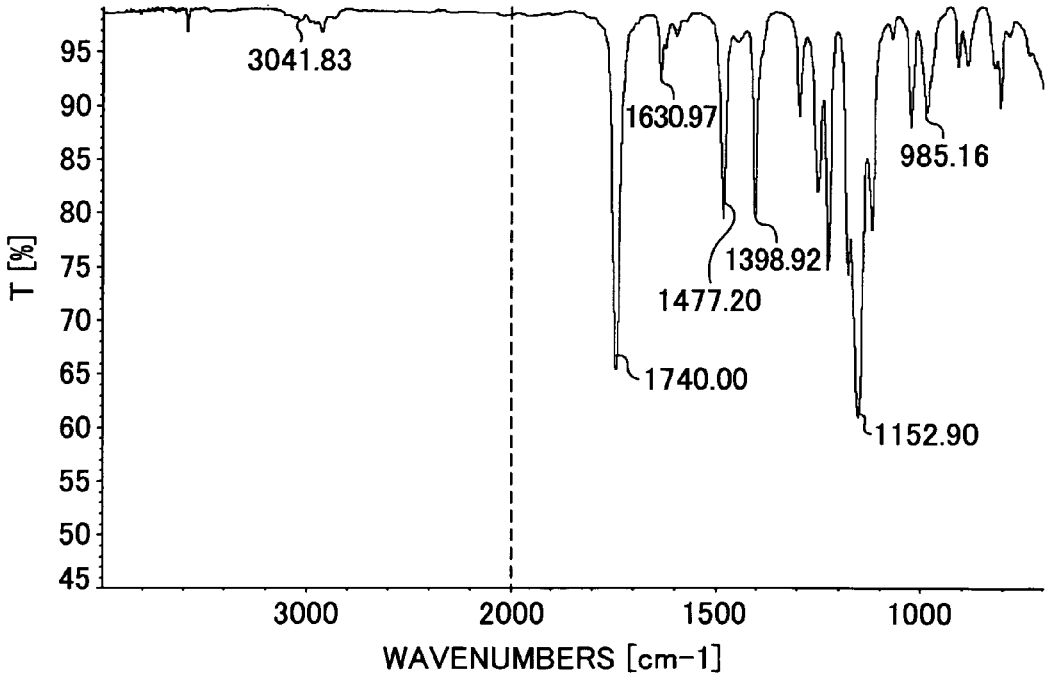

Further, the compound was subjected to an infrared spectroscopic analysis. The spectrum is shown in FIG. 16.

Synthesis Example 13

The radically polymerizable compound having formula J-1-9 was synthesized as follows.

At first, 20 g (0.087 mol) of 4,4'-oxybis(2-methylphenol) was dissolved in 200 ml of tetrahydrofuran. An aqueous solution of sodium hydroxide, which had been prepared by dissolving 13.92 g of sodium hydroxide in 56 ml of water, was dropped into the solution under a nitrogen gas flow. After the solution was cooled to 6° C., 22.10 g (0.348 mol) of acryl chloride was dropped thereinto over one hour. The mixture was agitated for 2.5 hours to complete the reaction. After the reaction product was fed into water, the mixture was subjected to an extraction treatment using toluene. The extracted liquid was repeatedly washed with water. After toluene was removed therefrom, the reaction product was subjected to a column chromatographic treatment using a silica gel as an absorbent, and a mixture solvent of toluene/ethyl acetate (1/1) as a developing solvent to be refined. The thus obtained colorless oily material was mixed with methanol to precipitate a crystal. Thus, 20.04 g of a white crystal (i.e., the compound having formula J-1-9) was obtained. In this regard, the yield was 69.2%.

The melting point of the compound J-1-9 was from 57 to 58° C. In addition, the compound was subjected to an elementary analysis. The results (i.e., the amounts (%) of the elements (C, H and O) in the crystal are as follows.

| | C | H | O |
|---|---|---|---|
| Found value | 71.11 | 5.35 | 23.70 |
| Calculated value | 71.00 | 5.36 | 23.64 |

Figure 17:
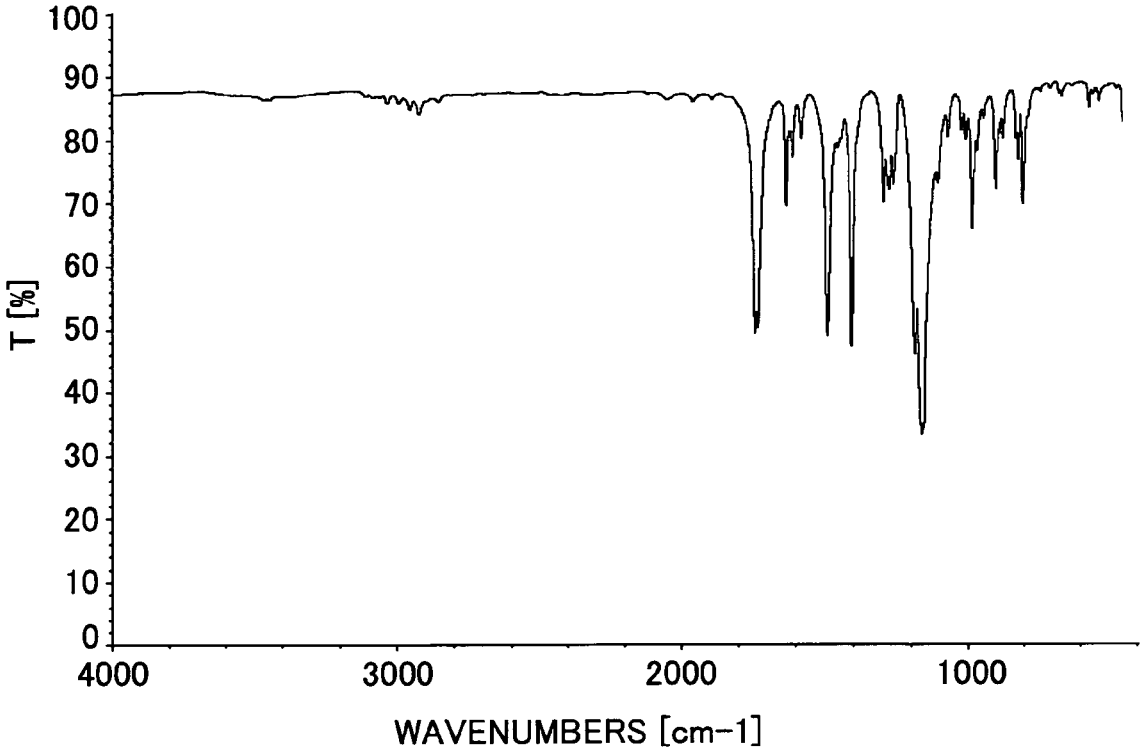

Further, the compound was subjected to an infrared spectroscopic analysis. The spectrum is shown in FIG. 17.

By using this method, other diphenol compounds can be synthesized.

Synthesis Example 14

The radically polymerizable compound having formula K-1-1 was synthesized as follows.

(1) Synthesis of Intermediate Compound having the Following Formula

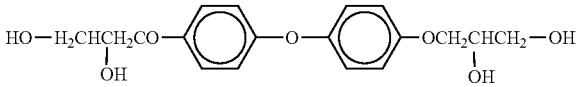

(i.e., Bis{4-(2,3-dihydroxypropyloxy)phenyl}ether)

At first, 5.9 g (0.029 mol) of 4,4'-oxybisphenol and 9.5 g (0.064 mol) of glycidyl methacrylate were dissolved in 50 ml of toluene. After 0.3 ml of triethylamine was added thereto, the mixture was agitated for 9 hours at 95° C. under an argon gas flow. Next, 33 ml of a 10% by weight aqueous solution of sodium hydroxide and 30 ml of toluene were added thereto, and the mixture was agitated for 6 hours at 92° C. The reaction product was neutralized with hydrochloric acid, followed by extraction using ethyl acetate. The extracted liquid was repeatedly washed with water. After removing the solvent from the solution, the reaction product was subjected to a column chromatographic treatment using a silica gel as an absorbent, and a mixture solvent of ethyl acetate/tetrahydrofuran (1/1) as a developing solvent to be refined. Thus, 8.6 g of a colorless powder (i.e., the intermediate compound, Bis{4-(2,3-dihydroxypropyloxy)phenyl}ether) was obtained. In this regard, the yield was 85%.

(2) Synthesis of the Compound having Formula K-1-1

At first, 3.54 g (0.010 mol) of the above-prepared intermediate compound was dissolved in 40 ml of dimethylacetamide. After 7.7 g (60.7 mmol) of 3-chloropropionyl chloride was added thereto at 3° C. under an argon gas flow, the mixture was agitated for 7 hours at room temperature. Next, 20 ml of triethylamine was added thereto at 3° C., and the mixture was agitated for 5 hours at 60° C. to complete the reaction. After the reaction product was fed into water, the mixture was subjected an extraction treatment using dichloromethane. The extracted liquid was repeatedly washed with water. After the solvent (dichloromethane) was removed therefrom, the reaction product was subjected to a column chromatographic treatment using a silica gel as an absorbent, and a mixture solvent of n-hexane/ethyl acetate (2/1) as a developing solvent to be refined. Thus, 4.52 g of an oily material (i.e., the compound having formula K-1-1) was obtained. In this regard, the yield was 77.7%.

The compound was subjected to an elementary analysis. The results (i.e., the amounts (%) of the eleme nts (C, H and O) in the oily material) are as follows.

| | C | H | O |
|---|---|---|---|
| Found value | 61.77 | 5.17 | 33.00 |
| Calculated value | 61.85 | 5.19 | 32.96 |

By using this method, other diphenol compounds can be synthesized.

Synthesis Example 15

The radically polymerizable compound having formula L-1-1 was synthesized as follows.

In a reaction vessel equipped with an agitator, a thermometer, and a dropping funnel, 4.0 g (20 mmol) of 4,4'-oxybisphenol, 18.51 g (200 mmol) of epichlorohydrin and 20 ml of toluene were mixed. The mixture was heated to 110° C. under a nitrogen gas flow while agitated. While controlling the temperature of the reaction system in a range of from 100 to 120° C., 9.60 g (48 mmol) of a 20% by weight aqueous solution of sodium hydroxide was dropped thereinto over 30 minutes. The mixture was reacted for 4 hours at 110° C. After the reaction product was cooled to room temperature, excess of epichlorohydrin was collected under a reduced pressure. Next, toluene was added to the reaction product, and the organic phase liquid was washed with water. The thus prepared toluene solution was mixed with anhydrous magnesium sulfate to remove water therefrom, followed by condensation under a reduced pressure. The reaction product was subjected to a column chromatographic treatment using a silica gel as an absorbent, and a mixture solvent of toluene/ethyl acetate (1/1) as a developing solvent to remove raw materials and polymer components therefrom. Thus, 5.05 g of a clear and colorless oily material was obtained.

The oily material was then dissolved in 80 ml of toluene. The toluene solution, 0.72 g (10 mmol) of acrylic acid, and 0.2 ml of triethylamine were fed into a reaction vessel, and the mixture was reacted for 3 hours at 80° C. After cooled, the reaction product was washed with water, followed by condensation under a reduced pressure. The condensed reaction product was dissolved in toluene, and the solution was mixed with 5 g of activated earth to be subjected to an absorptive treatment for 30 minutes, the reaction product was subjected to a column chromatographic treatment using a silica gel as an absorbent, and a mixture solvent of toluene/ethyl acetate (3/1) as a developing solvent to be refined. Thus, 4.5 g of a colorless oily material (i.e., the compound L-1-1) was obtained.

It was found by measurement of the molecular weight by gel permeation chromatography that the oily material includes components having a repeat number of from 1 to 10 as main components.

By using this method, other diphenol compounds can be synthesized.

Example 1

Formation of Photosensitive Layer

The following components were mixed and dispersed for 24 hours using a ball mill containing zirconia balls to prepare a pigment dispersion having a solid content of 3% by weight.

| | |
|---|---|
| Metal-free phthalocyanine (FASTOGEN BLUE 8120B from Dainippon Ink & Chemicals, Inc.) | 2 parts |
| Tetrahydrofuran | 64.7 parts |
| The following components were mixed to prepare a solution. | |
| Charge transport material having the following formula | 24 parts |

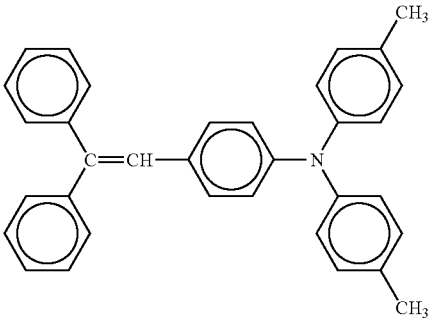

| | |
|---|---|
| Diphenoxy compound (2,6-dimethyl-2',6'-di-tert-butyl-diphenoquinone) | 20 parts |
| Bisphenol Z-form polycarbonate (PANLITE TS-2050 from Teijin Chemicals Ltd.) | 41 parts |
| Tetrahydrofuran | 317.3 parts |
| 1% tetrahydrofuran solution of silicone oil (silicone oil: KF50-100CS from Shin-Etsu Chemical Co., Ltd.) | 0.2 parts |

The thus prepared solution was mixed with the above-prepared pigment dispersion to prepare a photosensitive layer coating liquid.

The photosensitive layer coating liquid was applied on the peripheral surface of an aluminum cylinder with a diameter of 30 mm by a dip coating method, followed by drying. Thus, a photosensitive layer with a thickness of 23 μm was formed on the surface of the aluminum cylinder.

Formation of Outermost Layer

The following components were mixed in a dark place to prepare an outermost layer coating liquid.

| | |
|---|---|
| Radically polymerizable compound B-2-4 | 20 parts |
| Photopolymerization initiator (1-hydroxycyclohexyl phenyl ketone, IRGACURE 184 from Ciba Specialty Chemicals) | 1 part |
| Tetrahydrofuran | 100 parts |

The outermost layer coating liquid was coated on the photosensitive layer by a spray coating method, followed by natural drying for 5 minutes. Next the outermost layer was exposed to light to be crosslinked. The irradiation conditions are as follows:

Light source: Metal halide lamp with a power of 160 W/cm

Irradiation distance: 120 mm

Illuminance: 800 mW/cm$^2$

Irradiation time 60 seconds

Further, the layer (i.e., photoreceptor) was heated for 20 minutes at 130° C. Thus, an outermost layer having a thickness of 2 μm was formed on the photosensitive layer.

Thus, a photoreceptor of Example 1 of the present invention was prepared.

Example 2

The procedure for preparation of the photoreceptor in Example 1 was repeated except that the outermost layer coating liquid was replaced with the following outermost layer coating liquid and the thickness of the outermost layer was changed to 5 μm.

Outermost Layer Coating Liquid

| | |
|---|---|
| Radically polymerizable compound B-2-4 | 10 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 2 of the present invention was prepared.

Example 3

The procedure for preparation of the photoreceptor in Example 1 was repeated except that the outermost layer coating liquid was replaced with the following outermost layer coating liquid.

Outermost Layer Coating Liquid

| | |
|---|---|
| Radically polymerizable compound C-1-1 | 20 parts |
| Photopolymerization initiator (IRGACURE 184 from Ciba Specialty Chemicals) | 1 part |
| Tetrahydrofuran | 100 parts |

Thus, a photoreceptor of Example 3 of the present invention was prepared.

Example 4

The procedure for preparation of the photoreceptor in Example 1 was repeated except that the outermost layer coating liquid was replaced with the following outermost layer coating liquid and the thickness of the outermost layer was changed to 5 μm.

Outermost Layer Coating Liquid

| | |
|---|---|
| Radically polymerizable compound C-1-1 | 10 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 4 of the present invention was prepared.

Example 5

The procedure for preparation of the photoreceptor in Example 1 was repeated except that the outermost layer coating liquid was replaced with the following outermost layer coating liquid.

Outermost Layer Coating Liquid

| | |
|---|---|
| Radically polymerizable compound D-1-4 | 20 parts |
| Photopolymerization initiator (IRGACURE 184 from Ciba Specialty Chemicals) | 1 part |
| Tetrahydrofuran | 100 parts |

Thus, a photoreceptor of Example 5 of the present invention was prepared.

Example 6

The procedure for preparation of the photoreceptor in Example 1 was repeated except that the outermost layer coating liquid was replaced with the following outermost layer coating liquid and the thickness of the outermost layer was changed to 5 μm.

Outermost Layer Coating Liquid

| | |
|---|---|
| Radically polymerizable compound D-1-4 | 10 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 6 of the present invention was prepared.

Example 7

Formation of Undercoat Layer

The following components were mixed for 48 hours using a ball mill containing alumina balls, followed by filtering using a 500-mesh stainless screen to prepare an undercoat layer coating liquid.

| | |
|---|---|
| Alkyd resin (BEKKOLITE M6401-50 from Dainippon Ink And Chemicals, Inc.) | 6 parts |
| Melamine resin (SUPER BEKKAMINE G-821-60 from Dainippon Ink And Chemicals, Inc.) | 4 parts |
| Titanium oxide | 40 parts |
| Methyl ethyl ketone | 50 parts |

The undercoat layer coating liquid was applied on an aluminum drum having an outside diameter of 30 mm, and the coated liquid was dried. Thus, an undercoat layer having a thickness of about 3.5 μm was prepared.

Formation of Charge Generation Layer (CGL)

The following components were mixed and dispersed for 10 days using a ball mill containing zirconia balls to prepare a pigment dispersion having a solid content of 10% by weight.

| | |
|---|---|
| Bisazo pigment having the following formula | 2.5 parts |

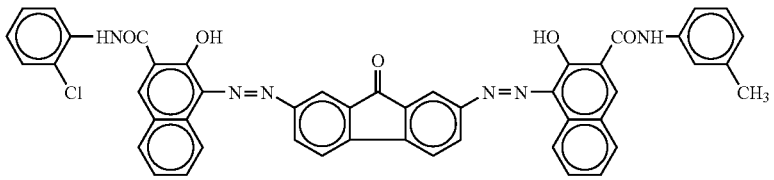

| | |
|---|---|
| Methyl ethyl ketone | 22.5 parts |

Next, 58.3 g of cyclohexanone were added to the dispersion, and the mixture was dispersed for 2 hours using the ball mill to prepare a 3% pigment dispersion.

The following components were mixed to prepare a solution.

| | |
|---|---|
| Polyvinyl butyral resin (XYHL, manufactured by Union Carbide Corp.) | 0.5 parts |
| Methyl ethyl ketone | 57.5 parts |
| Cyclohexanone | 141.7 parts |

The thus prepared solution was mixed with the above-prepared pigment dispersion while agitated. The mixture was filtered using a 1000-mesh stainless screen to prepare a CGL coating liquid.

The CGL coating liquid was applied on the undercoat layer, and the coated liquid was dried to prepare a CGL having a thickness of about 0.2 μm.

Formation of Charge Transport Layer (CTL)

The following components were mixed to prepare a solution, i.e., a CTL coating liquid.

| | |
|---|---|
| Bisphenol Z-form polycarbonate (PANLITE TS-2050manufactured by Teijin Chemicals Ltd.) | 10 parts |
| CTM having the following formula | 7 parts |

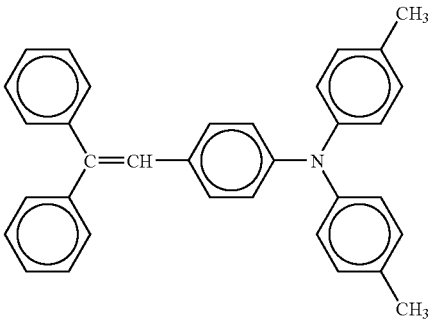

| | |
|---|---|
| Tetrahydrofuran | 100 parts |
| 1% tetrahydrofuran solution of silicone oil (Silicone oil: KF50-100CS from Shin-Etsu Chemical Co., Ltd.) | 1 part |

The CTL coating liquid was applied on the CGL, and the coated liquid was dried to prepare a CTL having a thickness of about 18 μm.

Formation of Outermost Layer

The following components were mixed in a dark place to prepare an outermost layer coating liquid.

| | |
|---|---|
| Radically polymerizable compound B-2-4 | 20 parts |
| Photopolymerization initiator (IRGACURE 184 from Ciba Specialty Chemicals) | 1 part |
| Tetrahydrofuran | 100 parts |

The outermost layer coating liquid was coated on the photosensitive layer by a spray coating method, followed by natural drying for 5 minutes. Next the outermost layer was exposed to light to be crosslinked. The irradiation conditions are as follows:

Light source: Metal halide lamp with a power of 160 W/cm

Irradiation distance: 120 mm

Illuminance: 800 mW/cm$^2$

Irradiation time 60 seconds

Further, the layer (i.e., photoreceptor) was heated for 20 minutes at 130° C. Thus, an outermost layer having a thickness of 3 μm was formed on the photosensitive layer.

Thus, a photoreceptor of Example 7 of the present invention was prepared.

Example 8

The procedure for preparation of the photoreceptor in Example 7 was repeated except that the outermost layer coating liquid was replaced with the following outermost layer coating liquid.

Outermost Layer Coating Liquid

| | |
|---|---|
| Radically polymerizable compound C-1-1 | 20 parts |
| Photopolymerization initiator (IRGACURE 184 from Ciba Specialty Chemicals) | 1 part |
| Tetrahydrofuran | 100 parts |

Thus, a photoreceptor of Example 8 of the present invention was prepared.

Example 9

The procedure for preparation of the photoreceptor in Example 7 was repeated except that the outermost layer coating liquid was replaced with the following outermost layer coating liquid.

Outermost Layer Coating Liquid

| | |
|---|---|
| Radically polymerizable compound D-1-4 | 20 parts |
| Photopolymerization initiator (IRGACURE 184 from Ciba Specialty Chemicals) | 1 part |
| Tetrahydrofuran | 100 parts |

Thus, a photoreceptor of Example 9 of the present invention was prepared.

Example 10

The procedure for preparation of the photoreceptor in Example 7 was repeated except that the outermost layer coating liquid was replaced with the following outermost layer coating liquid, and the thickness of the outermost layer was changed to 7 μm.

Outermost Layer Coating Liquid

| | |
|---|---|
| Radically polymerizable compound B-1-1 | 5 parts |
| Monomer having three or more radically polymerizable functional group having the following formula (i.e., trimethylol propane triacrylate, KAYARAD TMPTA, from Nippon Kayaku Co., Ltd.) | 5 parts |

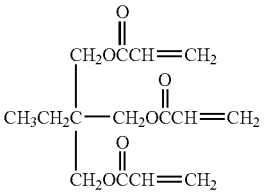

| | |
|---|---|
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 10 of the present invention was prepared.

Example 11

The procedure for preparation of the photoreceptor in Example 7 was repeated except that the outermost layer coating liquid was replaced with the following outermost layer coating liquid, and the thickness of the outermost layer was changed to 7 μm.

Outermost Layer Coating Liquid

| | |
|---|---|
| Radically polymerizable compound B-1-5 (The compound B-1-5 is a diacrylate prepared from 9,9-bis(4-hydroxy-3-methylphenyl)fluorine (B2396 from Tokyo Kasei Kogyo Co., Ltd.) using the same method as that used for preparing compound B-1-1) | 5 parts |
| Monomer having three or more radically polymerizable functional group having the following formula (i.e., dipentaerythritolcaprolactone-modified hexaacrylate, KAYARAD DPCA-120, from Nippon Kayaku Co., Ltd.) | 5 parts |

-continued

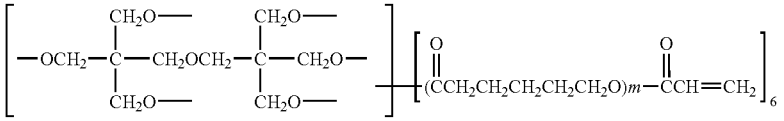

(m is 2 in average)

| | |
|---|---|
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 11 of the present invention was prepared.

Example 12

The procedure for preparation of the photoreceptor in Example 7 was repeated except that the outermost layer coating liquid was replaced with the following outermost layer coating liquid.

Outermost Layer Coating Liquid

| | |
|---|---|
| Radically polymerizable compound B-1-7 (The compound B-1-7 is a diacrylate prepared from 1,1-bis(3-cyclohexyl-4-hydroxyphenyl)cyclohexane (B2752 from Tokyo Kasei Kogyo Co., Ltd.) using the same method as that used for preparing compound B-1-1) | 5 parts |
| Monomer having three or more radically polymerizable functional group (dipentaerythritolcaprolactone-modified hexaacrylate, KAYARAD DPCA-120, from Nippon Kayaku Co., Ltd.) | 5 parts |
| CTM having one or more radically polymerizable functional group (Compound No. 109 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 12 of the present invention was prepared.

Example 13

The procedure for preparation of the photoreceptor in Example 7 was repeated except that the outermost layer coating liquid was replaced with the following outermost layer coating liquid, and the thickness of the outermost layer was changed to 7 μm.

Outermost Layer Coating Liquid

| | |
|---|---|
| Radically polymerizable compound B-1-10 (The compound B-1-10 is a diacrylate prepared from a diphenol (BISP-PZ from Honshu Chemical Industry Co., Ltd.) using the same method as that used for preparing compound B-1-1) | 5 parts |
| Monomer having three or more radically polymerizable functional group having the following formula (i.e., trimethylol propane triacrylate, KAYARAD TMPTA, from Nippon Kayaku Co., Ltd.) | 5 parts |
| CTM having one or more radically polymerizable functional group (Compound No. 54 mentioned above) | 10 parts |

-continued

| | |
|---|---|
| Photopolymerization initiator (IRGACURE 184 from Ciba Specialty Chemicals) | 1 part |
| Tetrahydrofuran | 100 parts |

Thus, a photoreceptor of Example 13 of the present invention was prepared.

Example 14

The procedure for preparation of the photoreceptor in Example 7 was repeated except that the outermost layer coating liquid was replaced with the following outermost layer coating liquid, and the thickness of the outermost layer was changed to 7 μm.

Outermost Layer Coating Liquid

| | |
|---|---|
| Radically polymerizable compound B-1-12 (The compound B-1-12 is a diacrylate prepared by the same method as that used for preparing compound B-1-1 except that acryl chloride was replaced with methacryl chloride) | 5 parts |
| Monomer having three or more radically polymerizable functional group having the following formula (i.e., dipentaerythritol hexaacrylate, KAYARAD DPHA, from Nippon Kayaku Co., Ltd.) | 5 parts |

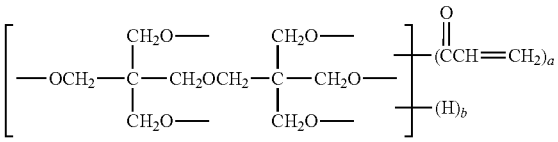

(Mixture of compound having formula in which a = 5 and b = 1 and compound having formula in which a = 6 and b = 0 is a main component)

| | |
|---|---|
| CTM having one or more radically polymerizable functional group (Compound No. 147 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 14 of the present invention was prepared.

Example 15

The procedure for preparation of the photoreceptor in Example 7 was repeated except that the outermost layer coating liquid was replaced with the following outermost layer coating liquid, and the thickness of the outermost layer was changed to 7 μm.

Outermost Layer Coating Liquid

| | |
|---|---|
| Radically polymerizable compound B-2-4 | 10 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 15 of the present invention was prepared.

Example 16

The procedure for preparation of the photoreceptor in Example 7 was repeated except that the outermost layer coating liquid was replaced with the following outermost layer coating liquid, and the thickness of the outermost layer was changed to 7 μm.

Outermost Layer Coating Liquid

| | |
|---|---|
| Radically polymerizable compound C-1-1 | 10 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 16 of the present invention was prepared.

Example 17

The procedure for preparation of the photoreceptor in Example 7 was repeated except that the outermost layer coating liquid was replaced with the following outermost layer coating liquid, and the thickness of the outermost layer was changed to 7 μm.

Outermost Layer Coating Liquid

| | |
|---|---|
| Radically polymerizable compound C-1-11 (The compound C-1-11 is a dimethacrylate-diacrylate prepared from 9,9-bis(4-hydroxy-3-methylphenyl)fluorine (B2396 from Tokyo Kasei Kogyo Co., Ltd.) using a method in which at first a dimethacrylate is prepared in the process C1-1 using glycidyl methacrylate and then a dimethacrylate-diacrylate is prepared using 3-chloropropionyl chloride) | 5 parts |
| Monomer having three or more radically polymerizable functional group having the following formula (i.e., trimethylolpropane triacrylate, KAYARAD TMPTA, from Nippon Kayaku Co., Ltd.) | 5 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 17 of the present invention was prepared.

Example 18

The procedure for preparation of the photoreceptor in Example 7 was repeated except that the outermost layer coating liquid was replaced with the following outermost layer coating liquid, and the thickness of the outermost layer was changed to 7 μm.

Outermost Layer Coating Liquid

| | |
|---|---|
| Radically polymerizable compound D-1-1 (The compound D-1-1 is a diacrylate prepared using the same method as that used for preparing the compound D-1-4 except that the added amount of epichlorohydrin is increased) | 10 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 18 of the present invention was prepared.

Example 19

The procedure for preparation of the photoreceptor in Example 7 was repeated except that the outermost layer coating liquid was replaced with the following outermost layer coating liquid, and the thickness of the outermost layer was changed to 7 μm.

Outermost Layer Coating Liquid

| | |
|---|---|
| Radically polymerizable compound D-1-4 | 5 parts |
| Monomer having three or more radically polymerizable functional group having the following formula (i.e., dipentaerythritol hexaacrylate, KAYARAD DPHA, from Nippon Kayaku Co., Ltd.) | 5 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 19 of the present invention was prepared.

Comparative Example 1

The procedure for preparation of the photoreceptor in Example 1 was repeated except that the outermost layer coating liquid was replaced with the following outermost layer coating liquid.

Outermost Layer Coating Liquid

| | |
|---|---|
| Radically polymerizable compound having the following formula | 20 parts |

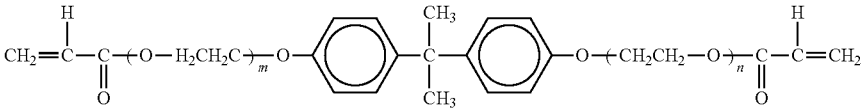

m + n = 3

| | |
|---|---|
| (i.e., ethyleneoxide-modified bisphenol A diacrylate, ABE-300 from Shin-Nakamura Chemical Co., Ltd.) | |
| Photopolymerization initiator (IRGACURE 184 from Ciba Specialty Chemicals) | 1 part |
| Tetrahydrofuran | 100 parts |

Thus, a photoreceptor of Comparative Example 1 was prepared.

Comparative Example 2

The procedure for preparation of the photoreceptor in Example 7 was repeated except that the outermost layer coating liquid was replaced with the following outermost layer coating liquid and the thickness of the outermost layer was changed to 5 μm.

Outermost Layer Coating Liquid

| | |
|---|---|
| Radically polymerizable compound having the following formula (ethyleneoxide-modified bisphenol A diacrylate, ABE-300 from Shin-Nakamura Chemical Co., Ltd.) | 10 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 2 was prepared.

Comparative Example 3

The procedure for preparation of the photoreceptor in Example 7 was repeated except that the outermost layer coating liquid was replaced with the following outermost layer coating liquid.

Outermost Layer Coating Liquid

| | |
|---|---|
| Radically polymerizable compound (ethyleneoxide-modified bisphenol A diacrylate, ABE-300 from Shin-Nakamura Chemical Co., Ltd.) | 20 parts |
| Photopolymerization initiator (IRGACURE 184 from Ciba Specialty Chemicals) | 1 part |
| Tetrahydrofuran | 100 parts |

Thus, a photoreceptor of Comparative Example 3 was prepared.

Comparative Example 4

The procedure for preparation of the photoreceptor in Example 7 was repeated except that the outermost layer coating liquid was replaced with the following outermost layer coating liquid and the thickness of the outermost layer was changed to 7 μm.

Outermost Layer Coating Liquid

| | |
|---|---|
| Radically polymerizable compound having the following formula (ethyleneoxide-modified bisphenol A diacrylate, ABE-300 from Shin-Nakamura Chemical Co., Ltd.) | 10 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 4 was prepared.

Comparative Example 5

The procedure for preparation of the photoreceptor in Example 7 was repeated except that the outermost layer coating liquid was replaced with the following outermost layer coating liquid and the thickness of the outermost layer was changed to 7 μm.

Outermost Layer Coating Liquid

| | |
|---|---|
| Radically polymerizable compound having the following formula (ethyleneoxide-modified bisphenol A diacrylate, ABE-300 from Shin-Nakamura Chemical Co., Ltd.) | 5 parts |
| Monomer having three or more radically polymerizable functional group (trimethylolpropane triacrylate, KAYARAD TMPTA, from Nippon Kayaku Co., Ltd.) | 5 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 5 was prepared.

Comparative Example 6

The procedure for preparation of the photoreceptor in Example 7 was repeated except that the outermost layer coating liquid was replaced with the following outermost layer coating liquid.

Outermost Layer Coating Liquid

| | |
|---|---|
| Monomer having three or more radically polymerizable functional group (dipentaerythritol hexaacrylate, KAYARAD DPHA, from Nippon Kayaku Co., Ltd.) | 20 parts |
| Photopolymerization initiator (IRGACURE 184 from Ciba Specialty Chemicals) | 1 part |
| Tetrahydrofuran | 100 parts |

Thus, a photoreceptor of Comparative Example 6 was prepared.

Comparative Example 7

The procedure for preparation of the photoreceptor in Example 7 was repeated except that the outermost layer coating liquid was replaced with the following outermost layer coating liquid, and the thickness of the outermost layer was changed to 7 μm.

Outermost Layer Coating Liquid

| | |
|---|---|
| Monomer having three or more radically polymerizable functional group (dipentaerythritol hexaacrylate, KAYARAD DPHA, from Nippon Kayaku Co., Ltd.) | 10 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 7 was prepared.

Comparative Example 8

The procedure for preparation of the photoreceptor in Example 7 was repeated except that the outermost layer coating liquid was replaced with the following outermost layer coating liquid, and the thickness of the outermost layer was changed to 7 μm.

Outermost Layer Coating Liquid

| | |
|---|---|
| Monomer having three or more radically polymerizable functional group (i.e., neopentylglycol diacrylate, KAYARAD NPGDA, from Nippon Kayaku Co., Ltd.) | 10 parts |

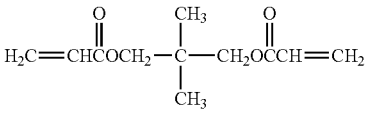

| | |
|---|---|
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 8 was prepared.

Comparative Example 9

The procedure for preparation of the photoreceptor in Example 1 was repeated except that the outermost layer was not formed, and the thickness of the photosensitive layer was changed to 28 μm.

Thus, a photoreceptor of Comparative Example 9 was prepared.

Comparative Example 10

The procedure for preparation of the photoreceptor in Example 7 was repeated except that the outermost layer was not formed, and the thickness of the CTL was changed to 25 μm.

Thus, a photoreceptor of Comparative Example 10 was prepared.

Each of the photoreceptors of Examples 1 to 19 and Comparative Examples 1 to 10 was set in a process cartridge, and the process cartridge was set in an image forming apparatus (i.e., modified IMAGIO NEO 271 from Ricoh Co., Ltd.) to perform a running test in which 50,000 copies of an original image with A-4 size are produced. The image forming conditions were as follows.

Light used for forming electrostatic images: semiconductor laser light with wavelength of 655 nm Initial potential of non-irradiated portion of photoreceptor: −750V Environmental conditions: normal temperature and normal humidity The following properties of each photoreceptor were evaluated.

1-1. Potential of Irradiated and Non-Irradiate Portions of Photoreceptor

Potentials of irradiated (lighted) and non-irradiate (dark) portions of each photoreceptor were checked when the first and 50,000$^{th}$ images were produced.

1-2. Abrasion Loss

The total thickness of the layers formed on each photoreceptor was measured with an instrument (FISCHER SCOPE MMS from Fischer Instruments K.K.) before and after the 50,000-copy running test to determine the abrasion loss of the outermost layer (or the photosensitive layer) of each photoreceptor.

1-3. Image Qualities

The 50,000$^{th}$ image was visually observed to determine whether the image has abnormal images such as low density images, poor resolution images, and images with background development.

The evaluation results are shown in Table 1.

TABLE 1

| | Initial potential (−V) | | Potential after production of 50,000 images (−V) | | | |
|---|---|---|---|---|---|---|
| | Dark portion | Lighted portion | Dark portion | Lighted portion | Abrasion loss (μm) | Image qualities |
| Ex. 1 | 750 | 105 | 730 | 115 | 0.8 | Good |
| Ex. 2 | 750 | 90 | 725 | 85 | 1.0 | Good |
| Ex. 3 | 750 | 110 | 730 | 120 | 0.6 | Good |
| Ex. 4 | 750 | 100 | 720 | 90 | 0.8 | Good |
| Ex. 5 | 750 | 115 | 730 | 125 | 0.7 | Good |
| Ex. 6 | 750 | 100 | 725 | 110 | 0.9 | Good |
| Ex. 7 | 750 | 100 | 750 | 110 | 0.8 | Good |
| Ex. 8 | 750 | 105 | 750 | 115 | 0.6 | Good |

TABLE 1-continued

| | Initial potential (−V) | | Potential after production of 50,000 images (−V) | | | |
|---|---|---|---|---|---|---|
| | Dark portion | Lighted portion | Dark portion | Lighted portion | Abrasion loss (μm) | Image qualities |
| Ex. 9 | 750 | 105 | 750 | 115 | 0.7 | Good |
| Ex. 10 | 750 | 85 | 735 | 80 | 1.0 | Good |
| Ex. 11 | 750 | 80 | 740 | 80 | 0.7 | Good |
| Ex. 12 | 750 | 75 | 740 | 65 | 0.8 | Good |
| Ex. 13 | 750 | 85 | 735 | 80 | 1.0 | Good |
| Ex. 14 | 750 | 110 | 730 | 125 | 0.8 | Good |
| Ex. 15 | 750 | 85 | 745 | 85 | 1.0 | Good |
| Ex. 16 | 750 | 85 | 740 | 80 | 0.8 | Good |
| Ex. 17 | 750 | 90 | 735 | 85 | 0.9 | Good |
| Ex. 18 | 750 | 90 | 740 | 90 | 1.0 | Good |
| Ex. 19 | 750 | 95 | 730 | 85 | 0.8 | Good |
| Comp. Ex. 1 | 750 | 110 | 710 | 130 | 2.0 | Good |
| Comp. Ex. 2 | 750 | 100 | 690 | 95 | 3.0 | Good |
| Comp. Ex. 3 | 750 | 115 | 700 | 135 | 2.3 | Slightly low density image |
| Comp. Ex. 4 | 750 | 95 | 695 | 100 | 3.0 | Good |
| Comp. Ex. 5 | 750 | 100 | 690 | 85 | 1.5 | Good |
| Comp. Ex. 6 | 750 | 150 | 650 | 180 | 0.4 | Low density image |
| Comp. Ex. 7 | 750 | 100 | 670 | 80 | 0.8 | Poor resolution image (broadened line image) |
| Comp. Ex. 8 | 750 | 85 | 680 | 150 | 3.4 | Low density image |
| Comp. Ex. 9 | 750 | 80 | 650 | 140 | 7.2 | Background development |
| Comp. Ex. 10 | 750 | 65 | 730 | 90 | 6.6 | Slight background development |

The following is clearly understood from Table 1.

(1) The photoreceptors of Comparative Examples 9 and 10, which have no crosslinked protective layer, have heavy abrasion loss, and therefore image qualities deteriorate after production of 50,000 images. In contrast, the photoreceptors of Examples 1-19 of the present invention have light abrasion loss and can produce high quality images.

(2) Although the photoreceptors of Comparative Examples 1-4, which have a protective layer prepared by using a bisphenol A-form diacrylate compound, have better abrasion resistance than the photoreceptors having no protective layer, the abrasion loss of the photoreceptors is greater than that of the photoreceptors of Examples 1-19.

Specifically, about half of the protective layer of the photoreceptors of Comparative Examples 1-4 is lost due to the running test.

(3) The photoreceptors of Comparative Examples 5-7, which have a protective layer prepared by using a monomer having three or more functional groups, have good abrasion resistance, but produce abnormal images such as low density images and broadened line images (i.e., images with poor resolution).

(4) The photoreceptor of Comparative Example 8, which has a protective layer prepared by using a monomer having two functional groups, has heavy abrasion loss to an extent such that the protective layer is almost lost.

Thus, it is clear from Table 1 that the photoreceptors of Examples 1-19 of the present invention is superior to the comparative photoreceptors as a whole.

After the 50,000-copy running test, each of the photoreceptors of Examples 1-19 and Comparative Examples 1-7 was further evaluated as follows.

2-1. Image Qualities under Low Temperature and Low Humidity Condition (10° C. and 15% RH)

Copies of an image evaluation test chart were produced by the same method as that mentioned above in paragraph 1-3 except that the environmental condition was changed to 10° C. and 15% RH to determine whether or not the image density decreases.

2-2. Image Qualities Under High Temperature and High Humidity Condition (30° C. and 90% RH)

Copies of an image evaluation test chart were produced by the same method as that mentioned above in paragraph 1-3 except that the environmental condition was changed to 30° C. and 90% RH to determine whether or not a tailed image is produced.

2-3. NOx Exposure Test

After the image tests under the low temperature/low humidity and high temperature/high humidity conditions, each photoreceptor was exposed to NOx gasses under the below-mentioned conditions and then subjected to the image test mentioned above in paragraph 2-1 under a normal temperature and normal humidity (20° C. and 55% RH) condition.

NOx Exposure Conditions

NOx exposure tester: DY-0102N from Dylec Inc.

Concentration of NOx: NO; 10 ppm, $NO_2$; 40 ppm

Exposure time: 48 hours

The produced images were visually observed to determine whether or not the resolution deteriorates. The images were graded as follows.

◎: The image qualities do not deteriorate.

○: The image qualities of part of images slightly deteriorate.

Δ: The image qualities of part of images clearly deteriorate.

×: The image qualities of the entire images deteriorate.

The results are shown in Table 2.

TABLE 2

| | 10° C. and 30% RH Image density | 30° C. and 90% RH Tailing | NOx exposure test Resolution |
|---|---|---|---|
| Ex. 1 | ○ | ◎ | ◎ |
| Ex. 2 | ◎ | ◎ | ◎ |
| Ex. 3 | ○ | ◎ | ◎ |
| Ex. 4 | ◎ | ◎ | ◎ |
| Ex. 5 | ○ | ◎ | ◎ |
| Ex. 6 | ◎ | ◎ | ◎ |
| Ex. 7 | ○ | ◎ | ◎ |
| Ex. 8 | ○ | ◎ | ◎ |
| Ex. 9 | ○ | ◎ | ◎ |
| Ex. 10 | ◎ | ◎ | ○ |
| Ex. 11 | ◎ | ◎ | ◎ |
| Ex. 12 | ◎ | ◎ | ◎ |
| Ex. 13 | ◎ | ◎ | ○ |
| Ex. 14 | ○ | ◎ | ○ |
| Ex. 15 | ◎ | ◎ | ◎ |
| Ex. 16 | ◎ | ◎ | ◎ |
| Ex. 17 | ◎ | ○ | ◎ |
| Ex. 18 | ◎ | ◎ | ○ |
| Ex. 19 | ○ | ◎ | ○ |
| Comp. Ex. 1 | ○ | Δ | Δ |
| Comp. Ex. 2 | ◎ | Δ | Δ |
| Comp. Ex. 3 | ○ | Δ | Δ |
| Comp. Ex. 4 | ○ | Δ | Δ |
| Comp. Ex. 5 | ○ | Δ | X |
| Comp. Ex. 6 | X | X | X |
| Comp. Ex. 7 | Δ | Δ | X |

The following is clearly understood from Table 2.

(1) The images produced by the photoreceptors of Examples 1, 3, 5 and 7-9, each of which includes a crosslinked outermost layer including no CTM, have a slightly low image density under the low temperature/low humidity condition, but the image quality is still acceptable. This is because the photoreceptors have slightly low photosensitivity under the condition.

(2) The resolution of the images produced by the photoreceptors of Examples 10, 13, 14, 18 and 19, in which the crosslinked outermost layer is prepared using radically polymerizable monomers including a tri- or more-functional monomer, slightly deteriorates after the photoreceptors are exposed to NOx, but the image quality is still acceptable.

(3) The photoreceptors of Examples 2, 4, 6, 11, 12, 15, and 16 can produce high quality images under these conditions.

(4) The image qualities of the photoreceptors of Comparative Examples 6 and 7, each of which has a crosslinked outermost layer prepared by using a tri- or more-functional radically polymerizable monomer, seriously deteriorate with respect to image density, tailing and resolution.

(5) The image qualities of the photoreceptors of Comparative Examples 1-5, each of which has a crosslinked outermost layer prepared by using a bisphenol A diacrylate monomer, are better than those of the photoreceptors of Comparative Examples 6 and 7, but are not satisfactory.

Thus, it is clear from Table 2 that the photoreceptors of Examples 1-19, each of which has a crosslinked outermost layer prepared by using a radically polymerizable compound having a unit (A), have a good combination of abrasion resistance, environmental stability and resistance to NOx.

Example 20

Formation of Photosensitive Layer

The following components were mixed and dispersed for 24 hours using a ball mill containing zirconia balls to prepare a pigment dispersion having a solid content of 3% by weight.

| | |
|---|---|
| Metal-free phthalocyanine (FASTOGEN BLUE 8120B from Dainippon Ink & Chemicals, Inc.) | 2 parts |
| Tetrahydrofuran | 64.7 parts |
| The following components were mixed to prepare a solution. | |
| Charge transport material having the following formula | 24 parts |

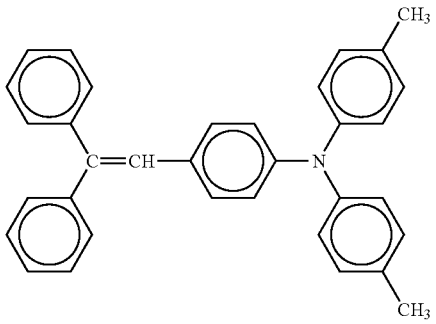

| | |
|---|---|
| Diphenoxy compound (2,6-dimethyl-2',6'-di-tert-butyl-diphenoquinone) | 20 parts |
| Bisphenol Z-form polycarbonate (PANLITE TS-2050 from Teijin Chemicals Ltd.) | 41 parts |
| Tetrahydrofuran | 241.3 parts |

-continued

| | |
|---|---|
| Cyclohexanone | 76 parts |
| 1% tetrahydrofuran solution of silicone oil (silicone oil: KF50-100CS from Shin-Etsu Chemical Co., Ltd.) | 0.2 parts |

The thus prepared solution was mixed with the above-prepared pigment dispersion to prepare a photosensitive layer coating liquid.

The photosensitive layer coating liquid was applied on the peripheral surface of an aluminum cylinder with a diameter of 30 mm by a dip coating method, followed by drying. Thus, a photosensitive layer with a thickness of 23 μm was formed on the surface of the aluminum cylinder.

Formation of Outermost Layer

The following components were mixed in a dark place to prepare an outermost layer coating liquid.

| | |
|---|---|
| Radically polymerizable compound G-1-3 | 20 parts |
| Photopolymerization initiator (1-hydroxycyclohexyl phenyl ketone, IRGACURE 184 from Ciba Specialty Chemicals) | 1 part |
| Tetrahydrofuran | 100 parts |

The outermost layer coating liquid was applied on the photosensitive layer by a spray coating method, followed by natural drying for 20 minutes. Next the outermost layer was exposed to light to be crosslinked. The irradiation conditions are as follows:

Light source: Metal halide lamp with a power of 160 W/cm

Irradiation distance: 120 mm

Illuminance: 500 mW/cm$^2$

Irradiation time 60 seconds

The layer (i.e., photoreceptor) was heated for 20 minutes at 130° C. Thus, an outermost layer having a thickness of 2 μm was formed on the photosensitive layer.

Thus, a photoreceptor of Example 20 of the present invention was prepared.

Example 21

The procedure for preparation of the photoreceptor in Example 20 was repeated except that the outermost layer coating liquid was replaced with the following outermost layer coating liquid.

Outermost Layer Coating Liquid

| | |
|---|---|
| Radically polymerizable compound F-1-4 | 10 parts |
| Monomer having three or more radically polymerizable functional group (trimethylolpropane triacrylate (KAYARAD TMPTA from Nippon Kayaku Co., Ltd.) | 10 parts |
| Photopolymerization initiator (IRGACURE 184 from Ciba Specialty Chemicals) | 1 part |
| Tetrahydrofuran | 100 parts |

Thus, a photoreceptor of Example 21 of the present invention was prepared.

Example 22

The procedure for preparation of the photoreceptor in Example 20 was repeated except that the outermost layer coating liquid was replaced with the following outermost layer coating liquid and the thickness of the outermost layer was changed to 5 μm.

Outermost Layer Coating Liquid

| | |
|---|---|
| Radically polymerizable compound F-1-1 | 5 parts |
| Monomer having three or more radically polymerizable functional group (trimethylolpropane triacrylate (KAYARAD TMPTA from Nippon Kayaku Co., Ltd.) | 5 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 22 of the present invention was prepared.

Example 23

Formation of Undercoat Layer

The following components were mixed to prepare an undercoat layer coating liquid.

| | |
|---|---|
| Alkyd resin (BEKKOLITE M6401-50 from Dainippon Ink And Chemicals, Inc.) | 6 parts |
| Melamine resin (SUPER BEKKAMINE G-821-60 from Dainippon Ink And Chemicals, Inc.) | 4 parts |
| Titanium oxide | 40 parts |
| Methyl ethyl ketone | 50 parts |

The undercoat layer coating liquid was applied on an aluminum drum having an outside diameter of 30 mm, and the coated liquid was dried. Thus, an undercoat layer having a thickness of about 3.5 μm was prepared.

Formation of Charge Generation Layer (CGL)

The following components were mixed and dispersed for 10 days using a ball mill containing zirconia balls to prepare a pigment dispersion having a solid content of 10% by weight.

| | |
|---|---|
| Polyvinyl butyral resin (XYHL, manufactured by Union Carbide Corp.) | 0.5 parts |
| Methyl ethyl ketone | 57.5 parts |
| Cyclohexanone | 141.7 parts |

The thus prepared solution was mixed with the above-prepared pigment dispersion while agitated. The mixture was filtered using a 1000-mesh stainless screen to prepare a CGL coating liquid.

The CGL coating liquid was applied on the undercoat layer, and the coated liquid was dried to prepare a CGL having a thickness of about 0.2 μm.

Formation of Charge Transport Layer (CTL)

The following components were mixed to prepare a CTL coating liquid.

| | |
|---|---|
| Bisphenol Z-form polycarbonate (PANLITE TS-2050 manufactured by Teijin Chemicals Ltd.) | 10 parts |
| CTM having the following formula | 7 parts |

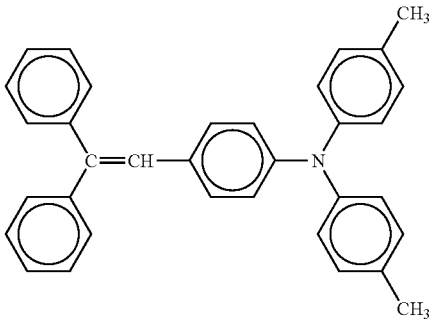

| | |
|---|---|
| Tetrahydrofuran | 100 parts |
| 1% tetrahydrofuran solution of silicone oil (Silicone oil: KF50-100CS from Shin-Etsu Chemical Co., Ltd.) | 1 part |

| | |
|---|---|
| Bisazo pigment having the following formula | 2.5 parts |

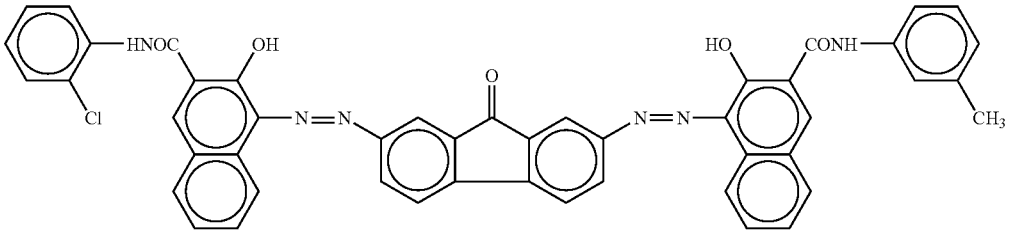

| | |
|---|---|
| Methyl ethyl ketone | 22.5 parts |

Next, 58.3 g of cyclohexanone were added to the dispersion, and the mixture was dispersed for 2 hours using the ball mill to prepare a 3% pigment dispersion.

The following components were mixed to prepare a solution.

The CTL coating liquid was applied on the CGL, and the coated liquid was dried to prepare a CTL having a thickness of about 18 μm.

Formation of Outermost Layer

The following components were mixed in a dark place to prepare an outermost layer coating liquid.

| | |
|---|---|
| Radically polymerizable compound G-1-3 | 10 parts |
| Monomer having three or more radically polymerizable functional group (trimethylolpropane triacrylate (KAYARAD TMPTA from Nippon Kayaku Co., Ltd.) | 10 parts |
| Photopolymerization initiator (IRGACURE 184 from Ciba Specialty Chemicals) | 1 part |
| Tetrahydrofuran | 100 parts |

The outermost layer coating liquid was coated on the photosensitive layer by a spray coating method, followed by natural drying for 20 minutes. Next the outermost layer was exposed to light to be crosslinked. The irradiation conditions are as follows:

Light source: Metal halide lamp with a power of 160 W/cm

Irradiation distance: 120 mm

Illuminance: 500 mW/cm$^2$

Irradiation time 60 seconds

The layer (i.e., photoreceptor) was heated for 20 minutes at 130° C. Thus, an outermost layer having a thickness of 3 μm was formed on the photosensitive layer.

Thus, a photoreceptor of Example 23 of the present invention was prepared.

Example 24

The procedure for preparation of the photoreceptor in Example 23 was repeated except that the outermost layer coating liquid was replaced with the following outermost layer coating liquid.

Outermost Layer Coating Liquid

| | |
|---|---|
| Radically polymerizable compound F-1-1 | 10 parts |
| Monomer having three or more radically polymerizable functional group (trimethylolpropane triacrylate (KAYARAD TMPTA from Nippon Kayaku Co., Ltd.) | 10 parts |
| Photopolymerization initiator (IRGACURE 184 from Ciba Specialty Chemicals) | 1 part |
| Tetrahydrofuran | 100 parts |

Thus, a photoreceptor of Example 24 of the present invention was prepared.

Example 25

The procedure for preparation of the photoreceptor in Example 23 was repeated except that the outermost layer coating liquid was replaced with the following outermost layer coating liquid, and the thickness of the outermost layer was changed to 7 μm.

Outermost Layer Coating Liquid

| | |
|---|---|
| Radically polymerizable compound F-1-1 | 5 parts |
| Monomer having three or more radically polymerizable functional group (trimethylolpropane triacrylate (KAYARAD TMPTA from Nippon Kayaku Co., Ltd.) | 5 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 25 of the present invention was prepared.

Example 26

The procedure for preparation of the photoreceptor in Example 23 was repeated except that the outermost layer coating liquid was replaced with the following outermost layer coating liquid, and the thickness of the outermost layer was changed to 6 μm.

Outermost Layer Coating Liquid

| | |
|---|---|
| Radically polymerizable compound F-1-4 | 5 parts |
| Monomer having three or more radically polymerizable functional group (trimethylolpropane triacrylate (KAYARAD TMPTA from Nippon Kayaku Co., Ltd.) | 5 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 26 of the present invention was prepared.

Example 27

The procedure for preparation of the photoreceptor in Example 23 was repeated except that the outermost layer coating liquid was replaced with the following outermost layer coating liquid, and the thickness of the outermost layer was changed to 5 μm.

Outermost Layer Coating Liquid

| | |
|---|---|
| Radically polymerizable compound F-1-13 (i.e., a diacrylate which is prepared from a diphenol YP-90 from Mitsui Petrochemical Industries, Ltd. using the same method as that used for synthesizing compound F-1-1) | 5 parts |
| Monomer having three or more radically polymerizable functional group (trimethylolpropane triacrylate (KAYARAD TMPTA from Nippon Kayaku Co., Ltd.) | 5 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 27 of the present invention was prepared.

Example 28

The procedure for preparation of the photoreceptor in Example 23 was repeated except that the outermost layer coating liquid was replaced with the following outermost layer coating liquid, and the thickness of the outermost layer was changed to 10 μm.

Outermost Layer Coating Liquid

| | |
|---|---|
| Radically polymerizable compound G-1-3 | 5 parts |
| Monomer having three or more radically polymerizable functional group (trimethylolpropane triacrylate, KAYARAD TMPTA from Nippon Kayaku Co., Ltd.) | 3 parts |
| Monomer having three or more radically polymerizable functional group (caprolactone-modified dipentaerythritol hexaacrylate, KAYARAD DPCA-120 from Nippon Kayaku Co., Ltd.) | 2 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 28 of the present invention was prepared.

Example 29

The procedure for preparation of the photoreceptor in Example 23 was repeated except that the outermost layer coating liquid was replaced with the following outermost layer coating liquid, and the thickness of the outermost layer was changed to 7 μm.

Outermost Layer Coating Liquid

| | |
|---|---|
| Radically polymerizable compound H-1-3 | 4 parts |
| Monomer having three or more radically polymerizable functional group (trimethylolpropane triacrylate, KAYARAD TMPTA from Nippon Kayaku Co., Ltd.) | 6 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 29 of the present invention was prepared.

Example 30

The procedure for preparation of the photoreceptor in Example 23 was repeated except that the outermost layer coating liquid was replaced with the following outermost layer coating liquid, and the thickness of the outermost layer was changed to 8 μm.

Outermost Layer Coating Liquid

| | |
|---|---|
| Radically polymerizable compound G-1-3 | 5 parts |
| Monomer having three or more radically polymerizable functional group (trimethylolpropane triacrylate, KAYARAD TMPTA from Nippon Kayaku Co., Ltd.) | 2 parts |
| Monomer having three or more radically polymerizable functional group (caprolactone-modified dipentaerythritol hexaacrylate, KAYARAD DPCA-120 from Nippon Kayaku Co., Ltd.) | 3 parts |
| CTM having one or more radically polymerizable functional group (Compound No. 182 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 30 of the present invention was prepared.

Example 31

The procedure for preparation of the photoreceptor in Example 23 was repeated except that the outermost layer coating liquid was replaced with the following outermost layer coating liquid, and the thickness of the outermost layer was changed to 5 μm.

Outermost Layer Coating Liquid

| | |
|---|---|
| Radically polymerizable compound G-1-3 | 10 parts |
| CTM having one or more radically polymerizable functional group (Compound No. 109 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 31 of the present invention was prepared.

Example 32

The procedure for preparation of the photoreceptor in Example 23 was repeated except that the outermost layer coating liquid was replaced with the following outermost layer coating liquid, and the thickness of the outermost layer was changed to 5 μm.

Outermost Layer Coating Liquid

| | |
|---|---|
| Radically polymerizable compound G-1-3 | 10 parts |
| CTM having one or more radically polymerizable functional group (Compound No. 146 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 32 of the present invention was prepared.

Comparative Example 11

The procedure for preparation of the photoreceptor in Example 20 was repeated except that the outermost layer was not formed, and the thickness of the photosensitive layer was changed to 25 μm.

Thus, a photoreceptor of Comparative Example 11 was prepared.

Comparative Example 12

The procedure for preparation of the photoreceptor in Example 23 was repeated except that the outermost layer was not formed, and the thickness of the CTL was changed to 21 μm.

Thus, a photoreceptor of Comparative Example 12 was prepared.

Comparative Example 13

The procedure for preparation of the photoreceptor in Example 20 was repeated except that the outermost layer coating liquid was replaced with the following outermost layer coating liquid.

Outermost Layer Coating Liquid

| | |
|---|---|
| Radically polymerizable compound having the following formula | 20 parts |

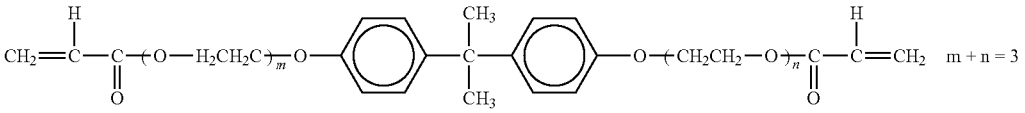

(i.e., ethyleneoxide-modified bisphenol A diacrylate, ABE-300 from Shin-Nakamura Chemical Co., Ltd.)

| | |
|---|---|
| Photopolymerization initiator (IRGACURE 184 from Ciba Specialty Chemicals) | 1 part |
| Tetrahydrofuran | 100 parts |

Thus, a photoreceptor of Comparative Example 13 was prepared.

Comparative Example 14

The procedure for preparation of the photoreceptor in Example 20 was repeated except that the outermost layer coating liquid was replaced with the following outermost layer coating liquid.

Outermost Layer Coating Liquid

| | |
|---|---|
| Radically polymerizable compound (ethyleneoxide-modified bisphenol A diacrylate, ABE-300 from Shin-Nakamura Chemical Co., Ltd.) | 10 parts |
| Monomer having three or more radically polymerizable functional group (trimethylolpropane triacrylate, KAYARAD TMPTA from Nippon Kayaku Co., Ltd.) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 14 was prepared.

Comparative Example 15

The procedure for preparation of the photoreceptor in Example 20 was repeated except that the outermost layer coating liquid was replaced with the following outermost layer coating liquid and the thickness of the outermost layer was changed to 5 μm.

Outermost Layer Coating Liquid

| | |
|---|---|
| Radically polymerizable compound (ethyleneoxide-modified bisphenol A diacrylate, ABE-300 from Shin-Nakamura Chemical Co., Ltd.) | 5 parts |
| Monomer having three or more radically polymerizable functional group (trimethylolpropane triacrylate, KAYARAD TMPTA from Nippon Kayaku Co., Ltd.) | 5 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Comparative Example 16

The procedure for preparation of the photoreceptor in Example 23 was repeated except that the outermost layer coating liquid was replaced with the following outermost layer coating liquid.

Outermost Layer Coating Liquid

| | |
|---|---|
| Radically polymerizable compound (ethyleneoxide-modified bisphenol A diacrylate, ABE-300 from Shin-Nakamura Chemical Co., Ltd.) | 10 parts |
| Monomer having three or more radically polymerizable functional group (trimethylolpropane triacrylate, KAYARAD TMPTA from Nippon Kayaku Co., Ltd.) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 16 was prepared.

Comparative Example 17

The procedure for preparation of the photoreceptor in Example 23 was repeated except that the outermost layer coating liquid was replaced with the following outermost layer coating liquid.

Outermost Layer Coating Liquid

| | |
|---|---|
| Monomer having three or more radically polymerizable functional group (trimethylolpropane triacrylate, KAYARAD TMPTA from Nippon Kayaku Co., Ltd.) | 10 parts |
| Monomer having three or more radically polymerizable functional group (caprolactone-modified dipentaerythritol hexaacrylate, KAYARAD DPCA-120 from Nippon Kayaku Co., Ltd.) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 17 was prepared.

Comparative Example 18

The procedure for preparation of the photoreceptor in Example 23 was repeated except that the outermost layer coating liquid was replaced with the following outermost layer coating liquid and the thickness of the outermost layer was changed to 10 μm.

Outermost Layer Coating Liquid

| | |
|---|---|
| Monomer having three or more radically polymerizable functional group (trimethylolpropane triacrylate, KAYARAD TMPTA from Nippon Kayaku Co., Ltd.) | 10 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 18 was prepared.

Comparative Example 19

The procedure for preparation of the photoreceptor in Example 23 was repeated except that the outermost layer coating liquid was replaced with the following outermost layer coating liquid, and the thickness of the outermost layer was changed to 7 μm.

Outermost Layer Coating Liquid

| | |
|---|---|
| Monomer having three or more radically polymerizable functional group (i.e., neopentylglycol diacrylate, KAYARAD NPGDA, from Nippon Kayaku Co., Ltd.) | 5 parts |

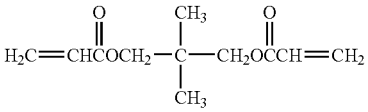

| | |
|---|---|
| Monomer having three or more radically polymerizable functional group (trimethylolpropane triacrylate, KAYARAD TMPTA from Nippon Kayaku Co., Ltd.) | 5 parts |
| Monomer having one or more radically polymerizable functional group (compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 19 was prepared.

Comparative Example 20

The procedure for preparation of the photoreceptor in Example 23 was repeated except that the outermost layer coating liquid was replaced with the following outermost layer coating liquid, and the thickness of the outermost layer was changed to 10 μm.

Outermost Layer Coating Liquid

| | |
|---|---|
| Radically polymerizable compound (ethyleneoxide-modified bisphenol A diacrylate, ABE-300 from Shin-Nakamura Chemical Co., Ltd.) | 5 parts |
| Monomer having three or more radically polymerizable functional group (trimethylolpropane triacrylate, KAYARAD TMPTA from Nippon Kayaku Co., Ltd.) | 3 parts |

-continued

| | |
|---|---|
| Monomer having three or more radically polymerizable functional group (caprolactone-modified dipentaerythritol hexaacrylate, KAYARAD DPCA-120 from Nippon Kayaku Co., Ltd.) | 2 parts |
| Monomer having one or more radically polymerizable functional group (compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 20 was prepared.

Comparative Example 21

The procedure for preparation of the photoreceptor in Example 23 was repeated except that the outermost layer coating liquid was replaced with the following outermost layer coating liquid, and the thickness of the outermost layer was changed to 5 μm.

Outermost Layer Coating Liquid

| | |
|---|---|
| Radically polymerizable compound (ethyleneoxide-modified bisphenol F diacrylate, M-208 from Toa Gosei Chemical Industry Co., Ltd.) | 5 parts |
| Monomer having three or more radically polymerizable functional group (trimethylolpropane triacrylate, KAYARAD TMPTA from Nippon Kayaku Co., Ltd.) | 5 parts |
| CTM having one or more radically polymerizable functional group (compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 21 was prepared.

Each of the photoreceptors of Examples 20 to 32 and Comparative Examples 11 to 21 was set in a process cartridge, and the process cartridge was set in an image forming apparatus (i.e., modified IMAGIO NEO 270 from Ricoh Co., Ltd.) to perform a running test in which 50,000 copies of an original image with A-4 size are produced. The image forming conditions were as follows.

Light used for forming electrostatic images: semiconductor laser light with wavelength of 655 nm Environmental conditions: normal temperature and normal humidity The following properties of each photoreceptor were evaluated.

1-1. Abrasion Loss

The total thickness of the layers formed on each photoreceptor was measured with an instrument (FISCHER SCOPE MMS from Fischer Instruments K.K.) before and after the 50,000-copy running test to determine the abrasion loss of the outermost layer of each photoreceptor.

The results are shown in Table 3.

TABLE 3

| | Abrasion loss after 50,000-copy running test (μm) |
|---|---|
| Example 20 | 0.8 |
| Example 21 | 0.7 |
| Example 22 | 0.9 |
| Example 23 | 0.5 |

TABLE 3-continued

| | Abrasion loss after 50,000-copy running test (μm) |
|---|---|
| Example 24 | 0.7 |
| Example 25 | 0.9 |
| Example 26 | 0.8 |
| Example 27 | 0.9 |
| Example 28 | 0.8 |
| Example 29 | 1.0 |
| Example 30 | 0.8 |
| Example 31 | 0.9 |
| Example 32 | 0.9 |
| Comparative Example 11 | 7.2 |
| Comparative Example 12 | 6.6 |
| Comparative Example 13 | 2.8 |
| Comparative Example 14 | 2.0 |
| Comparative Example 15 | 1.4 |
| Comparative Example 16 | 1.3 |
| Comparative Example 17 | 0.7 |
| Comparative Example 18 | 0.9 |
| Comparative Example 19 | 1.5 |
| Comparative Example 20 | 1.6 |
| Comparative Example 21 | 1.4 |

The following is clearly understood from Table 3.

(1) The photoreceptors of Comparative Examples 11 and 12, which have no protective layer, have heavy abrasion loss. In contrast, the photoreceptors of Examples 20-32 of the present invention have light abrasion loss.

(2) Although the photoreceptor of Comparative Example 13, which has a protective layer prepared by using a bisphenol A-form diacrylate compound, has better abrasion resistance than the photoreceptors having no protective layer, the abrasion loss of the comparative photoreceptor is greater than that of the photoreceptors of Examples 20-32 of the present invention. Specifically, the entire protective layer of the photoreceptor of Comparative Example 13 is lost after the 50,000-copy running test.

(3) The photoreceptors of Comparative Examples 14-21, which have a crosslinked protective layer, have good abrasion resistance. The photoreceptors of the present invention (i.e., Examples 20-32) have abrasion loss not greater than those of the photoreceptors of Comparative Examples 14-21.

Thus, it is clear from Table 1 that the photoreceptors of the present invention is superior to the comparative photoreceptors as a whole.

After the 50,000-copy running test, each of the photoreceptors of Examples 20-32 and Comparative Examples 14-21, in which the entire outermost layer was not abraded, was further evaluated as follows.

2-1. Image Qualities Under Low Temperature and Low Humidity Condition (10° C. and 15% RH)

Copies of an image evaluation test chart were produced by the same method as that mentioned above except that the environmental condition was changed to 10° C. and 15% RH to determine whether or not the image density and resolution decrease, and tailed images are formed.

2-2. Image Qualities Under High Temperature and High Humidity condition (30° C. and 90% RH)

Copies of an image evaluation test chart were produced by the same method as that mentioned above except that the environmental condition was changed to 30° C. and 90% RH to determine whether or not the image density and resolution decrease, and tailed images are formed.

2-3. NOx Exposure Test

After the image tests under the low temperature/low humidity and high temperature/high humidity conditions, each photoreceptor was exposed to NOx gasses under the below-mentioned conditions and then subjected to the image test mentioned above in paragraph 2-1 under a normal temperature and normal humidity condition (20° C. and 55% RH).

NOx Exposure Conditions

NOx exposure tester: DY-0102N from Dylec Inc.

Concentration of NOx: NO; 10 ppm, $NO_2$; 40 ppm

Exposure time: 48 hours

The produced images were visually observed to determine whether or not the image density and resolution decrease, and tailed images are formed. The images were graded as follows.

◎: The image qualities do not deteriorate.

○: The image qualities of part of images slightly deteriorate.

Δ: The image qualities of part of images clearly deteriorate.

×: The image qualities of the entire images deteriorate.

The results are shown in Table 4.

TABLE 4

| | 10° C./15% RH | | | 30° C./90% RH | | | NOx exposure test | | |
|---|---|---|---|---|---|---|---|---|---|
| | ID* | Tailing | RES** | ID* | Tailing | RES** | ID* | Tailing | RES** |
| Ex. 20 | ○ | ◎ | ◎ | ◎ | ◎ | ◎ | ◎ | ◎ | ◎ |
| Ex. 21 | ○ | ◎ | ◎ | ◎ | ◎ | ◎ | ◎ | ◎ | ◎ |
| Ex. 22 | ◎ | ◎ | ◎ | ◎ | ◎ | ◎ | ◎ | ◎ | ◎ |
| Ex. 23 | ○ | ◎ | ◎ | ◎ | ○ | ◎ | ◎ | ◎ | ○ |
| Ex. 24 | ○ | ◎ | ◎ | ◎ | ◎ | ◎ | ◎ | ◎ | ◎ |
| Ex. 25 | ◎ | ◎ | ◎ | ◎ | ◎ | ◎ | ◎ | ◎ | ◎ |
| Ex. 26 | ◎ | ◎ | ◎ | ◎ | ◎ | ◎ | ◎ | ◎ | ◎ |
| Ex. 27 | ◎ | ◎ | ◎ | ◎ | ◎ | ◎ | ◎ | ◎ | ◎ |
| Ex. 28 | ◎ | ◎ | ◎ | ◎ | ◎ | ◎ | ◎ | ◎ | ◎ |
| Ex. 29 | ◎ | ◎ | ◎ | ◎ | ◎ | ◎ | ◎ | ◎ | ◎ |
| Ex. 30 | ◎ | ◎ | ◎ | ◎ | ◎ | ◎ | ◎ | ◎ | ◎ |
| Ex. 31 | ◎ | ◎ | ◎ | ◎ | ◎ | ◎ | ◎ | ◎ | ◎ |
| Ex. 32 | ◎ | ◎ | ◎ | ◎ | ◎ | ◎ | ◎ | ◎ | ◎ |
| Comp. Ex. 14 | ○ | ◎ | ◎ | ○ | Δ | ◎ | ○ | ○ | Δ |
| Comp. Ex. 15 | ◎ | ◎ | ◎ | ◎ | Δ | ○ | ◎ | ○ | Δ |
| Comp. Ex. 16 | ○ | ◎ | ◎ | ○ | Δ | ◎ | ○ | ○ | Δ |

TABLE 4-continued

| | 10° C./15% RH | | | 30° C./90% RH | | | NOx exposure test | | |
|---|---|---|---|---|---|---|---|---|---|
| | ID* | Tailing | RES** | ID* | Tailing | RES** | ID* | Tailing | RES** |
| Comp. Ex. 17 | ○ | ◎ | ◎ | ○ | X | ○ | ○ | ○ | X |
| Comp. Ex. 18 | ◎ | ◎ | ◎ | ○ | Δ | ○ | ○ | ○ | X |
| Comp. Ex. 19 | ◎ | ◎ | ◎ | ◎ | Δ | ○ | ◎ | ○ | Δ |
| Comp. Ex. 20 | ◎ | ◎ | ◎ | ◎ | Δ | ○ | ◎ | ○ | Δ |
| Comp. Ex. 21 | ◎ | ◎ | ◎ | ◎ | Δ | ○ | ◎ | ○ | Δ |

ID*: Image density
RES**: Resolution

The following is clearly understood from Table 4.

(1) The images produced by the photoreceptors of Examples 20, 21, 23, and 24, each of which includes a crosslinked outermost layer including no CTM, have a slightly low image density under low temperature/low humidity condition, but the image quality is still acceptable. This is because the photoreceptors have slightly low photosensitivity under the condition.

(2) The other photoreceptors of the present invention can produce high quality images under these conditions.

(3) The image qualities of the comparative photoreceptors, each of which has a conventional crosslinked outermost layer, deteriorate with respect to tailing (under the high temperature and high humidity condition), and resolution (after the NOx exposure test).

Thus, it is clear from Table 4 that the photoreceptors of Examples 20-32, each of which has a crosslinked outermost layer prepared by using a radically polymerizable compound having a unit (E), have a good combination of abrasion resistance, environmental stability and resistance to NOx.

Example 33

Formation of Undercoat Layer

The following components were mixed to prepare an undercoat layer coating liquid.

| | |
|---|---|
| Alkyd resin (BEKKOZOL 1307-60-EL from Dainippon Ink And Chemicals, Inc.) | 6 parts |
| Melamine resin (SUPER BEKKAMINE G-821-60 from Dainippon Ink And Chemicals, Inc.) | 4 parts |
| Titanium oxide | 40 parts |
| Methyl ethyl ketone | 50 parts |

The undercoat layer coating liquid was applied on an aluminum drum having an outside diameter of 30 mm, and the coated liquid was dried. Thus, an undercoat layer having a thickness of about 3.5 μm was prepared.

Formation of Charge Generation Layer (CGL)

The following components were mixed and dispersed for 10 days using a ball mill containing zirconia balls to prepare a pigment dispersion having a solid content of 10% by weight.

Bisazo pigment having the following formula 2.5 parts

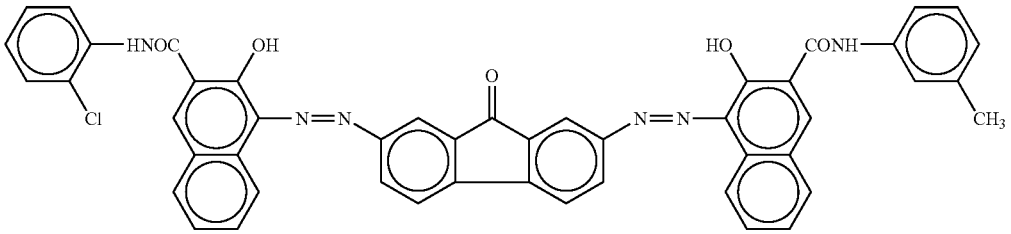

Methyl ethyl ketone 22.5 parts

Next, 58.3 g of cyclohexanone were added to the dispersion, and the mixture was dispersed for 2 hours using the ball mill to prepare a 3% pigment dispersion.

The following components were mixed to prepare a solution.

| | |
|---|---|
| Polyvinyl butyral resin (XYHL, manufactured by Union Carbide Corp.) | 0.5 parts |
| Methyl ethyl ketone | 57.5 parts |
| Cyclohexanone | 141.7 parts |

The thus prepared solution was mixed with the above-prepared pigment dispersion while agitated. The mixture was filtered using a 1000-mesh stainless screen to prepare a CGL coating liquid.

The CGL coating liquid was applied on the undercoat layer, and the coated liquid was dried to prepare a CGL having a thickness of about 0.2 μm.

Formation of Charge Transport Layer (CTL)

The following components were mixed to prepare a CTL coating liquid.

| | |
|---|---|
| Bisphenol Z-form polycarbonate (PANLITE TS-2050 manufactured by Teijin Chemicals Ltd.) | 10 parts |
| CTM having the following formula | 7 parts |

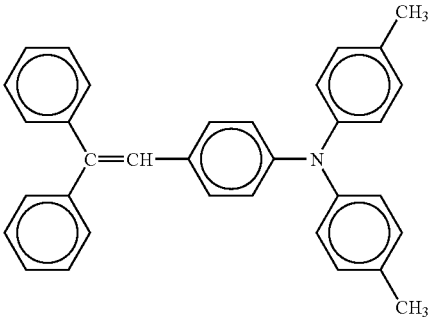

| | |
|---|---|
| Tetrahydrofuran | 100 parts |
| 1% tetrahydrofuran solution of silicone oil | 1 part |

(Silicone oil: KF50-100CS from Shin-Etsu Chemical Co., Ltd.)

The CTL coating liquid was coated on the CGL, and the coated liquid was dried to prepare a CTL having a thickness of about 18 μm.

Formation of Outermost Layer

The following components were mixed in a dark place to prepare an outermost layer coating liquid.

| | |
|---|---|
| Radically polymerizable compound f-1-1 | 5 parts |
| Monomer having three or more radically polymerizable functional group (trimethylolpropane triacrylate (KAYARAD TMPTA from Nippon Kayaku Co., Ltd.) | 5 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

The outermost layer coating liquid was coated on the photosensitive layer by a spray coating method, followed by natural drying for 20 minutes. Next the outermost layer was exposed to light to be crosslinked. The irradiation conditions are as follows:

Light source: Metal halide lamp with a power of 160 W/cm

Irradiation distance: 120 mm

Illuminance: 500 mW/cm$^2$

Irradiation time 60 seconds

Further, the layer (i.e., photoreceptor) was heated for 20 minutes at 130° C. Thus, an outermost layer having a thickness of 10 μm was formed on the photosensitive layer.

Thus, a photoreceptor of Example 33 of the present invention was prepared.

Example 34

The procedure for preparation of the photoreceptor in Example 33 was repeated except that the outermost layer coating liquid was replaced with the following outermost layer coating liquid.

Outermost Layer Coating Liquid

| | |
|---|---|
| Radically polymerizable compound f-1-2 | 5 parts |
| Monomer having three or more radically polymerizable functional group (trimethylolpropane triacrylate (KAYARAD TMPTA from Nippon Kayaku Co., Ltd.) | 5 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 34 of the present invention was prepared.

Example 35

The procedure for preparation of the photoreceptor in Example 33 was repeated except that the outermost layer coating liquid was replaced with the following outermost layer coating liquid.

Outermost Layer Coating Liquid

| | |
|---|---|
| Radically polymerizable compound f-1-3 | 5 parts |
| Monomer having three or more radically polymerizable functional group (trimethylolpropane triacrylate (KAYARAD TMPTA from Nippon Kayaku Co., Ltd.) | 5 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 35 of the present invention was prepared.

Example 36

The procedure for preparation of the photoreceptor in Example 33 was repeated except that the outermost layer coating liquid was replaced with the following outermost layer coating liquid.

Outermost Layer Coating Liquid

| | |
|---|---|
| Radically polymerizable compound f-1-4 | 5 parts |
| Monomer having three or more radically polymerizable functional group (trimethylolpropane triacrylate (KAYARAD TMPTA from Nippon Kayaku Co., Ltd.) | 5 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 36 of the present invention was prepared.

Example 37

The procedure for preparation of the photoreceptor in Example 33 was repeated except that the outermost layer coating liquid was replaced with the following outermost layer coating liquid.

Outermost Layer Coating Liquid

| | |
|---|---|
| Radically polymerizable compound f-1-25 | 10 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 37 of the present invention was prepared.

-continued

| | |
|---|---|
| (IRGACURE 184 from Ciba Specialty Chemicals) | |
| Tetrahydrofuran | 100 parts |

Thus, a photoreceptor of Example 38 of the present invention was prepared.

Example 39

The procedure for preparation of the photoreceptor in Example 33 was repeated except that the outermost layer coating liquid was replaced with the following outermost layer coating liquid.

Outermost Layer Coating Liquid

| | |
|---|---|
| Radically polymerizable compound g-1-1 | 10 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 39 of the present invention was prepared.

Example 40

The procedure for preparation of the photoreceptor in Example 33 was repeated except that the outermost layer coating liquid was replaced with the following outermost layer coating liquid.

Outermost Layer Coating Liquid

| | |
|---|---|
| Radically polymerizable compound h-1-1 having the following formula | 10 parts |

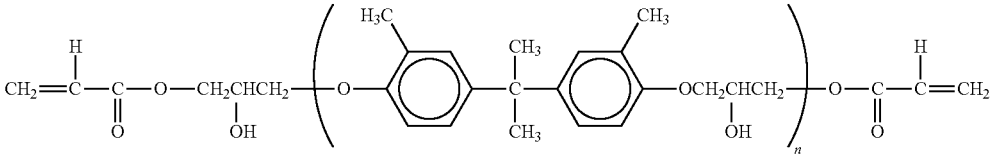

| | |
|---|---|
| (this compound is determined by gel permeation chromatography to be a mixture in which n is from 3 to 10) | |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 40 of the present invention was prepared.

Example 38

The procedure for preparation of the photoreceptor in Example 33 was repeated except that the outermost layer coating liquid was replaced with the following outermost layer coating liquid and the thickness of the outermost layer was changed to 3 μm.

Outermost Layer Coating Liquid

| | |
|---|---|
| Radically polymerizable compound f-1-44 | 10 parts |
| Photopolymerization initiator | 1 part |

Comparative Example 22

The procedure for preparation of the photoreceptor in Example 33 was repeated except that the outermost layer coating liquid was replaced with the following outermost layer coating liquid and the thickness of the outermost layer was changed to 3 μm.

Outermost Layer Coating Liquid

| | |
|---|---|
| Radically polymerizable compound having the following formula | 10 parts |

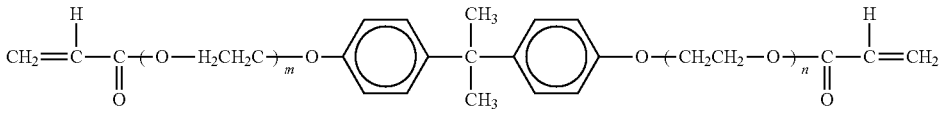

m + n = 3

| | |
|---|---|
| (i.e., ethyleneoxide-modified bisphenol A diacrylate, ABE-300 from Shin-Nakamura Chemical Co., Ltd.) | |
| CTM having one or more radically polymerizable functional group (Compound No. 54) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 22 was prepared.

Comparative Example 23

The procedure for preparation of the photoreceptor in Example 33 was repeated except that the outermost layer coating liquid was replaced with the following outermost layer coating liquid.

Outermost Layer Coating Liquid

| | |
|---|---|
| Monomer having three or more radically polymerizable functional group (i.e., dipentaerythritolcaprolactone-modified hexaacrylate, KAYARAD DPCA-120, from Nippon Kayaku Co., Ltd.) | 10 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 23 of the present invention was prepared.

Comparative Example 24

The procedure for preparation of the photoreceptor in Example 33 was repeated except that the outermost layer coating liquid was replaced with the following outermost layer coating liquid.

Outermost Layer Coating Liquid

| | |
|---|---|
| Monomer having three or more radically polymerizable functional group (i.e., neopentylglycol diacrylate, KAYARAD NPGDA, from Nippon Kayaku Co., Ltd.) | 10 parts |

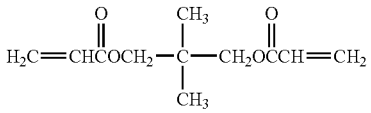

| | |
|---|---|
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 24 of the present invention was prepared.

Comparative Example 25

The procedure for preparation of the photoreceptor in Example 33 was repeated except that the outermost layer was not formed, and the thickness of the photosensitive layer was changed to 28 μm.

Thus, a photoreceptor of Comparative Example 25 was prepared.

Each of the photoreceptors of Examples 33 to 40 and Comparative Examples 22 to 25 was set in a process cartridge, and the process cartridge was set in an image forming apparatus (i.e., modified IMAGIO NEO 270 from Ricoh Co., Ltd.) to perform a running test in which 100,000 copies of an original image with A-4 size are produced. The image forming conditions were as follows.

Light used for forming electrostatic images: semiconductor laser light with wavelength of 655 nm Initial potential of non-irradiated portion of photoreceptor: −750V Environmental conditions: normal temperature and normal humidity The following properties of each photoreceptor were evaluated.

1-1. Potential of Irradiated and Non-Irradiate Portions of Photoreceptor

Potentials of irradiated (lighted) and non-irradiate (dark) portions of each photoreceptor were checked when the first and 100,000$^{th}$ images were produced.

1-2. Abrasion Loss

The total thickness of the layers formed on each photoreceptor was measured with an instrument (FISCHER SCOPE MMS from Fischer Instruments K.K.) before and after the 100,000-copy running test to determine the abrasion loss of the outermost layer of each photoreceptor.

The evaluation results are shown in Table 5.

TABLE 5

| | Initial potential (−V) | | Potential after production of 100,000 images (−V) | | |
|---|---|---|---|---|---|
| | Dark portion | Lighted portion | Dark portion | Lighted portion | Abrasion loss (μm) |
| Ex. 33 | 750 | 70 | 740 | 75 | 1.8 |
| Ex. 34 | 750 | 75 | 740 | 80 | 2.0 |
| Ex. 35 | 750 | 80 | 720 | 85 | 1.7 |

TABLE 5-continued

| | Initial potential (−V) | | Potential after production of 100,000 images (−V) | | |
|---|---|---|---|---|---|
| | Dark portion | Lighted portion | Dark portion | Lighted portion | Abrasion loss (μm) |
| Ex. 36 | 750 | 85 | 730 | 90 | 1.9 |
| Ex. 37 | 750 | 70 | 740 | 75 | 1.6 |
| Ex. 38 | 750 | 80 | 740 | 85 | 1.9 |
| Ex. 39 | 750 | 65 | 740 | 70 | 1.4 |
| Ex. 40 | 750 | 80 | 740 | 85 | 2.1 |
| Comp. Ex. 22 | 750 | 75 | 730 | 80 | 4.0 |
| Comp. Ex. 23 | 750 | 80 | 735 | 100 | 2.2 |
| Comp. Ex. 24 | 750 | 80 | 720 | 100 | 6.8 |
| Comp. Ex. 25 | 750 | 75 | 740 | 80 | 13.1 |

It is clear from Table 5 that the photoreceptors of the present invention have a good combination of electric properties and abrasion resistance.

Specifically, when the outermost layer include a unit (E), the outermost layer has better abrasion resistance than the outermost layer of the photoreceptor of Comparative Example 23 even when the number of radically polymerizable functional groups in a molecule is smaller.

Although the photoreceptor of Comparative Example 22, which has a protective layer prepared by using a bisphenol A-form diacrylate compound, has better abrasion resistance than the photoreceptor having no protective layer, the abrasion loss of the photoreceptor is greater than that of the photoreceptors of Examples 33-40. Specifically, the entire protective layer of the photoreceptor of Comparative Example 22 is lost.

The photoreceptor of Comparative Example 25, which has no protective layer and in which a CTL including a conventional thermoplastic resin as a binder resin serves as an outermost layer, has poor abrasion resistance, but has better environmental stability and resistance to NOx than the other comparative photoreceptors.

After the 100,000-copy running test, the photoreceptors of Examples 33, 37, 38, 39 and 40 and the photoreceptors of Comparative Examples 22 to 24 were subjected to an image test under a high temperature and high humidity condition (30° C. and 90% RH). In this regard, the outermost layer of the photoreceptor of Comparative Example 22 was lost in the running test, new one of the comparative photoreceptor was subjected to the image test.

The results are shown in Table 6.

TABLE 6

| | Image qualities at 30° C./90% RH |
|---|---|
| Example 33 | Good |
| Example 37 | Good |
| Example 38 | Good |
| Example 39 | Good |
| Example 40 | Good |
| Comparative Example 22 | Slightly tailed images were formed. |
| Comparative Example 23 | Tailed images were formed. |
| Comparative Example 24 | Tailed images were formed. |

The photoreceptors used for the image test were then subjected to a NOx exposure test. Specifically, each photoreceptor was exposed to NOx gasses under the below-mentioned conditions and then the potentials of irradiated (lighted) and non-irradiate (dark) portions of each photoreceptor were checked.

NOx Exposure Conditions

NOx exposure tester: DY-0102N from Dylec Inc.

Concentration of NOx: NO; 10 ppm, $NO_2$; 40 ppm

Exposure time: 48 hours

The results are shown in Table 7, in which the potentials are compared with those of the photoreceptors just after the 100,000-copy running test.

TABLE 7

| | Potentials after the running test (−V) | | Potentials after the NOx exposure test (−V) | |
|---|---|---|---|---|
| | Dark portion | Lighted portion | Dark portion | Lighted portion |
| Example 33 | 740 | 75 | 720 | 75 |
| Example 37 | 740 | 75 | 715 | 70 |
| Example 38 | 740 | 85 | 710 | 75 |
| Example 39 | 740 | 70 | 720 | 65 |
| Example 40 | 740 | 85 | 720 | 80 |
| Comp. Ex. 22 | 730 | 80 | 685 | 25 |
| Comp. Ex. 23 | 735 | 100 | 620 | 65 |
| Comp. Ex. 24 | 720 | 100 | 630 | 60 |

Thus, the photoreceptor of the present invention having an outermost layer including a radically crosslinked material having a unit (E) has a good combination of abrasion resistance, electric properties environmental stability and resistance to NOx. Therefore, by using the photoreceptor, high quality images can be produced over a long period of time.

Example 41

Formation of Photosensitive Layer

The following components were mixed and dispersed for 24 hours using a ball mill containing zirconia balls having a diameter of 2 mm to prepare a pigment dispersion having a solid content of 3% by weight.

| | |
|---|---|
| Metal-free phthalocyanine (FASTOGEN BLUE 8120B from Dainippon Ink & Chemicals, Inc.) | 2 parts |
| Cyclohexanone | 76 parts |
| The following components were mixed to prepare a solution. | |
| Charge transport material having the following formula | 24 parts |

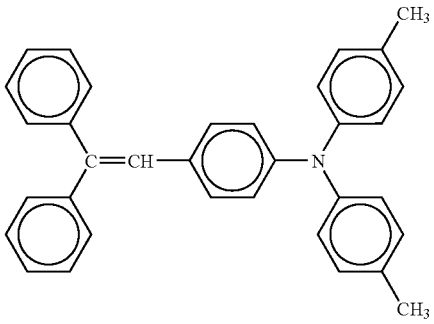

| | |
|---|---|
| Diphenoxy compound (2,6-dimethyl-2',6'-di-tert-butyl-diphenoquinone) | 20 parts |
| Bisphenol Z-form polycarbonate (PANLITE TS-2050 from Teijin Chemicals Ltd.) | 41 parts |
| Tetrahydrofuran | 306 parts |

-continued

| | |
|---|---|
| 1% tetrahydrofuran solution of silicone oil (silicone oil: KF50-100CS from Shin-Etsu Chemical Co., Ltd.) | 0.2 parts |

The thus prepared solution was mixed with the above-prepared pigment dispersion to prepare a photosensitive layer coating liquid.

The photosensitive layer coating liquid was applied on the peripheral surface of an aluminum cylinder with a diameter of 30 mm by a dip coating method, followed by drying for 20 minutes at 130° C. Thus, a photosensitive layer with a thickness of 23 μm was formed on the surface of the aluminum cylinder.

Formation of Outermost Layer

The following components were mixed in a dark place to prepare an outermost layer coating liquid.

| | |
|---|---|
| Radically polymerizable compound K-1-1 | 20 parts |
| Photopolymerization initiator (IRGACURE 184 from Ciba Specialty Chemicals) | 1 part |
| Tetrahydrofuran | 100 parts |

The outermost layer coating liquid was coated on the photosensitive layer by a spray coating method, followed by natural drying for 20 minutes. Next the outermost layer was exposed to light to be crosslinked. The irradiation conditions are as follows:

Light source: Metal halide lamp with a power of 160 W/cm

Irradiation distance: 120 mm

Illuminance: 500 mW/cm$^2$

Irradiation time 60 seconds

Further, the layer (i.e., photoreceptor) was heated for 20 minutes at 130° C. Thus, an outermost layer having a thickness of 4 μm was formed on the photosensitive layer.

Thus, a photoreceptor of Example 41 of the present invention was prepared.

Example 42

The procedure for preparation of the photoreceptor in Example 41 was repeated except that the outermost layer coating liquid was replaced with the following outermost layer coating liquid.

Outermost Layer Coating Liquid

| | |
|---|---|
| Radically polymerizable compound J-1-9 | 10 parts |
| Monomer having three or more radically polymerizable functional group (trimethylolpropane triacrylate (KAYARAD TMPTA from Nippon Kayaku Co., Ltd.) | 10 parts |
| Photopolymerization initiator (IRGACURE 184 from Ciba Specialty Chemicals) | 1 part |
| Tetrahydrofuran | 100 parts |

Thus, a photoreceptor of Example 42 of the present invention was prepared.

Example 43

The procedure for preparation of the photoreceptor in Example 41 was repeated except that the outermost layer coating liquid was replaced with the following outermost layer coating liquid and the thickness of the outermost layer was changed to 5 μm.

Outermost Layer Coating Liquid

| | |
|---|---|
| Radically polymerizable compound J-1-25 | 10 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 43 of the present invention was prepared.

Example 44

Formation of Undercoat Layer

The following components were mixed and dispersed for 120 hours using a ball mill including alumina balls with a diameter of 10 mm to prepare an undercoat layer coating liquid.

| | |
|---|---|
| Alkyd resin (BEKKOZOL 1307-60-EL from Dainippon Ink And Chemicals, Inc.) | 6 parts |
| Melamine resin (SUPER BEKKAMINE G-821-60 from Dainippon Ink And Chemicals, Inc.) | 4 parts |
| Titanium oxide | 40 parts |
| Methyl ethyl ketone | 50 parts |

The undercoat layer coating liquid was applied on an aluminum drum having an outside diameter of 30 mm by a dip coating method, and the coated liquid was dried for 20 minutes at 130° C. Thus, an undercoat layer having a thickness of about 3.5 μm was prepared.

Formation of Charge Generation Layer (CGL)

The following components were mixed and dispersed for 10 days using a ball mill containing zirconia balls with a diameter of 10 mm to prepare a pigment dispersion.

Bisazo pigment having the following formula 2.5 parts

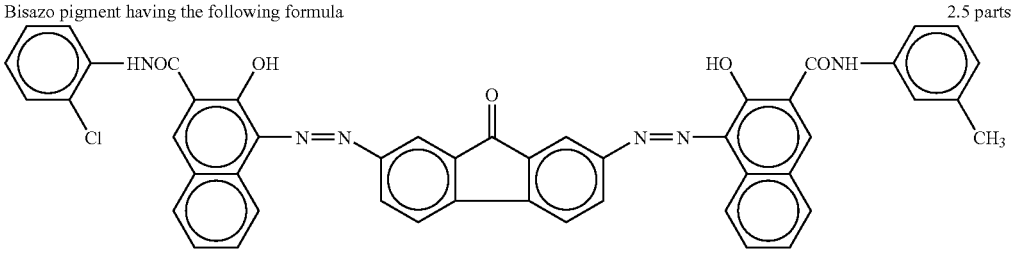

Cyclohexanone solution of polyvinyl butyral resin (0.5 parts of polyvinyl butyral resin is dissolved in 200 parts of cyclohexanone) 200.5 parts Next, 80 parts of methyl ethyl ketone was added to the dispersion, and the mixture was further dispersed for 2 days using the ball mill to prepare a CGL coating liquid.

The CGL coating liquid was applied on the undercoat layer, and the coated liquid was dried for 10 minutes at 130° C. to prepare a CGL having a thickness of 0.2 μm.

Formation of Charge Transport Layer (CTL)

The following components were mixed to prepare a CTL coating liquid.

| | |
|---|---|
| Bisphenol Z-form polycarbonate (PANLITE TS-2050 manufactured by Teijin Chemicals Ltd.) | 10 parts |
| CTM having the following formula | 7 parts |

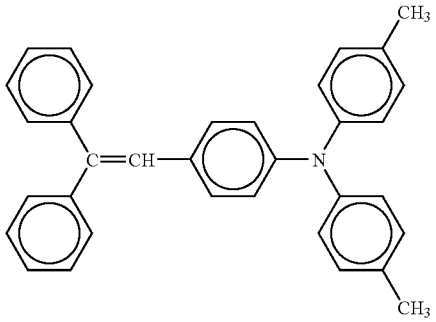

| | |
|---|---|
| Tetrahydrofuran | 100 parts |
| 1% tetrahydrofuran solution of silicone oil (Silicone oil: KF50-100CS from Shin-Etsu Chemical Co., Ltd.) | 1 part |

The CTL coating liquid was coated on the CGL, and the coated liquid was dried for 25 minutes at 135° C. to prepare a CTL having a thickness of about 18 μm.

Formation of Outermost Layer

The following components were mixed in a dark place to prepare an outermost layer coating liquid.

| | |
|---|---|
| Radically polymerizable compound K-1-3 | 10 parts |
| Monomer having three or more radically polymerizable functional group (trimethylolpropane triacrylate (KAYARAD TMPTA from Nippon Kayaku Co., Ltd.) | 10 parts |
| Photopolymerization initiator (IRGACURE 184 from Ciba Specialty Chemicals) | 1 part |
| Tetrahydrofuran | 100 parts |

The outermost layer coating liquid was applied on the photosensitive layer by a spray coating method, followed by natural drying for 20 minutes. Next the outermost layer was exposed to light to be crosslinked. The irradiation conditions are as follows:

Light source: Metal halide lamp with a power of 160 W/cm

Irradiation distance: 120 mm

Illuminance: 500 mW/cm$^2$

Irradiation time 60 seconds

Further, the layer (i.e., photoreceptor) was heated for 20 minutes at 130° C. Thus, an outermost layer having a thickness of 3 μm was formed on the photosensitive layer.

Thus, a photoreceptor of Example 44 of the present invention was prepared.

Example 45

The procedure for preparation of the photoreceptor in Example 44 was repeated except that the outermost layer coating liquid was replaced with the following outermost layer coating liquid.

Outermost Layer Coating Liquid

| | |
|---|---|
| Radically polymerizable compound J-1-2 | 10 parts |
| Monomer having three or more radically polymerizable functional group (trimethylolpropane triacrylate (KAYARAD TMPTA from Nippon Kayaku Co., Ltd.) | 10 parts |
| Photopolymerization initiator (IRGACURE 184 from Ciba Specialty Chemicals) | 1 part |
| Tetrahydrofuran | 100 parts |

Thus, a photoreceptor of Example 45 of the present invention was prepared.

Example 46

The procedure for preparation of the photoreceptor in Example 44 was repeated except that the outermost layer coating liquid was replaced with the following outermost layer coating liquid and the thickness of the outermost layer was changed to 7 μm.

Outermost Layer Coating Liquid

| | |
|---|---|
| Radically polymerizable compound J-1-1 | 5 parts |
| Monomer having three or more radically polymerizable functional group (trimethylolpropane triacrylate (KAYARAD TMPTA from Nippon Kayaku Co., Ltd.) | 5 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 46 of the present invention was prepared.

Example 47

The procedure for preparation of the photoreceptor in Example 44 was repeated except that the outermost layer coating liquid was replaced with the following outermost layer coating liquid and the thickness of the outermost layer was changed to 6 μm.

Outermost Layer Coating Liquid

| | |
|---|---|
| Radically polymerizable compound J-1-37 | 10 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 47 of the present invention was prepared.

Example 48

The procedure for preparation of the photoreceptor in Example 44 was repeated except that the outermost layer coating liquid was replaced with the following outermost layer coating liquid and the thickness of the outermost layer was changed to 5 μm.

Outermost Layer Coating Liquid

| | |
|---|---|
| Radically polymerizable compound J-1-51 (a diacrylate prepared from a diphenol YP-90 from Mitsui Petrochemical Industries, Ltd. by the same method as that used for synthesizing compound J-1-2) | 5 parts |
| Monomer having three or more radically polymerizable functional group (trimethylolpropane triacrylate (KAYARAD TMPTA from Nippon Kayaku Co., Ltd.) | 5 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 48 of the present invention was prepared.

Example 49

The procedure for preparation of the photoreceptor in Example 44 was repeated except that the outermost layer coating liquid was replaced with the following outermost layer coating liquid and the thickness of the outermost layer was changed to 10 μm.

Outermost Layer Coating Liquid

| | |
|---|---|
| Radically polymerizable compound K-1-3 | 5 parts |
| Monomer having three or more radically polymerizable functional group (trimethylolpropane triacrylate (KAYARAD TMPTA from Nippon Kayaku Co., Ltd.) | 3 parts |
| Monomer having three or more radically polymerizable functional group (dipentaerythritolcaprolactone-modified hexaacrylate, KAYARAD DPCA-120, from Nippon Kayaku Co., Ltd.) | 2 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 49 of the present invention was prepared.

Example 50

The procedure for preparation of the photoreceptor in Example 44 was repeated except that the outermost layer coating liquid was replaced with the following outermost layer coating liquid and the thickness of the outermost layer was changed to 7 μm.

Outermost Layer Coating Liquid

| | |
|---|---|
| Radically polymerizable compound L-1-1 | 4 parts |
| Monomer having three or more radically polymerizable functional group (trimethylolpropane triacrylate (KAYARAD TMPTA from Nippon Kayaku Co., Ltd.) | 6 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 50 of the present invention was prepared.

Example 51

The procedure for preparation of the photoreceptor in Example 44 was repeated. except that the outermost layer coating liquid was replaced with the following outermost layer coating liquid and the thickness of the outermost layer was changed to 8 μm.

Outermost Layer Coating Liquid

| | |
|---|---|
| Radically polymerizable compound K-1-2 | 5 parts |
| Monomer having three or more radically polymerizable functional group (trimethylolpropane triacrylate (KAYARAD TMPTA from Nippon Kayaku Co., Ltd.) | 2 parts |
| Monomer having three or more radically polymerizable functional group (caprolactone-modified dipentaerythritol hexaacrylate, KAYARAD DPCA-120, from Nippon Kayaku Co., Ltd.) | 3 parts |
| CTM having one or more radically polymerizable functional group (Compound No. 182 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 51 of the present invention was prepared.

Example 52

The procedure for preparation of the photoreceptor in Example 44 was repeated except that the outermost layer coating liquid was replaced with the following outermost layer coating liquid and the thickness of the outermost layer was changed to 5 μm.

Outermost Layer Coating Liquid

| | |
|---|---|
| Radically polymerizable compound K-1-4 | 10 parts |
| CTM having one or more radically polymerizable functional group (Compound No. 109 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Example 52 of the present invention was prepared.

Example 53

The procedure for preparation of the photoreceptor in Example 44 was repeated except that the outermost layer coating liquid was replaced with the following outermost layer coating liquid and the thickness of the outermost layer was changed to 5 μm.

Outermost Layer Coating Liquid

| | |
|---|---|
| Radically polymerizable compound J-1-3 | 5 parts |
| Monomer having three or more radically polymerizable functional group (caprolactone-modified dipentaerythritol hexaacrylate, KAYARAD DPCA-120, from Nippon Kayaku Co., Ltd.) | 5 parts |
| CTM having one or more radically polymerizable functional group (Compound No. 146 mentioned above) | 10 parts |

-continued

| | |
|---|---|
| Photopolymerization initiator (IRGACURE 184 from Ciba Specialty Chemicals) | 1 part |
| Tetrahydrofuran | 100 parts |

Thus, a photoreceptor of Example 53 of the present invention was prepared.

Comparative Example 26

The procedure for preparation of the photoreceptor in Example 41 was repeated except that the outermost layer was not formed and the thickness of the photosensitive layer was changed to 25 μm.

Thus, a photoreceptor of Comparative Example 26 was prepared.

Comparative Example 27

The procedure for preparation of the photoreceptor in Example 44 was repeated except that the outermost layer was not formed and the thickness of the CTL was changed to 21 μm.

Thus, a photoreceptor of Comparative Example 27 was prepared.

Comparative Example 28

The procedure for preparation of the photoreceptor in Example 44 was repeated except that the outermost layer coating liquid was replaced with the following outermost layer coating liquid.

Outermost Layer Coating Liquid

| | |
|---|---|
| Radically polymerizable compound having the following formula | 20 parts |

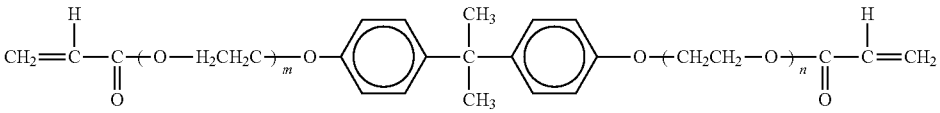

m + n = 3

| | |
|---|---|
| (i.e., ethyleneoxide-modified bisphenol A diacrylate, ABE-300 from Shin-Nakamura Chemical Co., Ltd.) | |
| Photopolymerization initiator (IRGACURE 184 from Ciba Specialty Chemicals) | 1 part |
| Tetrahydrofuran | 100 parts |

Thus, a photoreceptor of Comparative Example 28 was prepared.

Comparative Example 29

The procedure for preparation of the photoreceptor in Example 44 was repeated except that the outermost layer coating liquid was replaced with the following outermost layer coating liquid.

Outermost Layer Coating Liquid

| | |
|---|---|
| Radically polymerizable compound (ethyleneoxide-modified bisphenol A diacrylate, ABE-300 from Shin-Nakamura Chemical Co., Ltd.) | 10 parts |
| Monomer having three or more radically polymerizable functional group (trimethylolpropane triacrylate (KAYARAD TMPTA from Nippon Kayaku Co., Ltd.) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 29 was prepared.

Comparative Example 30

The procedure for preparation of the photoreceptor in Example 44 was repeated except that the outermost layer coating liquid was replaced with the following outermost layer coating liquid and the thickness of the outermost layer was changed to 5 μm.

Outermost Layer Coating Liquid

| | |
|---|---|
| Radically polymerizable compound (ethyleneoxide-modified bisphenol A diacrylate, ABE-300 from Shin-Nakamura Chemical Co., Ltd.) | 5 parts |
| Monomer having three or more radically polymerizable functional group (trimethylolpropane triacrylate (KAYARAD TMPTA from Nippon Kayaku Co., Ltd.) | 5 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 30 was prepared.

Comparative Example 31

The procedure for preparation of the photoreceptor in Example 44 was repeated except that the outermost layer coating liquid was replaced with the following outermost layer coating liquid.

Outermost Layer Coating Liquid

| | |
|---|---|
| Radically polymerizable compound (ethyleneoxide-modified bisphenol A diacrylate, ABE-300 from Shin-Nakamura Chemical Co., Ltd.) | 10 parts |

-continued

| | |
|---|---|
| Monomer having three or more radically polymerizable functional group (trimethylolpropane triacrylate (KAYARAD TMPTA from Nippon Kayaku Co., Ltd.) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 31 was prepared.

Comparative Example 32

The procedure for preparation of the photoreceptor in Example 44 was repeated except that the outermost layer coating liquid was replaced with the following outermost layer coating liquid.

Outermost Layer Coating Liquid

| | |
|---|---|
| Monomer having three or more radically polymerizable functional group (trimethylolpropane triacrylate (KAYARAD TMPTA from Nippon Kayaku Co., Ltd.) | 10 parts |
| Monomer having three or more radically polymerizable functional group (caprolactone-modified dipentaerythritol hexaacrylate, KAYARAD DPCA-120, from Nippon Kayaku Co., Ltd.) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 32 was prepared.

Comparative Example 33

The procedure for preparation of the photoreceptor in Example 44 was repeated except that the outermost layer coating liquid was replaced with the following outermost layer coating liquid and the thickness of the outermost layer was changed to 10 μm.

Outermost Layer Coating Liquid

| | |
|---|---|
| Monomer having three or more radically polymerizable functional group (trimethylolpropane triacrylate (KAYARAD TMPTA from Nippon Kayaku Co., Ltd.) | 10 parts |
| CTM having one or more radically polymerizable functional group (Compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 33 was prepared.

Comparative Example 34

The procedure for preparation of the photoreceptor in Example 44 was repeated except that the outermost layer coating liquid was replaced with the following outermost layer coating liquid, and the thickness of the outermost layer was changed to 7 μm.

Outermost Layer Coating Liquid

| | |
|---|---|
| Monomer having three or more radically polymerizable functional group (i.e., neopentylglycol diacrylate, KAYARAD NPGDA, from Nippon Kayaku Co., Ltd.) | 5 parts |

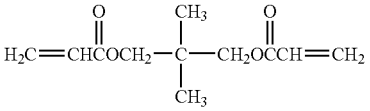

| | |
|---|---|
| Monomer having three or more radically polymerizable functional group (trimethylolpropane triacrylate, KAYARAD TMPTA from Nippon Kayaku Co., Ltd.) | 5 parts |
| Monomer having one or more radically polymerizable functional group (compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 34 was prepared.

Comparative Example 35

The procedure for preparation of the photoreceptor in Example 44 was repeated except that the outermost layer coating liquid was replaced with the following outermost layer coating liquid and the thickness of the outermost layer was changed to 10 μm.

Outermost Layer Coating Liquid

| | |
|---|---|
| Radically polymerizable compound (ethyleneoxide-modified bisphenol A diacrylate, ABE-300 from Shin-Nakamura Chemical Co., Ltd.) | 5 parts |
| Monomer having three or more radically polymerizable functional group (trimethylolpropane triacrylate (KAYARAD TMPTA from Nippon Kayaku Co., Ltd.) | 3 parts |
| Monomer having three or more radically polymerizable functional group (caprolactone-modified dipentaerythritol hexaacrylate, KAYARAD DPCA-120, from Nippon Kayaku Co., Ltd.) | 2 parts |
| Monomer having one or more radically polymerizable functional group (compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 35 was prepared.

Comparative Example 36

The procedure for preparation of the photoreceptor in Example 44 was repeated except that the outermost layer coating liquid was replaced with the following outermost layer coating liquid, and the thickness of the outermost layer was changed to 5 μm.

Outermost Layer Coating Liquid

| | |
|---|---|
| Radically polymerizable compound (ethyleneoxide-modified bisphenol F diacrylate, M-208 from Toa Gosei Chemical Industry Co., Ltd.) | 5 parts |
| Monomer having three or more radically polymerizable functional group (trimethylolpropane triacrylate, KAYARAD TMPTA from Nippon Kayaku Co., Ltd.) | 5 parts |
| CTM having one or more radically polymerizable functional group (compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 36 was prepared.

Comparative Example 37

The procedure for preparation of the photoreceptor in Example 46 was repeated except that the outermost layer coating liquid was replaced with the following outermost layer coating liquid.

Outermost Layer Coating Liquid

| | |
|---|---|
| Monomer having three or more radically polymerizable functional group (dipentaerythritolcaprolactone-modified hexaacrylate, KAYARAD DPCA-120, from Nippon Kayaku Co., Ltd.) | 10 parts |
| Monomer having one or more radically polymerizable functional group (compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Comparative Exarnple 37 was prepared.

Comparative Example 38

The procedure for preparation of the photoreceptor in Example 46 was repeated except that the outermost layer coating liquid was replaced with the following outermost layer coating liquid.

Outermost Layer Coating Liquid

| | |
|---|---|
| Monomer having three or more radically polymerizable functional group (pentaerythritol tetraacrylate, SR-295 from Nippon Kayaku Co., Ltd.) | 10 parts |
| Monomer having one or more radically polymerizable functional group (compound No. 54 mentioned above) | 10 parts |
| Photopolymerization initiator (IRGACURE 184 from Ciba Specialty Chemicals) | 1 part |
| Tetrahydrofuran | 100 parts |

Thus, a photoreceptor of Comparative Example 38 was prepared.

Example 54

The procedure for preparation of the photoreceptor in Example 41 was repeated except that the thickness of the outermost layer was changed to 6 μm.

Each of the photoreceptors of Examples 41 to 54 and Comparative Examples 26 to 38 was set in a process cartridge, and the process cartridge was set in an image forming apparatus (i.e., modified IMAGIO NEO C455 from Ricoh Co., Ltd.) to perform a running test in which 100,000 copies of an original image with A-4 size are produced. The image forming conditions were as follows.

Light used for forming electrostatic images: semiconductor laser light with wavelength of 655 nm Initial potential of non-irradiated portion of photoreceptor: −750V Environmental conditions: normal temperature and normal humidity The following properties of each photoreceptor were evaluated.

1-1. Potential of Irradiated and Non-Irradiate Portions of Photoreceptor

Potentials of irradiated (lighted) and non-irradiate (dark) portions of each photoreceptor were checked when the first and 100,000$^{th}$ images were produced.

1-2. Abrasion Loss

The total thickness of the layers formed on each photoreceptor was measured with an instrument (FISCHER SCOPE MMS from Fischer Instruments K.K.) before and after the 100,000-copy running test to determine the abrasion loss of the outermost layer of each photoreceptor.

The evaluation results are shown in Table 8.

TABLE 8

| | Initial potential (−V) | | Potential after production of 100,000 images (−V) | | |
|---|---|---|---|---|---|
| | Dark portion | Lighted portion | Dark portion | Lighted portion | Abrasion loss (μm) |
| Ex. 41 | 750 | 100 | 730 | 105 | 1.4 |
| Ex. 42 | 750 | 105 | 725 | 115 | 1.2 |
| Ex. 43 | 750 | 80 | 735 | 85 | 1.5 |
| Ex. 44 | 750 | 100 | 730 | 110 | 0.9 |
| Ex. 45 | 750 | 105 | 725 | 110 | 1.2 |
| Ex. 46 | 750 | 80 | 730 | 90 | 1.5 |
| Ex. 47 | 750 | 90 | 730 | 95 | 1.4 |
| Ex. 48 | 750 | 80 | 725 | 90 | 1.5 |
| Ex. 49 | 750 | 85 | 735 | 90 | 1.4 |
| Ex. 50 | 750 | 80 | 730 | 90 | 1.7 |
| Ex. 51 | 750 | 80 | 735 | 85 | 1.4 |
| Ex. 52 | 750 | 70 | 720 | 80 | 1.5 |
| Ex. 53 | 750 | 85 | 735 | 90 | 1.5 |
| Comp. Ex. 26 | 750 | 75 | 735 | 85 | 14 |
| Comp. Ex. 27 | 750 | 75 | 730 | 80 | 13 |
| Comp. Ex. 28 | 750 | 110 | 725 | 120 | 2.6 |
| Comp. Ex. 29 | 750 | 105 | 730 | 110 | 1.8 |
| Comp. Ex. 30 | 750 | 85 | 720 | 95 | 2.3 |
| Comp. Ex. 31 | 750 | 110 | 735 | 115 | 2.1 |
| Comp. Ex. 32 | 750 | 105 | 735 | 110 | 1.3 |
| Comp. Ex. 33 | 750 | 85 | 730 | 95 | 1.7 |
| Comp. Ex. 34 | 750 | 80 | 720 | 85 | 3.3 |
| Comp. Ex. 35 | 750 | 80 | 735 | 90 | 2.8 |
| Comp. Ex. 36 | 750 | 85 | 735 | 90 | 2.8 |
| Comp. Ex. 37 | 750 | 80 | 720 | 90 | 2.8 |

TABLE 8-continued

| | Initial potential (−V) | | Potential after production of 100,000 images (−V) | | |
|---|---|---|---|---|---|
| | Dark portion | Lighted portion | Dark portion | Lighted portion | Abrasion loss (μm) |
| Comp. Ex. 38 | 750 | 85 | 735 | 90 | 1.2 |
| Ex. 54 | 750 | 135 | 735 | 160 | 1.4 |

It is clear from Table 8 that the photoreceptors of the present invention have a good combination of electric properties and abrasion resistance.

Specifically, the abrasion loss of the outermost layers of the photoreceptors of Examples 41-54 of the present invention is much less than that of the outermost layers of the photoreceptors of Comparative Examples 26 and 27 which have no crosslinked protective layer.

The abrasion loss of the photoreceptor of Comparative Example 28, which has a protective layer prepared by using a bisphenol A-form diacrylate compound, is less than that of the photoreceptors having no protective layer, but is greater than that of the photoreceptors of Examples 41-54 of the present invention.

The abrasion loss of the photoreceptors of Comparative Examples 29-38, which have a crosslinked protective layer, is less than other comparative photoreceptors but is equal to or slightly greater than that of the photoreceptors of Examples 41-54 of the present invention.

The photoreceptor of Example 54 having a crosslinked outermost layer, which includes a unit (I) and has a thickness of 6 μm, has a slightly high potential in the lighted portion. As a result of the present inventors, it is found that when the outermost layer has a thickness of greater than 5 μm, the resultant photoreceptor has a slightly high potential in the lighted portion.

After the 100,000-copy running test, each of the photoreceptors of Examples 41-54 and Comparative Examples 28-38, in which the entire outermost layer was not abraded, was further evaluated as follows.

2-1. Image Qualities Under Low Temperature and Low Humidity Condition (10° C. and 15% RH)

Copies of an image evaluation test chart were produced under a condition of 10° C. and 15% RH to determine whether or not the image density and resolution decrease, and tailed images are formed.

2-2. Image Qualities Under High Temperature and High Humidity Condition (30° C. and 90% RH)

Copies of an image evaluation test chart were produced by the same method as mentioned above except that the environmental condition was changed to 30° C. and 90% RH to determine whether or not the image density and resolution decrease, and tailed images are formed.

2-3. NOx Exposure Test

After the image tests under the low temperature/low humidity and high temperature/high humidity conditions, each photoreceptor was exposed to NOx gasses under the below-mentioned conditions and then subjected to the image test mentioned above in paragraph 2-1 under a normal temperature and normal humidity condition (20° C. and 55% RH).

NOx Exposure Conditions

NOx exposure tester: DY-0102N from Dylec Inc.

Concentration of NOx: NO; 10 ppm, $NO_2$; 40 ppm

Exposure time: 48 hours

The produced images were visually observed to determine whether or not the image density and resolution decrease, and tailed images are formed.

The image density property was graded as follows.

◎: The image qualities do not deteriorate.

○: The image qualities of part of images slightly deteriorate.

Δ: The image qualities of part of images clearly deteriorate.

×: The image qualities of the entire images deteriorate.

The resolution (tailing property) was graded as follows.

A: Character images and line images are faithfully reproduced.

B: Part of character images and line images is not faithfully reproduced to a slight extent, but the images are still acceptable.

C: Character images and line images are not faithfully reproduced to an extent such that deterioration of resolution or formation of tailed images can be visually observed.

D: The entire images are seriously tailed or have low resolution and therefore character images and line images are not faithfully reproduced.

The results are shown in Table 9.

TABLE 9

| | 10° C. and 15% RH | | 30° C. and 90% RH | | NOx exposure test | |
|---|---|---|---|---|---|---|
| | ID* | RES** | ID* | Tailing | ID* | RES** |
| Ex. 41 | ○ | A | ◎ | A | ◎ | A |
| Ex. 42 | ○ | A | ◎ | A | ◎ | B |
| Ex. 43 | ◎ | A | ◎ | A | ◎ | A |
| Ex. 44 | ○ | A | ◎ | A | ◎ | B |
| Ex. 45 | ○ | A | ◎ | A | ◎ | B |
| Ex. 46 | ◎ | A | ◎ | A | ◎ | B |
| Ex. 47 | ◎ | A | ◎ | A | ◎ | A |
| Ex. 48 | ○ | A | ◎ | A | ◎ | A |
| Ex. 49 | ○ | A | ◎ | A | ◎ | B |
| Ex. 50 | ○ | A | ◎ | A | ◎ | B |
| Ex. 51 | ○ | A | ◎ | A | ◎ | B |
| Ex. 52 | ○ | A | ◎ | A | ◎ | A |
| Ex. 53 | ○ | A | ◎ | A | ◎ | B |
| Comp. Ex. 28 | ○ | A | ◎ | A | ◎ | A |
| Comp. Ex. 29 | ○ | A | ○ | B | ○ | C |
| Comp. Ex. 30 | ◎ | A | ◎ | B | ◎ | C |
| Comp. Ex. 31 | ○ | A | ○ | B | ○ | C |
| Comp. Ex. 32 | ○ | A | ○ | B | ○ | C |
| Comp. Ex. 33 | ◎ | A | ○ | C | ○ | D |
| Comp. Ex. 34 | ◎ | A | ◎ | C | ◎ | D |
| Comp. Ex. 35 | ◎ | A | ◎ | B | ◎ | C |
| Comp. Ex. 36 | ◎ | A | ◎ | C | ◎ | D |
| Comp. Ex. 37 | ◎ | A | ◎ | C | ◎ | D |
| Comp. Ex. 38 | ◎ | A | ◎ | C | ◎ | D |
| Ex. 54 | Δ | A | ◎ | A | ○ | B |

ID*: Image density

RES**: Resolution of images

The following is clearly understood from Table 9.

(1) The images produced by the photoreceptors of Examples 41, 42, 44, and 45, each of which includes a crosslinked outermost layer including no CTM, have a slightly low image density under low temperature/low humidity condition, but the image quality is still acceptable. This is because the photoreceptors have slightly low photosensitivity under the condition.

(2) The other photoreceptors of the present invention can produce high quality images under these conditions.

(3) The image qualities of the comparative photoreceptors, each of which has a conventional crosslinked outermost layer, deteriorate with respect to tailing (under the high temperature and high humidity condition), and resolution (after the NOx exposure test). In particular, the images produced by the photoreceptors of Comparative Examples 32, 33, 34, 37, and 38, each of which has a crosslinked outermost layer prepared by using a monomer having three or more radically functional groups have poor resolution property under the high temperature/high humidity condition or after the NOx exposure test.

Thus, it is clear from Table 9 that the photoreceptors of Examples 41-53 of the present invention, each of which has a crosslinked outermost layer prepared by using a radically polymerizable compound having a unit (I), have a good combination of abrasion resistance, environmental stability and resistance to NOx.

This document claims priority and contains subject matter related to Japanese Patent Applications Nos. 2007-006939, 2006-339402, 2007-004342 and 2006-333106, filed on Jan. 16, 2007, Dec. 18, 2006, Jan. 12, 2007, and Dec. 11, 2006, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A photoreceptor comprising:

an electroconductive substrate;

a photosensitive layer which is located overlying the electroconductive substrate and which is not radically crosslinked; and an outermost layer which is located overlying the photosensitive layer and which includes a radically crosslinked material, wherein the radically crosslinked material comprises units of formula (I):

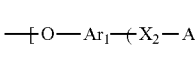

(I)

wherein each of $Ar_1$, $Ar_2$ and $Ar_3$ represents a substituted or unsubstituted arylene group, $X_2$ represents an oxygen atom or a sulfur atom, and n is 0 or 1, wherein the units of formula (I) are incorporated in the radically crosslinked material by crosslinking a radically polymerizable compound having a unit of formula (I) and a radically polymerizable functional group, wherein the radically polymerizable compound is a compound selected from the group consisting of compounds of formulae (J), (K), and (L):

(J)

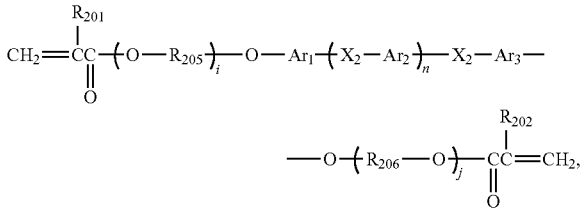

wherein each of $Ar_1$, $Ar_2$ and $Ar_3$ represents a substituted or unsubstituted arylene group, each of $R_{201}$ and $R_{202}$ represents a hydrogen atom or a methyl group, each of $R_{205}$ and $R_{206}$ represents a linear or a branched alkylene group, a 1-ketohexylene group, or a phenylene group, $X_2$ represents an oxygen atom or a sulfur atom, each of i and j is 0 or an integer of from 1 to 4, and n is 0 or 1;

(K)

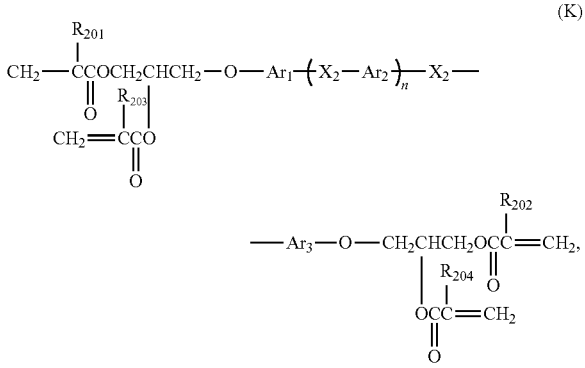

wherein each of $Ar_1$, $Ar_2$ and $Ar_3$ represents a substituted or unsubstituted arylene group, each of $R_{201}$, $R_{202}$, $R_{203}$ and $R_{204}$ represents a hydrogen atom or a methyl group, $X_2$ represents an oxygen atom or a sulfur atom, and n is 0 or 1;

(L)

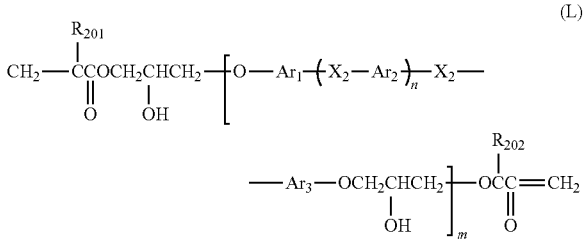

wherein each of $Ar_1$, $Ar_2$ and $Ar_3$ represents a substituted or unsubstituted arylene group, each of $R_{201}$ and $R_{202}$ represents a hydrogen atom or a methyl group, $X_2$ represents an oxygen atom or a sulfur atom, m is an integer of from 1 to 50, and n is 0 or 1.

2. The photoreceptor according to claim 1, wherein the radically crosslinked material includes a unit having formula (I), wherein the outermost layer is prepared by a method including:

applying a coating liquid overlying the photosensitive layer to form a layer; and then radically crosslinking the layer to form the outermost layer, and wherein the coating liquid comprises the radically polymerizable compound having a unit of formula (I) and a radically polymerizable functional group, wherein the radically polymerizable compound has the following formula (J):

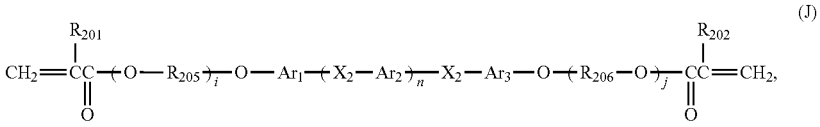

(J)

wherein each of $Ar_1$, $Ar_2$ and $Ar_3$ represents a substituted or unsubstituted arylene group, each of $R_{201}$ and $R_{202}$ represents a hydrogen atom or a methyl group, each of $R_{205}$ and $R_{206}$ represents a linear or a branched alkylene group, a 1-ketohexylene group, or a phenylene group, $X_2$ represents an oxygen atom or a sulfur atom, each of i and j is 0 or an integer of from 1 to 4, and n is 0 or 1.

3. The photoreceptor according to claim 2, wherein the coating liquid further includes at least one compound selected from monomers having three or more radically polymerizable functional groups and charge transport materials having one or more radically polymerizable functional groups.

4. The photoreceptor according to claim 1, wherein the radically crosslinked material includes a unit having formula (I), wherein the outermost layer is prepared by a method including:

applying a coating liquid overlying the photosensitive layer to form a layer; and then radically crosslinking the layer to form the outermost layer, and wherein the coating liquid comprises the radically polymerizable compound having a unit of formula (I) and a radically polymerizable functional group, wherein the radically polymerizable compound has the following formula (K):

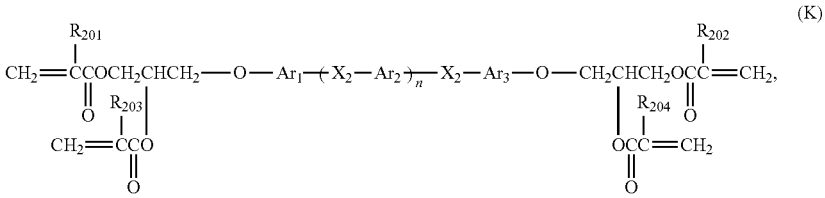

(K)

wherein each of $Ar_1$, $Ar_2$ and $Ar_3$ represents a substituted or unsubstituted arylene group, each of $R_{201}$, $R_{202}$, $R_{203}$ and $R_{204}$ represents a hydrogen atom or a methyl group, $X_2$ represents an oxygen atom or a sulfur atom, and n is 0 or 1.

5. The photoreceptor according to claim 4, wherein the coating liquid further includes at least one compound selected from monomers having three or more radically polymerizable functional groups and charge transport materials having one or more radically polymerizable functional groups.

6. The photoreceptor according to claim 1, wherein the radically crosslinked material includes a unit having formula (I), wherein the outermost layer is prepared by a method including:

applying a coating liquid overlying the photosensitive layer to form a layer; and then radically crosslinking the layer to form the outermost layer, and wherein the coating liquid comprises the radically polymerizable compound having a unit of formula (I) and a radically polymerizable functional group, wherein the radically polymerizable compound has following formula (L):

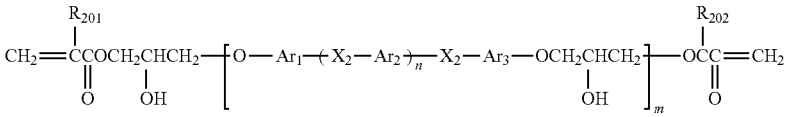

(L)

wherein each of $Ar_1$, $Ar_2$ and $Ar_3$ represents a substituted or unsubstituted arylene group, each of $R_{201}$ and $R_{202}$ represents a hydrogen atom or a methyl group, $X_2$ represents an oxygen atom or a sulfur atom, m is an integer of from 1 to 50, and n is 0 or 1.

7. The photoreceptor according to claim 6, wherein the coating liquid further includes at least one compound selected from monomers having three or more radically polymerizable functional groups and charge transport materials having one or more radically polymerizable functional groups.

8. The photoreceptor according to claim 1, wherein the radically polymerizable compound comprises the compound of formula (J).

9. The photoreceptor according to claim 1, wherein the radically polymerizable compound comprises the compound of formula (K).

10. The photoreceptor according to claim 1, wherein the radically polymerizable compound comprises the compound of formula (L).

11. A method for preparing the photoreceptor according to claim 1, comprising:

applying a coating liquid overlying the photosensitive layer to form a layer; and then radically crosslinking the layer to form an outermost layer comprising a radically crosslinked material containing units having formula (I);

wherein the coating liquid comprises the radically polymerizable compound having a unit of formula (I) and a radically polymerizable functional group, wherein the radically polymerizable compound is a compound selected from the group consisting of compounds of formulae (J), (K), and (L):

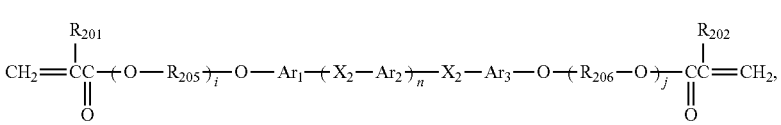

(J)

wherein each of $Ar_1$, $Ar_2$ and $Ar_3$ represents a substituted or unsubstituted arylene group, each of $R_{201}$ and $R_{202}$ represents a hydrogen atom or a methyl group, each of $R_{205}$ and $R_{206}$ represents a linear or a branched alkylene group, a 1-ketohexylene group, or a phenylene group, $X_2$ represents an oxygen atom or a sulfur atom, each of i and j is 0 or an integer of from 1 to 4, and n is 0 or 1;

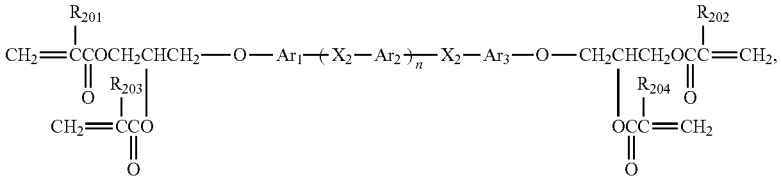

(K)

wherein each of $Ar_1$, $Ar_2$ and $Ar_3$ represents a substituted or unsubstituted arylene group, each of $R_{201}$, $R_{202}$, $R_{203}$ and $R_{204}$ represents a hydrogen atom or a methyl group, $X_2$ represents an oxygen atom or a sulfur atom, and n is 0 or 1;

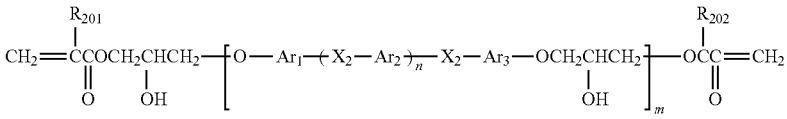

(L)

wherein each of $Ar_1$, $Ar_2$ and $Ar_3$ represents a substituted or unsubstituted arylene group, each of $R_{201}$ and $R_{202}$ represents a hydrogen atom or a methyl group, $X_2$ represents an oxygen atom or a sulfur atom, m is an integer of from 1 to 50, and n is 0 or 1.

12. The method according to claim 11, wherein the coating liquid further includes at least one compound selected from monomers having three or more radically polymerizable functional groups and charge transport materials having one or more radically polymerizable functional groups.

13. The method according to claim 11, wherein the coating liquid comprises the radically polymerizable compound of formula (J).

14. The method according to claim 11, wherein the coating liquid comprises the radically polymerizable compound of formula (K).

15. The method according to claim 11, wherein the coating liquid comprises the radically polymerizable compound of formula (L).

16. An image forming method comprising:

forming an electrostatic image on the photoreceptor according to claim 1;

developing the electrostatic image with a developer including a toner to form a toner image on the photoreceptor; and transferring the toner image onto a receiving material.

17. An image forming apparatus comprising:

the photoreceptor according to claim 1;

a latent image forming device configured to form an electrostatic image on the photoreceptor;

a developing device configured to develop the electrostatic image with a developer including a toner to form a toner image on the photoreceptor; and a transferring device configured to transfer the toner image onto a receiving material optionally via an intermediate transfer medium.

18. A process cartridge comprising:

the photoreceptor according to claim 1; and at least one of a charging device configured to charge the photoreceptor; a developing device configured to develop an electrostatic latent image on the photoreceptor with a developer including a toner to form a toner image thereon; a transferring device configured to transfer the toner image onto a receiving material; and a cleaning device configured to clean a surface of the photoreceptor after the toner image is transferred, wherein the photoreceptor, and at least one of the charging device, developing device, transferring device and cleaning device are detachably attached to an image forming apparatus as a unit.

* * * * *